US012774877B1

(12) United States Patent
Wach et al.

(10) Patent No.: US 12,774,877 B1
(45) Date of Patent: Oct. 27, 2026

(54) METHOD FOR AERONAUTICAL STABILIZATION

(71) Applicant: Wach LLC, Alpharetta, GA (US)

(72) Inventors: Michael L. Wach, Alpharetta, GA (US); Michael L. Wach, Jr., Alpharetta, GA (US)

( * ) Notice: Subject to any disclaimer, the term of this patent is extended or adjusted under 35 U.S.C. 154(b) by 399 days.

(21) Appl. No.: 18/389,491

(22) Filed: Nov. 14, 2023

Related U.S. Application Data

(62) Division of application No. 17/686,354, filed on Mar. 3, 2022, now Pat. No. 11,867,487.

(60) Provisional application No. 63/155,737, filed on Mar. 3, 2021.

(51) Int. Cl.

| | |
|---|---|
| ***F42B 10/28*** | (2006.01) |
| ***F42B 10/02*** | (2006.01) |
| ***F42B 12/62*** | (2006.01) |
| ***F42B 14/02*** | (2006.01) |
| ***F42B 14/06*** | (2006.01) |

(52) U.S. Cl.
CPC ..... *F42B 14/06* (2013.01); *F42B 10/025* (2013.01); *F42B 10/28* (2013.01); *F42B 12/625* (2013.01); *F42B 14/02* (2013.01)

(58) Field of Classification Search
CPC ..... F42B 10/00; F42B 10/02; F42B 10/025; F42B 10/26; F42B 10/28; F42B 12/625
See application file for complete search history.

(56) References Cited

U.S. PATENT DOCUMENTS

| | | | |
|---|---|---|---|
| 37,145 | A | 12/1862 | Williams |
| 214,023 | A | 4/1879 | Carpenter |
| 470,001 | A | 3/1892 | Howard |

(Continued)

FOREIGN PATENT DOCUMENTS

| | | | |
|---|---|---|---|
| CN | 105651123 | B | 8/2016 |
| DE | 298588 | C | 2/1920 |

(Continued)

OTHER PUBLICATIONS

USOG, "Very High Velocity (VHV (Tm) Small Arms," Transcript of video with still images, Apr. 13, 2018, https://www.youtube.com/watch?v=-sWnqlspa9o, YouTube.

(Continued)

*Primary Examiner* — Gabriel J. Klein

(57) ABSTRACT

Launching an aeronautical system can comprise applying force or energy to the system in connection with accelerating the system. Responsive to the force or energy, an element of the system can move along a defined path within the system. The system can comprise a drive that converts motion along the defined path into rotational motion. The drive can rotate a mass within the system, which can be supported by a gas bearing. The rotating mass can comprise the moving element, a different system element, or the entire system. The rotating mass can produce angular momentum and can support gyroscopic stabilization of the aeronautical system. Rotational energy can be selectively imparted to and transferred between system elements in connection with stabilization management. System elements can moderate the system's response to impulsive stimuli associated with rotation and acceleration. A gas bearing can support an external surface of the system during launch.

20 Claims, 48 Drawing Sheets

(56) References Cited

U.S. PATENT DOCUMENTS

| | | | | |
|---|---|---|---|---|
| 562,535 | A | 6/1896 | Hurst | |
| 1,222,142 | A | 4/1917 | Rossi | |
| 1,741,900 | A | 12/1929 | Alden | |
| 1,741,901 | A | 12/1929 | Alden | |
| 2,306,140 | A | 12/1942 | Reed | |
| 2,324,346 | A * | 7/1943 | Albree | F42B 10/42 244/3.1 |
| 2,352,260 | A * | 6/1944 | Herman | F42B 12/36 102/501 |
| 2,489,953 | A | 11/1949 | Burney | |
| 2,611,317 | A | 9/1952 | Africano | |
| 3,048,043 | A | 8/1962 | Slater | |
| 3,065,696 | A | 11/1962 | Kleinguenther | |
| 3,115,784 | A | 12/1963 | Parker | |
| 3,120,186 | A | 2/1964 | Harvey | |
| 3,170,403 | A | 2/1965 | Heilprin | |
| 3,225,694 | A | 12/1965 | Michelson | |
| 3,247,795 | A | 4/1966 | Abela | |
| 3,347,491 | A | 10/1967 | Pickart | |
| 3,377,954 | A | 4/1968 | Rabinow | |
| 3,397,851 | A | 8/1968 | McNutt | |
| 3,433,157 | A * | 3/1969 | Joch | F42B 8/10 102/513 |
| 3,672,304 | A | 6/1972 | Rogers | |
| 3,726,231 | A | 4/1973 | Kelly | |
| 3,772,992 | A | 11/1973 | Moore | |
| 3,785,081 | A | 1/1974 | Burkhart | |
| 3,826,193 | A * | 7/1974 | Rognmo | F42C 15/295 310/58 |
| 3,842,741 | A | 10/1974 | Brothers | |
| 3,913,870 | A | 10/1975 | Bolick | |
| 4,000,660 | A | 1/1977 | Brodersen | |
| 4,176,487 | A | 12/1979 | Manis | |
| 4,249,465 | A | 2/1981 | Ballmann | |
| 4,296,893 | A * | 10/1981 | Ballmann | F42B 10/26 102/501 |
| 4,431,150 | A * | 2/1984 | Epperson, Jr. | F41G 7/222 244/3.21 |
| 4,596,191 | A * | 6/1986 | Glotz | F42B 10/48 102/517 |
| 4,669,385 | A | 6/1987 | Maki | |
| 4,706,569 | A * | 11/1987 | Wallow | F42B 12/06 102/521 |
| 4,712,465 | A | 12/1987 | Macdonald | |
| 4,881,466 | A | 11/1989 | Ginley | |
| 4,932,326 | A * | 6/1990 | Ladriere | F42B 12/625 102/517 |
| 4,936,218 | A | 6/1990 | Wosenitz | |
| 4,977,834 | A | 12/1990 | Denis | |
| 4,995,318 | A * | 2/1991 | Stidston | F42B 10/26 102/501 |
| 5,139,216 | A | 8/1992 | Larkin | |
| 5,149,913 | A | 9/1992 | Arakaki | |
| 5,164,538 | A | 11/1992 | McClain, III | |
| 5,564,651 | A | 10/1996 | Wiemer | |
| 5,725,179 | A | 3/1998 | Gilman | |
| 5,971,875 | A | 10/1999 | Hill | |
| 6,105,506 | A | 8/2000 | Gangale | |
| 6,505,561 | B1 | 1/2003 | Dietrich | |
| 6,647,890 | B2 | 11/2003 | Findlay | |
| 6,666,144 | B1 | 12/2003 | Kim | |
| 6,679,178 | B2 | 1/2004 | Mihaylov | |
| 6,845,714 | B1 | 1/2005 | Smith | |
| 6,845,717 | B1 | 1/2005 | Sauvestre | |
| 7,231,874 | B2 | 6/2007 | Rastegar | |
| 7,312,557 | B2 | 12/2007 | Rastegar | |
| 7,541,563 | B1 | 6/2009 | Pal | |
| 7,775,148 | B1 | 8/2010 | McDermott | |
| 7,781,709 | B1 | 8/2010 | Jones | |
| 7,823,510 | B1 | 11/2010 | Hobart | |
| 8,151,712 | B2 * | 4/2012 | Salignon | F42C 11/06 102/521 |
| 8,183,746 | B2 | 5/2012 | Rastegar | |
| 8,319,162 | B2 | 11/2012 | Mccool | |
| 8,581,160 | B1 | 11/2013 | Sanford | |
| 8,596,199 | B2 | 12/2013 | Buttolph | |
| 8,739,347 | B2 | 6/2014 | Lin | |
| 8,844,443 | B2 | 9/2014 | Tomov | |
| 8,960,094 | B1 * | 2/2015 | Calvert | F42B 12/625 102/478 |
| 9,562,754 | B2 | 2/2017 | Peterson | |
| 9,714,819 | B1 | 7/2017 | DeMeester | |
| 9,823,053 | B1 | 11/2017 | Fink | |
| 9,851,186 | B2 | 12/2017 | Brown | |
| 10,119,780 | B1 | 11/2018 | Bergeron | |
| 10,222,186 | B2 | 3/2019 | Vezain | |
| 10,309,755 | B1 * | 6/2019 | Bradbury | F42B 10/28 |
| 10,591,263 | B2 * | 3/2020 | Brown | B22F 5/10 |
| 10,684,106 | B2 | 6/2020 | Gray | |
| 10,883,785 | B1 | 1/2021 | Rophael | |
| 11,867,487 | B1 * | 1/2024 | Wach | F42B 14/06 |
| 2004/0020395 | A1 | 2/2004 | Kutzli | |
| 2005/0241524 | A1 | 11/2005 | Garcia | |
| 2011/0041719 | A1 | 2/2011 | Ivtsenkov | |
| 2012/0079901 | A1 | 4/2012 | Shu | |
| 2016/0020671 | A1 | 1/2016 | Rastegar | |
| 2017/0131071 | A1 | 5/2017 | Burkart | |
| 2017/0322001 | A1 | 11/2017 | Panousakis | |
| 2018/0154446 | A1 * | 6/2018 | Brown | B22F 5/10 |
| 2018/0335285 | A1 | 11/2018 | Gizowski | |
| 2019/0120602 | A1 | 4/2019 | Couch | |
| 2019/0271519 | A1 | 9/2019 | Cleary | |
| 2019/0368836 | A1 | 12/2019 | Zhu | |
| 2025/0264296 | A1 * | 8/2025 | Wirth | F41B 6/003 |

FOREIGN PATENT DOCUMENTS

| | | | |
|---|---|---|---|
| DE | 1101222 | B | 3/1961 |
| DE | 202007015422 | U1 | 2/2008 |
| DE | 102011013066 | A1 | 5/2012 |
| EP | 0312666 | A1 | 4/1989 |
| EP | 2253924 | A2 | 11/2011 |
| FR | 686145 | A | 7/1930 |
| FR | 2602042 | A1 | 1/1988 |
| FR | 2671620 | A1 | 7/1992 |
| GB | 14431 | A | 3/1913 |
| GB | 1377750 | | 12/1974 |
| GB | 1538192 | A | 1/1979 |
| GB | 2259354 | A | 10/1993 |
| RU | 2163998 | C1 | 3/2001 |
| RU | 2288442 | C1 | 11/2006 |
| RU | 2371664 | C2 | 9/2008 |
| WO | WO9102211 | A1 | 2/1991 |
| WO | WO2006123192 | A2 | 3/2007 |
| WO | WO2008142457 | A2 | 11/2008 |
| WO | WO2009056081 | A1 | 5/2009 |
| WO | WO2009056082 | A1 | 5/2009 |
| WO | WO2010077213 | A1 | 7/2010 |
| WO | WO2014146170 | A1 | 9/2014 |
| WO | WO2017197504 | A1 | 11/2017 |

OTHER PUBLICATIONS

USOG, "Very High Velocity (VHV (Tm)) Small Arms," Comments posted online with video, Apr. 13, 2018, https://www.youtube.com/watch?v=- sWnqlspa9o, YouTube.

Murphy, Charles H., "Angular Motion of Projectiles with a Moving Internal Part," BRL Memorandum Report No. 2731, Feb. 1977, USA Ballistic Research Laboratory, Aberdeen Proving Ground, Maryland.

Rogers, Jonathan and Celmins, Ilmars, "Control Authority of a Mortal Using Internal Translating Mass Control," Report No. ARL-TR-4857, Jun. 2009, Army Research Laboratory, Aberdeen Proving Ground, MD.

Waumans, Tobias et al., "Design and Testing of Aerodynamic Thrust Bearings for Micro Turbomachinery Applications," Proceedings of the 7th International Workshop on Micro and Nanotechnology for Power Generation and Energy Conversion Applications, Nov. 28-29, 2007, pp. 257-260, Freiburg, Germany.

Liu, Ren and Wang, Xiaoli, "Dynamic Characteristics Analysis of Micro Air Spiral Grooved Thrust Bearing-Rotor System," Proceed-

(56) References Cited

OTHER PUBLICATIONS ings of the 2011 6th IEEE International Conference on Nano/Micro Engineered and Molecular Systems, Feb. 20-23, 2011, pp. 719-723, Kaohsiung, Taiwan.
US Army Materiel Command, "Engineering Design Handbook Sabot Technology Engineering," AMC Pamphlet No. 706-445, Jul. 10, 1972, US Department of the Army, Washington, DC.
Umstead, Christopher M, "Examination of Lateral Deviation of a Projectile Subjected to Internal Gyroscopic Forces," MS Thesis, Wichita State University, Dec. 2009.
Parker Hannifin Corporation, "Helical Hydraulic Rotary Actuators, L20 Series Service & Repair Manual," Sep. 2020, Enumclaw, Washington.
Parker Hannifin Corporation, "Helical Hydraulic Rotary Actuators, Series L and T," Aug. 2017, Enumclaw, Washington.
Pu, Guang, "Hybrid Air Bearings for High Speed Turbo Machinery," PHD Thesis, University of Birmingham, Dec. 2015, Edgbaston, Birmingham, United Kingdom.
Alan L. Hitchcox, "Hydraulics at the Wheel," Hydraulics and Pneumatics, Serving Fluid Power and Motion Control Engineers, 2010, Penton Media Inc., New York, NY.
Li, Yan, et al, "Interference Torque of a Gas-Dynamic Bearing Gyroscope Subject to a Uniform Change of the Specific Force and the Carrier Angular Velocity," Sensors 2020, MDPI, Nov. 30, 2020.
Frost, Geoffrey and Costello, Mark, "Linear Theory of a Projectile With a Rotating Internal Part in Atmospheric Flight," Report No. ARL-CR-530, Jul. 2003, US Army Research Laboratory, Aberdeen Proving Ground, MD.
Shan, X.-C., et al., "A Micro Turbine Device with Enhanced Micro Air Bearings," Apr. 2006, HAL Id: hal-00189281, Stresa, Lago Maggiore, Italy.
Jintanawan, Thitima, "A Model of Distributed Dynamic Forces in Herringbone Grooved Journal Bearing," 1st International Conference on Advanced Tribology, Dec. 1-3, 2004, Singapore.
Umstead, CM, et al., "Multibody Modeling of an Internal Gyroscopic Micro-mechanism for Development of Lateral Deviation of a Projectile," Proceedings of the Institution of Mechanical Engineers, Part K, Journal of Multi-body Dynamics, Mar. 2015.
E. A. Muijderman, E. A., "New Forms of Bearing: The Gas and the Spiral Groove Bearing," Philips Technical Review, Oct. 2, 1964, vol. 25, No. 10, Philips Research Laboratories, pp. 253-274, Eindhoven, Netherlands.
Han, Qing, et al., "A Novel Design of Spiral Groove Bearing in a Hydrodynamically Levitated Centrifugal Rotary Blood Pump" Artificial Organs, vol. 36, No. 8, Jul. 2012, pp. 739-746.
Norris, James, et al., "A Review of Dual-Spin Projectile Stability," Defence Technology, vol. 16, Issue 1, Feb. 2020, pp. 1-9.
Frost, Geoffrey and Costello, Mark, "Linear Theory of a Rotating Internal Part Projectile Configuration in Atmospheric Flight," Journal of Guidance, Control, and Dynamics, vol. 27, No. 5, Sep.-Oct. 2004, pp. 898-906.
Whipple, R. T. P., "Theory of the Spiral Grooved Thrust Bearing with Liquid or Gas Lubricant," Atomic Energy Research Establishment, T/R 622, Mar. 6, 1951.
Ware, Michael, "The Right Slug for Your Slug Gun," The Iowa Sportsman, Iowa Shooting News, p. 62, Nov. 2012.
Hornady Manufacturing Company, "Hornady 2005 Catalog," 2005, pp. 2 and 39, Grand Island, NE.
Hornady Manufacturing Company, "Hornady 2020 Catalog," 2020, pp. 13, 20, 21, 44, 45, and 156, Grand Island, NE.

* cited by examiner

FIG. M 961
743
922
721
941
SECTION B-B 5
950
721
B
B
910
922
700B
975
961
736
741
976
966
976

5
950
743
975
700A
910
922
999
700B
721

SECTION C-C

SECTION D-D

SECTION E-E

SECTION F-F

SECTION G-G

SECTION H-H

SECTION I-I

SECTION J-J 5
450D
410B
1462
1275C
1463
788
5
1488
1261B
788
5
450B
450B
51
1362
26
1489
1279
1499

1275
1410
1275
1410
1292
453
1261
1261
453
1405
1405
1266
1276
1276
1362
1362
51
26
1266
1244
51
26
65
65
452
452
454
454

SECTION K-K

SECTION M-M

SECTION N-N

SECTION L-L

SECTION O-O

SECTION P-P

SECTION Q-Q, MODIFIED

SECTION R-R

SECTION S-S

METHOD FOR AERONAUTICAL STABILIZATION

CROSS REFERENCE TO RELATED APPLICATIONS

This application claims priority to and is a divisional of co-pending U.S. patent application Ser. No. 17/686,354 filed Mar. 3, 2022 in the name of Michael L. Wach and Michael L. Wach Jr., entitled "System and Method for Aeronautical Stabilization," and issued on Jan. 9, 2024 as U.S. Pat. No. 11,867,487; which claims priority to U.S. Provisional Patent Application No. 63/155,737 filed Mar. 3, 2021 in the name of Michael L. Wach and Michael L. Wach Jr. and entitled "System and Method for Aeronautical Stabilization." The entire contents of each of the above-identified applications, including U.S. patents application Ser. Nos. 17/686,354 and 63/155,737 are hereby incorporated herein by reference.

TECHNICAL FIELD

Embodiments of the technology relate generally to system stabilization and more particularly to stabilizing a projectile by launching the projectile in a stabilizing manner that can entail producing spin and providing a gyroscopic effect.

BACKGROUND

Conventional technologies underserve stabilization of aeronautical systems in many respects.

Need exists in connection with improving performance of aeronautical systems.

Needs exist in connection with improving energy efficiency in aeronautical systems, such as to increase the fraction of produced energy that is converted to kinetic energy of a projectile and/or to reduce the fraction of produced energy that is lost to heat generation.

Need exists in connection with increasing kinetic energy of projectiles and other aeronautical systems.

Need exists in connection with increasing energy conveyed by a projectile whose velocity is limited, such as limited to staying below a threshold velocity associated with the speed of sound.

Need exists in connection with controlling aeronautical systems, including for improved approaches to stabilization of projectiles.

Needs exist in connection with providing flexibility in gyroscopic stabilization of aeronautical systems, for instance so that different types of projectiles launched through a common barrel of fixed geometry can be imparted with individually optimized levels of gyroscopic stabilization.

Needs exist in connection with managing gyroscopic stabilization of aeronautical systems, for example so a projectile acquires angular momentum gradually, progressively, or in a controlled manner, or gains angular momentum along a desired plot or curve that may be time based.

Need exists in connection with decoupling interdependent parameters related to gyroscopic stabilization of aeronautical systems, for instance to facilitate managing or treating the parameters individually in system design or in system operation in support of gyroscopic stabilization.

Need exists in connection with managing forces and dynamic loads associated with gyroscopic stabilization of aeronautical systems, for example to avoid excessive or undue mechanical stress or shock associated with imparting angular momentum on a projectile or with projectile acceleration. Need exists in connection with suppressing concussion on projectiles, on projectile launching systems, and/or on users thereof during projectile launch.

Need exists in connection with subduing torsional impulse of projectiles during launch. Need exists in connection with managing torque applied to projectiles, for instance to avoid undue torsion or shear stress.

Need exists in connection with limiting or mitigating balloting of projectiles during launch.

Need exists in connection with managing transients in gyroscopically stabilized aeronautical systems, for example towards suppressing, damping, or deadening transient responses that could adversely impact system performance or towards avoiding undue transient response generation.

Need exists in connection with producing angular momentum in gyroscopically stabilized aeronautical systems, including to spin a component of a projectile at an angular velocity sufficient to gyroscopically stabilize the entire projectile.

Need exists in connection with managing rotational energy in gyroscopically stabilized aeronautical systems, for example to provide a capability to transfer rotational energy between components of a gyroscopically stabilized projectile.

Need exists in connection with gyroscopically stabilizing an aeronautical system in which an exterior of the system is rotationally constrained.

Need exists in connection with preserving angular momentum of a projectile that is traveling on a trajectory towards a target and subject to viscous interaction with open air.

Need exists in connection with imparting a projectile with sufficient angular momentum to stabilize the projectile while avoiding undue perturbations, diminished precision, or destabilization due to the Magnus effect, gyroscopic drift, or aerodynamic jump.

Need exists in connection with green ammunition, such as ammunition platforms and designs that perform well utilizing materials recognized as environmentally friendly or non-toxic, that contain less than one percent lead by weight, that can qualify as nonlead ammunition, or that satisfy the requirements set forth by the state of California for certification as lead-free.

A technology addressing one or more of the aforementioned needs, or some related deficiency in the art, would benefit the aeronautical field. As will be appreciated by those having skill in the art, the disclosure provided herein includes written description containing clear, exact terms to enable carrying out embodiments meeting the aforementioned needs. The needs discussed above are representative rather than exhaustive, and those skilled in the art having benefit of this disclosure will appreciate that the written description fully supports ample embodiments satisfying other needs.

The foregoing discussion of needs is not to be construed as disparaging any approach or technology (whether prior, current, or future) and further does not constitute disclaimer of any disclosure or subject matter, nor disavowal of any claim scope. Moreover, something that represents a need or problem in one application may represent something beneficial in another application. For example, while need exists in connection with increasing kinetic energy of projectiles by increasing projectile speed, certain projectiles may intentionally travel at subsonic speed with lower energy than a supersonic counterpart projectile.

This section of the specification, headed "Background," does not constitute applicant admitted prior art. Moreover, this Background section provides disclosure that teaches insight, conceptions, and theories about system behavior that are believed to be new, novel, nonobvious, unrecognized, and unappreciated.

SUMMARY

A portion of an aeronautical system or the entire system can rotate during launch in support of gyroscopically stabilizing the system.

In some aspects of the disclosure, the aeronautical system can comprise a gun, a smoothbore gun, a firearm, a smoothbore firearm, a light firearm, a smoothbore light firearm, a crew-served firearm, a smoothbore crew-served firearm, an air gun, a smoothbore air gun, a railgun, or an archery device that launches a projectile, to mention some representative examples without limitation.

In an aspect of the disclosure, the aeronautical system can comprise a system that travels through air, space, or other appropriate medium and is self-propelled utilizing onboard propellant, for example a rocket, a ballistic missile, or a manned or unmanned craft.

In an aspect of the disclosure, the aeronautical system can comprise a projectile. In a subaspect, the projectile can be of a caliber in the range of .17 caliber to .50 caliber. The projectile can have an exterior diameter that varies along an axis of the projectile, for instance tapering in an ogive, teardrop shaped, or comprising fins. An outer diameter of the projectile can be taken at an axial location where the exterior diameter is greatest. In a subaspect, the projectile can have an outer diameter in the range of 4 millimeters to 14 millimeters. In a subaspect, the projectile can have a maximum outer diameter in the range of 14 millimeters to 65 millimeters. In a subaspect, the projectile can comprise a sabot or discarding sabot and a sub-projectile carried by the sabot. In a subaspect, the projectile can be sized for a cartridge that is characterized by gauge, for instance 10 gauge, 12 gauge, 16 gauge, 20 gauge, 28 gauge, or 410 bore.

In an aspect of the disclosure, a projectile can comprise an integrated stabilization system.

In an aspect of the disclosure, a projectile can comprise an integrated stabilization system, and the integrated stabilization system can comprise a mass that spins relative to an exterior surface of the projectile to produce a gyroscopic effect. In a subaspect, the spinning mass can produce the gyroscopic effect while the exterior surface maintains a sufficiently uniform rotational orientation to avoid a problematic level of the Magnus effect, gyroscopic drift, and/or aerodynamic jump. The spinning mass can produce an effective amount of angular momentum to mitigate, to avoid, or to cure the Magnus effect, gyroscopic drift, and/or aerodynamic jump.

In an aspect of the disclosure, a projectile that spins for gyroscopic stabilization can comprise an integrated stabilization system for improving performance.

In an aspect of the disclosure, a projectile can comprise an integrated stabilization system that controls how the projectile responds to forces or dynamic loads that are applied to the projectile for linear and rotational acceleration of the projectile.

In an aspect of the disclosure, a projectile can comprise a rotor and a gas bearing that supports the rotor. In a subaspect, the rotor can have a mass and a rotational speed sufficient for gyroscopic stabilization of the projectile. In a subaspect, the gas bearing can support a rotational speed of the rotor of at least 100,000 revolutions per minute. In a subaspect, the gas bearing can bear an axial load equivalent to an inertial force resulting from acceleration of the mass from 0 to 800 meters per second over 0.75 meters. In a subaspect, the gas bearing can bear at least 1,000 newtons of axial load. In a subaspect, the gas bearing can support the rotor at a rotational speed of at least 150,000 revolutions per minute and an axial load of at least 3,000 newtons. In a subaspect, the gas bearing can comprise a thrust bearing. In a subaspect, the gas bearing can comprise a journal bearing. In a subaspect, the gas bearing can comprise an aerostatic bearing. In a subaspect, the gas bearing can comprise an aerodynamic bearing. In a subaspect, the gas bearing can comprise a spiral groove bearing. In a subaspect, the gas bearing can comprise an aero spiral groove bearing.

In an aspect of the disclosure, a projectile can launch using propulsion provided by an off-board energy source that is external to the projectile, for instance energy provided by combustion or chemical reaction, pneumatic energy, energy stored in physically compressed gas, hydraulic energy, electromagnetic energy, gravity, or mechanical energy stored in a physical member via flexure or elastic deformation, to mention some representative examples without limitation. In an aspect of the disclosure, a projectile can coast towards a destination, for example proceeding without onboard power following a period of propulsion. In an aspect of the disclosure, a projectile can utilize onboard power for propulsion, for instance using rocket fuel, gasoline, kerosene, alcohol, a jet engine, a piston or combustion engine, compressed gas, or an inert propellant, to mention some representative examples without limitation. In an aspect of the disclosure, a projectile can comprise a vehicle that may, for instance, carry a payload, a warhead, a scientific instrument, cargo, a load, a shaped charge, or a passenger, to mention some representative examples without limitation. In an aspect of the disclosure, a projectile can proceed towards a destination without active guidance. In an aspect of the disclosure, a projectile can proceed under active guidance towards a destination, for instance utilizing onboard guidance, internal control, off-board guidance, remote control, aerodynamic guidance, active steering, self-steering, autonomous control, or inertial guidance, to mention some representative examples without limitation.

In an aspect of the disclosure, a projectile can comprise two members. One of the two members can move axially relative to the other member during launch of the projectile. The axial movement can cause one of the two members to spin. The spin can produce a gyroscopic effect. The gyroscopic effect can provide gyroscopic stabilization while the launched projectile advances towards a destination.

In an aspect of the disclosure, a projectile can comprise a drive that converts translational motion into rotational motion and a rotor that the drive rotates. The rotating rotor can, for example, gyroscopically stabilize the projectile. In a subaspect, the translational motion can comprise rectilinear motion. In a subaspect, the translational motion can comprise curvilinear motion. In a subaspect, the translational motion can be pure translation motion in which a member moves from place to place without substantial rotation, for example while being held in a fixed rotational orientation by a keyed joint. In a subaspect, the translational motion can be motion in which a member moves from place to place while rotating. In a subaspect, the translational motion can comprise movement of the rotor from a first place to a second place, and the rotational motion can comprise rotation of the rotor as the rotor moves from the first place to the second place, wherein the drive rotates the rotor as the rotor moves from the first place to the second place. In a subaspect, the drive can convert axial, linear, rectilinear, or curvilinear acceleration into rotational acceleration of the rotor. In a subaspect, the conversion can occur while the projectile is moving through a gun barrel. In a subaspect, the drive can comprise a compound helical drive. In a subaspect, the drive can comprise a soft starter.

In an aspect of the disclosure, a projectile can comprise a drive that converts inertial force associated with launching the projectile or associated with acceleration of the projectile into rotation of a mass that the projectile comprises. In a subaspect, the rotating mass can provide angular momentum useful for stabilizing the projectile. In a subaspect, the conversion can occur while the projectile is moving through a gun barrel. In a subaspect, the drive can comprise a compound helical drive. In a subaspect, the drive can comprise a soft starter.

In an aspect of the disclosure, a projectile can comprise a drive. In a subaspect, the drive can comprise an inertial drive. In a subaspect, the drive can comprise a gas drive. In a subaspect, the drive can comprise a compound helical drive. In a subaspect, the drive can comprise a soft starter.

In an aspect of the disclosure, a projectile can comprise a drive that comprises a member and a rotor and that converts relative motion between the member and the rotor into rotation of the rotor. In a subaspect, the relative motion can be along a path. In a subaspect, the relative motion can be along a curved path. In a subaspect, the relative motion can comprise axial motion. In a subaspect, the relative motion can comprise linear motion. In a subaspect, the relative motion can comprise curved motion. In a subaspect, the relative motion can comprise motion along an axis of the projectile.

In an aspect of the disclosure, a projectile can comprise a helix. In a subaspect, the helix can convert force or energy applied to the projectile into rotation of at least a portion of the projectile. In a subaspect, the rotation can gyroscopically stabilize the projectile.

In an aspect of the disclosure, a portion of a projectile can spin during a selected timeframe, a selected travel segment, or a selected launch interval or responsive to an occurrence of an event. For example, the projectile portion may spin during launch of the projectile, during an early phase of launch, while the projectile is accelerating, or while an exterior surface of the projectile is constrained from spinning. In a subaspect, the spinning portion of the projectile can transfer at least some spin or rotational energy to another portion of the projectile following the timeframe, travel segment, or launch interval or in response to an event, state, mode, trigger, or condition. For example, spin or rotational energy can transfer following launch, after an early phase of launch, once acceleration has concluded, once deceleration has started, when acceleration changes, or when the projectile becomes unconstrained. In a subaspect, the transfer of spin or rotational energy can produce spinning of a different portion of the projectile, a greater portion of the projectile, or the entire projectile, for example.

In an aspect of the disclosure, a projectile can comprise a rotor and an exterior surface that circumscribes the rotor. The rotor and the exterior surface can rotate relative to one another about an axis of the projectile. In a subaspect, the projectile can encounter rifling of a barrel during projectile launch; at the encounter, the rifling can engage and abruptly rotate the exterior surface. Initiation and buildup of rotation of the rotor can be less abrupt. The rotor can have a subdued reaction that can moderate the composite reaction of the projectile. The rotor can comprise a buffer.

In an aspect of the disclosure, a projectile can comprise a member and a mass. When the projectile is subject to a stimulus, the mass can respond more slowly than the member or with a different rise time or lag time or with relative time delay. The response of the mass can smooth out spikes in the projectile's response to the stimulus. The mass can have sufficient freedom of movement to buffer the response. Mobility of the mass can increase a time constant of the projectile's response to the stimulus.

In an aspect of the disclosure, a projectile can comprises a retainer that releases responsive to an event or a condition. In a subaspect, the retainer comprises a conditional-release retainer. In a subaspect, the retainer releases a member so the member can move during launch. In a subaspect, the member comprises a rotor. In a subaspect, the member, once released, drives rotation of a rotor.

In an aspect of the disclosure, a projectile can comprise a distribution of gas outlets that form a gas annulus between the projectile and a tube through which the projectile is propelled.

In an aspect of the disclosure, a gas bearing can comprise an exterior surface of a projectile and an interior surface of a barrel that has exactly one gas inlet.

The foregoing discussion about projectiles is for illustrative purposes only. Various aspects of the present disclosure may be more clearly understood and appreciated from a review of the following text and by reference to the associated drawings and the claims that follow. This Summary does not intend to be exhaustive, nor does it intend to enumerate each and every aspect of the disclosure. Other aspects, systems, methods, features, advantages, and objects of the present disclosure will become apparent to those with skill in the art upon examination of the following drawings and text. It is intended that all such aspects, systems, methods, features, advantages, and objects are to be included within this description and covered by this paper and by the appended claims.

BRIEF DESCRIPTION OF THE FIGURES

FIG. 1, are illustrations of a system for launching and gyroscopic stabilization of a projectile in accordance with some example embodiments of the disclosure. FIG. 1A is a line drawing of the system for launching and gyroscopic stabilization of a projectile in accordance with some example embodiments. FIG. 1B is an illustration of a cross section of a barrel that the system may comprise in accordance with some example embodiments. FIG. 1C is an illustration of a cross section of another barrel that the system may comprise in accordance with some example embodiments. FIG. 1D is a partial cutaway illustration, in side view, of a cartridge that the system comprises in accordance with some example embodiments. FIG. 1E is an illustration of a rear end of the cartridge in accordance with some example embodiments. FIG. 1M is an illustration of a member that the projectile comprises in accordance with some example embodiments.

FIG. 2, are illustrations of a projectile comprising a system for gyroscopic stabilization in accordance with some example embodiments of the disclosure. FIGS. 2A and 2B are cross sectional illustrations of the projectile with an axis of the projectile in the cutting plane of the view, respectively illustrating two modes in accordance with some example embodiments. FIG. 2C is a cross sectional detail view of a retainer that the projectile comprises in accordance with some example embodiments.

FIG. 3, are illustrations of a projectile comprising a system for gyroscopic stabilization in accordance with some example embodiments of the disclosure. FIGS. 3A and 3B are cross sectional illustrations of the projectile with an axis of the projectile in the cutting plane of the view, respectively illustrating two modes in accordance with some example embodiments.

FIG. 4, are illustrations of a system for launching and gyroscopic stabilization of a projectile in accordance with some example embodiments of the disclosure. FIG. 4A is a line drawing of the system for launching and gyroscopic stabilization of a projectile in accordance with some example embodiments. FIG. 4B is an illustration of a cartridge comprising the projectile, in partial cutaway, that the system comprises in accordance with some example embodiments. FIG. 4C is a line drawing presenting a side view of an exterior of another projectile that the cartridge may comprise in accordance with some example embodiments. FIG. 4D is a detail cross sectional view of a portion of another cartridge the system may comprise in accordance with some example embodiments. FIGS. 4E and 4F are cross sectional illustrations of the projectile of FIG. 4B, with an axis of the projectile in the cutting plane of the view, respectively illustrating two modes in accordance with some example embodiments. FIG. 4G is a line drawing of a member that the projectile of FIG. 4B comprises in accordance with some example embodiments. FIG. 4H is a perspective illustration of a portion of the member in accordance with some example embodiments. FIGS. 4I and 4J are illustrations of alternative elements of the projectile of FIG. 4B in accordance with some example embodiments. FIG. 4K is a detail cross sectional illustration of a portion of the projectile of FIG. 4B illustrating a retainer the projectile comprises in accordance with some example embodiments. FIG. 4L is a detail cross sectional illustration of the projectile of FIG. 4B illustrating another retainer that the projectile comprises in accordance with some example embodiments. FIG. 4M is a detail cross sectional illustration of the projectile of FIG. 4B illustrating another retainer that the projectile comprises in accordance with some example embodiments.

FIG. 5, are illustrations of a projectile comprising a system for gyroscopic stabilization in accordance with some example embodiments of the disclosure. FIGS. 5A and 5B are illustrations of the projectile respectively illustrating two modes in accordance with some example embodiments. FIGS. 5A and 5B are partial cross sectional views in which an axis of the projectile is in a cutting plane of the view in accordance with some example embodiments of the disclosure. The partial cross sectional views of FIGS. 5A and 5B expose a rotor disposed within the projectile, wherein the rotor is illustrated without sectioning in accordance with some example embodiments of the disclosure. Exposed contours are illustrated with shading in accordance with some example embodiments of the disclosure. FIG. 5C is a detail illustration of a portion of a leading face of the rotor in accordance with some example embodiments of the disclosure. FIG. 5D is another detail illustration of the portion of the leading face of the rotor that further illustrates an adjoining section of a member of the projectile in accordance with some example embodiments of the disclosure.

FIG. 6, are illustrations of a projectile comprising a system for gyroscopic stabilization in accordance with some example embodiments of the disclosure. FIGS. 6A and 6B are cross sectional illustrations of the projectile with an axis of the projectile in the cutting plane of the view, respectively illustrating two modes in accordance with some example embodiments. FIGS. 6C, 6D, 6E, and 6F are illustrations of springs that the projectile may comprise in accordance with some example embodiments.

FIG. 7, are illustrations of a projectile comprising a system for gyroscopic stabilization in accordance with some example embodiments of the disclosure. FIGS. 7A and 7B are cross sectional illustrations of the projectile with an axis of the projectile in the cutting plane of the view, respectively illustrating two modes in accordance with some example embodiments. FIG. 7C is a cross sectional illustration of the projectile with the cutting plane of the view cutting the axis perpendicularly at Section A-A in accordance with some example embodiments. FIGS. 7D, 7E, 7F, 7G, 7H, 7N, and 7O are illustrations of rotors that the projectile may comprise in accordance with some example embodiments. FIG. 7I is a detail cross sectional illustration of a trailing end of the projectile with an axis of the projectile in the cutting plane of the view in accordance with some example embodiments. FIG. 7J is another illustration of the trailing end of the projectile that provides an end-on view in accordance with some example embodiments. FIG. 7K is a detail perspective illustration of a section of a drive member the projectile can comprise in accordance with some example embodiments. FIG. 7L is a detail perspective illustration of contours of an internal space the projectile can comprise in accordance with some example embodiments. FIG. 7M is a detail cross sectional illustration of a rear portion of the projectile with an axis of the projectile in the cutting plane of the view in accordance with some example embodiments.

FIG. 8, are illustrations of a projectile comprising a system for gyroscopic stabilization in accordance with some example embodiments of the disclosure. FIGS. 8A and 8B are cross sectional illustrations of the projectile, with an axis of the projectile in the cutting plane of the view, respectively illustrating two modes in accordance with some example embodiments.

FIG. 9, are illustrations of a projectile comprising a system for gyroscopic stabilization in accordance with some example embodiments of the disclosure. FIGS. 9A and 9B are cross sectional illustrations of the projectile with an axis of the projectile in the cutting plane of the view, respectively illustrating two modes in accordance with some example embodiments. FIG. 9C is a cross sectional illustration of the projectile with the cutting plane of the view cutting the axis perpendicularly at Section B-B in accordance with some example embodiments.

FIG. 10, are illustrations of a projectile comprising a system for gyroscopic stabilization in accordance with some example embodiments of the disclosure. FIGS. 10A and 10B are cross sectional illustrations of the projectile with an axis of the projectile in the cutting plane of the view, respectively illustrating two modes in accordance with some example embodiments. FIG. 10C is a detail cross sectional illustration of a central region the projectile with the cutting plane of the view cutting the axis perpendicularly at Section C-C in accordance with some example embodiments. FIG. 10D is a detail cross sectional illustration of a central region of the projectile with the cutting plane of the view cutting the axis perpendicularly at Section D-D in accordance with some example embodiments. FIG. 10E is a detail cross sectional illustration of a central region of the projectile with the cutting plane of the view cutting the axis perpendicularly at Section E-E in accordance with some example embodiments.

FIG. 11, are illustrations of a projectile comprising a system for gyroscopic stabilization in accordance with some example embodiments of the disclosure. FIGS. 11A and 11B are cross sectional illustrations of the projectile, with an axis of the projectile in the cutting plane of the view, respectively illustrating two modes in accordance with some example embodiments. FIG. 11C is an illustration of a member that the projectile comprises in accordance with some example embodiments. FIG. 11D is a detail cross sectional illustration of a central region of the projectile with the cutting plane of the view cutting the axis perpendicularly at Section F-F in accordance with some example embodiments. FIG. 11E is a detail cross sectional illustration of a central region of the projectile with the cutting plane of the view cutting the axis perpendicularly at Section G-G in accordance with some example embodiments. FIG. 11F is a detail cross sectional illustration of a central region of the projectile with the cutting plane of the view cutting the axis perpendicularly at Section H-H in accordance with some example embodiments. FIG. 11G is an illustration of a portion of an alternative form of the member of FIG. 11C that the projectile may comprise in accordance with some example embodiments.

FIG. 12, are illustrations of a projectile comprising a system for gyroscopic stabilization in accordance with some example embodiments of the disclosure. FIGS. 12A, 12B, 12C, 12D, and 12E are cross sectional illustrations of the projectile, with an axis of the projectile in the cutting plane of the view, respectively illustrating progressive modes in accordance with some example embodiments. The cutting plane exposes within the projectile helices that are illustrated without sectioning in accordance with some example embodiments. FIG. 12F is a detail cross sectional illustration of the projectile at Section I-I (as shown on FIG. 12A) in accordance with some example embodiments. FIG. 12G is a detail cross sectional illustration of the projectile at Section J-J (as shown on FIG. 12E) in accordance with some example embodiments. FIGS. 12H and 12I are illustrations of a rotor that the projectile comprises in accordance with some example embodiments.

FIG. 13, are illustrations of a projectile comprising a system for gyroscopic stabilization in accordance with some example embodiments of the disclosure. FIGS. 13A, 13B, 13C, and 13D are cross sectional illustrations of the projectile, with an axis of the projectile in the cutting plane of the view, respectively illustrating progressive modes in accordance with some example embodiments. The cutting plane exposes within the projectile helices that are illustrated without sectioning in accordance with some example embodiments.

FIG. 14, are illustrations of a projectile comprising a system for gyroscopic stabilization in accordance with some example embodiments of the disclosure. FIGS. 14A and 14B are cross sectional illustrations of the projectile, with an axis of the projectile in the cutting plane of the view, respectively illustrating two modes in accordance with some example embodiments. FIG. 14C is a cross sectional illustration of an alternative form of the projectile, with an axis of the projectile in the cutting plane of the view, in accordance with some example embodiments. In each of FIGS. 14A, 14B, and 14C, the cutting plane exposes within the projectile helices that are illustrated without sectioning in accordance with some example embodiments.

FIG. 15, are illustrations of a projectile comprising a system for gyroscopic stabilization in accordance with some example embodiments of the disclosure. FIGS. 15A and 15B are cross sectional illustrations of the projectile, with an axis of the projectile in the cutting plane of the view, respectively illustrating two modes in accordance with some example embodiments. The cutting plane exposes within the projectile helices that are illustrated without sectioning in accordance with some example embodiments. FIG. 15C is a detail cross sectional illustration of a central region of the projectile with the cutting plane of the view cutting the axis perpendicularly at Section K-K in accordance with some example embodiments.

FIG. 16, are illustrations of two projectiles comprising respective systems for gyroscopic stabilization in accordance with some example embodiments of the disclosure. FIGS. 16A, 16B, and 16C are cross sectional illustrations of a first one of the projectiles, with an axis of the projectile in the cutting plane of the view, respectively illustrating progressive modes in accordance with some example embodiments. FIGS. 16D, 16E, and 16F are cross sectional illustrations of a second one of the projectiles, with an axis of the projectile in the cutting plane of the view, respectively illustrating progressive modes in accordance with some example embodiments.

FIG. 17, are illustrations of a projectile comprising a system for gyroscopic stabilization in accordance with some example embodiments of the disclosure. FIGS. 17A and 17B are cross sectional illustrations of the projectile, with an axis of the projectile in the cutting plane of the view, respectively illustrating two modes in accordance with some example embodiments. The cutting plane exposes within the projectile a helix that is illustrated without sectioning in accordance with some example embodiments. FIG. 17C is an illustration of a member that the projectile comprises in accordance with some example embodiments. FIG. 17D is an illustration of an alternative form of the member in accordance with some example embodiments. FIGS. 17E, 17F, and 17G are detail cross sectional illustrations of central regions of the projectile with the cutting planes of the views cutting the axis perpendicularly at Section L-L, Section M-M, and Section N-N, respectively, in accordance with some example embodiments. FIGS. 17H and 17I are cross sectional illustrations further describing features illustrated in FIG. 17E in accordance with some example embodiments.

FIG. 18, are illustrations of a projectile comprising a system for gyroscopic stabilization in accordance with some example embodiments of the disclosure. FIGS. 18A and 18B are cross sectional illustrations of the projectile, with an axis of the projectile in the cutting plane of the view, respectively illustrating two modes in accordance with some example embodiments. The cutting plane exposes within the projectile a helix that is illustrated without sectioning in accordance with some example embodiments. FIG. 18C is a cross sectional illustration of a central region of an alternative form of the projectile in accordance with some example embodiments.

FIG. 19, are illustrations of a projectile comprising a system for gyroscopic stabilization in accordance with some example embodiments of the disclosure. FIGS. 19A and 19B are cross sectional illustrations of the projectile, with an axis of the projectile in the cutting plane of the view, respectively illustrating two modes in accordance with some example embodiments. The cutting plane exposes within the projectile a helix that is illustrated without sectioning in accordance with some example embodiments. FIG. 19C is a detail cross sectional illustration of a central region of the projectile with the cutting plane of the view cutting the axis perpendicularly at Section O-O in accordance with some example embodiments. FIG. 19D is a detail perspective illustration of internal features of the projectile in accordance with some example embodiments.

FIG. 20, are illustrations of a projectile comprising a system for gyroscopic stabilization in accordance with some example embodiments of the disclosure. FIGS. 20A and 20B are cross sectional illustrations of a leading portion of the projectile, with an axis of the projectile in the cutting plane of the view, respectively illustrating two modes in accordance with some example embodiments.

FIG. 23, are illustrations of a projectile comprising a system for gyroscopic stabilization in accordance with some example embodiments of the disclosure. FIGS. 23A, 23B, 23C, and 23D respectively illustrate progressive modes in accordance with some example embodiments. FIGS. 23A, 23C, and 23D are cross sectional illustrations of the projectile, with an axis of the projectile in the cutting plane of the view. FIG. 23B is a cross sectional illustration of the projectile disposed in a rifled gun barrel with the cutting plane of the view cutting the axis perpendicularly at Section P-P in accordance with some example embodiments.

FIG. 25, are illustrations of a projectile comprising a system for gyroscopic stabilization in accordance with some example embodiments of the disclosure. FIGS. 25A and 25B are cross sectional illustrations of the projectile, with an axis of the projectile in the cutting plane of the view, respectively illustrating two modes in accordance with some example embodiments. The cutting plane exposes within the projectile a helix that is illustrated without sectioning in accordance with some example embodiments.

FIG. 26, are illustrations of a projectile comprising a system for gyroscopic stabilization in accordance with some example embodiments of the disclosure. FIGS. 26A and 26B are cross sectional illustrations of the projectile, with an axis of the projectile in the cutting plane of the view, respectively illustrating two modes in accordance with some example embodiments. FIG. 26C is a cross sectional illustration of a central region of a modified version of the projectile with the cutting plane of the view cutting the axis perpendicularly at Section Q-Q in accordance with some example embodiments.

FIG. 27, are illustrations of a projectile comprising a system for gyroscopic stabilization in accordance with some example embodiments of the disclosure. FIGS. 27A and 27B are cross sectional illustrations of the projectile, with an axis of the projectile in the cutting plane of the view, respectively illustrating two modes in accordance with some example embodiments. The cutting plane exposes within the projectile a helix that is illustrated without sectioning in accordance with some example embodiments. FIG. 27 C is a cross sectional illustration of a central region of the projectile with the cutting plane of the view cutting the axis perpendicularly at Section R-R in accordance with some example embodiments.

FIG. 28, are illustrations of a projectile comprising a system for gyroscopic stabilization in accordance with some example embodiments of the disclosure. FIGS. 28A, 28B, 28C, 28D, and 28E are cross sectional illustrations of the projectile, with an axis of the projectile in the cutting plane of the view. The cutting plane exposes within the projectile a helix that is illustrated without sectioning in accordance with some example embodiments. FIGS. 28A, 28B, 28C, 28D, and 28E respectively illustrate progressive modes in accordance with some example embodiments.

FIG. 29, are illustrations of two projectiles comprising respective systems for gyroscopic stabilization in accordance with some example embodiments of the disclosure. FIGS. 29A and 29B are cross sectional illustrations of a first one of the projectiles, with an axis of the projectile in the cutting plane of the view, respectively illustrating two modes in accordance with some example embodiments. FIGS. 29C and 29D are cross sectional illustrations of a second one of the projectiles, with an axis of the projectile in the cutting plane of the view, respectively illustrating two modes in accordance with some example embodiments.

FIG. 30, are illustrations of a projectile comprising a system for gyroscopic stabilization in accordance with some example embodiments of the disclosure. FIG. 30A is a cross sectional illustration of the projectile, with an axis of the projectile in the cutting plane of the view. FIG. 30B is an illustration of a trailing end of the projectile in accordance with some example embodiments. FIG. 30C is a detail cross sectional illustration of a portion of the projectile in which the cutting plane of the view is perpendicular to the axis of the projectile in accordance with some example embodiments. FIG. 30D is a detail cross sectional illustration of an alternative embodiment of the portion of the projectile in which the cutting plane of the view is perpendicular to the axis of the projectile in accordance with some example embodiments. FIG. 30E is an illustration of the projectile disposed in a gun barrel in a cross sectional view taken perpendicular to an axis of the projectile in accordance with some example embodiments.

FIG. 31, are illustrations of a projectile comprising a system for gyroscopic stabilization in accordance with some example embodiments of the disclosure. FIGS. 31A, 31B, and 31C are cross sectional illustrations of the projectile, with an axis of the projectile in the cutting plane of the view, respectively illustrating three modes in accordance with some example embodiments. FIGS. 31A and 31B illustrate the projectile disposed in a sabot in accordance with some example embodiments. FIG. 31C illustrates the projectile wherein the sabot has been discarded in accordance with some example embodiments. The cutting plane of FIGS. 31A, 31B, and 31C exposes within the projectile a drive member that comprises a helix and that is illustrated without sectioning in accordance with some example embodiments. FIG. 31 D is a detail cross sectional illustration of a portion of the projectile that comprises a retainer in accordance with some example embodiments. FIG. 31E is a line-drawing illustration of a trailing end of the sabot in accordance with some example embodiments. FIG. 31F is a detail cross sectional illustration of a portion of the projectile operably coupled to the sabot with the cutting plane of the view cutting the axis perpendicularly at Section S-S in accordance with some example embodiments. FIGS. 31G and 31H are line-drawing illustrations of a member that structurally supports the sabot, wherein FIG. 31G is a view of a leading side of the member and FIG. 31H is a view of a trailing side of the member that depicts a hidden feature using dashed or broken line, in accordance with some example embodiments. FIG. 31I is a detail cross sectional illustration, corresponding to FIG. 31F, of a portion of the projectile operably coupled to the sabot via an alternative to the embodiment that FIG. 31F illustrates, wherein the cutting plane of the view cuts the axis perpendicularly, in accordance with some example embodiments. FIG. 31J is a diagram illustrating angular orientation of features of the projectile and the sabot that FIG. 31F illustrates, wherein the viewing planes of FIGS. 31F and 31J are perpendicular to one another and FIGS. 31J and 31B have common viewing perspectives, in accordance with some example embodiments. FIGS. 31K and 31L are diagrams that correspond to FIG. 31J and that illustrate alternative angular orientations of features of the projectile and the sabot that FIG. 31J illustrates in accordance with some example embodiments.

Figure 1A:
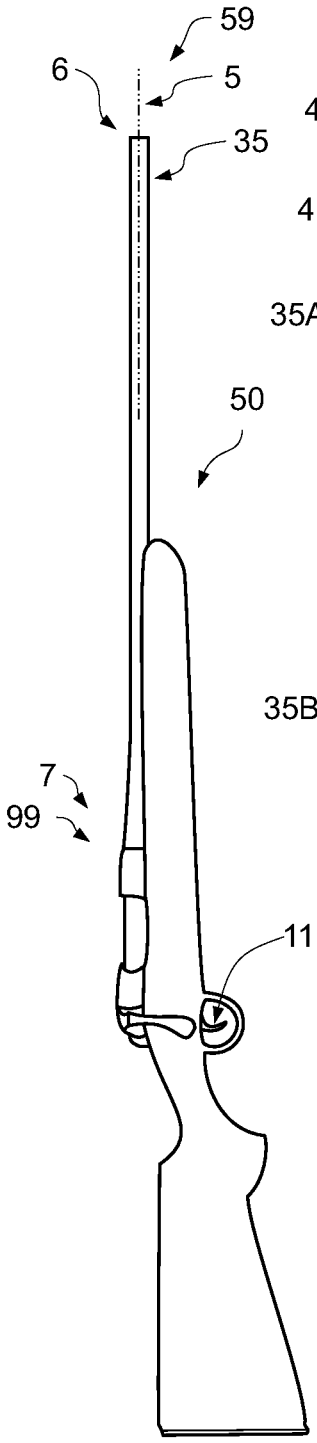
FIGS. 1A, 1B, 1C, 1D, 1E, IF, 1G, 1H, 1I, 1J, 1K, 1L, 1M, 1N, 1O, 1P, 1Q, 1R, 1S, 1T, 1U, 1V, and 1W, collectively

Many aspects of the disclosure can be better understood with reference to these figures. The elements and features shown in the figures are not necessarily to scale, emphasis being placed upon clearly illustrating principles of example embodiments of the disclosure. Moreover, certain dimensions and features may be exaggerated to help visually convey such principles. In the figures, reference numerals often designate like or corresponding, but not necessarily identical, elements throughout the several views.

DETAILED DESCRIPTION OF EXAMPLE EMBODIMENTS

The present disclosure comprises technical solutions to technical problems relating generally to stabilization of aeronautical systems. Representative needs that certain example embodiments satisfy in connection with providing technical solutions to technical problems will now further discussed, without limitation. In many instances within the discussion, a recognition of a need or a framing of a technical problem stems from new, nonobvious insight about system behavior. Moreover, this written description may disclose novel solutions to existing problems or new capabilities that fully satisfy long-standing needs, and such novel solutions and new capabilities may give rise to new opportunities or needs that the written description identifies for the first time and fully satisfies, for example in connection with optimization. Needs identified herein may, therefore, comprise subject matter that is novel and nonobvious.

In stabilizing aeronautical systems, energy intended to provide acceleration can be lost to heat generation, which can pose problems. For example, a gun may operate inefficiently as it discharges a bullet through a rifled barrel to impart spin on the bullet. In this scenario, propellant gas presses the bullet through grooves and lands that size the bullet as the rifling engraves itself on the bullet. The grooves and lands seize the bullet's exterior and rotate the bullet. The expanding propellant gas drives the rotating bullet down the barrel. Bullet swaging and engraving and friction between the rotating bullet and barrel may consume substantial energy, which becomes heat. Energy so consumed is generally unavailable for bullet acceleration; thus velocity may be suppressed and propellant wasted. A cartridge may include capacity for accommodating such wasted propellant, thereby representing excess ammunition weight and calling for oversized actions, chambers, and receivers. High-capacity magnum cartridges may further result in an overbore condition that shortens barrel life. Additionally, wasted energy can detrimentally elevate barrel temperature. Resulting thermal variations within a barrel and between the barrel and other gun components can cause dimensional changes, misalignment, and mechanical stresses that can compromise accuracy, precision, or repeatability. Engineering to accommodate such thermal effects and to dissipate the heat can substantially complicate the design of a gun. Moreover, the problem of heat accumulation can impose a major limitation on rate of fire. That is, thermal load can limit the cycle time between shots, so the barrel has sufficient time to release heat and avoid overheating. When a gun is fired too fast, such as may happen in a combat situation, overheating can cause a failure to fire, catastrophic failure, or unintentional firing, known as cooking-off. Multi-barrel machine guns and rotary cannons may approach this problem by employing a Gatling-style rotating cluster of barrels, with the rotation providing each barrel some time between shots to transfer heat to surrounding air. Cost, complexity, size, and weight of such guns can limit their application. Certain machine guns may incorporate unwieldly water cooling systems for thermal management. Other approaches may entail routine user intervention, such as configuring a gun so that a crew can rapidly swap out an overheated barrel for a cool one—with the drawbacks of carrying at least one spare barrel and crew vulnerability during the barrel exchange. Need accordingly exists for an energy-efficient capability for stabilizing an aeronautical system; the disclosure provided herein includes written description containing clear, exact terms to enable carrying out embodiments meeting this need. Need further exists for avoiding barrel heat and wasted energy; the disclosure provided herein includes written description containing clear, exact terms to enable carrying out embodiments meeting this need. Need exists for increasing the fraction of propellant energy that delivers bullet acceleration; the disclosure provided herein includes written description containing clear, exact terms to enable carrying out embodiments meeting this need. Need exists for decreasing the fraction of propellant energy that is lost to and/or consumed by friction, bullet deformation, and heat; the disclosure provided herein includes written description containing clear, exact terms to enable carrying out embodiments meeting this need. Need exists for an improved capability to impart spin or angular momentum on a bullet; the disclosure provided herein includes written description containing clear, exact terms to enable carrying out embodiments meeting this need. Need exists for a capability of shooting spinning bullets or bullets having angular momentum out of a barrel that is energy efficiency; the disclosure provided herein includes written description containing clear, exact terms to enable carrying out embodiments meeting this need. Need further exists for a capability of imparting spin or angular momentum on bullets in a smoothbore gun and for shooting spinning bullets or bullets with angular momentum through or from a smoothbore gun; the disclosure provided herein includes written description containing clear, exact terms to enable carrying out embodiments meeting this need. Need further exists for a capability to improve the speed, energy, trajectory, and/or wind deflection characteristics of a bullet of a desired caliber shot using a powder charge that may be limited by case capacity, by a pressure specification, or by other constraint; the disclosure provided herein includes written description containing clear, exact terms to enable carrying out embodiments meeting this need. Needs identified in this paragraph are representative rather than exhaustive and are among others satisfied by embodiments fully supported by the present written description. This paragraph further includes disclosure teaching insight, conceptions, and theories about system behavior that are believed to be new, novel, nonobvious, unrecognized, and unappreciated.

In a rifled barrel, the rifling pattern or twist rate may be built in at manufacture and thus fixed. The term "twist rate," as used herein with reference to rifling of a barrel generally refers to the length of barrel that the rifling takes to complete one complete revolution; for instance, the rifling of a barrel with a twist rate of 1 turn in 254 mm (which may be expressed as 1:254 mm) would take 254 mm of barrel length to complete one full revolution. Since different conventional bullets of a given caliber may have preferred twist rates governed by bullet weight and length or mass distribution within the bullet's volume, a barrel with fixed rifling may lack flexibility to perform well with a wide range of bullets. For example, a barrel that is optimized for shooting long, heavy bullets may have a twist rate that is too tight to shoot shorter, lighter bullets well. Need accordingly exists for a capability to operate with flexible spin rate; the disclosure provided herein includes written description containing clear, exact terms to enable carrying out embodiments meeting this need. Need further exists for a capability to shoot different bullets with different spin rates through a common barrel; the disclosure provided herein includes written description containing clear, exact terms to enable carrying out embodiments meeting this need. Need further exists for a capability to increase or decrease the spin rate or angular momentum of a bullet shot through a barrel that has a fixed twist rate; the disclosure provided herein includes written description containing clear, exact terms to enable carrying out embodiments meeting this need. For example, for a barrel with a slow twist rate that is optimized for shooting short, light bullets, need exists for increasing the spin rate or angular momentum to accommodate long, heavy bullets in which mass may be distributed over a long axial length; the disclosure provided herein includes written description containing clear, exact terms to enable carrying out embodiments meeting this need. For a gun having a rifled barrel configured to shoot a bullet and spin the bullet about an axis of the bullet, wherein the bullet has a center of mass on the axis, wherein the bullet has a moment of inertia about the center of mass taken perpendicular to the axis, and wherein the rifled barrel comprises rifling of a twist rate that limits the gun to shooting the bullet precisely when the moment of inertia of the bullet is within a range of moment of inertia values, need exists for a capability for the gun to shoot the bullet precisely when the moment of inertia of the bullet is outside the range of moment of inertia values; the disclosure provided herein includes written description containing clear, exact terms to enable carrying out embodiments meeting this need. For a gun rifled for precision shooting of bullets that have a moment of inertia within a moment-of-inertia range, need exists for a capability for precision shooting of bullets that have a moment of inertia outside said moment-of-inertia range; the disclosure provided herein includes written description containing clear, exact terms to enable carrying out embodiments meeting this need. Needs identified in this paragraph are representative rather than exhaustive and are among others satisfied by embodiments fully supported by the present written description. This paragraph further includes disclosure teaching insight, conceptions, and theories about system behavior that are believed to be new, novel, nonobvious, and unappreciated.

Launching a projectile, such as firing a round in a gun, can subject the projectile to multiple energy-intensive operations in a compressed time period and/or a constrained space, for example near the breach of a barrel. Such operations may entail swaging associated with encountering rifling grooves and lands, peak rotational acceleration associated with entering and traveling through an initial section of rifling, and maximum propellant gas pressure and cresting linear acceleration occurring as the bullet starts moving down the barrel. When compressed too tightly, these operations can result in undue stresses on the bullet, the gun, and/or the gun's operator or in elevated gas pressure. Further, a design engineer attempting to optimize one of the operations may encounter challenges or design constraints when the operations are conventionally intertwined or interdependent. For example, rifling may impose a fixed, direct relationship between bullet rotation and the distance the bullet travels down the barrel. Accordingly, need exists for flexibility in implementing bullet rotation and/or imparting angular momentum on a bullet; the disclosure provided herein includes written description containing clear, exact terms to enable carrying out embodiments meeting this need. Need exists for a capability of treating operations on a bullet separately and/or for decoupling conventional dependencies; the disclosure provided herein includes written description containing clear, exact terms to enable carrying out embodiments meeting this need. Need exists for a capability of achieving bullet rotation or angular momentum that works around or removes a fixed dependence on the distance a bullet has travelled down a barrel; the disclosure provided herein includes written description containing clear, exact terms to enable carrying out embodiments meeting this need. Need further exists for a capability to control the angular acceleration of a bullet mass, for example so that spin rate or angular momentum can increase at a desired rate or can follow a desired spin-rate or angular-momentum trajectory; the disclosure provided herein includes written description containing clear, exact terms to enable carrying out embodiments meeting this need. Need further exists for a capability to manipulate or control angular momentum of a bullet, for example so that angular momentum builds up in a prescribed manner that may be smooth or incremental; the disclosure provided herein includes written description containing clear, exact terms to enable carrying out embodiments meeting this need. Needs identified in this paragraph are representative rather than exhaustive and are among others satisfied by embodiments fully supported by the present written description. This paragraph further includes disclosure teaching insight, conceptions, and theories about system behavior that are believed to be new, novel, nonobvious, and unappreciated.

A bullet may undergo abrupt rotational acceleration when the bullet encounters rifling at a breach end of a gun barrel. The rifling can impose impulsive torque at this encounter. The twist rate of the encountered rifling may constrain the bullet to rotating a defined number of rotations for a given length of barrel length traversed. For example, for a barrel with a fixed twist rate of 1:10 inches (1:254 mm), the barrel would impose~0.1 revolutions (~36 degrees) of bullet rotation in the first inch (~25.4 mm) of barrel length traversed. Accordingly, once a bullet is fully engaged with the rifling, a fixed correlation may exist between the barrel length traversed and degrees of bullet rotation. Under such constraints, a related correlation may exist between a bullet's linear velocity along the barrel axis and the bullet's rotational velocity about the axis, and further between the bullet's axial acceleration and rotational acceleration. Thus, if the bullet's linear acceleration changes rapidly or peaks at or near the barrel breach, the bullet's angular acceleration may likewise change rapidly or peak. The bullet may jump from having one rotational orientation prior to encountering the barrel's rifling to being rotated rapidly by the rifling, and may experience high angular jerk or jolt associated with this abrupt rotational change. The resulting torsional impulse can cause balloting of the bullet. The bullet can be forced out of true with respect to the barrel. The impulsive torque that the rifling applies to the bullet's exterior to achieve an abrupt rotational change and angular jerk or jolt of the bullet's mass can pose further issues in some situations. The associated shear force and shear stress at the interface between the bullet and the rifling can be of sufficient magnitude to impose limits on choices of materials capable of withstanding the force and stress. In some instances, bullet materials offering desirable characteristics for obturation or sealing of propellant gases and/or for managing or suppressing bullet-to-barrel friction may have inadequate mechanical properties to withstand the torsional forces and load occurring at the bullet-rifling interface. For example, a candidate bullet material may offer a desirably low coefficient of friction but be unsuitable due to lacking sufficient strength to endure the forces, stresses, and/or strains of the rifling gripping the bullet and of the rifling applying a level of torque to drive angular acceleration associated with the twist rate for the total mass of the bullet. Moreover, the propellant gas driving the bullet into the rifling and the rifling imposing a step or impulse change associated with the bullet's rotational orientation can produce a transient response that may include one or more oscillations, vibrations, transients, perturbations, waves, and/or periodic movements. Such a transient response may, for instance, produce an erratic barrel movement that can adversely impact precision, accuracy, or repeatability in some situations. Need accordingly exists for an improved capability to manage interaction between a bullet and rifling of a barrel; the disclosure provided herein includes written description containing clear, exact terms to enable carrying out embodiments meeting this need. Need exists for a capability to manage or reduce force, torque, stress, and/or strain associated with a bullet encountering and/or interacting with rifling at or near a breach of a barrel; the disclosure provided herein includes written description containing clear, exact terms to enable carrying out embodiments meeting this need. Need further exists to expand material options for bullets, including so that materials having desirable gas-sealing properties or low coefficients of friction can be utilized more effectively; the disclosure provided herein includes written description containing clear, exact terms to enable carrying out embodiments meeting this need. Need further exists for a capability to manage or extend over time the rotational response of a bullet's mass to a pulse or abrupt increase in torque applied to an exterior surface of the bullet; the disclosure provided herein includes written description containing clear, exact terms to enable carrying out embodiments meeting this need. Need further exists for a capability to build up progressively or gradually the rotation of a bullet's mass when rifling rotates an exterior surface of the bullet abruptly or with rotational jerk or jolt; the disclosure provided herein includes written description containing clear, exact terms to enable carrying out embodiments meeting this need. Need further exists for a capability to increase linear acceleration of a bullet in a breach of a rifled barrel; the disclosure provided herein includes written description containing clear, exact terms to enable carrying out embodiments meeting this need. Need further exists for reallocating propulsive power from rotational acceleration to linear acceleration in a breach of a rifled barrel to increase linear velocity in the breach; the disclosure provided herein includes written description containing clear, exact terms to enable carrying out embodiments meeting this need. Need further exists for a capability to shorten length of a rifled barrel while sustaining muzzle velocity; the disclosure provided herein includes written description containing clear, exact terms to enable carrying out embodiments meeting this need. Need further exists for avoiding undue buildup of pressure associated with a bullet encountering barrel rifling as the bullet is propelled through the barrel; the disclosure provided herein includes written description containing clear, exact terms to enable carrying out embodiments meeting this need. Need further exists for avoiding excessive gas pressure while reducing or eliminating free travel; the disclosure provided herein includes written description containing clear, exact terms to enable carrying out embodiments meeting this need. The term "free travel," as used herein in the context of a system comprising a projectile and a gun having a rifled barrel, generally refers to the distance that the projectile needs to travel from the in-battery position to make contact with rifling of the rifled barrel. For example, with a cartridge that is chambered in a gun and that comprises a projectile seated in a case containing solid propellant, free travel refers to the distance that the projectile moves forward from its seated position in the case to contact a rifling land upon firing the gun. In this example, free travel might be changed by varying the seating depth of the projectile in the case or the dimensional configuration of the chamber. Need further exists for a capability to reduce, deaden, damp, suppress, or otherwise manage transient responses associated with firing a gun and/or a bullet interacting with barrel rifling; the disclosure provided herein includes written description containing clear, exact terms to enable carrying out embodiments meeting this need. Needs identified in this paragraph are representative rather than exhaustive and are among others satisfied by embodiments fully supported by the present written description. This paragraph further includes disclosure teaching insight, conceptions, and theories about system behavior that are believed to be new, novel, nonobvious, and unappreciated.

In some approaches to stabilizing an aeronautical system, the system may be imparted with angular momentum via spinning the entire system. This approach, however, can pose challenges when an application relies on the system maintaining a consistent rotational orientation. Interest exists in precision guided munitions in which a projectile has an internal guidance system for actively steering to a destination by manipulating fins or other control surfaces on the projectile implements course changes or course corrections. Spinning such a projectile at a rate sufficient to provide stabilizing angular momentum can pose complications for the guidance system in some situations. Additionally, spinning the projectile's exterior surface can result in challenges associated with the Magnus effect, gyroscopic drift, aerodynamic jump, and related phenomena. Accordingly, need exists for a capability to spin a component of a projectile in a manner that provides the projectile with stabilizing angular momentum while the projectile maintains an intended attitude or angular orientation or spins too slowly to implement a desired level of gyroscopic stabilization; the disclosure provided herein includes written description containing clear, exact terms to enable carrying out embodiments meeting this need.

A projectile can have a center of mass and a center of pressure. Need exists for a capability to manage or control axial distribution of mass of a projectile, for example so that the projectile's center of mass changes axially in accordance with a specification between the time of firing a round that the projectile comprises and the time of the projectile reaching a target; the disclosure provided herein includes written description containing clear, exact terms to enable carrying out embodiments meeting this need. Need further exists for a capability to manage or control axial location of center of mass of a projectile, for example so that the projectile's center of mass changes relative to a center of pressure of the projectile; the disclosure provided herein includes written description containing clear, exact terms to enable carrying out embodiments meeting this need. Need further exists for a capability to manage or control distribution or location of angular momentum production in a projectile, for example so that a source of angular momentum has different locations or shifts between the time of firing a round that the projectile comprises and the time of the projectile reaching a target; the disclosure provided herein includes written description containing clear, exact terms to enable carrying out embodiments meeting this need. Need identified in this paragraph is representative rather than exhaustive and is among others satisfied by embodiments fully supported by the present written description. This paragraph further includes disclosure teaching insight, conceptions, and theories about system behavior that are believed to be new, novel, nonobvious, and unappreciated.

A projectile of a sabot system may comprise a sabot and a sub-projectile the sabot carries. The sabot may hold the sub-projectile in a restrained position that prevents uncontrolled movement between the sabot and the sub-projectile. After launch, the sabot can release the sub-projectile to travel separately towards its destination. There is interest in railguns and related systems that may hold the sabot in a fixed angular orientation as the sabot and its sub-projectile accelerate during launch. With the sabot maintaining a fixed angular orientation and restraining the sub-projectile, the sub-projectile may lack freedom to spin in a manner that would provide adequate gyroscopic stabilization. Approaches to stabilizing the sub-projectile without rotation may entail configuring it as a dart, flechette, or arrow with extended length and fins that support stabilization. However in many situations, the extended length and fins needed for sufficient stabilization can create detrimental drag. Another application involves shooting a sabot system through a smoothbore barrel of a gun, for example a hunting shotgun or a gun of a military tank. The sabot may be situated in the smoothbore barrel in an arbitrary angular orientation with friction between the sabot and the barrel preventing controlled rotation of the sabot. Accordingly, need exists for a capability of imparting spin or angular momentum on a sub-projectile that is carried within or released from a sabot; the disclosure provided herein includes written description containing clear, exact terms to enable carrying out embodiments meeting this need. Need further exists for gyroscopically stabilizing projectiles launched from railguns and other systems that accelerate without using combustion-generated propellant gas; the disclosure provided herein includes written description containing clear, exact terms to enable carrying out embodiments meeting this need. Need further exists for spinning an element within a sabot system to provide sufficient gyroscopic stabilization without rotating the entire sabot system; the disclosure provided herein includes written description containing clear, exact terms to enable carrying out embodiments meeting this need. Need further exists for a capability to spin part of a projectile and achieve gyroscopic stabilization when an exterior surface of the projectile is constrained, for example constrained by being held in a sabot or by contact with an interior surface of a barrel having a smoothbore; the disclosure provided herein includes written description containing clear, exact terms to enable carrying out embodiments meeting this need. Need further exist for a capability to shoot from a smoothbore shotgun spin-stabilized projectiles with accuracy, precision, and/or repeatability; the disclosure provided herein includes written description containing clear, exact terms to enable carrying out embodiments meeting this need. Need further exist for a capability to alternate between shooting birdshot or buckshot and shooting sabot-carried slugs in a smoothbore shotgun without requiring a barrel change or insertion of a rifled choke; the disclosure provided herein includes written description containing clear, exact terms to enable carrying out embodiments meeting this need. Need additionally exists for a capability to transfer spin or rotational energy between or among different components of a projectile; the disclosure provided herein includes written description containing clear, exact terms to enable carrying out embodiments meeting this need. With such a capability, a spinning mass within a projectile may store rotational energy while the projectile's exterior is rotationally constrained, such as while traveling down a smoothbore barrel or while being carried within a sabot. Once the projectile exits the barrel or is released from the sabot, the rotational energy may transfer from the spinning mass to the entire projectile so that the entire projectile spins. The resulting rotation of the entire projectile can serve accuracy, precision, and/or repeatability by helping compensate for deviations in rotational symmetry of the projectile in some applications. For example, rotation can average out small trajectory deviations caused by a surface irregularity or a density variation on one side of a projectile. Needs identified in this paragraph are representative rather than exhaustive and are among others satisfied by embodiments fully supported by the present written description. This paragraph further includes disclosure teaching insight, conceptions, and theories about system behavior that are believed to be new, novel, nonobvious, and unappreciated.

The foregoing discussion of needs and problems does not disparage, disclaim, or disavow any applications or technologies or any means towards satisfying a need or solving a problem. The identified needs and problems do not constitute applicant admitted prior art.

The technology will be discussed more fully hereinafter with reference to the figures, which provide additional information regarding representative or illustrative embodiments of the disclosure. The present technology can be embodied in many different forms and should not be construed as limited to the embodiments set forth herein; rather, these embodiments are provided so that this disclosure will be thorough and complete, and will fully convey the scope of the technology to those having ordinary skill in the art. Furthermore, all "examples," "embodiments," and "exemplary embodiments" provided herein are intended to be non-limiting and among others supported by representations of the disclosure.

Those of ordinary skill in the art having benefit of this disclosure will be able, without undue experimentation, to combine compatible features that are described at various places in the written description, which includes the text of the specification, the illustrations of the figures, the claims, and the abstract. Such features can comprise physical system elements or process steps. Thus, each and every disclosed feature comprises an embodiment of the disclosure, and each and every combination of two or more such features comprises an embodiment of the disclosure provided that the features of such a combination are not mutually inconsistent. The illustrations and specification have been organized to facilitate practicing numerous combinations, such as by combining a feature of one illustrated embodiment with another feature of another illustrated embodiment or by combining a feature disclosed in an early paragraph of the specification with another feature disclosed in a later paragraph of the specification. For example, a number of bearings are illustrated and discussed as respective features of a number of projectiles, so that each of the different bearings can be practiced in each of the different projectiles; and the written description contains clear, exact terms to enable carrying out each of these combinations. Likewise, the disclosed drives (compound helical drives, gas drives, inertial drives, drives with soft starters, and other embodiments), helices (male helices, female helices, external helices, internal helices, helices with progressive helical rate, and other embodiments), retainers, keyed joints, rotors, materials, projectile configurations, and other features can be combined and can be practiced with the disclosed projectile and system embodiments, and the written description has been prepared to contain clear, exact terms to enable carrying out each such combination.

This document includes sentences, paragraphs, and passages (some of which might be viewed as lists) disclosing alternative components, elements, features, functionalities, usages, operations, steps, etc. for various embodiments of the disclosure. Unless clearly stated otherwise, all such lists, sentences, paragraphs, passages, and other text are not exhaustive, are not limiting, are provided in the context of describing representative examples and variations, and are among others supported by various embodiments of the disclosure. Accordingly, those of ordinary skill in the art having benefit of this disclosure will appreciate that the disclosure is not constrained by any such lists, examples, or alternatives. Moreover, the inclusion of lists, examples, embodiments, and the like (where provided as deemed beneficial to the reader) may help guide those of ordinary skill in practicing many more implementations and instances that embody the technology without undue experimentation, all of which are intended to be within the scope of the claims.

This disclosure includes figures and discussion in which features and elements of certain embodiments may be organized into what might be characterized as functional units, blocks, subsystems, or modules. And, certain processes and methods may be organized into blocks or into steps. Such organization is intended to serve readership and to facilitate teaching the reader about working principles of the technology and about making and using an abundance of embodiments of the disclosure. The organization is not intended to force any rigid divisions or partitions that would limit the disclosure. In practice, the flexibility of the technology and the depth of this disclosure supports dispersing or grouping functionalities, elements, and features in many different ways. The inclusion of an element or function in one block, unit, module, or subsystem verses another may be substantially arbitrary in many instances, with the divisions being soft and readily redrawn using ordinary skill in combination with this rich teaching. Accordingly, functional blocks, modules, subsystems, units, and the like can be combined, divided, repartitioned, redrawn, moved, reorganized, or otherwise altered without deviating from the scope and spirit of the disclosure. This is not to say that, nor will it support a conclusion that, any disclosed organizations and combinations are not novel, are not innovative, or are obvious.

Certain steps in the processes and methods disclosed or taught herein, may naturally need to precede others to achieve desirable functionality. However, the disclosure is not limited to the order of the described steps if such order or sequence does not adversely alter functionality to the extent of rendering technology inoperable or nonsensical. That is, it is recognized that some steps of a process or method may be performed before or after other steps or in parallel with other steps without departing from the scope and spirit of the disclosure.

In some instances, a process or method (for example of using, making, or practicing) may be discussed with reference to a particular illustrated embodiment, application, or environment. For example, a flowchart may reference or be discussed with reference to a figure. Those of skill in the art will appreciate that any such references are by example and are provided without limitation. Accordingly, the disclosed processes and methods can be practiced with other appropriate embodiments supported by the present disclosure and in other appropriate applications and environments. Moreover, one of ordinary skill in the art having benefit of this disclosure will be able to practice many variations of the disclosed and flowcharted methods and processes as may be appropriate for various applications and embodiments.

When the terms "a" or "an" are used herein, one or more is to be generally understood, except when more than one would be nonsensical in context or would adversely alter functionality to the extent of rendering technology inoperable.

The term "fasten," as used herein, generally refers to physically coupling something to something else firmly or securely. The term can thus be read with a plain and ordinary meaning.

The term "fastener," as used herein, generally refers to an apparatus or system that fastens something to something else, whether releasably, temporarily, or permanently. The term can thus be read with a plain and ordinary meaning.

The term "connector," as used herein, generally refers to an apparatus or system that connects something with something else. The term can thus be read with a plain and ordinary meaning.

The term "couple," as used herein, generally refers to joining, connecting, or associating something with something else. The term can thus be read with a plain and ordinary meaning.

The term "retainer," as used herein, generally refers to something that retains something. The term can thus be read with a plain and ordinary meaning.

The term "conditional-release retainer," as used herein generally refers to a retainer comprising a self-acting release that releases something retained in response to a predetermined condition or an event occurrence. The term can thus be read with an ordinary and customary meaning.

The term "drive," as used herein as a noun, generally refers to a system that utilizes power to achieve motion. The term can thus be read with a plain and ordinary meaning.

The term "mechanism," as used herein, generally refers to a system that uses relative motion between parts of the system to convert input force and movement into desired output force and movement. The term can thus be read with a plain and ordinary meaning.

The term "rotor," as used herein, generally refers to part of a system that rotates relative to another part of the system. The term can thus be read with a plain and ordinary meaning.

The term "helical pair," as used herein, generally refers to a pair of members that are operably coupled so that translational motion along an axis is paired with synchronous rotational motion about the axis. The term can thus be read with an ordinary and customary meaning.

The term "plunger," as used herein, generally refers a part of a system that operates with a thrusting or plunging movement. The term can thus be read with a plain and ordinary meaning.

The term "piston," as used herein, generally refers to a member that fits in an aperture and is moved along the aperture by pneumatic force. The term can thus be read with a plain and ordinary meaning.

The term "pivot," as used herein as a noun, generally refers to an axle with a tapered end that rotates or upon which something rotates while seated in a tapered recess. The term can thus be read with an ordinary and customary meaning. A pivot can comprise a nib. The term "pivot joint," as used herein, generally refers to a joint comprising the pivot and the tapered recess.

As one of ordinary skill in the art will appreciate, the term "operably coupled," as used herein, encompasses direct coupling and indirect coupling via another, intervening component, element, or module; moreover, a first component may be operably coupled to a second component when the first component comprises the second component.

As one of ordinary skill in the art will appreciate, the terms "approximate" and "approximately," as used herein, provide an industry-accepted tolerance for the corresponding term modified. Industry-accepted tolerances may range from less than one percent to three percent and correspond to, but are not limited to, component values, process variations, and manufacturing tolerance. The terms "substantial" and "substantially," as used herein, are words of degree accommodating deviations that a skilled artisan would recognize as unintentional deviation from a target value or as inconsequential. In each instance in which a number is disclosed for an embodiment, it is intended that approximately the number is disclosed for an embodiment and that substantially the number is disclosed for an embodiment. For example if the specification discloses an embodiment comprising a length of 1.0 millimeters, it will be understood that a disclosed embodiment comprises a length of approximately 1.0 millimeter and that a disclosed embodiment comprises a length of substantially 1.0 millimeter.

In each instance in which a range of numbers is disclosed for an embodiment, it is intended that approximately the range of numbers is disclosed for an embodiment and that substantially the range of numbers is disclosed for an embodiment. For example if the specification discloses an embodiment comprising a length in a range of 1.0 to 2.0 millimeters, it will be understood that a disclosed embodiment comprises a length in an approximate range of 1.0 to 2.0 millimeters. Further, in this example, a disclosed embodiment comprises a length in a range of approximately 1.0 millimeter to approximately 2.0 millimeters. Further, in this example, a disclosed embodiment comprises a length in a substantial range of 1.0 to 2.0 millimeters. Further, in this example, a disclosed embodiment comprises a length in a range of substantially 1.0 millimeter to substantially 2.0 millimeters.

As appreciated by those of skill in the art having benefit of the disclosure provided herein, unless specified otherwise, the values provided herein generally conform to commercial design practices, industry terminology, or nominal manufacturing targets. This is not to say that, nor will it support a conclusion that, any provided values or ranges or values are not novel, are not innovative, or are obvious. Moreover, certain disclosed values and ranges of values are believed novel, innovative, and nonobvious.

The term "gun," as used herein, generally refers to a device with a tube through which gas produced by combustion of chemical propellant propels one or more projectiles at a target located a distance beyond physical reach of the tube. Combustion of chemical propellant in a gun can comprise burning, oxidizing, or exploding smokeless power or another combustible solid propellant or liquid propellant to provide pneumatic force for accelerating projectiles, for example. Example targets include an inanimate object, an animate creature, an enemy combatant, a hunted animal, a hostile piece of equipment, a bullseye drawn on a piece of paper, or a clay pigeon, to mention some representative example without limitation. Firearms are a category of guns, as discussed below. A gun may be a firearm, a cannon, a tank gun, an autocannon, a rotary cannon, a heavy machine gun, an artillery piece, a field gun, a howitzer, or a machine gun mounted on a ship, airplane, drone, or armored vehicle, to mention some representative examples without limitation. For example, some example embodiments of the disclosure can comprise a projectile for a gun or a gun, including each gun example disclosed herein, without limitation. The projectile 150, the projectile 250, the projectile 350, the projectile 450, the projectile 450B, the projectile 450C, the projectile 450D, the projectile 550, the projectile 650, the projectile 750, the projectile 750B, the projectile 850, the projectile 950, the projectile 1050, the projectile 1150, the projectile 1250, the projectile 1350, the projectile 1550, the projectile 1650, the projectile 1650B, the projectile 1750, the projectile 1850, the projectile 2050, and the projectile 2350 (not an exhaustive list), for which the figures illustrate example embodiments as discussed below, can each comprise a gun projectile, including a gun projectile configured for each of the gun examples disclosed herein.

The term "smoothbore gun," as used herein, generally refers to a gun with a barrel having a bore that is smooth or that lacks rifling. Some example embodiments of the disclosure can comprise a projectile for a smoothbore gun or a smoothbore gun, including each smoothbore gun example disclosed herein, without limitation. For example, the projectile 150, the projectile 250, the projectile 350, the projectile 450, the projectile 450B, the projectile 450C, the projectile 450D, the projectile 550, the projectile 650, the projectile 750, the projectile 750B, the projectile 850, the projectile 950, the projectile 1050, the projectile 1150, the projectile 1250, the projectile 1350, the projectile 1550, the projectile 1650, the projectile 1650B, the projectile 1750, the projectile 1850, the projectile 2050, and the projectile 2350 (not an exhaustive list), for which the figures illustrate example embodiments as discussed below, can each comprise a smoothbore gun projectile, including a smoothbore gun projectile configured for each of the smoothbore gun examples disclosed herein.

The term "firearm," as used herein, generally refers to a gun designed to be readily carried and used by an individual or by a crew. A firearm may be a rifle, a shoulder-mounted gun, a long gun, a bolt-action gun, a single-shot gun, a pistol, a revolver, a muzzleloader, a musket, a shotgun, a semiautomatic shotgun, a sawed-off shotgun, a short-barreled shotgun, a shotgun having a rifled choke insert, a slug gun, a smoothbore gun, a handgun, a sidearm, a pistol, a revolver, a squad automatic weapon, a 50-caliber machine gun, an M2 machine gun, a medium machine gun, a light machine gun, a light firearm, a crew-served firearm, an assault weapon, an M16-style gun, an AR-15-style gun, a selective-fire weapon, a gun designed for carry by an infantry soldier, a designated marksman rifle, a machine gun designed for operation by a single soldier, or a machine gun operated by a crew, to mention some representative examples without limitation. A firearm may have a barrel that is rifled or a barrel that is not rifled. In various forms, a firearm may be utilized for hunting, military, personal defense, or sport shooting applications. Some example embodiments of the disclosure can comprise a projectile for a firearm or a firearm, including each firearm example disclosed herein, without limitation. For example, the projectile 150, the projectile 250, the projectile 350, the projectile 450, the projectile 450B, the projectile 450C, the projectile 450D, the projectile 550, the projectile 650, the projectile 750, the projectile 750B, the projectile 850, the projectile 950, the projectile 1050, the projectile 1150, the projectile 1250, the projectile 1350, the projectile 1550, the projectile 1650, the projectile 1650B, the projectile 1750, the projectile 1850, the projectile 2050, and the projectile 2350 (not an exhaustive list), for which the figures illustrate example embodiments as discussed below, can each comprise a firearm projectile, including a firearm projectile configured for each of the firearm examples disclosed herein.

The term "smoothbore firearm," as used herein, generally refers to a firearm with a barrel having a bore that is smooth or that lacks rifling. Some example embodiments of the disclosure can comprise a projectile for a smoothbore firearm or a smoothbore firearm, including each smoothbore firearm example disclosed herein, without limitation. For example, the projectile 150, the projectile 250, the projectile 350, the projectile 450, the projectile 450B, the projectile 450C, the projectile 450D, the projectile 550, the projectile 650, the projectile 750, the projectile 750B, the projectile 850, the projectile 950, the projectile 1050, the projectile 1150, the projectile 1250, the projectile 1350, the projectile 1550, the projectile 1650, the projectile 1650B, the projectile 1750, the projectile 1850, the projectile 2050, and the projectile 2350 (not an exhaustive list), for which the figures illustrate example embodiments as discussed below, can each comprise a smoothbore firearm projectile, including a smoothbore firearm projectile configured for each of the smoothbore firearm examples disclosed herein.

The term "light firearm," as used herein, generally refers to a firearm that is designed to be readily carried and used by an individual, such as a single infantry man. A light firearm may be an individual-service firearm that a competent individual may run at its intended capabilities. Some example embodiments of the disclosure can comprise a projectile for a light firearm or a light firearm, including each light firearm example disclosed herein, without limitation. For example, the projectile 150, the projectile 250, the projectile 350, the projectile 450, the projectile 450B, the projectile 450C, the projectile 450D, the projectile 550, the projectile 650, the projectile 750, the projectile 750B, the projectile 850, the projectile 950, the projectile 1050, the projectile 1150, the projectile 1250, the projectile 1350, the projectile 1550, the projectile 1650, the projectile 1650B, the projectile 1750, the projectile 1850, the projectile 2050, and the projectile 2350 (not an exhaustive list), for which the figures illustrate example embodiments as discussed below, can each comprise a light firearm projectile, including a light firearm projectile configured for each of the light firearm examples disclosed herein.

The term "smoothbore light firearm," as used herein, generally refers to a light firearm with a barrel having a bore that is smooth or that lacks rifling. Some example embodiments of the disclosure can comprise a projectile for a smoothbore light firearm or a smoothbore light firearm, including each smoothbore light firearm example disclosed herein, without limitation. For example, the projectile 150, the projectile 250, the projectile 350, the projectile 450, the projectile 450B, the projectile 450C, the projectile 450D, the projectile 550, the projectile 650, the projectile 750, the projectile 750B, the projectile 850, the projectile 950, the projectile 1050, the projectile 1150, the projectile 1250, the projectile 1350, the projectile 1550, the projectile 1650, the projectile 1650B, the projectile 1750, the projectile 1850, the projectile 2050, and the projectile 2350 (not an exhaustive list), for which the figures illustrate example embodiments as discussed below, can each comprise a smoothbore light firearm projectile, including a smoothbore light firearm projectile configured for each of the smoothbore light firearm projectiles examples disclosed herein.

The term "crew-served firearm," as used herein, generally refers to a firearm that is designed to be readily carried and used by a crew of two or more individuals. A competent crew may run a crew-served firearm at its intended capabilities. Some example embodiments of the disclosure can comprise a projectile for a crew-served firearm or a crew-served firearm, including each crew-served firearm example disclosed herein, without limitation. For example, the projectile 150, the projectile 250, the projectile 350, the projectile 450, the projectile 450B, the projectile 450C, the projectile 450D, the projectile 550, the projectile 650, the projectile 750, the projectile 750B, the projectile 850, the projectile 950, the projectile 1050, the projectile 1150, the projectile 1250, the projectile 1350, the projectile 1550, the projectile 1650, the projectile 1650B, the projectile 1750, the projectile 1850, the projectile 2050, and the projectile 2350 (not an exhaustive list), for which the figures illustrate example embodiments as discussed below, can each comprise a crew-served firearm projectile, including a crew-served firearm projectile configured for each of the crew-served firearm examples disclosed herein.

The term "smoothbore crew-served firearm," as used herein, generally refers to a crew-served firearm with a barrel having a bore that is smooth or that lacks rifling. Some example embodiments of the disclosure can comprise a projectile for a smoothbore crew-served firearm or a smoothbore crew-served firearm, including each smoothbore crew-served firearm example disclosed herein, without limitation. For example, the projectile 150, the projectile 250, the projectile 350, the projectile 450, the projectile 450B, the projectile 450C, the projectile 450D, the projectile 550, the projectile 650, the projectile 750, the projectile 750B, the projectile 850, the projectile 950, the projectile 1050, the projectile 1150, the projectile 1250, the projectile 1350, the projectile 1550, the projectile 1650, the projectile 1650B, the projectile 1750, the projectile 1850, the projectile 2050, and the projectile 2350 (not an exhaustive list), for which the figures illustrate example embodiments as discussed below, can each comprise a smoothbore crew-served firearm projectile, including a smoothbore crew-served firearm projectile configured for each of the smoothbore crew-served firearm examples disclosed herein.

A light-gas gun is a type of gun in which gas generated by combustion of a propellant, for instance gunpowder, drives a piston; the moving piston compresses a light, intermediate gas, such as helium or hydrogen; and the intermediate gas propels the projectile out of a barrel. Some example embodiments of the disclosure can comprise a projectile for a light-gas gun or a light-gas gun, including each light-gas gun example disclosed herein, without limitation. For example, the projectile 150, the projectile 250, the projectile 350, the projectile 450, the projectile 450B, the projectile 450C, the projectile 450D, the projectile 550, the projectile 650, the projectile 750, the projectile 750B, the projectile 850, the projectile 950, the projectile 1050, the projectile 1150, the projectile 1250, the projectile 1350, the projectile 1550, the projectile 1650, the projectile 1650B, the projectile 1750, the projectile 1850, the projectile 2050, and the projectile 2350 (not an exhaustive list), for which the figures illustrate example embodiments as discussed below, can each comprise a light-gas gun projectile, including a light-gas gun projectile configured for each of the light-gas gun examples disclosed herein.

The term "air gun," as used herein, generally refers to a device with a tube through which gas propels one or more projectiles at a target located a distance beyond physical reach of the tube, wherein the gas is mechanically pressurized without involving chemical reactions. The mechanically pressurized gas can comprise air, carbon dioxide, nitrogen, or other appropriate gas. An air gun may be a paintball gun, an air rifle, a BB gun, an airsoft gun, or a pellet gun, to mention some representative examples without limitation. Some air guns are configured as toy weapons, while others may have lethal power. Some example embodiments of the disclosure can comprise a projectile for an air gun or an air gun, including each air gun example disclosed herein, without limitation. For example, the projectile 150, the projectile 250, the projectile 350, the projectile 450, the projectile 450B, the projectile 450C, the projectile 450D, the projectile 550, the projectile 650, the projectile 750, the projectile 750B, the projectile 850, the projectile 950, the projectile 1050, the projectile 1150, the projectile 1250, the projectile 1350, the projectile 1550, the projectile 1650, the projectile 1650B, the projectile 1750, the projectile 1850, the projectile 2050, and the projectile 2350 (not an exhaustive list), for which the figures illustrate example embodiments as discussed below, can each comprise an air gun projectile, including an air gun projectile configured for each of the air gun examples disclosed herein.

The term "smoothbore air gun," as used herein, generally refers to an air gun with a barrel having a bore that is smooth or that lacks rifling. Some example embodiments of the disclosure can comprise a projectile for a smoothbore air gun or a smoothbore air gun, including each smoothbore air gun example disclosed herein, without limitation. For example, the projectile 150, the projectile 250, the projectile 350, the projectile 450, the projectile 450B, the projectile 450C, the projectile 450D, the projectile 550, the projectile 650, the projectile 750, the projectile 750B, the projectile 850, the projectile 950, the projectile 1050, the projectile 1150, the projectile 1250, the projectile 1350, the projectile 1550, the projectile 1650, the projectile 1650B, the projectile 1750, the projectile 1850, the projectile 2050, and the projectile 2350 (not an exhaustive list), for which the figures illustrate example embodiments as discussed below, can each comprise a smoothbore air gun projectile, including a smoothbore air gun projectile configured for each of the smoothbore air gun examples disclosed herein.

The term "railgun," as used herein, generally refers to a device that uses electromagnetic force to propel one or more projectiles at a target located a distance from the device. A railgun may comprise a rail or a tube along which or through which a projectile is propelled. Some example embodiments of the disclosure can comprise a projectile for a railgun or a railgun, including each railgun example disclosed herein, without limitation. For example, the projectile 150, the projectile 250, the projectile 350, the projectile 450, the projectile 450B, the projectile 450C, the projectile 450D, the projectile 550, the projectile 650, the projectile 750, the projectile 750B, the projectile 850, the projectile 950, the projectile 1050, the projectile 1150, the projectile 1250, the projectile 1350, the projectile 1550, the projectile 1650, the projectile 1650B, the projectile 1750, the projectile 1850, the projectile 2050, and the projectile 2350 (not an exhaustive list), for which the figures illustrate example embodiments as discussed below, can each comprise a railgun projectile, including a railgun projectile configured for each of the railgun examples disclosed herein.

The term "archery device," as used herein, generally refers to a device with elastic limbs that store mechanical energy for propelling an elongated projectile at a target via a string attached to the limbs, with the target located a distance beyond physical reach of the device. An archery device can be, for example, a recurve bow, a compound bow, a longbow, or a crossbow (not an exhaustive list). Some example embodiments of the disclosure can comprise a projectile for an archery device or an archery device, including each archery device example disclosed herein, without limitation. For example, the projectile 150, the projectile 250, the projectile 350, the projectile 450, the projectile 450B, the projectile 450C, the projectile 450D, the projectile 550, the projectile 650, the projectile 750, the projectile 750B, the projectile 850, the projectile 950, the projectile 1050, the projectile 1150, the projectile 1250, the projectile 1350, the projectile 1550, the projectile 1650, the projectile 1650B, the projectile 1750, the projectile 1850, the projectile 2050, and the projectile 2350 (not an exhaustive list), for which the figures illustrate example embodiments as discussed below, can each comprise an archery device projectile, including an archery device projectile configured for each of the archery device examples disclosed herein.

The term "helical rate," as used herein with reference to a helix that extends along and about an axis, generally refers to the axial length the helix takes to complete one complete revolution about the axis. For instance, a helix with a helical rate of 1:10 mm would take 10 mm of length of the axis to complete one full revolution about the axis. A helix that extends only 5 mm along the axis and that revolves only one-half of a revolution would also have a 1:10 mm helical rate. As another example, a helix with a progressive helical rate that varies smoothly between a helical rate of 1:05 mm and a helical rate of 1:15 mm could have a 1:10 mm helical rate at a single location along the axis.

As will be appreciated by one of ordinary skill in the art having benefit of the disclosure provided herein, the term "caliber," as used herein with reference to a gun, generally refers to a customary industry designation generally describing a nominal internal diameter of the bore of the gun's barrel, regardless of how or where the bore diameter is measured and whether or not the finished bore matches the nominal internal diameter. As will be appreciated by one of ordinary skill in the art having benefit of the disclosure provided herein, the term "caliber," as used herein with reference to a cartridge or a projectile, generally refers to a customary industry designation generally describing the cartridge or projectile as being designed or intended for usage in a gun of the indicated caliber. In many cases, actual physical dimensions may deviate from values implied by a caliber name. For example, Standard SAAMI Z299.4 entitled "Voluntary Industry Performance Standards for Pressure and Velocity of Centerfire Rifle Ammunition for the Use of Commercial Manufacturers" published by the Sporting Arms and Ammunition Manufacturers' Institute (SAAMI) with an approval date of Dec. 14, 2015 specifies common diameters for the calibers .308 Winchester, .30-30 Winchester, .300 Winchester Magnum, and .30-06 Springfield. SAAMI Z299.4 specifies the bullet diameters of each of these calibers as .3090 with a tolerance of −.0030 and the bore and groove diameters as .300 and .308 respectively with a tolerance of +0.002 (all in inches). As another example, a typical .50 BMG caliber bullet may have an outer diameter of approximately 0.510 inches.

"WINCHESTER" is a registered trade name of the Olin Corporation of Clayton, Missouri. "SAAMI" is a registered trade name of the Sporting Arms and Ammunition Manufacturers' Institute, Inc. of Newtown, Connecticut.

The term "fluid bearing," as used herein, generally refers to a bearing that utilizes a layer of fluid, for example pressurized gas or liquid, to provide a low-friction, load-bearing interface between two surfaces in support of relative motion between the surfaces. In accordance with some example embodiments of the disclosure, a projectile comprises a fluid bearing. For example, the projectile 150, the projectile 250, the projectile 350, the projectile 450, the projectile 450B, the projectile 450C, the projectile 450D, the projectile 550, the projectile 650, the projectile 750, the projectile 750B, the projectile 850, the projectile 950, the projectile 1050, the projectile 1150, the projectile 1250, the projectile 1350, the projectile 1550, the projectile 1650, the projectile 1650B, the projectile 1750, the projectile 1850, the projectile 2050, the projectile 2350, the projectile 2550, the projectile 2650, the projectile 2750, the projectile 2850, the projectile 2950, the projectile 2950B, the projectile 3050, and the projectile 3150, for which the figures illustrate example embodiments as discussed below, can each comprise one or more fluid bearings; further, disclosed variants of the illustrated projectiles can comprise one or more fluid bearings. In accordance with some example embodiments of the disclosure, a drive comprises a fluid bearing. Example embodiments of each of the drives disclosed herein can comprise one or more fluid bearings, including without limitation the drive 10, the drive 410, the drive 510, the drive 610, the drive 710, the drive 810, the drive 910, the drive 1010, the drive 1110, the drive 1210, the drive 1310, the drive 1410, the drive 1510, the drive 1610, the drive 1610B, the drive 1710, the drive 1810, the drive 1910, the drive 2010, the drive 2510, the drive 2610, the drive 2710, the drive 2810, the drive 2910, the drive 2910B, the drive 3010, the drive 3112, and disclosed variants thereof.

The term "gas bearing," as used herein, generally refers to a bearing that utilizes a layer of pressured gas to provide a low-friction, load-bearing interface between two surfaces in support of relative motion between the two surfaces. In accordance with some example embodiments of the disclosure, a projectile comprises a gas bearing. The projectile 150, the projectile 250, the projectile 350, the projectile 450, the projectile 450B, the projectile 450C, the projectile 450D, the projectile 550, the projectile 650, the projectile 750, the projectile 750B, the projectile 850, the projectile 950, the projectile 1050, the projectile 1150, the projectile 1250, the projectile 1350, the projectile 1550, the projectile 1650, the projectile 1650B, the projectile 1750, the projectile 1850, the projectile 2050, the projectile 2350, the projectile 2550, the projectile 2650, the projectile 2750, the projectile 2850, the projectile 2950, the projectile 2950B, the projectile 3050, and the projectile 3150, for which the figures illustrate example embodiments as discussed below, can each comprise one or more gas bearings; further, disclosed variants of the illustrated projectiles can comprise one or more gas bearings. In accordance with some example embodiments of the disclosure, a drive comprises a gas bearing. Example embodiments of each of the drives disclosed herein can comprise one or more gas bearings, including without limitation the drive 10, the drive 410, the drive 510, the drive 610, the drive 710, the drive 810, the drive 910, the drive 1010, the drive 1110, the drive 1210, the drive 1310, the drive 1410, the drive 1510, the drive 1610, the drive 1610B, the drive 1710, the drive 1810, the drive 1910, the drive 2010, the drive 2510, the drive 2610, the drive 2710, the drive 2810, the drive 2910, the drive 2910B, the drive 3010, the drive 3112, and disclosed variants thereof.

The term "aerodynamic bearing," as used herein, generally refers to a bearing that utilizes a layer of pressured gas to provide a low-friction, load-bearing interface between two surfaces, wherein relative motion between the two surfaces produces or sustains the layer of pressurized gas. The relative motion typically conveys gas into the interface and/or pressurizes gas that is disposed in the interface. In accordance with some example embodiments of the disclosure, a projectile comprises an aerodynamic bearing. The projectile 150, the projectile 250, the projectile 350, the projectile 450, the projectile 450B, the projectile 450C, the projectile 450D, the projectile 550, the projectile 650, the projectile 750, the projectile 750B, the projectile 850, the projectile 950, the projectile 1050, the projectile 1150, the projectile 1250, the projectile 1350, the projectile 1550, the projectile 1650, the projectile 1650B, the projectile 1750, the projectile 1850, the projectile 2050, the projectile 2350, the projectile 2550, the projectile 2650, the projectile 2750, the projectile 2850, the projectile 2950, the projectile 2950B, the projectile 3050, and the projectile 3150, for which the figures illustrate example embodiments as discussed below, can each comprise one or more aerodynamic bearings; further, disclosed variants of the illustrated projectiles can comprise one or more aerodynamic bearings. In accordance with some example embodiments of the disclosure, a drive comprises an aerodynamic bearing. Example embodiments of each of the drives disclosed herein can comprise one or more aerodynamic bearings, including without limitation the drive 10, the drive 410, the drive 510, the drive 610, the drive 710, the drive 810, the drive 910, the drive 1010, the drive 1110, the drive 1210, the drive 1310, the drive 1410, the drive 1510, the drive 1610, the drive 1610B, the drive 1710, the drive 1810, the drive 1910, the drive 2010, the drive 2510, the drive 2610, the drive 2710, the drive 2810, the drive 2910, the drive 2910B, the drive 3010, the drive 3112, and disclosed variants thereof.

The term "spiral groove bearing," as used herein, generally refers to a bearing that utilizes a layer of pressurized fluid to provide a low-friction, load-bearing interface between two surfaces, wherein one or both surfaces comprise grooves so that relative motion between the two surfaces produces or sustains the layer of pressurized fluid. The grooves typically extend spirally about an axis, for example an axis of rotation, and typically convey fluid into the interface and/or pressurize fluid that is disposed in the interface. In accordance with some example embodiments of the disclosure, a projectile comprises a spiral groove bearing. The projectile 150, the projectile 250, the projectile 350, the projectile 450, the projectile 450B, the projectile 450C, the projectile 450D, the projectile 550, the projectile 650, the projectile 750, the projectile 750B, the projectile 850, the projectile 950, the projectile 1050, the projectile 1150, the projectile 1250, the projectile 1350, the projectile 1550, the projectile 1650, the projectile 1650B, the projectile 1750, the projectile 1850, the projectile 2050, the projectile 2350, the projectile 2550, the projectile 2650, the projectile 2750, the projectile 2850, the projectile 2950, the projectile 2950B, and the projectile 3050 for which the figures illustrate example embodiments as discussed below, can each comprise one or more spiral groove bearings; further, disclosed variants of the illustrated projectiles can comprise one or more spiral groove bearings. In accordance with some example embodiments of the disclosure, a drive comprises a spiral groove bearing. Example embodiments of each of the drives disclosed herein can comprise one or more spiral groove bearings, including without limitation the drive 10, the drive 410, the drive 510, the drive 610, the drive 710, the drive 810, the drive 910, the drive 1010, the drive 1110, the drive 1210, the drive 1310, the drive 1410, the drive 1510, the drive 1610, the drive 1610B, the drive 1710, the drive 1810, the drive 1910, the drive 2010, the drive 2510, the drive 2610, the drive 2710, the drive 2810, the drive 2910, the drive 2910B, the drive 3010, the drive 3112, and disclosed variants thereof.

The term "aero spiral groove bearing," as used herein, generally refers to a spiral groove bearing in which the pressurized fluid comprises gas. In accordance with some example embodiments of the disclosure, a projectile comprises an aero spiral groove bearing. The projectile 150, the projectile 250, the projectile 350, the projectile 450, the projectile 450B, the projectile 450C, the projectile 450D, the projectile 550, the projectile 650, the projectile 750, the projectile 750B, the projectile 850, the projectile 950, the projectile 1050, the projectile 1150, the projectile 1250, the projectile 1350, the projectile 1550, the projectile 1650, the projectile 1650B, the projectile 1750, the projectile 1850, the projectile 2050, the projectile 2350, the projectile 2550, the projectile 2650, the projectile 2750, the projectile 2850, the projectile 2950, the projectile 2950B, the projectile 3050, and the projectile 3150, for which the figures illustrate example embodiments as discussed below, can each comprise one or more aero spiral groove bearings; further, disclosed variants of the illustrated projectiles can comprise one or more aero spiral groove bearings. In accordance with some example embodiments of the disclosure, a drive comprises an aero spiral groove bearing. Example embodiments of each of the drives disclosed herein can comprise one or more aero spiral groove bearings, including without limitation the drive 10, the drive 410, the drive 510, the drive 610, the drive 710, the drive 810, the drive 910, the drive 1010, the drive 1110, the drive 1210, the drive 1310, the drive 1410, the drive 1510, the drive 1610, the drive 1610B, the drive 1710, the drive 1810, the drive 1910, the drive 2010, the drive 2510, the drive 2610, the drive 2710, the drive 2810, the drive 2910, the drive 2910B, the drive 3010, and disclosed variants thereof.

The term "aerostatic bearing," as used herein, generally refers to a bearing that utilizes a layer of pressured gas to provide a low-friction, load-bearing interface between two surfaces in support of relative motion between the two surfaces, wherein a source of pressured gas outside the interface provides the interface with the pressurized gas. In accordance with some example embodiments of the disclosure, a projectile comprises an aerostatic bearing. The projectile 150, the projectile 250, the projectile 350, the projectile 450, the projectile 450B, the projectile 450C, the projectile 450D, the projectile 550, the projectile 650, the projectile 750, the projectile 750B, the projectile 850, the projectile 950, the projectile 1050, the projectile 1150, the projectile 1250, the projectile 1350, the projectile 1550, the projectile 1650, the projectile 1650B, the projectile 1750, the projectile 1850, the projectile 2050, the projectile 2350, the projectile 2550, the projectile 2650, the projectile 2750, the projectile 2850, the projectile 2950, the projectile 2950B, the projectile 3050, and the projectile 3150, for which the figures illustrate example embodiments as discussed below, can each comprise one or more aerostatic bearings; further, disclosed variants of the illustrated projectiles can comprise one or more aerostatic bearings. In accordance with some example embodiments of the disclosure, a drive comprises an aerostatic bearing. Example embodiments of each of the drives disclosed herein can comprise one or more aerostatic bearings, including without limitation the drive 10, the drive 410, the drive 510, the drive 610, the drive 710, the drive 810, the drive 910, the drive 1010, the drive 1110, the drive 1210, the drive 1310, the drive 1410, the drive 1510, the drive 1610, the drive 1610B, the drive 1710, the drive 1810, the drive 1910, the drive 2010, the drive 2510, the drive 2610, the drive 2710, the drive 2810, the drive 2910, the drive 2910B, the drive 3010, the drive 3112, and disclosed variants thereof.

The term "thrust bearing," as used herein, generally refers to a bearing that supports a predominantly axial load. In accordance with some example embodiments of the disclosure, a projectile comprises a thrust bearing. The projectile 150, the projectile 250, the projectile 350, the projectile 450, the projectile 450B, the projectile 450C, the projectile 450D, the projectile 550, the projectile 650, the projectile 750, the projectile 750B, the projectile 850, the projectile 950, the projectile 1050, the projectile 1150, the projectile 1250, the projectile 1350, the projectile 1550, the projectile 1650, the projectile 1650B, the projectile 1750, the projectile 1850, the projectile 2050, the projectile 2350, the projectile 2550, the projectile 2650, the projectile 2750, the projectile 2850, the projectile 2950, the projectile 2950B, the projectile 3050, and the projectile 3150, for which the figures illustrate example embodiments as discussed below, can each comprise one or more thrust bearings; further, disclosed variants of the illustrated projectiles can comprise one or more thrust bearings. In accordance with some example embodiments of the disclosure, a drive comprises a thrust bearing. Example embodiments of each of the drives disclosed herein can comprise one or more thrust bearings, including without limitation the drive 10, the drive 410, the drive 510, the drive 610, the drive 710, the drive 810, the drive 910, the drive 1010, the drive 1110, the drive 1210, the drive 1310, the drive 1410, the drive 1510, the drive 1610, the drive 1610B, the drive 1710, the drive 1810, the drive 1910, the drive 2010, the drive 2510, the drive 2610, the drive 2710, the drive 2810, the drive 2910, the drive 2910B, the drive 3010, the drive 3112, and disclosed variants thereof.

FIGS. 1-24 will be further discussed below, in turn. Those of skill in the art having the benefit of the disclosure provided herein will appreciate interchangeability of the various features and elements of the illustrated embodiments and the textually-described embodiments. While the specification includes discussion about such interchangeability with reference to certain features and elements and perhaps discussion that might be viewed as emphasizing certain substitutions, such discussion is nonlimiting. The written description intends to provide guidance of sufficient detail to recognize and enable substitutions among the disclosed embodiments and combinations of the disclosed features and elements. Feature interchangeability does not imply that exchanged features are obvious variants; moreover, any substitutability between something conventional and a disclosed feature does not mean that the feature is obvious.

Turning now to FIGS. 1A, 1B, 1C, 1D, 1E, IF, 1G, 1H, 1I, 1J, 1K, 1L, 1M, 1N, 1O, 1P, 1Q, 1R, 1S, 1T, 1U, 1V, and 1W, some example embodiments will be further discussed with reference to these figures. These figures illustrate an example system 59 for launching and gyroscopic stabilization of an example projectile 150, and some example variants thereof, according to some embodiments of the disclosure.

FIG. 1 further illustrates an example operating environment in which launching and stabilizing the projectile 150 can comprise shooting a light firearm. The written description provided herein supports other operating environments and applications for the technologies that are illustrated graphically and described textually. Elements and features of the projectile 150—such as a drive 10, one or more rotors 75, 80, features supporting multiple projectile modes, and features for retaining the rotors 75, 80 in specified positions before, during, and after launch (discussed below)—can be incorporated in diverse systems and utilized beneficially in diverse applications. The written description provided herein intends full support of utilizing the disclosed elements, features, and technologies in systems that travel through air, outer space, water, or other medium or that travel on a surface of land or water. Example embodiments of fully supported systems can be manned, remotely piloted, or autonomous. Example embodiments of fully supported systems can utilize onboard propulsion, for example rockets, torpedoes, boats, rocket sleds, drones, and wheeled vehicles. Such onboard propulsion can comprise ongoing or sustained propulsion, intermittent propulsion, or a single, initial thrush of propulsion. Example embodiments of fully supported systems can utilize propulsion provided by an offboard source, for example propulsion using a blast of air applied during launch, using expanding gas produced by combustion, using electromagnetic force, or using energy stored in an archery device. Example embodiments of fully supported systems can utilize gravity as a source of propulsion, for example a bomb dropped from an airplane, a satellite that releases something to fall from orbit towards a target, or a projectile that gains vertical speed from an accelerating force of gravity. Technologies, elements, and features of other embodiments disclosed in all the figures appended hereto and/or in all the textual description provided herein are likewise applicable to a wide range of systems and applications, including the systems and applications enumerated in the present paragraph, without limitation; and the written description supports such systems and applications fully and sufficiently so that claims can be direct thereto.

As illustrated by FIG. 1, the system 59 comprises an example gun 50 and an example cartridge 20 for the gun 50 comprising an example projectile 150. When the cartridge 20 is loaded in a chamber 99 of the gun 50 and the gun 50 is discharged, solid propellant 25 in the cartridge 20 combusts and imparts energy to the projectile 150, and the barrel 35 of the gun 50 expels the projectile 150.

Figure 1B:
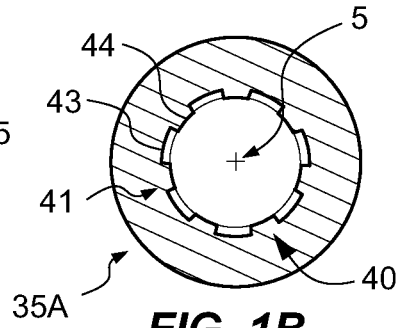
Figure 1C:
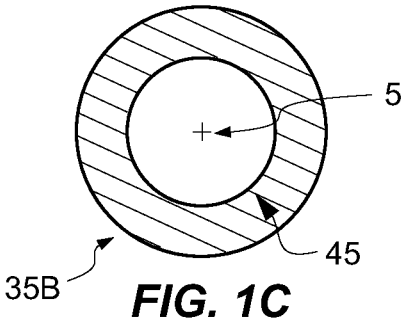

The example gun 50 that FIG. 1A illustrates comprises a firearm, which in the illustrated example comprises a light firearm that is bolt action and shoulder mounted. The illustrated gun 50 thus comprises a bolt-action, shoulder-mounted firearm. The barrel 35 of the gun 50 extends lengthwise between a breach 7 and a muzzle 6 along an axis 5 and circumscribes the axis 5. In operation, upon firing, the gun 50, launches the projectile 150 along the axis 5 and out the muzzle 6. FIGS. 1B and 1C respectively illustrate two example embodiments of the barrel 35. FIG. 1B illustrates an example embodiment in which the barrel 35A comprises a rifled bore 40, with rifling 41. The rifling 41 comprises grooves 43 and lands 44 that spiral and extend lengthwise in the barrel 35A to impart spin on the projectile 150. FIG. 1C illustrates exaggerated groove and land dimensions to facilitate the view.

In some example embodiments, the barrel 35A is fully rifled. In some example embodiments, the rifling 41 is limited to a section of the barrel 35 near the muzzle 6. For example, a shotgun 451 (FIG. 4A illustrates an example embodiment of a shotgun) may comprise a rifled tubular insert (not illustrated) that a user screws into an otherwise unrifled barrel 35 when rifling 41 is desired and removes when rifling 41 is not desired.

In some example embodiments, the gun 50 is chambered and the cartridge 20 and projectile 150 are configured to operate without free travel. In such an embodiment, when the cartridge 20 is loaded in the chamber 99, the projectile 150 contacts the lands 44 of the rifling 41 before firing the gun 50. In some example embodiments, the gun 50 is chambered and the cartridge 20 and projectile 150 are configured to operate without substantial free travel. In such an embodiment, when the cartridge 20 is loaded in the chamber 99, the projectile 150 contacts the lands 44 of the rifling 41 when the projectile 150 moves forward no more than approximately 0.002 inches or 0.051 millimeters. Example embodiments may have various other levels of free travel. In some example embodiments, free travel is at a level that the projectile 150 moves completely out of the case 21 of the cartridge before contacting the lands 44 of the rifling.

In some example embodiments, the rifling 41 is of constant twist rate. In some example embodiments, the rifling 41 progressively tightens from the breach 7 to the muzzle 6, so that barrel length for one revolution near the breach 7 is greater than barrel length for one revolution near the muzzle 6. In some example embodiments, the rifling 41 is formed to impart a clockwise spin on the projectile 150. In some example embodiments, the rifling 41 is formed to impart a counterclockwise spin on the projectile 150. In some example embodiments, the grooves 43 and lands 44 extend lengthwise without spiraling, with a result of locking the projectile's exterior to a particular rotational orientation or attitude within the barrel 35A. The grooves 43 and lands 44 can be shallow and be straight rather than spiraled in some embodiments.

FIG. 1C illustrates another example embodiment in which the barrel 35B comprises a smoothbore 45, without rifling 41 for imparting spin on the projectile 150.

In some example embodiments, the example gun 50 illustrated by FIG. 1A has a nominal caliber in the range of .17 caliber to .50 caliber (which may alternatively be written as 17 caliber to 50 caliber) and comprises a smoothbore 45 or a rifled bore 40. In some example embodiments, the example gun 50 illustrated by FIG. 1A comprises a barrel 35B that is smoothbore 45 with an internal diameter measured midway between the muzzle 6 and the breach 7 that is in a range of 0.160 inches to 0.550 inches (4.064 mm to 13.97 mm). In some example embodiments, the gun 50 of FIG. 1A comprises a rifled barrel 35A with a rifled bore 40 having an internal land-to-land diameter (i.e., distance between diametrically opposing lands 41) measured midway between the muzzle 6 and the breach 7 that is in a range of 0.160 inches to 0.550 inches (4.064 mm to 13.97 mm). The foregoing caliber and dimensional ranges represent nonlimiting examples and are among others supported by the disclosure provided herein.

As illustrated by FIG. 1A, the system 59 comprises the gun 50 in an example embodiment of a bolt-action, shoulder-mounted light firearm as discussed above. The system 59 can comprise other embodiments of a gun, a smoothbore gun, a firearm, a smoothbore firearm, a light fire arm, a smoothbore light firearm, a crew-served firearm, a smoothbore crew-served firearm, a light-gas gun, an air gun, a smoothbore air gun, a railgun, or an archery device, or each of the examples disclosed herein, without limitation.

Referring now to FIGS. 1B and 1C, in some example embodiments, a barrel 35B having a smoothbore 45 of a desired caliber may be provided by obtaining a barrel that has been prepared for forming rifling 41 of the desired caliber. For example, to provide a .308 Winchester smoothbore barrel 35B, steel rod stock may be drilled and reamed to a suitable diameter for forming rifling 41 in a subsequent stage of fabrication. However, rather than forming the rifling 41, the drilled hole can provide the smoothbore 45 (which may be lapped and/or honed as appropriate for finishing depending on the surface of the drilled and reamed hole). For example, a barrel blank that has been drilled but not yet rifled for .308 Winchester can be obtained from a commercial barrel supplier. If the barrel blank has been drilled and reamed in preparation for a rifling process that creates grooves 43 by material removal, the hole diameter may be 0.300 inches in preparation for meeting a land-to-land diameter range of 0.300-0.302 inches of a .308 Winchester SAAMI specification. If the barrel blank has been prepared for a rifling process such as hammer forging or button rifling that forms the grooves 43 by material displacement rather than material removal, the pre-rifling hole diameter may have a different dimension. Thus, in some example embodiments, the actual internal diameter of the barrel 35B of a smoothbore gun 50 that can be characterized as .308 Winchester may deviate from SAAMI diameter specifications for a rifled .308 Winchester barrel. Further, a smoothbore form of the gun 50 capable of shooting a .308 Winchester cartridge (which may or may not comply with all .308 SAAMI cartridge and bullet specifications) can be characterized as calibered in .308 Winchester whether or not its bore diameter meets all .308 Winchester SAAMI specifications.

Figure 1D:
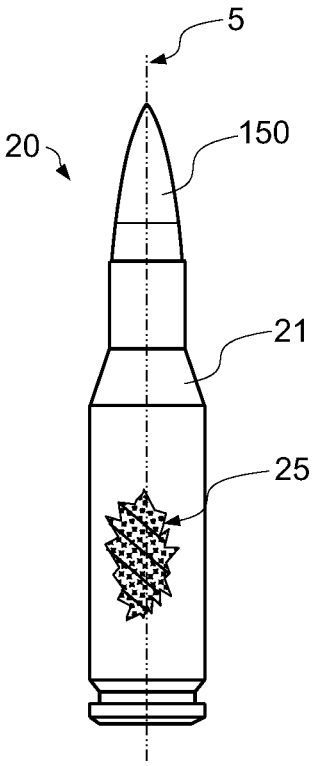
Figure 1E:
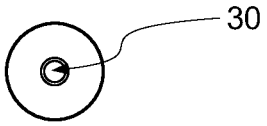

FIGS. 1D and 1E illustrate an example cartridge 20 for firing in the gun 50. As illustrated, the cartridge 20 comprises a case 21 that houses the solid propellant 25, for example smokeless gunpowder, nitrocellulose, or black powder, behind the projectile 150 and a primer 30 for initiating combustion of the propellant 25. In the illustrated embodiment, the cartridge 20, the case 21, the projectile 150, and the primer 30 are aligned with the axis 5, and each is substantially rotationally symmetrical about the axis 5. In operation, the cartridge 20 is loaded in the gun 50 so the respective axes 5 are substantially collinear or substantially coincident. When launch is initiated by pulling the trigger 11, combustion of the solid propellant 25 generates gas that expands rapidly and produces accelerating force that propels the projectile 150 down and out of the barrel 35 along the axis 5. In some example embodiments, the cartridge 20 and projectile 150 have a nominal caliber in the range of .17 caliber to .50 caliber. Representative embodiments of the system illustrated by FIG. 1 can fire rounds such as .223 Remington, 5.56×45 mm NATO, .308 Winchester, 7.62×51 mm NATO, .338 Lapua Magnum, .50 BMG, or 12.7×99 mm NATO, to mention a few examples without limitation. In some example embodiments, the projectile 150 is held in a sabot (not illustrated in FIG. 1) that is mounted, in turn, in the case 21.

"REMINGTON" is a registered trade name of RA Brands, L.L.C. of Huntsville, Alabama. "LAPUA" is a registered trade name of Nammo Lapua OY Corporation of Lapua, Finland.

Figure 1G:
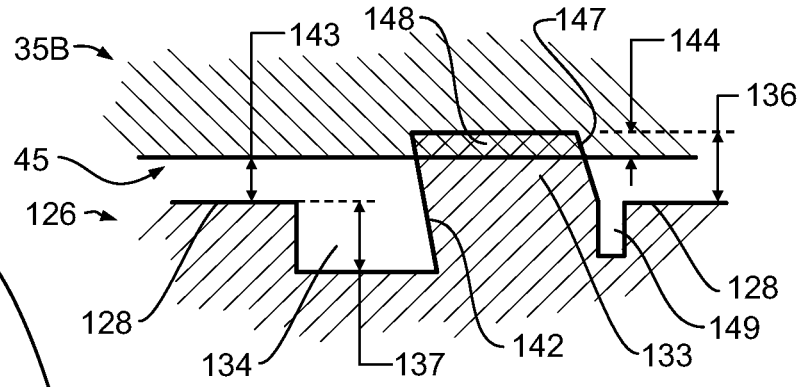
FIG. 1G is a detail cross sectional illustration of a profile of a region of the exterior of the projectile and an associated barrel region in accordance with some example embodiments.
Figure 1F:
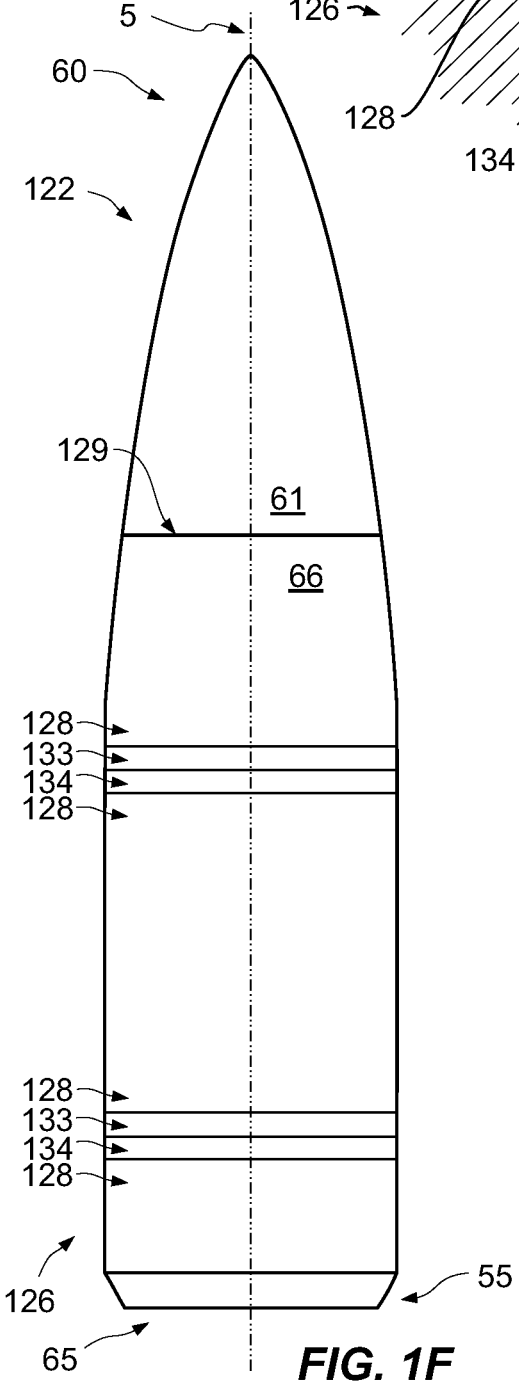
FIG. 1F is a line drawing presenting a side view of an exterior of a projectile that the cartridge comprises in accordance with some example embodiments.
Figure 1H:
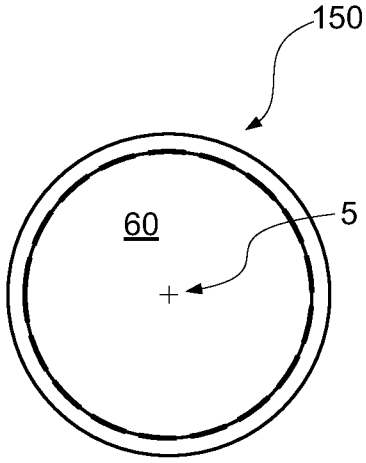
FIG. 1H is a line-drawing illustration of the exterior of the projectile with the observer forward of the projectile viewing towards a leading end of the projectile in accordance with some example embodiments.

FIGS. 1F, 1G, and 1H illustrate an example exterior of the projectile 150. FIG. 1F illustrates a side view of the projectile 150. FIG. 1G illustrates a detail cross sectional view of a side profile of the projectile 150 and an adjoining section of smoothbore 45 of the barrel 35B. FIG. 1H illustrates an end-on view of the projectile 150. The example projectile 150 comprises a leading end 60 and a trailing end 65. The leading end 60 comprises an example ogive 122, and the trailing end comprises an example boattail 55 for suppressing drag. As further discussed below, in the illustrated example, the exterior of the projectile 150 comprises a seam 129 where leading and trailing members 61, 66 of the projectile 150 join.

In the illustrated example, a region 126 extends between the ogive 122 and the boattail 55. The illustrated region 126 can be characterized as cylindrical. In some example embodiments, the region 126 comprises a bullet bearing surface. While FIGS. 1F and 1G illustrate surface features of the region 126 as discussed below, in some example embodiments, the region 126 is smooth and may, for example, engage rifling 41 in rifled-barrel applications. The projectile 150 can be dimensioned in accordance with SAAMI standards, standards of the Commission Internationale Permanente (C.I.P.), specifications or standards of the North Atlantic Treaty Organization (NATO), a military specification, or other appropriate engineering or trade specification or standard. For instance, in some example embodiments, the projectile 150 can have a diameter that is dimensioned pursuant to the SAAMI specifications for .308 Winchester.

In some example applications, the region 126 of the projectile 150 comprises a readily deformable material that is relatively soft, such as lead, copper, silver, or plastic, to facilitate swaging or sizing to a smoothbore 45 during discharge. In some embodiments, the region 126 of the projectile 150 comprises one or more areas that are composed of readily deformable material and may have a diameter that is slightly oversized relative to the diameter of the smoothbore 45. For instance, projectile diameter can be oversized in a range of 0.0003 to 0.001 inches (8-25 microns), which represents an example, nonlimiting range that is among others supported by the written description. In some example embodiments, the projectile 150 comprises a bourrelet. In some example embodiments, the projectile 150 comprises one or more cannelures.

As illustrated in FIGS. 1F and 1G and discussed below, in some example embodiments, the region 126 of the projectile 150 can comprise features useful in certain applications, for instance to facilitate swaging and sealing in smoothbore applications. In various embodiments, the illustrated features may be formed directly in the region 126 or in a cladding or jacket of readily deformable or soft material or formed using a fastening process. As illustrated, the region 126 comprises two or more projections 133 that project radially and extend circumferentially fully about the projectile 150 to circumscribe the projectile 150 and the axis 5. In the illustrated example, the projectile 150 further comprises associated channels 134 that are respectively disposed on a trailing side of each projection 133. Each channel 134 extends circumferentially fully about the projectile 150 to circumscribe the projectile 150 and the axis 5. The diameter of the projectile 150 in areas 128 of the region 126 disposed outside of the projections 133 and the channels 134 can be undersized relative to the smoothbore diameter. As illustrated in FIG. 1G, the undersizing provides an annular gap 143 between the projectile area 128 of the region 126 and the smoothbore 45 of the barrel 35B. Thus, in the illustrated example embodiment, clearance exists between the area 128 of the projectile 150 and the smoothbore 45. For instance, in some example .30 caliber embodiments of the projectile 150, the area 128 is diametrically undersized in a range of 0.001 to 0.004 inches (25 to 102 microns)—a range representing a nonlimiting example that is among others supported by the written description.

As FIG. 1G further illustrates, in some example embodiments the projections 133 project a radial distance 136 outward from the area 128 of the region 126. As illustrated, the projections 133 can be characterized as ridges on the surface of the area 128, with the ridges having a height corresponding to the radial distance 136. For instance, in some example .30 caliber embodiments of the projectile 150, the radial distance 136 is in a range of 0.0005 to 0.008 inches (13 to 203 microns)—a range representing a nonlimiting example that is among others supported by the written description. In the illustrated example embodiment, mechanical interference 148 exists between the projections 133 and the smoothbore 45. That is, with the gun 50 unloaded and the projectile 150 outside the barrel 35B, the diameter of the projectile 150 taken at one of the projections 133 exceeds the inner diameter of the smoothbore 45. In some example .30 caliber embodiments of the projectile 150, the mechanical interference 148 can have a radial dimension 144 (i.e., on one side of the axis 5) in a range of 0.0005 to 0.002 inches (13 to 51 microns)—a range representing a nonlimiting example that is among others supported by the written description.

As FIG. 1G further illustrates, in some example embodiments, the channels 134 on the trailing side of the projections 133 provide relief and a three-dimensional space or volume into which material of the projections 133 can be displaced as the projections 133 conform to the smoothbore diameter during discharge of the projectile 150. With the projections 133 being oversized relative to the diameter of the smoothbore 45 (as discussed above), when the projectile 150 is driven down the barrel 35B, the projections 133 can swage and provide a gaseous seal. The projections 133 can thus provide managed contact between the projectile 150 and the smoothbore 45 in a manner that further manages friction and overheating of the barrel 10. In some example embodiments, the channels 134 have depth 137 in a range of one-half to three times the height 136 of the projections 133-*a* range representing a nonlimiting example that is among others supported by the written description. In some example embodiments, the projections 133 and channels 134 are formed with an undercut 142 on the trailing side of the projections 133 to facilitate controlled swaging during discharge. In some example embodiments, the projections 133 are further formed with a groove 149 on the leading side that facilitates flexure of the projections 133 towards the channels 134 during discharge. In some example embodiments, each groove 149 has a width in a range of one-tenth to one-half of the width of its associated projection 133 (a range representing a nonlimiting example that is among others supported by the written description) and a depth in a range of one-tenth to one-half the height 136 of its associated projection 133 (a range that represents a nonlimiting example that is among others supported by the written description).

In some example embodiments, the leading surface 147 of each projection 133 is beveled or slanted back away from the groove 149 so as to facilitate insertion and advancement in the smoothbore 45 and overcoming of the mechanical interference 148.

In some example embodiments, the projections 133 can comprise driving bands. In some example embodiments, the projections 133 can comprise bands formed of lead, copper, silver, or plastic that are fastened to the projectile 150. Fastening of such bands may comprise shrink fitting or molding of a plastic material such as polytetrafluoroethylene (PTFE) or another fluorocarbon or swaging, mechanical forming, brazing, or welding of a metal, or another appropriate fastening technique, for example. In some example embodiments, the projections 133 and associated features discussed above are machined into the region 126, for example on a computer numerically controlled (CNC) lathe.

The region 126 can comprise copper, brass, lead, PTFE, or other appropriate machinable material, for example.

Figure 1I:
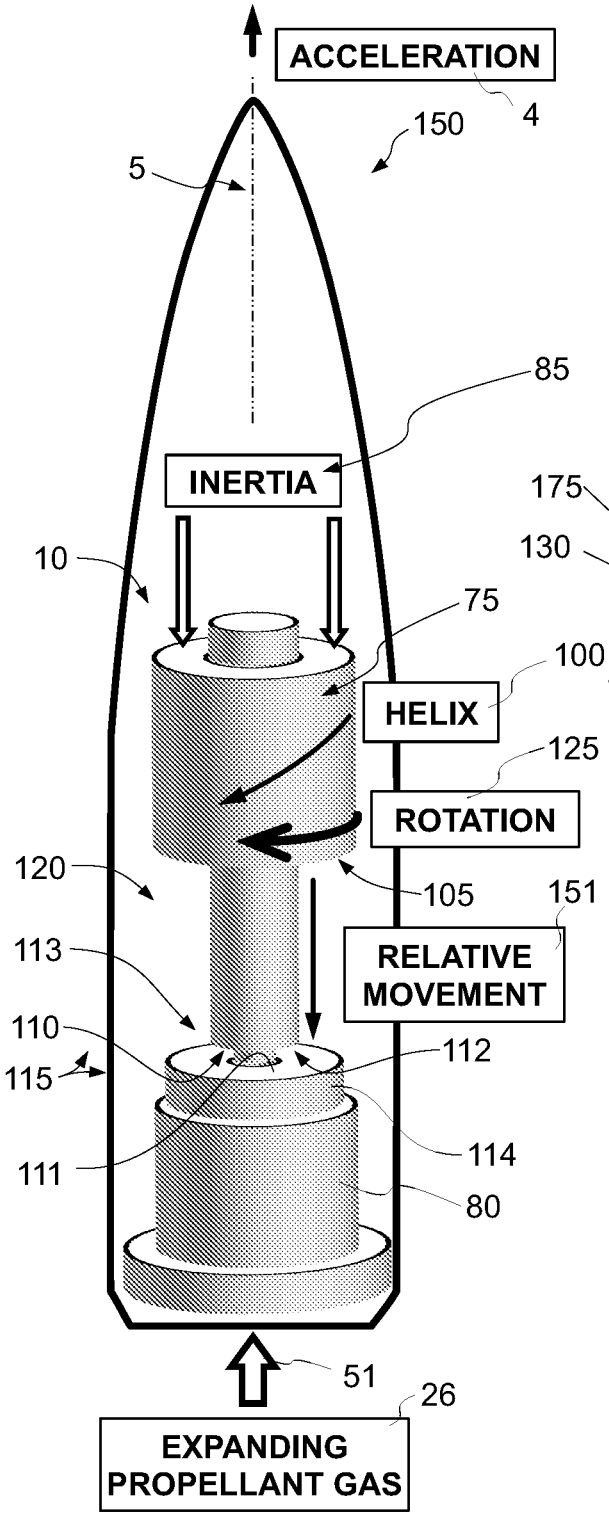
FIG. 1I is a functional schematical diagram illustrating the projectile in accordance with some example embodiments.

Turning now to FIG. 1I, this figure illustrates an example functional schematical diagram for the example projectile 150 according to some embodiments of the disclosure. FIG. 1I further illustrates an example embodiment of the drive 10 that converts linear motion into rotational motion to spin the rotor 75 for stabilizing the projectile 150. The drive 10, as discussed below, utilizes inertia to rotate the rotor 75 and comprises an example embodiment of an inertial drive. In some example embodiments, the projectile 150 utilizes energy produced by solid propellant combustion to spin the rotor 75 within the projectile 150. The projectile 150 further comprises an example embodiment of a mechanism.

Some example embodiments of the projectile 150 can comprise a gun projectile, a smoothbore gun projectile, a firearm projectile, a smoothbore firearm projectile, a light firearm projectile, a smoothbore light firearm projectile, a crew-served firearm projectile, a smoothbore crew-served firearm projectile, a light-gas gun projectile, an air gun projectile, a smoothbore air gun projectile, a railgun projectile, or an archery device projectile (not an exhaustive list).

When the gun 50 fires, the primer 30 ignites the solid propellant 25 as discussed above with reference to FIGS. 1A, 1D, and 1E. The resulting solid propellant combustion generates expanding propellant gas 26. The expanding propellant gas 26 applies propulsive force 51 to the projectile 150. The propulsive force 51 propels the projectile 150 forward along the axis 5 and accelerates the projectile 150 as the projectile 150 travels down the barrel 35. Acceleration 4 of the projectile 150 results in inertia 85 on the rotor 75. The inertia 85 results from the rotor 75 resisting acceleration 4, bearing some similarity to how airplane passengers feel pressed into their seatbacks as their airplane accelerates during takeoff. As will be appreciated by one of ordinary skill having benefit of the disclosure provided herein, the inertia 85 of the rotor 75 can be viewed as an inertial force 85 on the rotor 75 opposite the direction of the propulsive force 51 and herein will generally be referred to as such to promote teaching readers about principles of the disclosure.

The rotor 75 is mounted on a bar 120 that extends along the axis 5, with the bar 120 extending through the rotor 75. (FIG. 1I, like certain other illustrations of the figures, represents the example axis 5 with a truncated line in the interest of avoiding cluttering the view by extending the line all the way across the illustrated features.) The rotor 75 can move rearward along the bar 120. A helix 100 engages the rotor 75 with the bar 120. The inertial force 85 drives the rotor 75 rearward along the bar 120, resulting in relative movement 151 between the rotor 75 and the bar 120. As the rotor 75 moves rearward, the helix 100 produces rotation 125 of the rotor 75 about the bar 120.

In some example embodiments, the helix 100 can have a progressive helical rate. The helix 100 can thus progressively tighten, so that as the rotor 75 moves rearward while engaged with the helix 100, the helix 100 may drive the rotor 75 to rotate a progressively increasing number of degrees of rotation per millimeter of axial displacement of the rotor 75. Accordingly, with the rotor 75 moving rearward with a fixed velocity, the rotor 75 undergoes angular acceleration. In the representative situation of the rotor 75 accelerating rearward along the axis 5, the progressive helical rate produces increasing angular acceleration of the rotor 75 as the rotor 75 moves rearward. In some example embodiments, a progressive helical rate can facilitate starting rotation of the rotor 75 upon firing of the gun 50, to facilitate rotational movement from the rotor's initial, fixed position, thereby overcoming static friction between the helix 100 and the rotor 75. With a progressive helical rate softly starting rotation of the rotor 75, the helix 100 can progressively tighten to a relative high helical rate. Static friction may impose a threshold helical rate for initiating rotation of the rotor 75. With a progressive helical rate, the helix 100 can start with the helical rate below that threshold and end with a helical rate above that threshold. The drive 10 can comprise a soft starter. The soft starter can comprise a progressive helical rate that manages how the drive 10 applies torque to the rotor 75, for example to facilitate a soft start and angular acceleration following a specified plot or curve. In some example embodiments, a progressive helical rate can further facilitate release of the rotor 75 from a forward position 175 as retained by a magnet 175 (discussed below) or other retainer embodiments.

In some example embodiments, the helix 100 is configured to rotate the rotor 75 clockwise. In some example embodiments, the helix 100 is configured to rotate the rotor 75 counterclockwise. When the rotor 75 moves rearward past the helix 100, helical engagement between the rotor 75 and the bar 120 releases, and the rotor 75 spins freely about the bar 120 and continues moving rearward.

The drive 10 can have various configurations as may be useful for various applications. For example, rather than moving rearward, the rotor 75 can be mounted with a fixed axial position.

In some embodiments of the drive 10, a rotor 75 is mounted at a fixed axial disposition in helical engagement with a member; inertia moves the member axially rearward; and helical engagement between the moving member and the rotor 75 drives rotation of the rotor 75. See, for example, FIGS. 7, 8, 9, 11, 17, and 18 and FIGS. 29C and 29D. In some embodiments of the drive 10, a rotor 75 is mounted at a fixed axial disposition in engagement with a member; expanding propellant gas 26 drives the member forward; and helical engagement between the moving member and the rotor 75 drives rotation of the rotor 75. See, for example, FIGS. 10, 14, 15, and 19 and FIGS. 29A and 29B. In some example embodiments of the drive 10 expanding propellant gas 26 drives the rotor 75 forward; and helical engagement drives rotation of the forward-moving rotor. See, for example, FIGS. 16D, 16E, and 16F and FIGS. 26 and 28. Example embodiments of the drive 10 may further employ hybrid and other configurations in accordance with the disclosure provided herein.

Example embodiments of the drive 10 can be incorporated in projectiles of guns, smoothbore guns, firearms, smoothbore firearms, light firearms, smoothbore light firearms, crew-served firearms, smoothbore crew-served firearms, light-gas guns, air guns, smoothbore air guns, railguns, or archery devices, including the disclosed examples thereof (not an exhaustive list). Example embodiments of the drive 10 can further be incorporated in other aeronautical systems, including in the disclosed examples of aeronautical systems.

Referring now to FIG. 1I, a second rotor 80 is mounted at the rear of the bar 120 below a shoulder 110 that constrains the second rotor 80 from moving forward but allows rotation of the second rotor 80 about the bar 120, which comprises an axle in the illustrated embodiment. The rotor 75 comprises a receptacle 105 facing rearward, and the second rotor 80 comprises a plug 114 facing forward, with the receptacle 105 and the plug 114 comprising a connector 115. (Some example embodiments of the connector 115 will be further discussed below, including with reference to FIGS. 1J, 1K, and 1L.) When the spinning rotor 75 moves sufficiently rearward, the spinning rotor 75 encounters the second rotor 80. At the encounter, the connector 115 connects the spinning rotor 75 to the second rotor 80, and the spinning rotor 75 spins the second rotor 80. Connected together, the two rotors 75, 80 can spin in unison. Thus, the rotor 75 is spun, the spinning rotor 75 moves into position to spin the rotor 80, and the rotor 75 transfers spin to the rotor 80 so they spin as an integrated unit with unified mass. The shoulder 110 thereby restrains the integrated unit of the two rotors 75, 80 from moving forward. In example embodiments, the spin rate of the rotor 75 decreases as a result of transferring spin to the second rotor 80, so that the connected rotors 75, 80 spin as a unit more slowly than the rotor 75 spins prior to connecting to the second rotor 80. In example embodiments, angular momentum is preserved. Thus, the angular momentum of the connected rotors 75, 80 may remain substantially equal to the angular momentum of the spinning rotor 75 immediately before the connection.

In some example embodiments, beyond providing a capability for restraining forward motion of the two rotors 75, 80, a two-rotor configuration can support extending the time available for rotational acceleration. The total mass of the two rotors 75, 80 may, for example, be rotationally accelerated over an extended period of time. Extending the time for rotational acceleration can soften or smooth stress relative to an abrupt rotational acceleration associated with driving a conventional projectile into conventional rifling.

The propulsive force 51 provided by the expanding propellant gas 26 typically accelerates the projectile 150 throughout the length of the barrel 35, so there is inertial force 85 directed rearward throughout the barrel length. Once the projectile 150 exits the barrel 35 with sufficient clearance that the expanding propellant gas 26 is no longer providing acceleration 4, drag or air resistance begins decelerating the projectile 150. Thus, the projectile 150 gradually loses speed in open air. This deceleration of the projectile 150 produces inertial force on the spinning rotors 75, 80 in the forward direction, opposite the illustrated inertial force 85 that is due to the forward acceleration 4 that occurs in the barrel 35. The forward inertial force on the spinning rotors 75, 80 bears some similarity to the forward force a passenger of a car feels when the car's driver aggressively applies the car's brakes . Since the deceleration of the projectile 150 due to air resistance is typically much smaller than the acceleration 4 of the projectile 150 in the barrel 35, the forward inertial force on the rotors 75, 80 is typically much lower than the inertial force 85 directed rearward while the projectile 150 is in the barrel 35. The shoulder 110 restrains the second rotor 80 from moving forward along the bar 120, so the forward inertial force associated with projectile deceleration in open air does not move the second rotor 80 forward beyond the shoulder 110. Since the two rotors 75, 80 become mechanically connected together prior to deceleration of the projectile 150 (during acceleration 4 within the barrel 35), the shoulder 110 prevents both rotors 75, 80 from moving forward under the force of forward inertia due to air resistance. Accordingly, as the projectile 150 travels between the gun 50 and a target, the two rotors 75, 80 spin as a unit that remains displaced from the helix 100. The spinning rotors 75, 80 produce angular momentum and gyroscopically stabilize the projectile 150.

As discussed above, the forward inertial force of air-resistance-based deceleration tends to move the rotors 75, 80 forward within the projectile 150 towards the helix 100, but the shoulder 110 restrains the rotors 75, 80 and limits their forward movement. The interface 113 between the shoulder 110 and the second rotor 80 can be configured to manage interaction between the shoulder 110 and the rotors 75, 80 and to achieve effects that can be useful for some applications. A discussion of some examples of such configurations follows.

Some applications may benefit from the exterior of the projectile 150 maintaining a planned or constant attitude or rotational orientation while traveling between the gun 50 and a target. For example, if the projectile 150 comprises a smart-bullet platform with capabilities for homing in on the target, the projectile's guidance system may operate more effectively with the projectile's exterior in consistent or slowly changing rotational orientation rather than spinning rapidly. Friction between the exterior of the projectile 150 and a smoothbore 45 of a barrel 35B can impede projectile rotation within the barrel 35B, so the projectile 150 maintains a constant or planned rotational orientation during travel through the barrel 35B. To further hold the projectile 150 to a fixed rotational orientation within the barrel 35, in some embodiments, the barrel 35 can have grooves 43 and lands 44 that extend lengthwise within the barrel 35 without spiraling. In both of these barrel forms, once the projectile 150 exits the barrel 35, interaction between the barrel 35 and the projectile 150 no longer impedes rotation of the projectile 45. With the projectile 150 in open air, air resistance decelerates the projectile 150, and the spinning rotors 75, 80 move forward against the shoulder 110 as discussed above. Friction between the surface 111 of the second rotor 80 and the surface 112 of the shoulder can transfer rotation from the rotors 75, 80 through the shoulder 110 to the entire projectile 150. More friction equates to more rotation of the entire projectile 150, while less friction equates to less rotation of the entire projectile 150. Providing an interface 113 of low-friction between the shoulder 100 and the second rotor 80 can reduce the transfer of rotational energy from the spinning rotors 75, 80 through the shoulder 110 and thus can reduce or avoid rotation of the entire projectile 150. In other words, reducing friction at that interface 113 reduces torque that the spinning rotors 75, 80 apply to the shoulder 100, thereby reducing or avoiding rotation of the entire projectile 150. Reducing the transfer of rotational energy or the applied torque thereby reduces the tendency of the spinning rotors 75, 80 to produce spinning of the entire projectile 150 in open air. In addition to offering benefit in smart-bullet applications, providing gyroscopic stabilization from a spinning mass mounted internally can help avoid spin down, or a decrease in spin rate and associated decrease in angular momentum due to viscous interaction with open air. The internally spinning mass can further help avoid diminished precision associated with detrimental levels of the Magnus effect, gyroscopic drift, aerodynamic jump, and related phenomena. In some example embodiments, a bearing at the interface 113 provides low-friction to avoid or to manage applying torque or transferring rotational energy. For example, in some embodiments, the surface 111 of the rotor 75 facing the surface 112 of the shoulder 110 is patterned with features that create a gas bearing, such as an aerodynamic bearing. As further discussed below with reference to FIG. 7, inter alia, the aerodynamic bearing can comprise a spiral groove bearing or an aero spiral groove bearing. In some other example embodiments, the bearing can comprise a sintered brass bearing, a graphite bearing, a magnetic bearing, or other appropriate bearing technology.

While maintaining the projectile 150 in a steady or particular angular orientation in open air can offer advantages for certain applications, rotating the entire projectile 150 while in open air offers benefit in some other applications. For example, rotation of the entire projectile 150 can balance out asymmetries or nonuniformities in the projectile 150 that would otherwise alter the projectile's course in a manner that could reduce accuracy, precision, or repeatability. For example, suppose the projectile 150 has a localized surface imperfection on one side of the axis 5 that creates asymmetric drag having a tendency to veer the projectile 150 off course in a particular direction relative to the axis 5. In this hypothetical situation, rotating the projectile 150 about the axis 5 can produce stabilization that helps the projectile 150 remain on course to a target. For instance, further suppose the projectile's intended course is due north and that the asymmetry veers the projectile 150 a fraction of a degree to the east when the projectile 150 is in a particular rotational orientation. Once the projectile 150 revolves 180 degrees about the axis 5, the asymmetry veers the projectile 150 to the west essentially the same fraction of a degree. The west course deviation essentially cancels the east course deviation. Incremental course deviations that occur as the projectile 150 rotates 360 degrees similarly cancel one another or balance out to provide an equilibrium that helps keep the projectile 150 on its intended course. This stabilization can provide benefit even when the entire projectile 150 is rotating too slowly to generate sufficient angular momentum for gyroscopic stabilization against large perturbations or large unsettling moments. Accordingly, it can be useful to transfer a fraction of the rotors' angular momentum to the entire projectile 150 so that the entire projectile 150 rotates, albeit typically at a slower rate than the rotors 75, 80, even when angular momentum is conserved and the transfer results in little or no significant change in the total angular momentum of the entire projectile system. The interface 113 between the shoulder 110 and the rotor 80 can be configured to promote this stabilization of a projectile 150 that is not substantially rotating upon exit from the barrel 45, for example when the projectile 150 exits from a barrel 35B having a smoothbore 45. For example, in some embodiments, one or both of the surfaces 111, 112 facing one another at the interface 113 between the shoulder 110 and second rotor 80 can be roughed up or patterned to increase friction or produce engagement. The interface 113 can accordingly be configured to provide a specified level of friction so that transfer of spin from the rotors 75, 80 to the entire projectile 150 occurs gradually or progressively or in a specified manner as the projectile 150 travels from the muzzle 6 to a target. For example, the transfer can help maintain a specified spin rate of the projectile 150 by compensating for a tendency of the projectile's spin rate to decrease due to air resistance. In other words, spin can be transferred from the rotors 75, 80 to the entire projectile 150 to replenish spin of the projectile 150 lost to drag. In some example embodiments, the surfaces 111, 112 can be sanded, bead blasted, etched, or machined to create a rough finish that provides a specified level of friction. In some example embodiments, radially extending ridges or grooves (not illustrated by FIG. 1) can be machined or otherwise formed in the surfaces 111, 112 so that they engage one another and/or mesh when the rotors 75, 80 move forward under forward inertial force associated with deceleration. In example embodiments, in the process of the rotors 75, 80 producing rotation of the entire projectile 150, the rotational rate of the rotors 75, 80 can decrease, while the angular momentum of the entire projectile 150 can be substantially preserved. Thus in some example embodiments, the level of gyroscopic stabilization of the projectile 150 provided by spinning the rotors 75, 80 while the entire projectile 150 is in a constant rotational position can be substantially equal to the gyroscopic stabilization of the projectile 150 following applying rotational energy of the spinning rotors 75, 80 to spin the entire projectile 150.

As discussed above, in some example embodiments, the helix 100 is configured to impart clockwise spin, while in other example embodiments, the helix 100 is configured to impart counterclockwise spin. The projectile 150 can accordingly be imparted with clockwise or counterclockwise spin. When the projectile 150 is shot from a rifled barrel 35A, the clockwise or counterclockwise spin provided by the helix 100 can be additive to or subtractive from spin imparted by the barrel's rifling 41. Thus, the drive 10 can provide angular momentum that adds to or subtracts from the angular momentum provided by the barrel rifling 41. With the helix 100 and the rifling 41 spinning the projectile 150 in the same rotational direction, spin and angular momentum can add, and gyroscopic effect can increase. With the helix 100 and the rifling 41 spinning the projectile 150 in opposite rotational directions, spin and angular momentum can subtract, and gyroscopic effect can decrease. The spin rate of (and gyroscopic effect applied to) projectiles 150 fired through a rifled barrel 35A of a given twist rate can thus be increased or decreased to achieve a target level of composite angular momentum. Accordingly, a barrel 35A having rifling 41 of a twist rate optimized for a bullet of a particular weight and length can shoot bullets of different weights and lengths that would otherwise only perform well in a barrel 35A of a different twist rate. The projectile 150 can be imparted with a desired level of gyroscopically stabilizing spin or angular momentum when shot from a rifled barrel 35A with rifling 41 that spirals too slowly (i.e., the twist rate is too loose) for gyroscopic stabilization in a desired application. The projectile 150 can further be imparted with a desired level of gyroscopically stabilizing spin or angular momentum when shot from a rifled barrel 35A with rifling 41 that spirals too fast (i.e., the twist rate is too tight) for gyroscopic stabilization in a desired application. In some example embodiments, the projectile 150 can further be imparted with a desired level of gyroscopically stabilizing spin or angular momentum when shot from a barrel 35 having grooves 43 and lands 44 that are straight or extend lengthwise in the barrel 35 without spiraling. In some example embodiments, the projectile 150 can further be imparted with a desired level of gyroscopically stabilizing spin or angular momentum when shot from a rifled barrel 35A in which the grooves 43 and lands 44 provide insufficient grip to impart a desired amount of spin, for example by the grooves 43 having insufficient depth or by the exterior of the projectile 150 being composed of a material that is not gripped well, for instance a fluorocarbon plastic. In some example embodiments, the exterior of projectile 150 can further be formed of a low-strength material that would not otherwise withstand torque applied by the grooves 43 and lands 44 of a rifled barrel 35A, for example polytetrafluoroethylene (PTFE) or another fluorocarbon. In some example embodiments, the grooves 43 and lands 44 can sufficiently grip such a low-strength material to produce rotation of the exterior of the projectile 150 without rotational slippage or with a one-to-one correspondence between twist rate of the rifled barrel 35A and rotation of the projectile 150 along the barrel length. In some example embodiments, the projectile 150 can be imparted with a sufficient level of angular momentum to provide gyroscopic stabilization of the projectile 150 even though the grooves 43 and lands 44 insufficiently grip such a low-strength material to produce rotation of the exterior of the projectile 150 on a one-to-one correspondence with the twist rate of the rifling 41. Thus, the projectile 150 can be jacketed with a material providing desirable low-friction properties and desirable obturation properties even though the material may result in rotational slippage near the breach 7 of the barrel 35A (or throughout the barrel length).

In some example embodiments, subsonic operation is desired, for instance in some military applications in which loud noise can be detrimental. In such subsonic applications, the projectile 150 may be limited to operating at a velocity below the speed of sound in order to avoid generation of a supersonic shockwave or a miniature sonic boom. This velocity limit can represent a corresponding upper limit on kinetic energy the projectile 150 can deliver by linear velocity. The spinning rotors 75, 80 can store additional rotational kinetic energy that the projectile 150 can delivery while operating in a subsonic regime. By storing rotational kinetic energy in the spinning mass of the rotors 75, 80 within the projectile 150, some example embodiments of the projectile 150 operate at subsonic velocity while delivering the energy of a supersonic projectile having the same weight as the projectile 150.

Figure 1J:
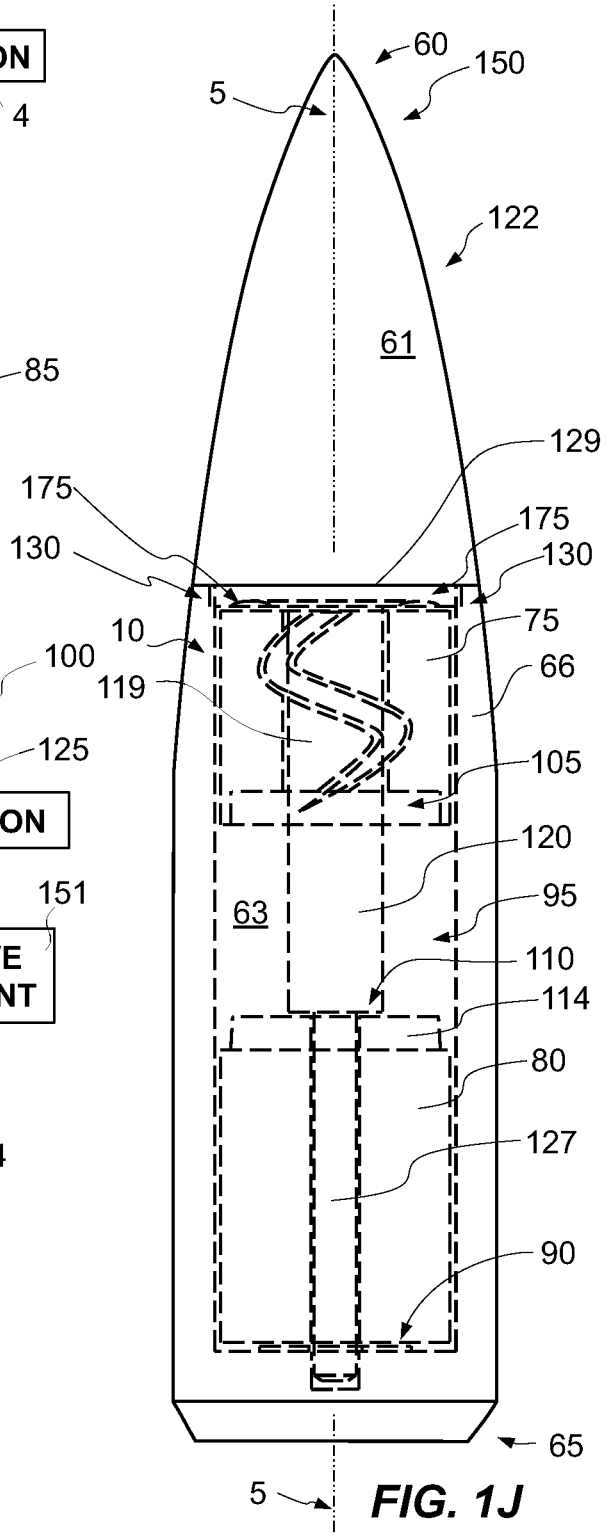
FIG. 1J is a line drawing of the projectile generally corresponding to the view of FIG. 1F with hidden internal features illustrated as hidden lines (i.e., broken or dashed lines) in accordance with some example embodiments.
Figure 1K:
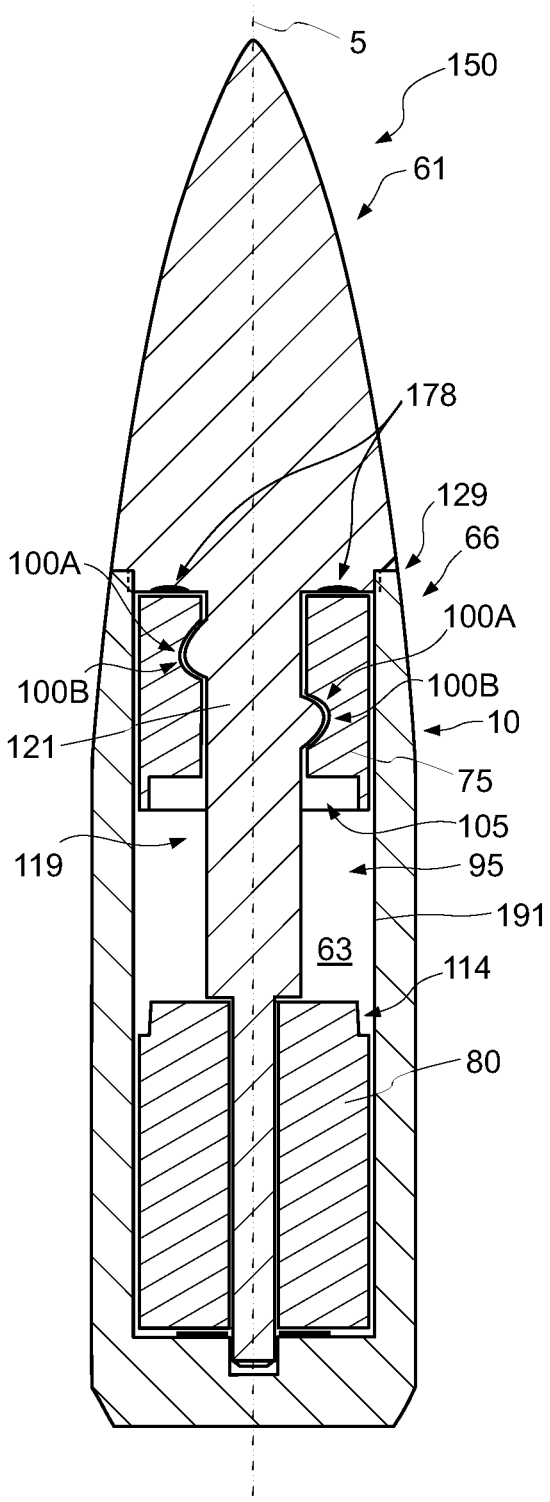
FIGS. 1K and 1L are cross sectional illustrations of the projectile with an axis of the projectile in the cutting plane of the view, respectively illustrating two modes in accordance with some example embodiments.

The example system 59 for launching and gyroscopic stabilization of a projectile 150 will now be further discussed with reference to FIGS. 1J, 1K, 1L, 1M, 1N, 1O, 1P, 1Q, and 1R that illustrate example features of an example of the projectile 150 according to some embodiments of the disclosure. FIG. 1J illustrates the projectile 150 with example internal features illustrated as hidden lines according to some embodiments. To facilitate an uncluttered view of the internal features, FIG. 1J does not show the projections 133, channels 134, and associated features depicted in FIGS. 1F and 1G as discussed above. (FIG. 1J, like certain other illustrations of the Figs., represents the example axis 5 with an interrupted line in the interest of avoiding cluttering the view by extending the line all the way across the illustration.) FIG. 1K illustrates a cross sectional view of the example projectile 150, in which the cutting plane of the view includes the axis 5 of the projectile 150 and the projectile 150 is in a first example mode according to some embodiments. FIGS. 1J and 1K illustrate the projectile 150 in the same mode. FIG. L illustrates a cross sectional view of the example projectile 150 in which the cutting plane of the view is in the same position as the cutting plane of FIG. 1K and the projectile 150 is in a second example mode according to some embodiments. In some example embodiments, the projectile 150 starts and completes a transition from the mode of FIG. K to the mode of FIG. 1 during a launch of the projectile 150, for instance while the projectile 150 is in a gun barrel. FIGS. 1M and 1N illustrate an example of the leading member 61 of the projectile 150, with FIG. 1N depicting example hidden features with hidden lines, according to some embodiments. FIGS. 1O and 1P respectively illustrate a cross sectional view and a line drawing of an example of the rotor 75 according to some embodiments. FIG. 1Q illustrates an example of the second rotor 80 according to some embodiments. FIG. 1R illustrates a perspective view of an example of a bearing 90 that the projectile 150 comprises according to some embodiments.

Figure 1L:
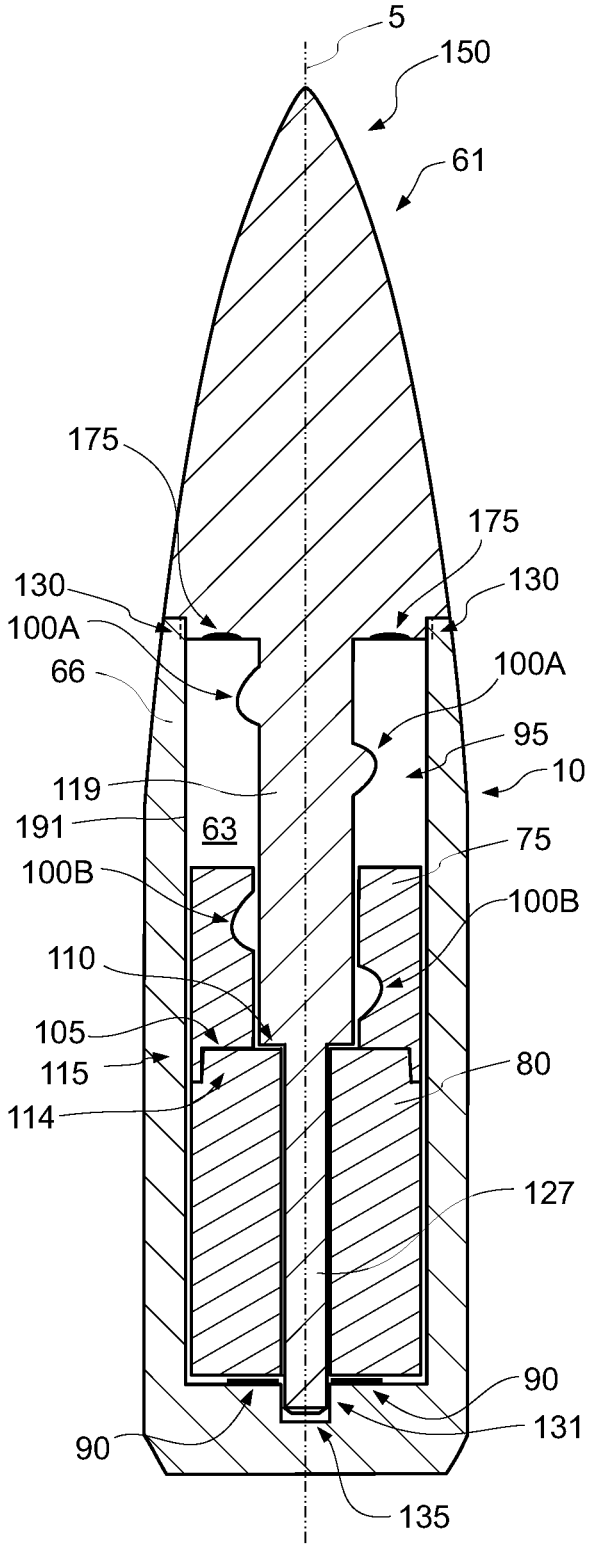
Figure 1N:
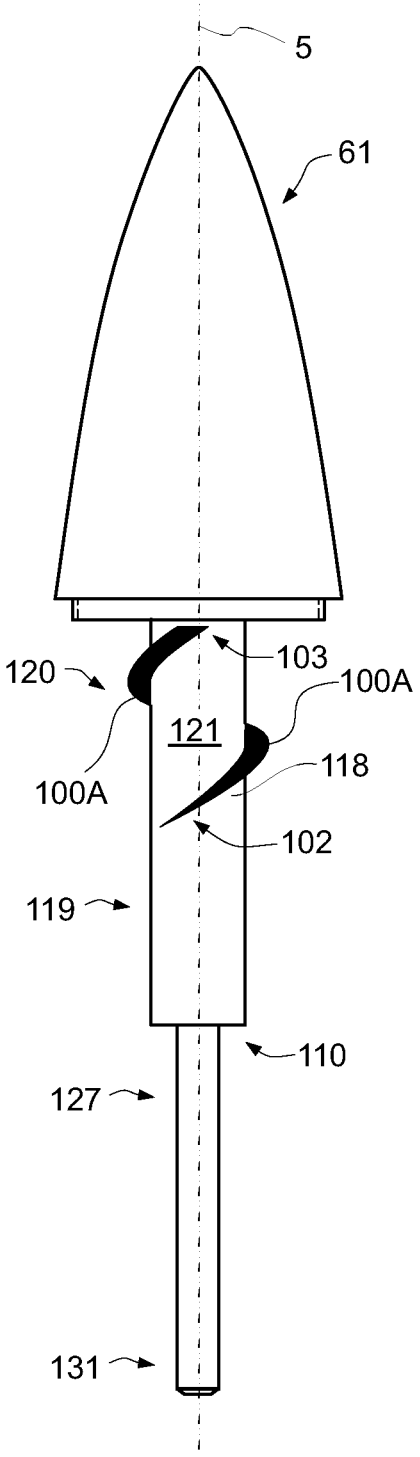
FIG. 1N is an illustration of the member that the projectile comprises, with hidden lines depicting hidden features, in accordance with some example embodiments.
Figure 1N:
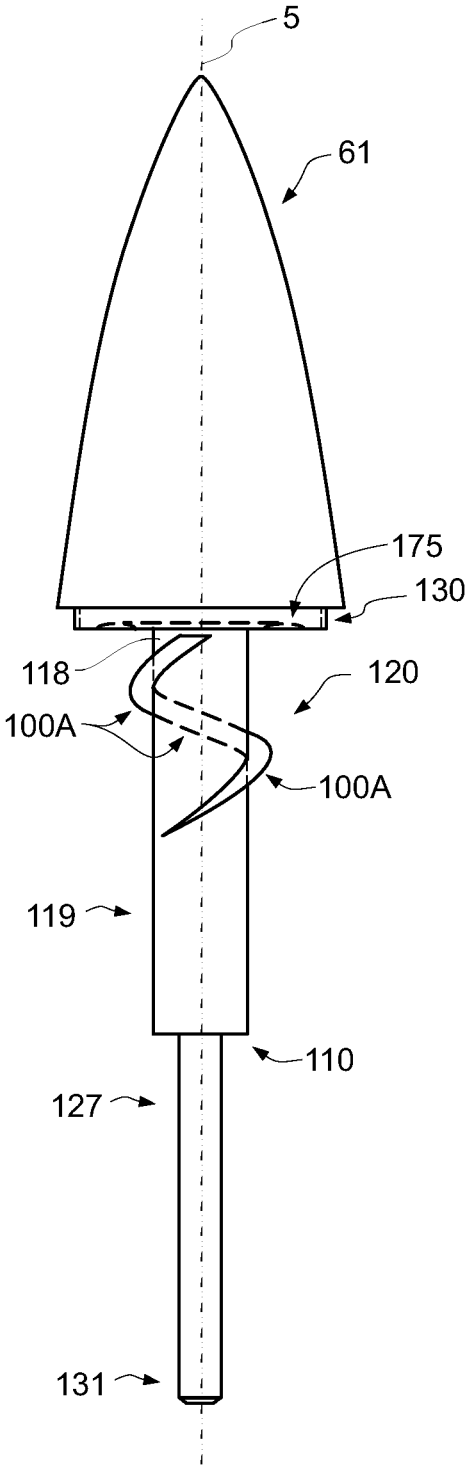
Figure 1O:
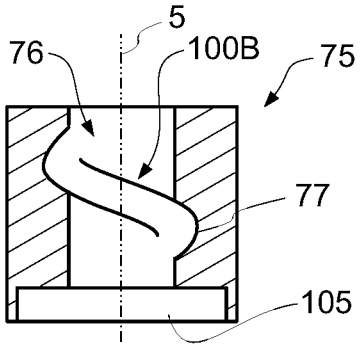
FIGS. 1O and 1P are illustrations respectively presenting a cross sectional view and a line drawing of a rotor that the projectile comprises in accordance with some example embodiments.
Figure 1P:
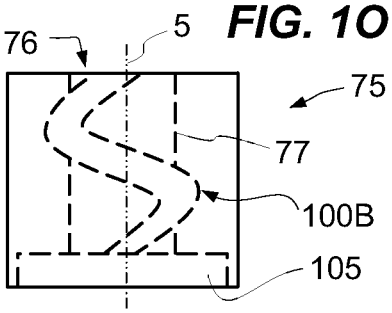
Figure 1Q:
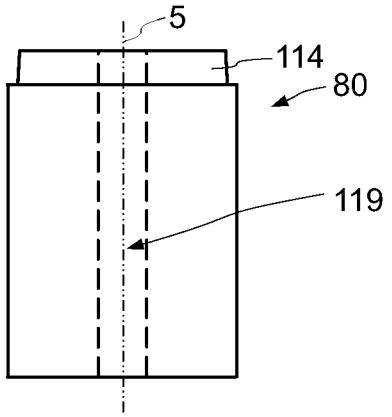
FIG. 1Q is a line drawing of a second rotor that the projectile comprises in accordance with some example embodiments.
Figure 1R:
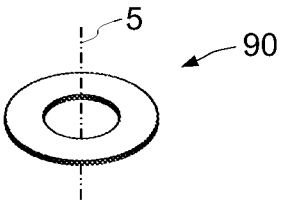
FIG. 1R is a perspective illustration of a thrust bearing that the projectile comprises in accordance with some example embodiments.

As best seen in FIGS. 1J, 1K, and 1L, in the first mode illustrated in FIGS. 1J and 1K, launch of the projectile 150 has yet to be initiated by firing the gun 50, and thus the projectile 150 has not yet started accelerating down the barrel 35. Accordingly, the rotor 75 is disposed fully forward within the projectile 150 as discussed above with reference to FIG. 1I, inter alia. The example mode of the projectile 150 as illustrated by FIG. 1K can be characterized as a pre-launch mode. In the second mode illustrated in FIG. 1L, launch has initiated and inertial force 85 associated with acceleration 4 of the projectile 150 down the barrel 34B has moved the rotor 75 rearward, and the rotor 75 has coupled to the second rotor 80 as discussed above with reference to FIG. 1I, inter alia. In some example embodiments, the projectile 150 assumes the example mode that FIG. 1L illustrated prior to the projectile 150 being expelled from the barrel 35 and remains in that mode after being expelled and while traveling in open air toward a target or other destination. Thus, the projectile 150 can be in the mode of FIG. 1L during and following launch, and the mode can be characterized as a post-launch mode.

In the illustrated example, the projectile 150 comprises a magnet 175 attached to the leading member 61 forward of the rotor 75. With the rotor 75 composed of steel or other ferromagnetic material, the magnet 175 attracts the rotor 75 and retains the rotor 75 in the forward position. The magnet 175 accordingly comprises an example embodiment of a retainer 178. As illustrated, the magnet 175 has a geometric form of a ring, which can be attached to the leading member 61 by pressing the ring into a corresponding cavity, by glue, or another appropriate attachment facility. In the illustrated embodiment, the magnet 175 is embedded in the leading member 61. In some example embodiments, the magnet 175 has a ferrite composition. In some example embodiments, the rotor 75 is composed of brass, copper, lead, or other nonferromagnetic material that is not readily attracted by the magnet 175. In such embodiments, a second magnet (not illustrated) can be attached to or embedded in the rotor 75 in a polarity orientation that provides attraction between the two magnets to retain the rotor 75 in the forward position that FIG. 1K illustrates.

In some other example embodiments, the retainer 178 can comprise an elastomeric band and/or friction (see FIG. 2A, example element 279), a shear pin (see FIG. 4K, example element 414), a pin or wire subjected to tension (see FIG. 4L, example element 414B, FIG. 4M, example element 414C, and FIG. 18A, example element 791), a serrated interface (see FIG. 5D), a spring (see FIG. 6A, example element 617), a breakable filament connection (see FIG. 7A, example element 791), a jammed-against shoulder and/or elastic deformation (see FIGS. 11A and 11B, example element 1159), a threaded connection (see FIG. 23A, example elements 2361, 2362), or other embodiment disclosed herein (not an exhaustive list).

In the illustrated example embodiment, the leading member 61 is fastened to the trailing member 66 with threads 130 at the seam 129. That is, the two members 61, 66 are threaded so they can be fastened to one another by screwing them together. In some example embodiments, a thread-locking compound is applied to the threads 130 for enhanced locking. In some example embodiments, the threads 130 are righthanded. In some example embodiments, the threads 130 are lefthanded. In some example embodiments, the handedness of the threads 130 is selected so that torque generated by operating the drive 10 and/or by the rotors 75, 80 tends to tighten the threads 130, or the generated torque is in a rotational direction that avoids loosening the threads 130.

In some example embodiments, the leading and trailing members 61, 66 are fastened to one another by press fit, brazing, soldering, welding, or other appropriate fastening process. In some example embodiments, the leading and trailing members 61, 66 are attached to one using welding, soldering, brazing, or fusing that provides a hermetic seal. With the resulting hermetically sealed enclosure, the projectile 150 can be evacuated to provide a vacuum or can have an internal pressure that is less than one atmosphere, or can be filled with a gas such as hydrogen, helium, nitrogen, or oxygen. In the illustrated embodiment, the seam 129 is disposed in the ogive 122. In some example embodiments, the leading and trailing members 61, 66 join at a location of the projectile 150 other than the ogive 122. In some example embodiments, the seam 129 and threads 130 are located at the trailing end 65 of the projectile 150.

As fastened together in the illustrated example embodiment, the leading and trailing members 61, 66 form an exterior of the projectile 150 and an enclosed interior space 63 within the projectile 150. The interior space 63 comprises a cavity 95. In some example embodiments, the cavity 95 is evacuated, with a result of avoiding air drag on the spinning rotors 75, 80 that may otherwise slow their rotational speed when the projectile 150 is traveling to a target.

Figures 16A, 16B, 16C:
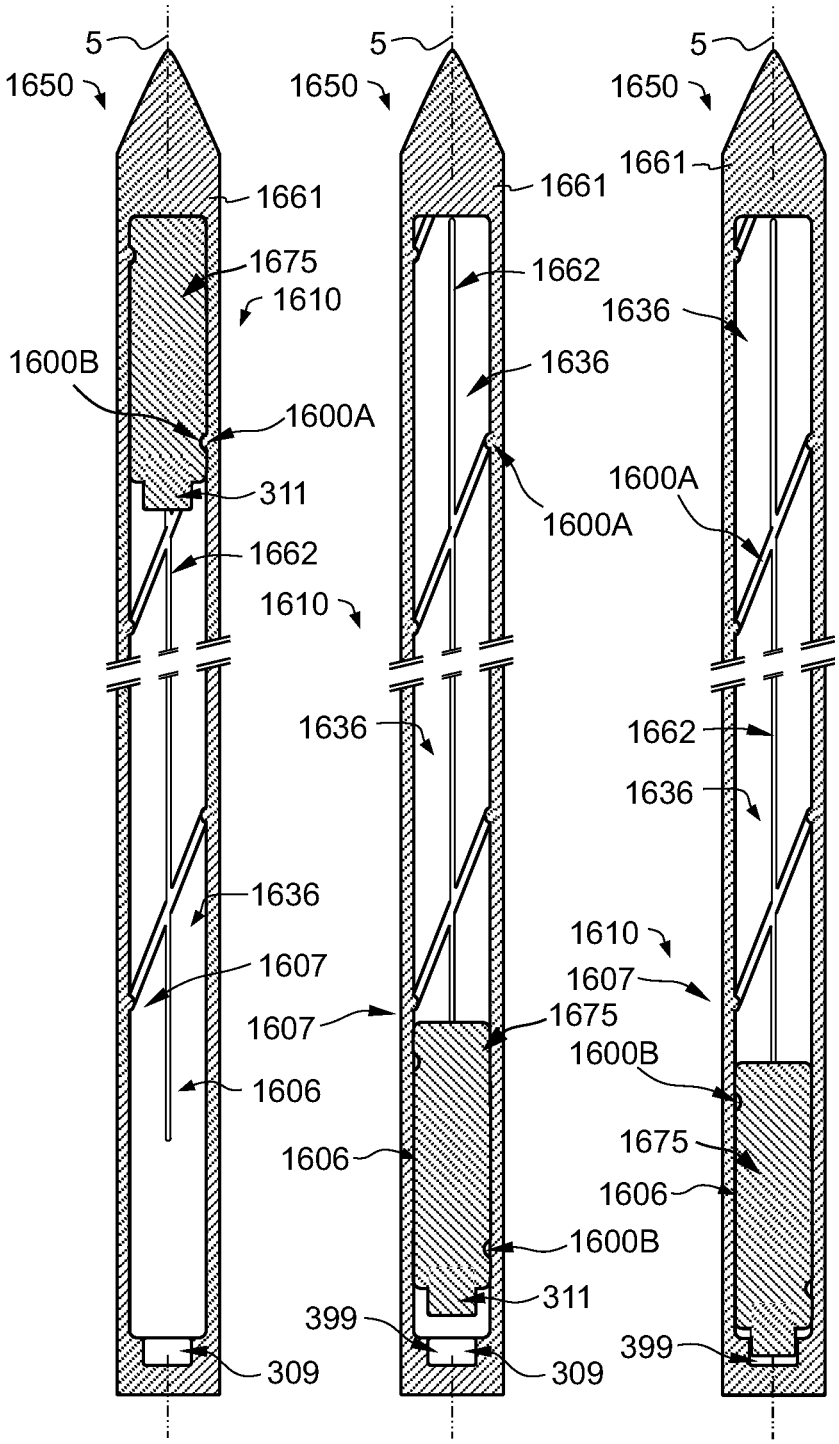
FIGS. 16A, 16B, 16C, 16D, 16E, and 16F, collectively
Figures 17A, 17B:
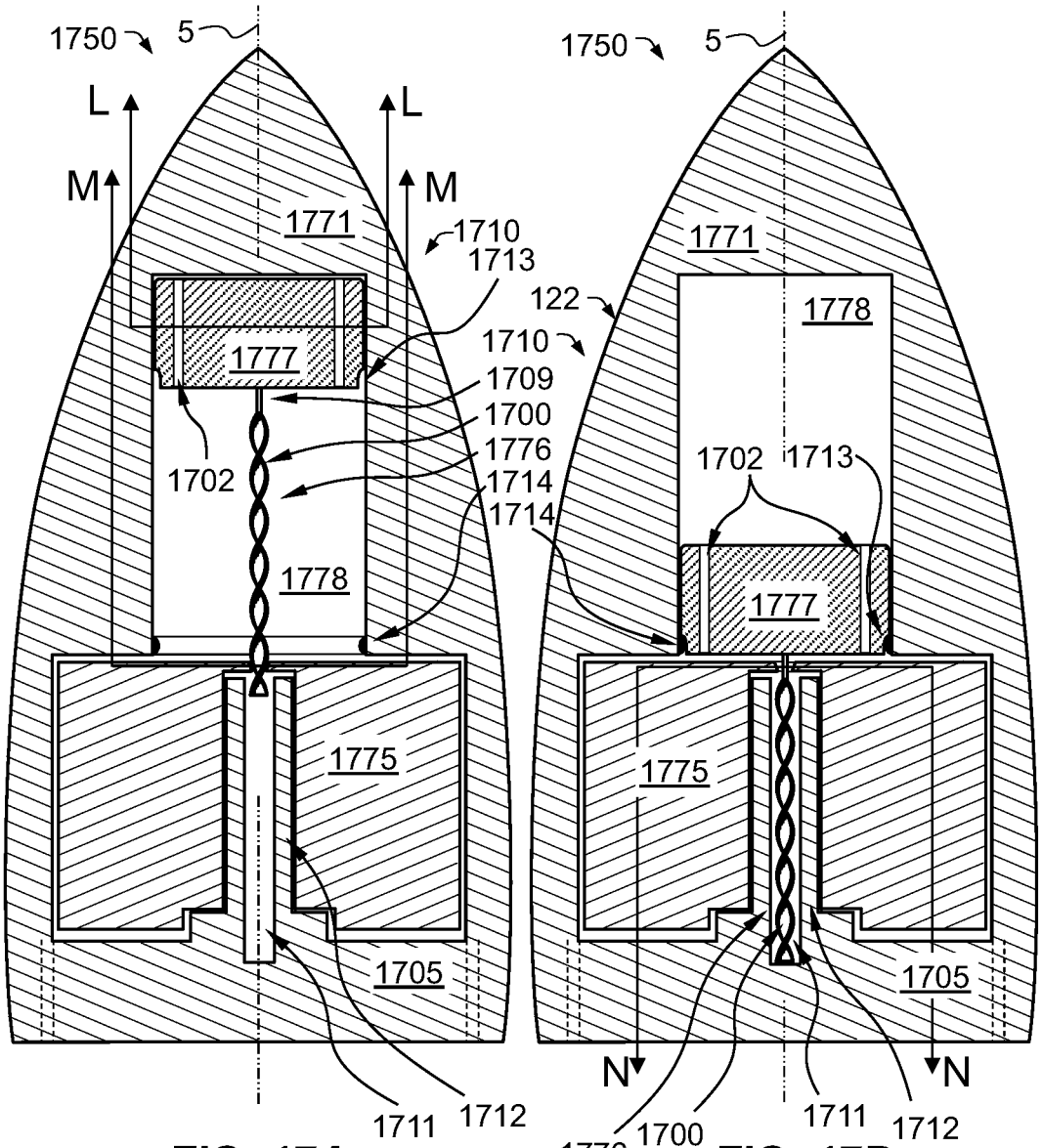
FIGS. 17A, 17B, 17C, 17D, 17E, 17F, 17G, 17H, and 17I, collectively

In embodiments in which the cavity 95 contains gas, gas circulation within the cavity 95 can be managed to avoid unduly impeding the rearward motion of the rotor 75 during rotational acceleration of the rotor 75. An annular space between the rotor 75 and the adjacent interior surface 191 of the trailing member 66 can be provided so that gas can flow lengthwise. Gas can flow through lengthwise-extending grooves formed in the interior surface 191. See, for example, the grooves 1662 in the projectile 1650 that FIGS. 16A, 16B, and 16C illustrate and the grooves 2725 in the projectile 2750 that FIG. 27 illustrates. Apertures through which gas can flow can be formed in the rotor 75. See, for example, the gas channels 1702 in the projectile 1750 that FIGS. 17A and 17B illustrate. The outer, cylindrical surface of the rotor 75 can be patterned with features that pump gas. See, for example, the discussion below directed to FIGS. 3A and 3B about patterning the rotor surface 382 of the projectile 350 with features for pumping gas through the interface 381 of that projectile 350.

As illustrated by FIGS. 1J, 1K, and 1L, the leading member 61 comprises the bar 120 that extends along the axis 5 and through the interior space 63. As illustrated, the bar 120 comprises an embodiment of a drive member. The illustrated bar 120 comprises a rear member 127 and a forward member 119 that are disposed in the interior space 63. The forward member 119 is of larger diameter than the rear member 127, with the diametrical change forming the shoulder 110. The rear end 131 of the rear member 127 is disposed in an aperture 135 at the rear of the trailing member 66. In some example embodiments, the rear end 131 and the aperture 135 are threaded (not illustrated by FIG. 1), so they screw together and the rear end 131 fastens to the aperture 135. As illustrated, the rear member 127 of the bar 120 extends coaxially through the second rotor 80 and comprises an axle about which the second rotor 80 can spin.

As shown in FIGS. 1M and 1N, the forward member 119 of the bar 120 comprises an example helix 100A that projects from and spirals about a leading portion 121 of the forward member 119. As illustrated, the example helix 100A comprises a projection on an outer surface 118 of the forward member 119 of the bar 120. The example outer surface 118 faces away from the axis 5 and can be characterized as a circumferential surface or as a cylindrical surface. As illustrated by FIG. 1L, the example helix 100A is convex in the cross section of the figure. In the illustrated example embodiment, the helix 100A comprises a leading end 103 and a trailing end 102 that is tapered to form a tail. In some example embodiments, a second helix (not illustrated) also spirals about the leading portion 121 of the forward member 119, with 180 degrees of rotational separation between the illustrated helix 100A and the second helix. In such an embodiment, like the helix 100A, the second helix has a second leading end and a second trailing end. The second leading end of the second helix is on the opposite side of the bar's forward member 119 from the illustrated leading end 103 (i.e., the illustrated leading end 103 and the second leading end are in diametric opposition). The second trailing end of the second helix is likewise diametrically opposite from the illustrated trailing end 102. Thus, some example embodiments of the bar 120 can comprise two helices that spiral synchronously about a central axis 5 in a double-start configuration. Some example embodiments of the bar 120 further can comprise three, four, or more helices that spiral synchronously in a multi-start configuration. For instance, in some example embodiments, the bar 120 can comprise multi-start helices in a range of two to twenty starts (a representative range that is not limiting and is among other ranges that the written description supports). In some example embodiments, providing the bar 120 with two or more such helices can enhance rotational symmetry of the projectile 150 and can increase mechanical load distribution by expanding the load-bearing helical surface area and the associated helical supporting structure.

In the example embodiment illustrated in FIGS. 1M and 1N, the helix 100A extends lengthwise sufficiently to complete more than a full revolution about the forward member 119 of the bar 120 of the leading member 61 of the projectile 150. In some example embodiments, the helix 100A completes a number of revolutions about the bar 120 in a range of one to ten revolutions-a range representing a nonlimiting example that is among others supported by the written description. In some other example embodiments, the helix 100A completes less than a full revolution about the forward member 119, for example in a range of one-half to nine-tenths of a rotation-a range representing a nonlimiting example that is among others supported by the written description. In some example embodiments, the helical rate of the helix 100A may be relatively loose or relatively tight, for instance as may be appropriate for various applications, calibers, materials, projectile lengths, and projectile weights.

As illustrated in FIGS. 10 and 1P, the rotor 75 comprises a helix 100B corresponding to the helix 100A. The rotor 75 further comprises an aperture 76 that extends axially through the rotor 75. Helix 100B is formed in an inner surface 77 of the aperture, with the inner surface 77 facing the axis 5. In the illustrated embodiment, the helix 100B comprises a spiral channel formed in the inner surface 77 that extends lengthwise along and circumferentially about the axis 5. As illustrated by FIG. 1L, the example helix 100B is concave in the cross section of the figure.

FIGS. 1J and 1K illustrate the bar 120 extending through the aperture 76 of the rotor 75, with the leading portion 121 of the forward member 119 of the bar 120 disposed in the aperture 76. As further discussed below, FIGS. 1J and 1K illustrate an example mode in which the two helices 100A, 100B are engaged. As illustrated, the two helices 100A, 100B comprise like helical rates and have respective geometries for engaging with one another. In the illustrated example, the helix 100A is formed on an external surface of the forward member 119 and comprises an example embodiment of an external helix. In the illustrated example, the helix 100B is formed on an internal surface of the rotor 75 and comprises an example embodiment of an internal helix. With the helices 100A, 100B engaged with one another as illustrated by FIGS. 1J and 1K, the projecting contour of helix 100A is disposed in the channel contour of helix 100B. In the illustrated example engagement, the convex form of the helix 100A extends into the concave form of the helix 100B. In the illustrated example, the helix 100A comprises an example embodiment of a male helix, and the helix 100B comprises an example embodiment of a female helix. In the illustrated example disposition of FIGS. 1J and 1K, the helices 100A, 100B can be characterized as mated with one another in a male-female configuration.

In some alternative example embodiments (not illustrated by FIG. 1), the rotor 75 comprises a convex helix that comprises a projection, and the forward member 119 of the bar 120 comprises a corresponding concave helix that comprises a channel. In such an embodiment, the rotor 75 can characterized as comprising a male helix and the bar's forward member 119 as comprising a female helix. When mated, the rotor's convex helical projection extends into the bar's concave helical channel.

In some example embodiments, the leading member's forward member 121 comprises a concave contour (not illustrated by FIGS. 1J and 1K) that extends helically about the forward member 121 adjacent the illustrated projecting contour, and the internal surface 77 of the rotor 75 comprises a projecting contour (not illustrated by FIGS. 1J and 1K) that extends helically within the rotor 75 adjacent the illustrated concave contour. With the rotor 75 and the forward member 121 so reconfigured and the projectile 150 in the mode illustrated by FIG. 1K, a projecting helical contour of the forward member 121 extends into a concave helical contour of the rotor 75, and a projecting helical contour of the rotor 75 extends into a concave helical contour of the forward member 121. In such an embodiment, the rotor 75 can be characterized as comprising a male helix and a female helix, and the forward member 121 can be characterized as comprising a male helix and a female helix.

As discussed above, in the example that FIG. 1 illustrates, the magnet 175 comprises a retainer 178 that retains the helix 100A and the rotor 100B in the configuration of FIGS. 1J and 1K. When the gun 50 fires, acceleration 4 of the projectile 150 produces inertial force 85 on the rotor 75 that overcomes the magnetic attraction provided by the magnet 175. The retainer 178 thus releases on the condition that the inertial force 85 overcomes the magnetic force. The retainer 178 comprises an example embodiment of a conditional-release retainer. With the rotor 75 released from the magnet 175, the inertial force 85 drives the rotor 75 linearly rearward along a path of the axis 5, and the helices 100A, 100B convert the linear movement into rotation of the rotor 75 about the axis 5. The leading member 61, which comprises the bar 120 and the bar's helix 100A, and the trailing member 66 are fastened together as discussed above to form a unit. The rotor 75 and that unit comprise an example embodiment of a helical pair. With the inertial force 85 accelerating the rotor 75 rearward, engagement of the helices 100A, 100B accelerates rotation of the rotor 75 until the rotor 75 moves past the leading portion 121 of the forward member 119 where the helix 100A is located. Once the rotor 75 moves rearward past the trailing end 102 of the helix 100A, the helical engagement releases, and the rotor 75 spins freely about the forward member 119 of the bar 120, which functions as an axle (and comprises an axle) in the illustrated embodiment. The inertial force 85 continues driving the spinning rotor 75 rearward towards the second rotor 80.

With the helices 100A, 100B disengaged and the spinning rotor 75 moved rearward, the plug 114 of the second rotor 80 inserts into the receptacle 105 of the rotor 75. As illustrated in FIG. 1Q, in an example embodiment, the plug 114 comprises a tapered end of the second rotor 80. As illustrated in FIGS. 1L and 1O, the receptacle 105 of the rotor 75 comprises an aperture that is sized to receive and mate with the plug 114 and that can be tapered in correspondence with the plug 114. The inertial force 85 wedges the plug 114 and the receptacle 105 together causing the spinning rotor 75 and the second rotor 80 to bind to one another. The spinning rotor 75 drives rotation of the second rotor 80 as discussed above with reference to FIG. 1I, inter alia. The male plug 114 and female receptacle 105 thus comprise the connector 115 which connects as a machine taper that transfers torque from the rotor 75 to the second rotor 80. With the rotor 75 and the second rotor 80 fastened together by the connector 115, the shoulder 110 retains and restrains both rotors 75, 80 from moving forward during deceleration due to air resistance. In the illustrated embodiment, the connector 115 and shoulder 110 comprise a retainer. In some other example embodiments, the retainer can comprise a clip (see FIG. 2C, example element 291), a magnet (see FIG. 3B, example element 379 and FIG. 4F, example element 479), suction (see FIG. 3B, example element 399 and FIG. 16C, example element 399), an interface (see FIG. 5B, example element 591), a spring (see FIG. 6B, example element 617), a wedge (see FIG. 7B, example element 799, FIG. 8B, example element 899, and FIG. 19B, example element 1502), a plug-and-socket connection (see FIG. 15B, example elements 1501 and 1502, and FIG. 18B, example elements 1501, 1502), an interfering ring or stop (see FIG. 17B, example element 1714), or other embodiment disclosed herein (not an exhaustive list).

In some example embodiments, the projectile 150 comprises a .30 caliber projectile and the rotors 75, 80 have a combined mass in a range of 25 to 150 grains or 1.6 to 9.7 grams (a representative range that is nonlimiting and is among others supported by the written description). In some such example .30 caliber embodiments, the projectile 150 accelerates in the barrel 35 from rest to a velocity in a range of 2,500 to 6,000 feet per second or 762 to 1828 meters per second (a representative range that is nonlimiting and is among others supported by the written description). With a barrel length on the order of 26 inches or .7 meters, the rotors 75, 80 can experience an inertial force 85 in excess of 1,000 newtons. In some example .30 caliber embodiments, the projectile 150 accelerates in the barrel 35 from rest to a subsonic velocity in a range of 850 to 1120 feet per second or 259 to 341 meters per second.

As illustrated in FIGS. 1L and 1R, an example bearing 90 supports rotation of the joined rotors 75, 80 under the axial load, which can exceed 1,000 newtons in some example embodiments as discussed above. In the illustrated example, the bearing 90 has an axis 5 that is substantially collinear or substantially coincident with the axes of the projectile 150, the leading member 61, the trailing member 66, the magnet 175, the rotor 75, and the second rotor 80, and those axes are substantially collinear or substantially coincident with one another. The illustrated example bearing 90 comprises a rotary bearing and more particularly a thrust bearing that supports the axial load or thrust load of the inertial force 85 during acceleration 4.

In some example embodiments and as illustrated in FIG. 1R, the bearing 90 comprises a thrust washer that may be formed of bearing bronze, sintered bronze impregnated with graphite or oil, porous iron or copper or other appropriate metal in which interconnecting pores are filled with a lubricant, copper or bronze with plugs of graphite, or a matrix of PTFE and a metal such as copper, brass, or bonze (some representative examples, not an exhaustive list). In some example embodiments, in place of the bearing 90 that FIG. 1R illustrates, the projectile 150 comprises a gas bearing, for example an aerodynamic thrust bearing, which can comprise a spiral groove bearing or an aero spiral groove bearing, (see FIG. 7 and accompanying discussing below for some example embodiments of aero spiral groove bearings). Some example embodiments further comprise another thrust bearing (not illustrated) disposed between the shoulder 110 and the second rotor 80 for supporting forward axial load associated with forward inertial force caused by deceleration of the projectile 150. Such a thrust bearing can comprise an aerodynamic bearing, a thrust washer, or other appropriate bearing.

Some example embodiments of the projectile 150 can incorporate bearings disposed at adjoining surfaces subject to relative movement and load. Bearings can, for example, be disposed where contact between the rotors 75, 80 and other portions of the projectile 150 occurs or could occur without bearings. The written description, including the figures and accompanying textual discussion, describes suitable bearing embodiments in detail with accompanying detailed teaching for implementation and practice. In some example embodiments, such bearings can comprise one or more aero spiral groove bearings that may, in some embodiments, be supported by one or more associated gas channels and/or one or more associated cavities from which gas may be drawn. In some example embodiments, such bearings can comprise one or more aerostatic bearings. In some example embodiments, the aerostatic bearings comprise one or more channels that direct expanding propellant gas 26 between the adjoining surfaces to provide a layer of pressured gas that provides a low-friction, load-bearing interface.

As discussed herein with reference to FIGS. 1D and 1E, inter alia, in some example embodiments, a cartridge 20 can comprise the projectile 150. In some such example embodiments, the projectile can comprise a .308/.300 caliber bullet mounted to the case 21 containing the solid propellant 25 to form the cartridge 20. For instance, in some example embodiments, the cartridge 20 can comprise a caliber of .308 Winchester, .30-30 Winchester, .300 Winchester Magnum (sometimes referred to as .300 Win Mag or 300WM), .30-06 Springfield, .300 Remington Ultra Magnum (sometimes referred to as .300 Ultra Mag, 7.62×72 mm, or .300 RUM), 300 AAC Blackout (a subsonic round sometimes referred to as 300 BLK and as 7.62×35 mm), .300 Whisper (a subsonic round), .30 Carbine, .30 Nosler, .308 Norma Magnum, .300 Norma Magnum, or .30-387 Weatherby Magnum (some representative examples that do not constitute an exhaustive list). In such embodiments, the projectile 150 and the cartridge 20 can be characterized as .30 caliber.

"BLACKOUT" and "AAC" are registered trade names of RA Brands, L.L.C. of Winston-Salem, North Carolina. "WHISPER" is a registered trade name of SSK Industries of Wintersville, Ohio. "WEATHERBY" is a registered trade name of Weatherby, Inc. of Sheridan, Wyoming. "NOSLER" is a registered trade name of Nosler, Inc. of Bend, Oregon. "NORMA" is a registered trade name of Norma Precision Aktiebolag Corporation of Amotfors, Sweden.

Powder charges for the .30 caliber cartridges 20 can vary according to application. In some example embodiments, the .30 caliber cartridges 20 can comprise powder charges in a range of 5 to 120 grains (a representative range that is nonlimiting and is among others supported by the written description). In some embodiments, a lower portion of this range, for instance a subrange of 5 to 20 grains, can be applicable to some subsonic rounds, such as 300 AAC Blackout, for example. In some embodiments, a middle portion of this range, for instance a subrange of 30 to 50 grains, can be applicable to some medium-power rounds, such as .308 Winchester, for example. An upper portion of this range, for instance a subrange of 75 to 120 grains, can be applicable to some high-power rounds, such as .30-387 Weatherby Magnum, for example. Each of the subranges disclosed in this paragraph is nonlimiting and is among others supported by the written description.

Example embodiments of the .30 caliber projectile can have material compositions that vary according to application. In some example embodiments, the leading member 61 and the rotors 75, 80 are composed of carbon steel and the trailing member 66 is composed of copper or a copper alloy, such as a gilding copper that can comprise approximately 90 percent elemental copper and approximately 10 percent zinc. In some example embodiments, the leading member 61 and the rotors 75, 80 are composed of carbon steel and the trailing member 66 is composed of carbon steel with a jacket comprising copper, gilding copper, or a copper alloy. In some example embodiments, the leading member 61 is composed of carbon steel, the trailing member 66 is composed of carbon steel with a jacket comprising copper, gilding copper, or a copper alloy and the rotors 75, 80 are composed of bearing bronze, sintered bronze, or porous iron or copper in which interconnecting pores are filled with a lubricant such as graphite, oil, or powdered PTFE; for example the rotors 75, 80 can be formed of Oilite material, Olite Plus material, or Super Olite material. "OILITE" is a registered trade name of Beemer Precision, Incorporated of Washington, Pennsylvania. In some example embodiments, the leading member 61 is composed of carbon steel, the trailing member 66 is composed of carbon steel with a jacket comprising copper, gilding copper, or a copper alloy, and the rotors 75, 80 are composed of tungsten, tungsten alloy, or tungsten carbide or are composed of depleted uranium. In some example embodiments, the leading member 61, the rotors 75, 80, and the trailing member 66 comprise copper, gilding copper, or a copper alloy. In some example embodiments, the leading member 61, the rotors 75, 80, and the trailing member 66 comprise brass. In some example embodiments, the leading member 61, the rotors 75, 80, and the trailing member 66 comprise bronze. In some example embodiments, the leading member 61, the rotors 75, 80, and the trailing member 66 comprise iron, iron alloy, steel, or carbon steel. In some example embodiments, the leading member 61, the rotors 75, 80, and the trailing member 66 comprise tungsten, tungsten alloy, or tungsten carbide. In some example embodiments, the leading member 61, the rotors 75, 80, and the trailing member 66 comprise depleted uranium. In some example embodiments, the leading member 61, the rotors 75, 80, and the trailing member 66 have compositions that comprise lead, lead-antimony alloy, or another appropriate lead alloy. As discussed herein with reference to FIGS. 1F and 1G, inter alia, in some embodiments, the trailing member 66 comprises an exterior surface comprising plastic, PTFE, or fluoropolymer material with surface features that promote sealing and reduced friction. As discussed herein with reference to FIGS. 1F and 1G, inter alia, in some embodiments, the trailing member 66 comprises an exterior surface comprising a metallic material that is relatively soft, relatively ductile, and/or relatively malleable, for example copper, gilding copper, copper alloy, lead, or gold.

In some example embodiments, the .30 caliber projectile is fabricated using automated or semi-automated machining processes, for instance on a CNC lathe or machining center. In some example embodiments, the .30 caliber projectile is fabricated by three-dimensional (3-D) printing. In some example embodiments, the .30 caliber projectile is fabricated using manual machining processes or metal working.

Components of the .30 caliber projectile 150 can be assembled using automated assembly, robotics, or manually, for example.

Weight of the .30 caliber projectile can vary according to application. In some example embodiments, the .30 caliber projectile 150 has a weight in the range of 70 to 275 grains (a representative range that is nonlimiting and is among others supported by the written description). In some example embodiments, the rotors 75, 80 of the .30 caliber projectile have a combined weight in the range of 20 to 95 percent of the total projectile weight (a representative range that is nonlimiting and is among others supported by the written description). In some example embodiments, the rotor 75 represents a fraction in the range of 20 to 75 percent of the combined weight of the rotor 75 and the rotor 80 (a representative range that is nonlimiting and is among others supported by the written description).

Length of the .30 caliber projectile can vary according to application. In some example embodiments, the .30 caliber projectile 150 has a length in the range of 15 to 40 mm (a representative range that is nonlimiting and is among others supported by the written description).

Helical geometry of the drive 10 of the .30 caliber projectile 150 can vary according to application. In some example embodiments, the helices 100A, 100B of the projectile 150 can have forms consistent with or can comprise a ball screw, a helical raceway in which ball bearings are disposed, acme threads, centralizing acme threads, general-purpose acme threads, stub acme threads, worm threads, square threads, knuckle threads, buttress threads, ball full radius threads, ball offset radii threads, trapezoidal threads, ASME Type U drive screw threads, screw nails, screw-shank nails, spiral-shank nails, or fluted-shank nails (some representative examples that do not constitute an exhaustive list). In some example embodiments, the helices 100A, 100B can be formed in accordance with the helical forms illustrated in the Figs. appended hereto and the accompanying written disclosure of the specification. For instance, in some example embodiments, the helices 100A, 100B can have helical forms in accordance with the illustrations of FIGS. 1J, 1K, 1L, 1M, 1N, 1O, and 1P, and the textual description of the specification. For instance, in some example embodiments, the helices 100A, 100B can have helical forms in accordance with the illustrations of FIGS. 4E, 4F, 4G, 4H, 4I, and 4J and the textual description of the specification. For instance, in some example embodiments, the helices 100A, 100B can have helical forms in accordance with the illustrations of FIGS. 5A and 5B and the textual description of the specification. For instance, in some example embodiments, the helices 100A, 100B can have helical forms in accordance with the illustrations of FIGS. 6A and 6B and the textual description of the specification. For instance, in some example embodiments, the helices 100A, 100B can have helical forms in accordance with the illustrations of FIGS. 7A and 7B and the textual description of the specification. For instance, in some example embodiments, the helices 100A, 100B can have helical forms in accordance with the illustrations of FIGS. 8A and 8B and the textual description of the specification. For instance, in some example embodiments, the helices 100A, 100B can have helical forms in accordance with the illustrations of FIGS. 9A and 9B and the textual description of the specification. For instance, in some example embodiments, the helices 100A, 100B can have helical forms in accordance with the illustrations of FIGS. 10A and 10B and the textual description of the specification. For instance, in some example embodiments, the helices 100A, 100B can have helical forms in accordance with the illustrations of FIGS. 11A, 11B, 11C, 11D, and 11G and the textual description of the specification. For instance, in some example embodiments, the helices 100A, 100B can have helical forms in accordance with the illustrations of FIGS. 12A, 12B, 12C, 12D, and 12E and the textual description of the specification. For instance, in some example embodiments, the helices 100A, 100B can have helical forms in accordance with the illustrations of FIGS. 16A, 16B, and 16C and the textual description of the specification. For instance, in some example embodiments, the helices 100A, 100B can have helical forms in accordance with the illustrations of FIGS. 16D, 16E, and 16F and the textual description of the specification. For instance, in some example embodiments, the helices 100A, 100B can have helical forms in accordance with the illustrations of FIGS. 17A, 17B, 17C, 17D, 17G, and 17G and the textual description of the specification. For instance, in some example embodiments, the helices 100A, 100B can have helical forms in accordance with the illustration of FIG. 18C and the textual description of the specification. For instance, in some example embodiments, the helices 100A, 100B can have helical forms in accordance with the illustrations of FIGS. 19A, 19B, 19C, and 19D and the textual description of the specification. For instance, in some example embodiments, the helices 100A, 100B can have helical forms in accordance with the illustrations of FIGS. 20A and 20B and the textual description of the specification.

Helical configuration of the drive 10 of a .30 caliber embodiment of the projectile 150 can vary according application. In some example .30 caliber embodiments, the projectile 150 comprises a single-start helical configuration, such as the representative helices 100A, 100B illustrated by FIG. 1. In some example .30 caliber embodiments, the projectile 150 comprises a helical configuration that provide two or more starts. In some example .30 caliber embodiments, the projectile comprises multi-start helices in a range of two to twenty starts (a representative, non-limiting range that is among others the written description supports). In some example .30 caliber embodiments, the projectile 150 comprises helices 100A, 100B that extend an axial length in a range of 10 to 45 percent of the length of the projectile 150 (a representative, non-limiting range that is among others the written description supports). In some example .30 caliber embodiments, the projectile 150 comprises helices 100A, 100B that extend an axial length in a range of 4 to 18 mm (a representative, non-limiting range that is among others the written description supports). In some example .30 caliber embodiments, the projectile 150 comprises helices 100A, 100B that revolve in a range of one fourth of a revolution to five revolutions in the axial length they extend (a representative, non-limiting range that is among others the written description supports); for instance, the helices 100A, 100B may extend an axial length of 10 mm while revolving one fourth of a revolution to five revolutions about the axis 5 in the distance of 10 mm; and in some example embodiments, the helices 100A, 100B progressively tighten within that range. In some example .30 caliber embodiments, the projectile 150 comprises helices 100A, 100B with a helical rate in a range of 1:02 mm to 1:20 mm (a representative, non-limiting range that is among others the written description supports); and in some example embodiments, the helices 100A, 100B progressively tighten within this range. In some example .30 caliber embodiments, the projectile comprises helices 100A, 100B that progressively tighten by a factor in a range of 1.5 to 10 (a representative, non-limiting range that is among others the written description supports).

Figure 1S:
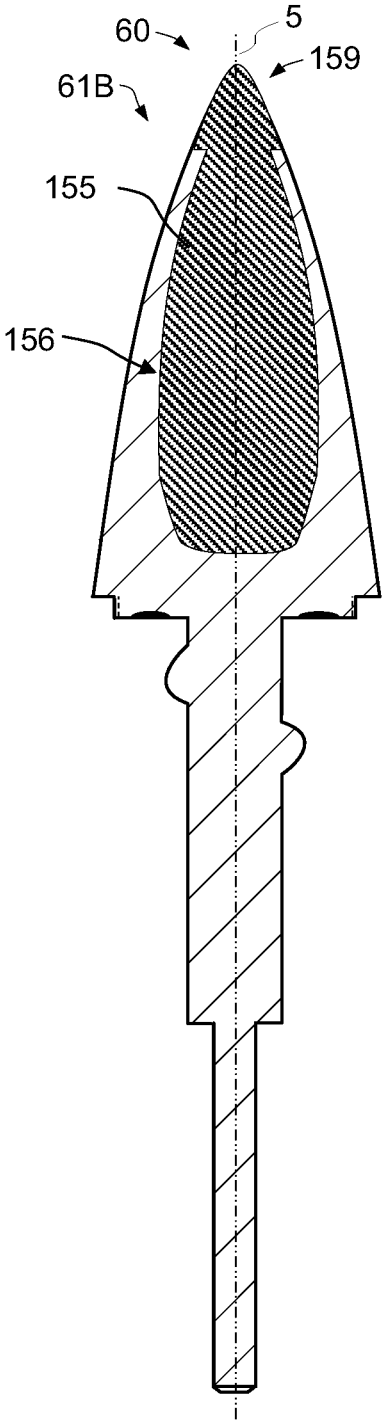
FIG. 1S is an illustration presenting a cross sectional view of a member that the projectile may comprise as an alternative to the member illustrated by FIGS. 1M and 1N in accordance with some example embodiments.

Turning now to FIG. 1S, some example alternatives to the leading member 61 illustrated in FIGS. 1J, 1K, 1L, 1M, and 1N will be discussed. FIG. 1S illustrates another example leading member 61B for the projectile 150, in cross section with the cutting plane including the axis 5.

In the example embodiment that FIG. 1S illustrates, the leading member 61B comprises a cavity 156 in its leading end 60. A material 155 is disposed in the cavity 156 and extends forward from the cavity 156 along the axis 5 to form a tip 159. In some example embodiments, the material 155 comprises a softer or more readily deformed material than the main body of the leading member 61B. For example, the material 155 can comprise lead or lead alloy, while the remainder of the leading member 61B comprises steel, brass, or copper. In some example embodiments, the material 155 comprises beads or particles of tungsten dispersed or otherwise distributed in a matrix of lead, copper, or plastic. Upon the projectile 150 impacting a target, the material 155, with such composition, can deform and expand so as to promote transfer of energy to the target. In some example embodiments, the material 155 comprises a lightly sintered metal powder, for instance sintered iron, steel, copper, or carbide tungsten, that is frangible upon projectile impact. In some example embodiments, the material 155 is of higher density than the main portion of the leading member 155 so as to move center of mass of the projectile 150 forward. In some example embodiments, the material 155 comprises a plastic material, for instance PTFE or another fluoropolymer, that may be insert injection molded into the cavity 156 so as to completely fill the cavity 156 without intentional voids and so that the plastic adheres to surfaces of the cavity 156. Upon the projectile 150 impacting the target, such plastic material can pressurize the cavity 156 to expand and open up the leading end 60 of the leading member 61B. In some example embodiments, such plastic material is loaded with metallic powder, for example powdered iron, powdered copper, powdered steel, or powdered tungsten. In some example embodiments, surfaces (not visible in FIG. 1S) of the leading end 60 are scored lengthwise as illustrated in FIGS. 1U and 1V and indicated there by reference numbers 160 and 161. Upon projectile impact, petals of controlled expansion can open up along the scores and increase diameter of the projectile 150. So opened, the petals can promote energy transfer to the target and/or help avoid the projectile 150 passing completely through certain targets as may be desirable for some applications.

Figure 1T:
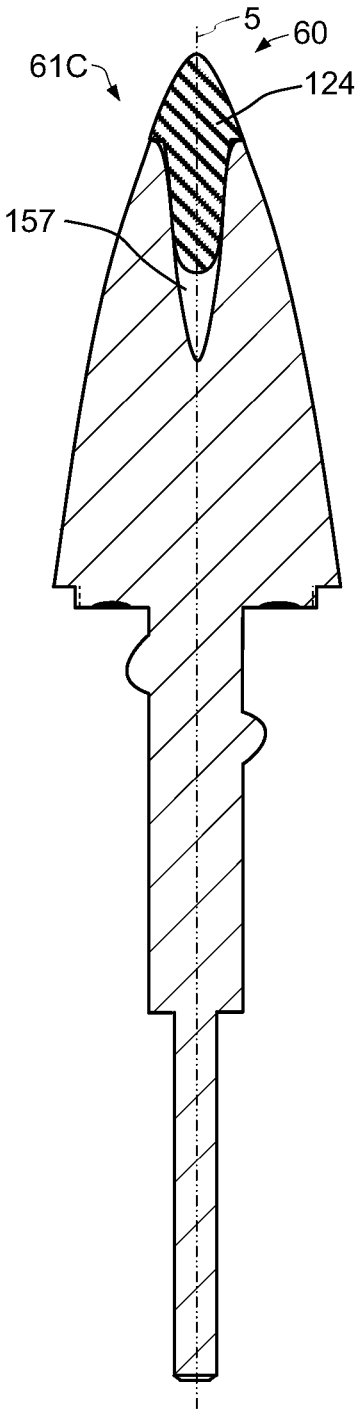
FIGS. 1T, 1U, and 1V are illustrations of another member that the projectile may comprise as an alternative to the member illustrated by FIG. 1S in accordance with some example embodiments.
Figure 1U:
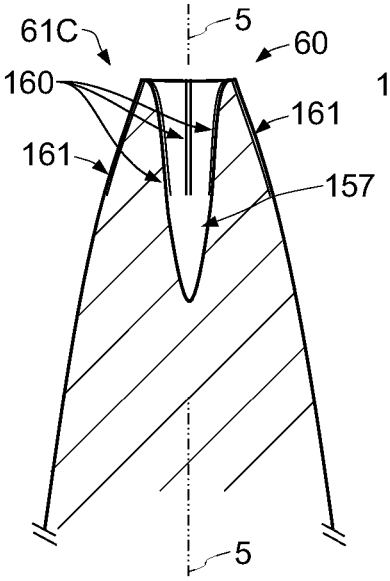
Figure 1V:
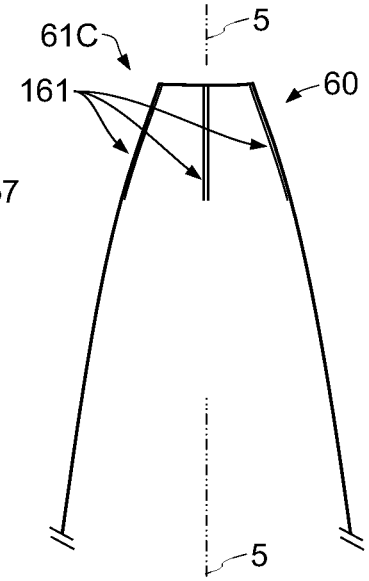
Figure 1W:
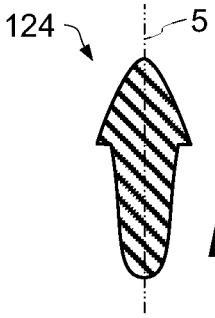
FIG. 1W is a cross sectional illustration of an insert tip that the member may comprise in accordance with some example embodiments.

Turning now to FIGS. 1T, 1U, 1V, and 1W, some more example alternatives to the leading member 61 illustrated in FIGS. 1J, 1K, 1L, 1M, and 1N will be discussed. FIG. 1T illustrates another example leading member 61C in a cross sectional view in which the cutting plane of the view includes the axis 5 of the projectile 150. FIG. 1U illustrates a forward portion of the example leading member 61 in like cross sectional view to FIG. 1T but with an example insert tip 124 removed to show features otherwise obscured. FIG. 1V illustrates a line drawing of an exterior of the leading member 61C corresponding to the view of FIG. 1U. FIG. 1W illustrates a cross sectional view of the insert tip 124.

As illustrated in FIG. 1T, the insert tip 124 is disposed in a cavity 157 at a leading end 60 of the leading member 61C. The insert tip 124 can be press fit in the cavity 157 and held in place by interference, epoxy, solder, or other appropriate fastening means. In various embodiments, the insert tip 124 can have a composition comprising plastic or metal or a combination thereof. For example, the insert tip 124 can comprise one or more of the substances or materials disclosed herein for the material 155 illustrated in FIG. 1S as discussed above.

As illustrated in FIG. 1U, the leading end 60 of the leading member 61C comprises scores 160 on the inner surface of the cavity 157 that extend lengthwise along the axis 5. The illustrated example embodiment comprises four scores 160 separated by 90 degrees, three of which are visible in the view of FIG. 1U. As illustrated in FIG. 1V, the leading end 60 of the leading member 61C further comprises scores 161 exterior to the cavity 157 that extend lengthwise along the axis 5 and are aligned with the scores 160. The illustrated example embodiment comprises four scores 160 separated by 90 degrees, three of which are visible in the view of FIG. 1V. Upon representative projectile impact with a target, the insert tip 124 moves rearward, the leading end 60 of the leading member 61C cleaves along the scores 160, 161 to form four petals (not illustrated), and the petals open to increase diameter of the projectile 150. The opened petals can promote interactions with the target that may include management of energy transfer to the target in some applications.

Figure 2C:
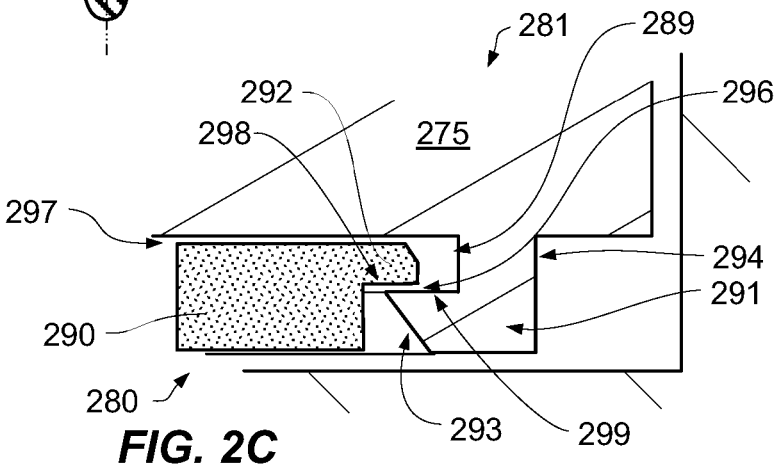
FIGS. 2A, 2B, and 2C, collectively
Figure 2A:
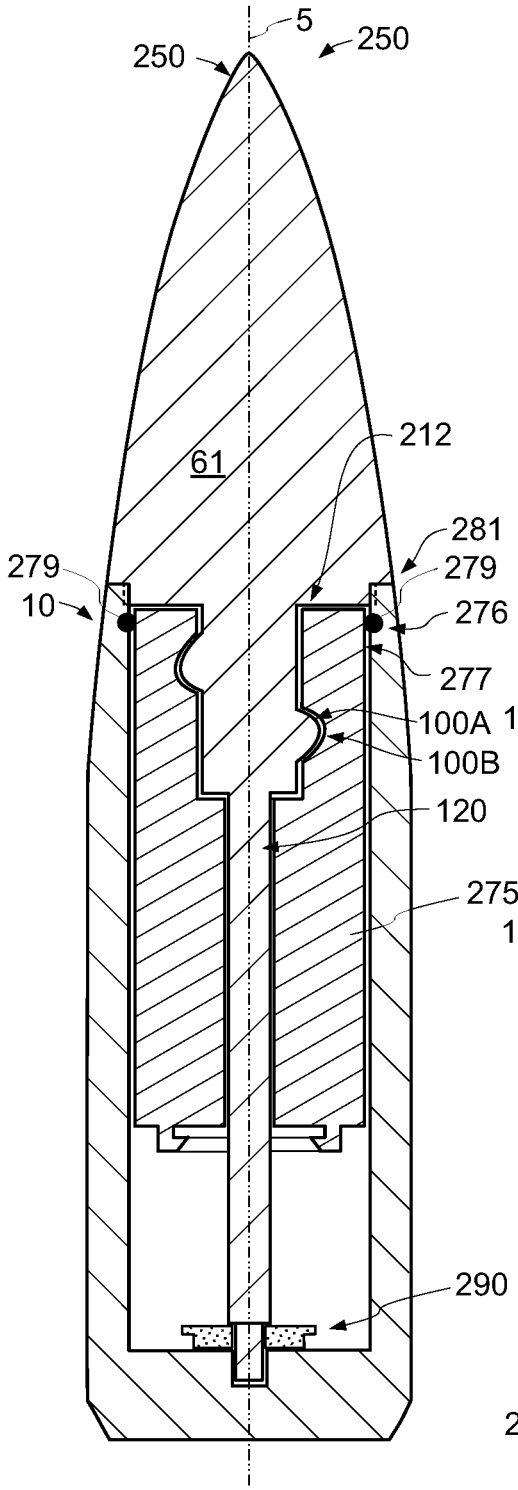
Figure 2B:
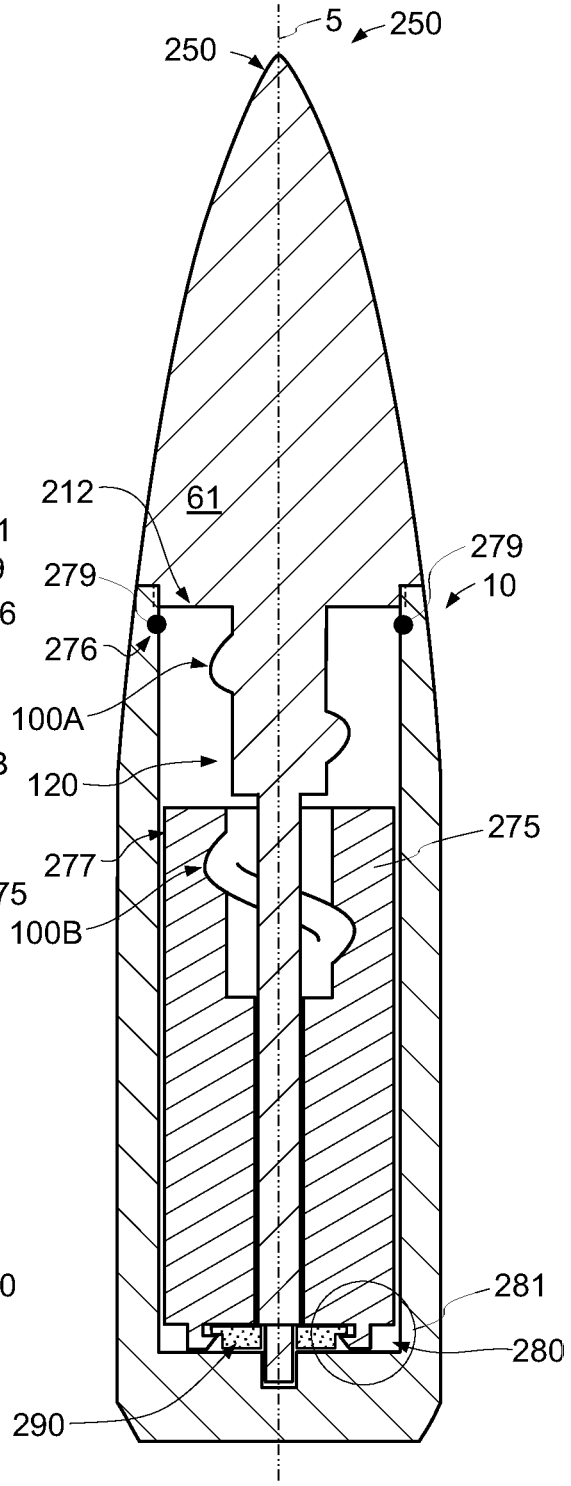

Turning now to FIGS. 2A, 2B, and 2C, these figures illustrate an example system for gyroscopic stabilization according to some embodiments of the disclosure. FIGS. 2A and 2B more specifically illustrate cross sectional views of an example projectile 250 in two respective modes. FIG. 2C illustrates a cross sectional detail view of a portion 281 of the projectile 250 comprising an example retainer 280, with the projectile 250 in the mode that FIG. 2B illustrates.

Whereas the projectile 150 illustrated by FIG. 1 is configured with two rotors 75, 80, the illustrated example projectile 250 of FIG. 2 comprises a single-rotor configuration. In another distinction, the projectile 250 comprises an O-ring 279 comprising an example embodiment of a retainer. In the mode that FIG. 2A illustrates, the O-ring 279 retains the rotor 275 in a forward position and releases the rotor 275 responsive to a predetermined event comprising an occurrence of a threshold level of stress or force. The example O-ring 279 comprises elastomeric material and is seated in a groove 276 of the projectile 250. In some example embodiments, friction between the O-ring 279 and the rotor 275 retains the rotor 275. In some other example retainer embodiments, the projectile 250 can comprise one or more elastomer plugs, for instance composed of silicone, or members made of a resilient or elastic material, or one or more springs that retain the rotor 275 in a designated position within the projectile 250 and then release the rotor 275. When the projectile 250 is assembled with the rotor 275 forward (for example during manufacture or production), the O-ring's elastomeric material presses against the projectile's outer circumferential surface 277 to hold the rotor 275 in place. When the projectile 250 accelerates forward, inertia acts on the rotor 275 and forces the rotor 275 rearward. Under a threshold level of acceleration 4 (see FIG. 1I for an illustration of an example embodiment), rearward inertial force 85 overcomes the O-ring's hold on the rotor 275, and the O-ring 279 releases its retention of the rotor 275. Once released, the rotor 275 moves rearward over the bar 120 along the axis 5, and the drive 10 spins the rotor 275 about the axis 5 as discussed above with reference to FIG. 1, inter alia. The rotor 275 and the bar 120 comprise an example embodiment of a helical pair. The projectile 250 comprises an example embodiment of a mechanism.

Example embodiments of the drive 10 can be incorporated in projectiles of guns, smoothbore guns, firearms, smoothbore firearms, light firearms, smoothbore light firearms, crew-served firearms, smoothbore crew-served firearms, light-gas guns, air guns, smoothbore air guns, railguns, or archery devices, including the disclosed examples thereof (not an exhaustive list). Example embodiments of the drive 10 can further be incorporated in other aeronautical systems, including in the disclosed examples of aeronautical systems.

Once the spinning rotor 275 moves sufficiently rearward, a retainer 280 retains the rotor 275 in a rear position as illustrated by FIG. 2C, which presents a detail view of the portion 281 of the projectile 250 in the example mode of FIG. 2B. As illustrated in the detail view, the projectile 250 comprises an example bearing 290 that supports thrust or axial load in keeping with the bearing 90 of the projectile 150 as discussed above with reference to FIG. 1, inter alia. As illustrated by FIG. 2, the example retainer 280 comprises an example projection 292 that extends radially from and circumferentially about the bearing 290 and an example clip 291 extending rearward from the rotor 275. In the illustrated embodiment, the example bearing projection 292 can be characterized as a flange or as a radial extension. As illustrated, the example clip 291 comprises a channel 289, an angled surface 293, and an extension 294 from the rotor's body. When the rotor 275 moves rearward and encounters the bearing 290, the angled surface 293 contacts and slides against the bearing projection 292. Sliding between the angled surface 293 and the projection 292 results in flexing of the extension 294 and associated progressive outward deflection of the clip 291. Once the angled surface 293 has moved rearward past the projection 292, the bearing projection 292 moves into the channel 289, and the extension 294 and the clip 291 recover from their flexing and deflection. Thus, the channel 289 receives and captures the projection 292. In the resulting mode, which FIG. 2C illustrates, the retainer 280 has captured the bearing projection 292 in the channel 289 and thus retains the rotor 275 in a rearward position of the projectile 250. The retainer 280 maintains this mode of the projectile 250, with the rotor 275 in the illustrated position, while the projectile 250 travels in open air and interaction with the open air decelerates the projectile 250 due to air resistance or drag.

During forward acceleration 4 of the projectile 250, for example while expanding propellant gas 26 propels the projectile 250 forward (see FIG. 1I, for example), the interface 297 between the bearing 290 and the rotor 275 supports the axial load of rearward inertial force 85 (see FIG. 1I, for example) and supports low-friction rotational motion of the rotor 275. Once the projectile 250 is decelerating in open air, the rearward inertial force 85 ceases and forward inertial force takes over. To the extent that a gap exists between a rear surface 298 of the bearing projection 292 and a forward surface 299 of the clip 291 at an interface 296, the forward inertial force moves the rotor 275 forward to take up the gap. The forward force (and potentially accompanying forward movement) of the rotor 275 due to projectile deceleration relieves pressure at the interface 297 and creates interaction at the interface 296 between the rear surface 298 of the bearing projection 292 and the forward surface 299 of the clip 291. The interface 296 supports the axial load of forward inertial force and rotational motion of the rotor 275. In some example embodiments, the interface 296 is configured as a low-friction interface. In some example embodiments, the interface 296 is configured to provide a controlled or elevated level of friction. The interface 296 can be configured to manage interaction between the rotor 275 and the bearing 290 during deceleration in open air, including as discussed above with reference to FIG. 1 and the discussion of managing friction associated with the shoulder 110 illustrated in FIG. 1. In some example embodiments, the interface 296 can be configured for low friction to reduce torque occurring between the rotor 275 and the bearing 290 in open air, thereby promoting spinning of the rotor 275 internally within the projectile 250 independent from any spinning of the entire projectile 250. In some example embodiments, the interface 296 can be configured to promote torque between the rotor 275 and the bearing 290 in open air, thereby transferring spin from the rotor 275 to the entire projectile 250 so the entire projectile 250 rotates in open air.

Once the projectile 250 reaches its target, impact with the target can cause a step change in forward inertia on the rotor 275. The impact can cause failure of the clip 291, with a result of the rotor 275 surging forward within the projectile 250 and potential ejection from the projectile 250. In some example embodiments, the clip 291 is designed to fail at threshold level of forward inertial force to control this forward surge and to induce such an ejection.

In some example embodiments, the projectile 250 can be reconfigured relative to the configuration that FIGS. 2A and 2B illustrate. As illustrated by FIG. 2, the rotor 275 moves linearly along the axis 5 while the helices 100A, 100B drive rotation of the rotor 275; and the axis 5 comprises an axis of rotation of the rotor 275 and a longitudinal axis of the projectile 250 and can further comprise an axis of rotational symmetry of the projectile 250. The projectile 250 can be reconfigured so that the rotor 275 follows a curved path as the rotor 275 moves rearward and rotationally accelerates. For example, the helix 100A can be lengthened to extend farther rearward on the bar 120 than illustrated. The bar 120 can be bent to create a curvature in the bar 120 relative to the axis 5. The rotor 275 can be shortened to extend rearward less than illustrated, thereby helping avoid binding between the rotor 275 and the bar 120 as the rotor 275 moves over the curvature. The curvature can cause the rotor 275 to rotate about an axis that is tilted relative to the axis 5 of the projectile 250. Thus, the spinning rotor 275 can produce angular momentum that has a direction that is different than the direction of the axis 5 or that is different than the direction of the velocity of the projectile 250. The spinning rotor's angular momentum can be oriented at an angle to the direction of the projectile's velocity and at an angle to the direction of the projectile's longitudinal axis 5. These angles can be controlled for terminal performance, for spatially dispersing projectiles launched in rapid succession (for instance in a group of burst-fired projectiles), or for compensation of other effects. In some example embodiments, such angles are provided by the bar 120 diverging from the projectile's axis 5 where the leading member 61 has a step 212 in diameter and the bar 120 extends rearward. The portion of the leading member 61 forward of the step 212 can have a first axis while the bar 120 has a second axis, wherein the first and second axes intersect adjacent the diameter step 212 to form an angle. Thus, forward of the diameter step 212, the leading member 61 can be centered on the axis 5 of the projectile, so that forward of the diameter step 212, the leading member 61 and the projectile have colinear axes. The bar 120 can extend linearly rearward from the diameter step 212 along an axis that forms an angle with the projectile's axis 5.

Figure 3A:
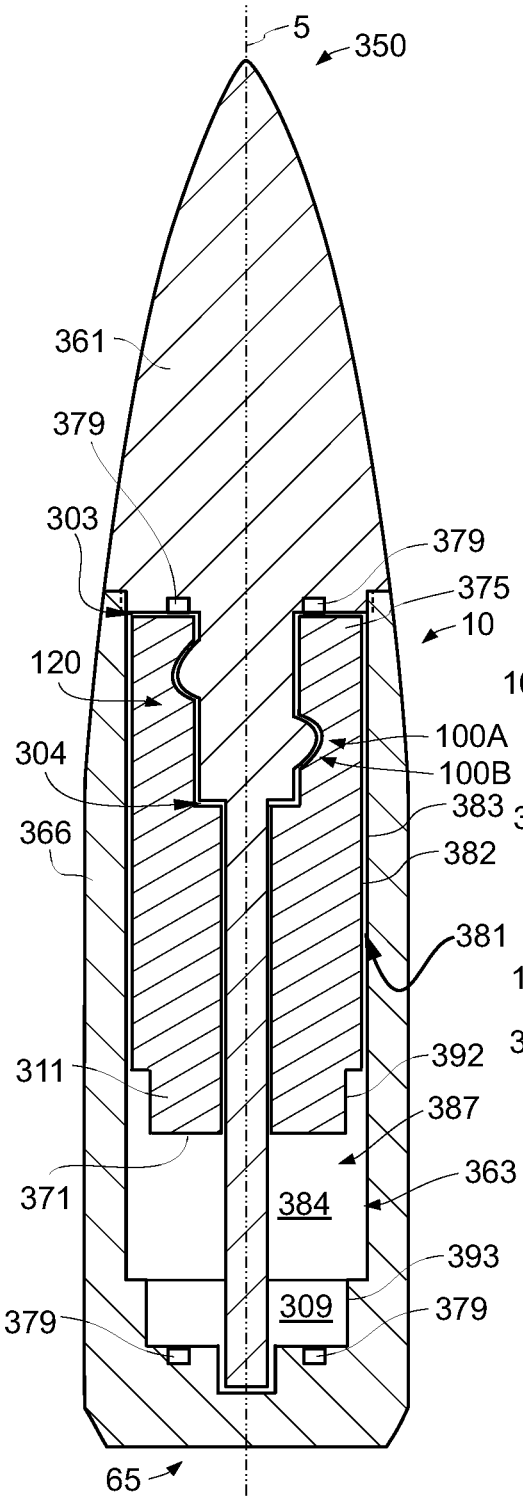
FIGS. 3A and 3B, collectively
Figure 3B:
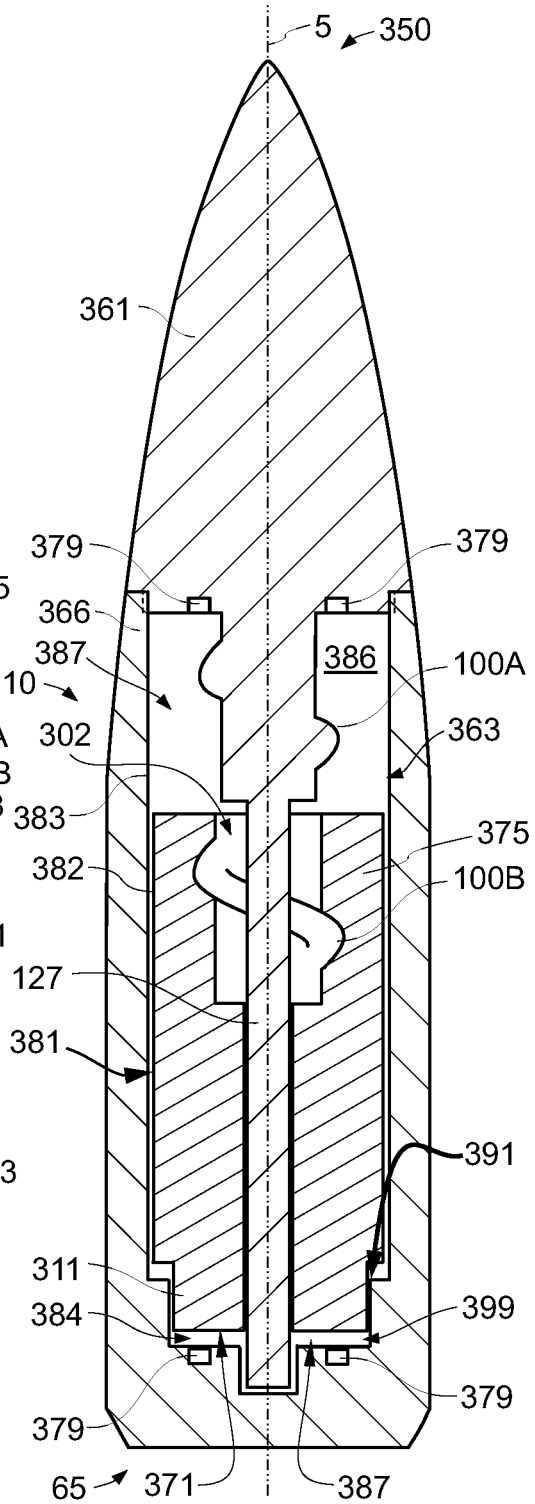

Turning now to FIGS. 3A and 3B, these figures illustrate an example system for gyroscopic stabilization according to some embodiments of the disclosure. FIGS. 3A and 3B more specifically illustrate cross sectional views of an example projectile 350 in two respective modes. The example projectile 350 illustrated by FIG. 3 comprises a like helical arrangement to the projectile 250 of FIG. 2, and the projectiles 250, 350 comprise other common features apparent from a review of FIGS. 2 and 3. As further discussed below, in one distinguishing feature between the two projectiles 250, 350, the example projectile 350 of FIG. 3 manipulates gas flow inside the projectile 350 in connection with rotor control or rotor management.

In another distinguishing feature between the two illustrated projectiles 250, 350, the example projectile 350 of FIG. 3 comprises discrete magnets 379 for retaining a rotor 3375 in a forward position prior to launch. In the illustrated example embodiment, the projectile 350 has four discrete magnets 379 mounted to the leading member 361 forward of the rotor 375. The four discrete magnets 379 are mounted on 90 degrees intervals about the axis 5, with two of the magnets 379 visible in the view of FIG. 3, a third one behind the view plane, and a fourth one in front of the view plane. The projectile 350, as illustrated, thus comprises an example retainer comprising four discrete magnets 379. The discrete magnets 379 can be mounted by embedding in the leading member 361, for example by disposing the magnets 379 in drilled holes, or another appropriate mounting means. Example embodiments of the projectile 350 can have two discrete magnets 379 mounted on 180 degree intervals, three discrete magnets 379 mounted on 120 degree intervals, eight on 45 degree intervals, or in another appropriate arrangement. In the example mode that FIG. 3 A illustrates, the discrete magnets 379 adjoin the rotor 375. With the rotor 375 formed of carbon steel or a ferromagnetic material, the magnetic field of the magnets 379 holds the rotor 375 forward. In some example embodiments, the rotor 375 can be formed of one or more materials that are not attracted by a magnetic field or that provide insufficient attraction, for example certain tungsten carbide and stainless steel metals. In such embodiments, corresponding discrete magnets (not illustrated) may be embedded within the rotor 375 or otherwise mounted to the rotor 375. Accordingly, in some example embodiments of the projectile 350, the rotor 375 and the leading member 361 can comprise two respective arrangements of discrete magnets 379 that adjoin one another in the mode of FIG. 3A and attract one another to retain the rotor 375 in the forward position that FIG. 3A illustrates.

Inertial force 85 (see FIG. 1I for an example illustration) produced during launch of the projectile 350 overcomes the magnetically attractive force of the discrete magnets 379 holding the rotor 375 forward, and the retainer releases the rotor 375. As the rotor 375 moves rearward during projectile launch, the magnetic force applied by the magnets 379 on the rotor 375 diminishes and the rotor 375 frees.

Launching the projectile 350 can, for instance, comprise shooting, firing, or discharging in a gun, a smoothbore gun, a firearm, a smoothbore firearm, a rifle, a handgun, a pistol, a long gun, an air gun, a light-gas gun, a railgun, an archery device, a cannon, a howitzer, a machine gun, a system comprising a rifled barrel, or a system comprising a smoothbore barrel, to mention some representative examples without limitation. The projectile 350 can thus comprise a gun projectile, a smoothbore-gun projectile, a firearm projectile, a smoothbore-firearm projectile, a rifle projectile, a handgun or pistol projectile, a long-gun projectile, an air gun projectile, a light-gas gun projectile, a railgun projectile, an archery-device projectile, a cannon projectile, a howitzer projectile, a machine gun projectile, a projectile for a system comprising a rifled barrel, or a projectile for a system comprising a smoothbore barrel, to mention some representative examples without limitation.

The projectile 350 comprises an example embodiment of a mechanism. As discussed above with reference to FIGS. 1 and 2, inter alia, the drive 10 rotates the rotor 375 as the rotor 375 moves rearward within an interior space 363 enclosed by the leading member 361 and a trailing member 366. The rotor 375 and the leading member 361 comprise an example embodiment of a helical pair. In some example embodiments, the drive 10 operates with a direct relationship between axial position and angular position of the rotor 375, with a corresponding relationship between axial velocity and angular velocity of the rotor 375, and with a corresponding relationship between axial acceleration 4 and angular acceleration of the rotor 375. With such a direct relationship between axial position and angular position of the rotor 375, angular displacement of the rotor 375 (for example displacements of 0°, 180°, 360°, 540°, 720°, and so forth) can be proportional to axial displacement of the rotor 375. The relationship between axial velocity and angular velocity of the rotor 375 can be such that the spinning speed of the rotor 375 (for example in revolutions per second) is proportional to the speed of the rotor's linear movement (for example in meters per second). The relationship between axial acceleration 4 and angular acceleration of the rotor 375 can be such that the spinning acceleration of the rotor 375 (for example in revolutions per second per second) is proportional to linear acceleration 4 of the rotor (for example in meters per second per second). In some such example embodiments, hindrance on the rotor's axial movement while the drive 10 is engaged can suppress the spinning speed that the drive 10 is able to impart on the rotor 375. Accordingly, as further discussed below, suppressing hindrances during drive engagement, such as viscous force or friction acting on the rotor 375, can serve drive effectiveness and can heighten spinning speed of the rotor 375.

Example embodiments of the drive 10 can be incorporated in projectiles of guns, smoothbore guns, firearms, smoothbore firearms, light firearms, smoothbore light firearms, crew-served firearms, smoothbore crew-served firearms, light-gas guns, air guns, smoothbore air guns, railguns, or archery devices, including the disclosed examples thereof (not an exhaustive list). Example embodiments of the drive 10 can further be incorporated in other aeronautical systems, including in the disclosed examples of aeronautical systems.

The interior space 363 includes a rear space 384 rearward of the rotor 375 and a forward space 386 forward of the rotor 375 as illustrated respectively by FIGS. 3A and 3B. A gas 387, for example air or nitrogen, fills the interior space 363 that is available as unoccupied by the rotor 375, including the rear space 384 and the forward space 386. In some example embodiments, the gas 387 is sealed within the projectile 350 during manufacture of the projectile 350. In example embodiments, the gas 387 can have a steady state pressure that is above, below, or substantially equal to ambient pressure outside the projectile 350.

In the example embodiment illustrated by FIG. 3, the outer surface 382 of the rotor 375 and the inner surface 383 of the trailing member 366 face one another across an annular gap 381. The annular gap 381 between these surfaces 382, 383 forms a channel for the gas 387 to flow from the rear space 384 to the forward space 386 as the rotating rotor 375 moves rearward with the helices 100A, 100B engaged. In the example embodiment that FIG. 3 illustrates, the annular gap 381 is configured to promote this gaseous flow and relieve pressure accumulation. That is, the annular gap 381 can be dimensioned to avoid trapping the gas 387 in the rear space 384 and impeding the rearward movement of the rotor 375 while the helices 100A, 100B remain engaged. For instance, in some example .30 caliber embodiments of the projectile 350, the annular gap 381 can have a width (on one side of the axis 5) in a range of 0.004 to 0.020 inches (102 to 508 microns), which is a representative, non-limiting range that is among others the written description supports. While inertial force 85 moves the rotor 375 rearward and the helices 100A, 100B convert the rotor's rearward movement into spinning of the rotor 375, gas 387 flows readily forward through the annular gap 381, from rearward of the rotor 375 to forward of the rotor 375. The flow of gas through this channel avoids an undue buildup of pressure rear of the rotor 375 that could slow rearward motion of the rotor 375 and thus unwantedly hinder or suppress rotational acceleration of the rotor 375. Accordingly, in the projectile 350 that FIG. 3 illustrates, the rotor 375 can move rearward without undue restraint, and the helices 100A, 100B can convert the rotor's rearward movement into rapid spinning of the rotor 375.

Figure 7A:
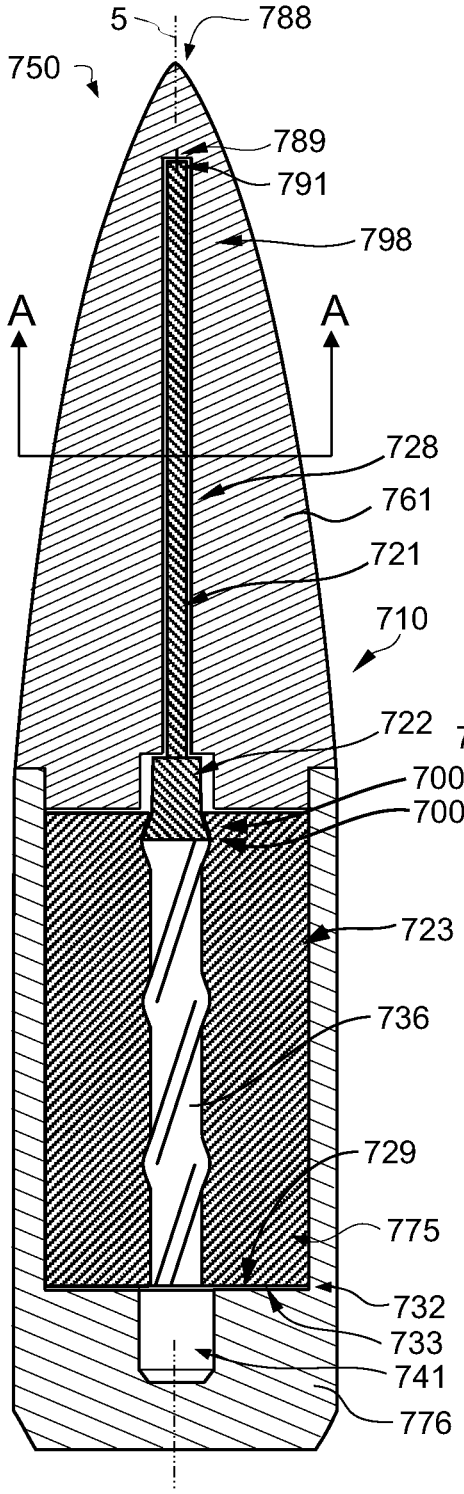
FIGS. 7A, 7B, 7C, 7D, 7E, 7F, 7G, 7H, 7I, 7J, 7K, 7L, 7M, 7N, and 7O, collectively
Figure 7B:
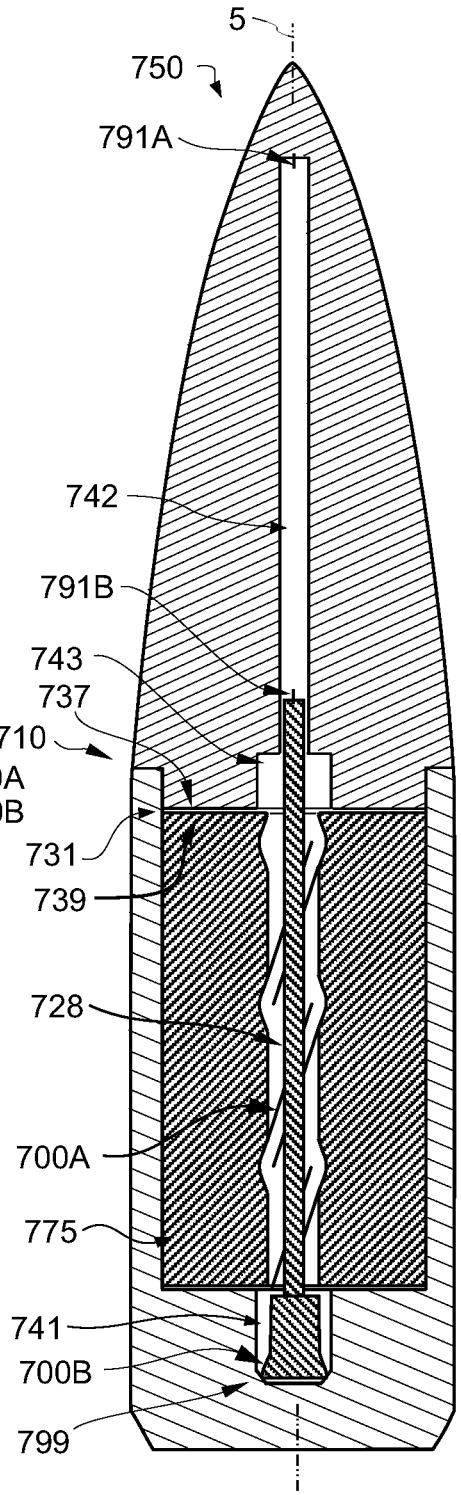
Figure 7C:
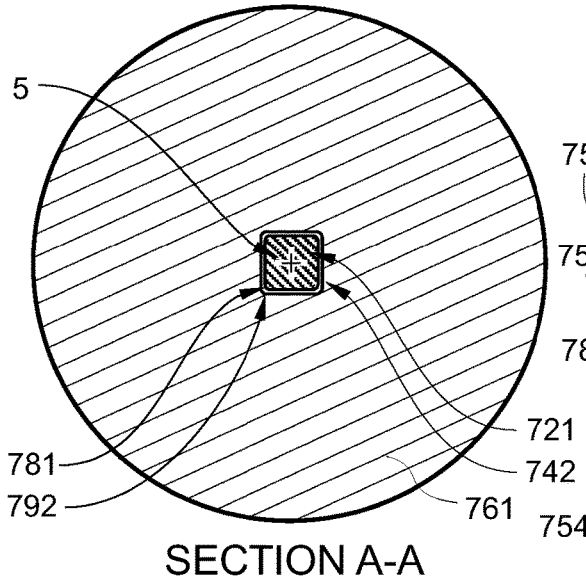
Figure 7D:
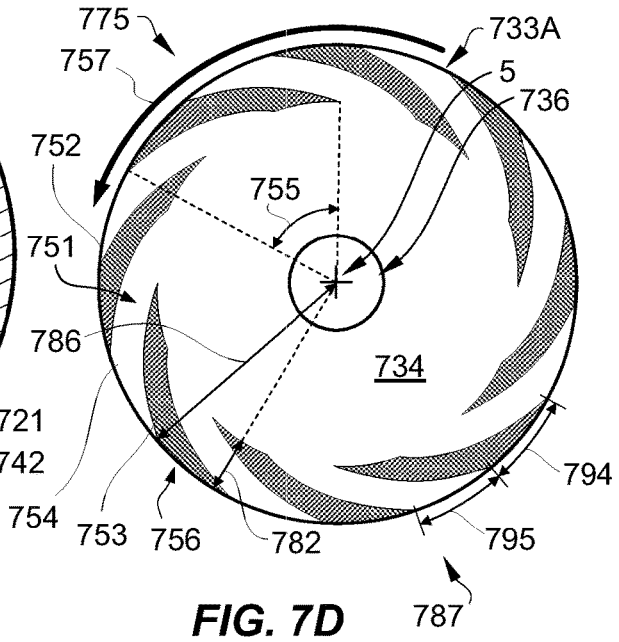
Figure 7E:
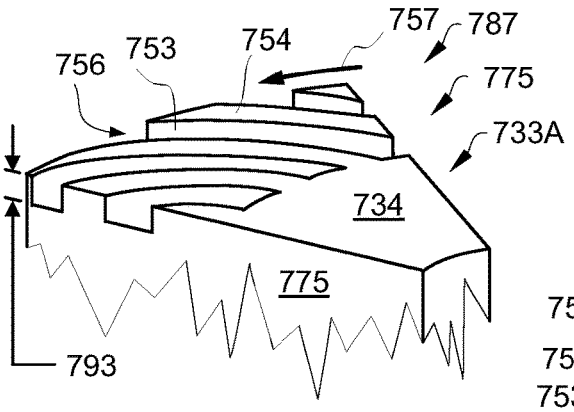
Figure 7F:
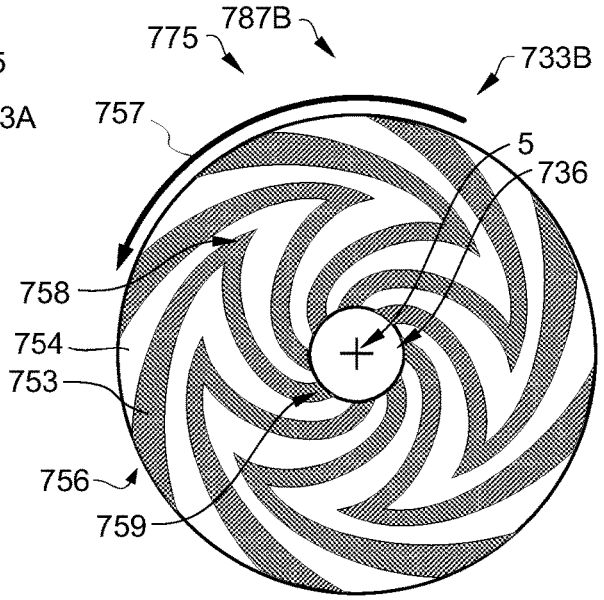

In some example embodiments, the outer surface 382 of the rotor 375 can be patterned with surface features (not illustrated by FIG. 3) that convey gas flow forward through the annular gap 381. The outer surface 382 can, for example, comprise a pattern of grooves that spiral circumferentially about the rotor 375. The drive's spinning of the rotor 375 can force gas 387 to channel forward through the spiral grooves to expedite gas flow. Accordingly, some example embodiments of the rotor 375 can comprise an impeller that drives forward flow of gas 387 from the rear space 384 to the forward space 386. In some example embodiments, the outer surface 382 of the rotor 375 is patterned with a number of grooves in a range of 10 to 30 grooves, with each groove having a depth in a range of 25 to 100 microns and a width that spans an arc length width in a range of 10 to 30 degrees (these are representative, non-limiting ranges that are among others the written description supports). In the projectile 350 that FIG. 3 illustrates, the example drive 10 is configured to spin the rotor 375 about the axis 5 in a direction that is counterclockwise from the perspective of an observer positioned rear of the projectile 150 looking along the axis 5 towards the trailing end 65 of the projectile 150. Example spiral direction of a groove pattern on the rotor 375 rotating in said counterclockwise direction will now be discussed with brief reference to FIG. 7H. Consistent with said counterclockwise rotation, the rotor 375 of the projectile 350 of FIG. 3 spins in the same rotational direction as the rotor 775B illustrated in FIG. 7H, as indicated by the arrow 706 in FIG. 7H. The groove pattern on the outer surface 382 of the rotor 375 can spiral about the rotor 375 in the same spiral direction as the grooves 701 and the intervening lands 702 of the rotor 775B as illustrated in FIG. 7H. In this spiral configuration, as the rotor 375 rotates, the rear mouths 711 of the grooves 701 of the rotor 375 of the projectile 350 can capture gas 387 in the rear space 384 and pump the captured gas 387 into the forward space 387.

Referring now FIG. 3, whether or not the rotor 375 comprises a pattern of spiral grooves, once the rotor 375 has moved sufficiently rearward, the helices 100A, 100B disengage, and the drive 10 ceases converting rearward movement of the rotor 375 into rotation of the rotor 375. The rotor 375 then spins freely at the rotational speed imparted by the drive 10. The helices 100A, 100B disengage when the rotor 375 has moved far enough rearward that the helix 100B has moved past the helix 100A. In the illustrated example embodiment, the helices 100A, 100B disengage prior to the rotor 375 moving to the rearward position that FIG. B illustrates. That is, at the point when the helix 100B moves past the helix 100A, the rotor 375 is forward of the rotor position illustrated in FIG. 3B.

As illustrated, the example projectile 350 is configured to inhibit gas flow through the channel of the annular gap 381 once the helix 100B clears the helix 100A and helical engagement ceases. Thus, responsive to the rotor 375 moving sufficiently rearward to disengage the helix 100A from the helix 100A, the projectile 150 inhibits the flow of gas 387 from the rear space 384 (which is rear of the rotor 375) to the forward space 387 (which is forward of the rotor 375). In the illustrated example embodiment, the projectile 350 implements the gas-flow inhibition by obstructing the channel. As illustrated, the example rotor 375 of the projectile 350 comprises a projection 311 of reduced diameter that projects rearward. The trailing member 366 comprises an aperture 309 of reduced diameter corresponding to the projection 311, with the aperture 309 configured or sized to receive the projection 311. As illustrated, the example projection 311 comprises an outer surface 392, and the example aperture 309 comprises a corresponding inner surface 393. As the rotor 375 moves rearward with the helices 100A, 100B separated axially from one another, the projection 311 moves towards and enters the aperture 309. As the projection 311 enters the aperture 309, the outer surface 392 of the projection 311 faces the inner surface of the aperture 309 to form an annular gap 391. In the illustrated example, the annular gap 391 is narrower than the annular 381, so that the annular gap 391 obstructs forward gaseous flow through the annular gap 381. The cross sectional area of the channel thus reduces, and the channel's capacity to convey gas 387 diminishes. Gas flow is thus restricted. For instance, in some example embodiments, the annular gap 391 can have a width (on one side of the axis 5) in a range of 5 to 25 percent of the width of the annular gap 381 (which is a representative, non-limiting range that is among others the written description supports). In some example .30 caliber embodiments of the projectile 350, the annular gap 391 can have a width (on one side of the axis 5) in a range of 0.0005 to 0.004 inches (13 to 102 microns), which is a representative, non-limiting range that is among others the written description supports.

With the gas flow out of the rear space 384 inhibited and the inertial force 85 pressing the rotor 375 rearward, pressure builds rearward of the rotor 375, and a gas cushion 399 develops from the confined gas 387. The gas cushion 399 comprises a gas bearing that supports axial load, absorbs shock of rearward motion of the rotor 375, and provides controlled deceleration of the rotor's axial motion. The gas cushion 399 further supports free spinning of the rotor 375 with low friction. Captured, pressurized gas 387 of the gas cushion 399 thus provides a low-friction, load-bearing interface. The gas cushion 399 further comprises a thrust bearing that, in some example embodiments, utilizes air, nitrogen, or other suitable gas or gases. The aperture 309, the rotor projection 311, the rotor surface 392, and rear member surface 393, and the annular gap 391 can further comprise a dashpot or linear damper that utilizes viscous friction or viscous force to resist, control, and/or damp axial motion of the rotor 375 and/or associated shock.

In some example embodiments, the rotor surface 392 comprises a spiral pattern of grooves configured to convey gas 387 into the rear space 384 as the rotor 375 spins and/or to maintain gas 387 of the gas cushion 399 in the rear space 384. The grooves on the rotor surface 392 can be dimensioned in accordance with the foregoing discussion of patterning the rotor surface 382 with grooves. The grooves on the rotor surface 392 can spiral in a rotational direction that is opposite to the spiral direction of grooves on the rotor surface 382 as discussed above. That is, the rotor surface 392 can comprise a pattern of grooves that spirals in the same rotational direction as the grooves 703 on the rotor 775B illustrated in FIG. 7H.

In some embodiments, the surface 371 of the rotor 375 facing rearward is patterned with features forming an aerodynamic bearing. As further discussed below with reference to FIG. 7, inter alia, the aerodynamic bearing can comprise a spiral groove bearing or an aero spiral groove bearing.

In some example embodiments, the inner surface 393 of the aperture 309 is tapered so that the aperture 309 diametrically narrows rearward (with increasing depth). The inner surface 393 can taper incrementally or in steps or can taper continuously, for example. In some example embodiments, the rotor projection 311 is also or alternatively tapered. In some example embodiments, the aperture tapering comprises a lead-in of the aperture 309. The tapering can provide a gradual narrowing of the gas channel that conveys gas 363 from rear of the rotor 375 to forward of the rotor 375. The resulting transition can facilitate absorption of shock or abrupt deceleration of the rotor 375.

In some example embodiments, the gas cushion 399 gradually bleeds down so that the rotor 375 gradually moves rearward beyond the rotor position illustrated in FIG. 3B.

In the example embodiment that FIG. 3 illustrates, the projectile 350 comprises discrete magnets 379 that comprise a retainer for retaining the rotor 350 in a rearward position once launch is complete and the projectile 350 begins decelerating due to air resistance. The rear discrete magnets 379 can comprise various arrangements as discussed above with reference to the discrete magnets 379 forward of the rotor 375. In some example embodiments, suction aids the magnets 379 in maintaining the rotor 375 in a rear position or may be utilized in place of the magnets 379. That is, in some example embodiments, the forward force of inertia acting on the rotor 375 while the projectile 350 is traveling in open air is insufficient to draw gas 387 into the gas cushion 399 through the annular gap 391 and thus forward movement of the rotor 375 is inhibited. Accordingly, the aperture 309, the rotor projection 311, the rotor surface 392, and rear member surface 393, and the annular gap 391 can comprise a retainer for retaining the rotor 375 in a desired position.

In some example embodiments, the projectile 350 comprises features differing from those illustrated by FIG. 3. The foregoing discussion has described some representative embodiments varying from the illustration of FIG. 3. Some example embodiments with features varying from FIG. 3 will be further discussed below.

In some example embodiments varying from the illustration of FIG. 3, the bar 120 of the leading member 361 is truncated immediately rear of the helix 100A, thereby removing the illustrated rear member 127. In some such embodiments, the aperture 302 of the rotor 375 may be likewise truncated so that the aperture 302 has a bottom immediately rear of the helix 100B, rather than extending completely through the rotor 375 as illustrated.

In some example embodiments varying from the illustration of FIG. 3, the trailing member 366 of the projectile 150 comprises the bar 120, including the member 127 and the helix 100A.

In some example embodiments varying from the illustration of FIG. 3, the illustrated discrete magnets 379 are removed and replaced with another embodiment of a retainer for retaining the rotor 375 in the forward position that FIG. 3A illustrates. In some such embodiments, the aperture 302 of the rotor 375 is dimensioned so that when the rotor 375 is rotated onto the bar 120 during assembly of the projectile 150, with the helices 100A, 100B engaged and the rotor 375 fully forward, contact occurs at the interface 304 and a gap exists at the interface 303. Tightening or further rotation of the rotor 375 during assembly results in pressure at the interface 304 and elastic deformation of the bar 120 adjacent the helix 100A and the rotor 375 adjacent the helix 100B. The elastic deformation retains the rotor 375 in the forward position. The forces, stresses, and strains associated with firing the projectile 350 in a gun 50 or otherwise launching the projectile 350 releases the retention, so the rotor 375 can move rearward and the helices 100A, 100B can impart rotation on the rotor 375. In some other retainer embodiments, the aperture 302 and the rotor 375 are configured so that during projectile assembly, the contact occurs at the interface 303, and the gap exists at the interface 304. Tightening the rotor 375 onto the bar 120 can produce elastic deformation associated with contact at the interface 303 that retains the rotor 375 forward until projectile launch, at which time the retention releases and the rotor 375 can move rearward and spin. In some other retainer embodiments, the rotor 375 and the leading member 361 are dimensioned so that contact occurs during projectile assembly at one of the interfaces 303, 304 and a gap exists at the other interface 303, 304. In some example embodiments, the rotor 375 or the leading member 361 can comprise surface features at the contacting interface (interface 303 or interface 304) that bite in as the rotor 375 is tightened onto the bar 120. For example, with contact occurring at the interface 303, the rotor 375 can comprise, at the interface 303, a serrated face that bites into the leading member 361 as the rotor is tightened onto the bar 120. See, for example, FIG. 5C, discussed below. The serrated face of the rotor 375 can comprise ridges that are angled to grab the adjoining surface of the leading member 361 during assembly and to release during projectile launch. In some such embodiments, the serrated face of the rotor 375 comprises a relatively hard material, for example carbon steel, while the adjoining surface of the leading member comprises an insert composed of a relatively soft material, for example lead or copper. During projectile launch, the relatively soft material yields so the rotor 375 can rotate in the opposite direction from the assembly rotation and can move rearward.

Turning now to FIGS. 4A, 4B, 4C, 4D, 4E, 4F, 4G, 4H, 4I, 4J, 4K, 4L, and 4M, some example embodiments will be further discussed with reference to these figures. These figures illustrate an example system 452 for launching and gyroscopic stabilization of an example projectile 450 in an example sabot system, and some example variants thereof, according to some embodiments of the disclosure.

FIG. 4 further illustrates an example operating environment in which launching and stabilizing a projectile 450 can comprise shooting a shoulder-mounted light firearm. The disclosure and teaching support a wide range of operating environments and applications involving sabot systems carrying projectiles that comprise integrated stabilization systems. For instance, the disclosure is sufficiently detailed to enable those skilled in the art to carry out and practice such sabot systems in sizes and configurations suited for launch through cannons, heavy machine guns, howitzers, guns exceeding .50 caliber permanently mounted to airplanes and other military vehicles, tank guns, and railguns (some representative examples that is not an exhaustive list).

Some example embodiments of the projectile 450 can comprise a gun projectile, a smoothbore gun projectile, a firearm projectile, a smoothbore firearm projectile, a light firearm projectile, a smoothbore light firearm projectile, a crew-served firearm projectile, a smoothbore crew-served firearm projectile, a light-gas gun projectile, an air gun projectile, a smoothbore air gun projectile, a railgun projectile, or an archery device projectile (not an exhaustive list).

Figure 4B:
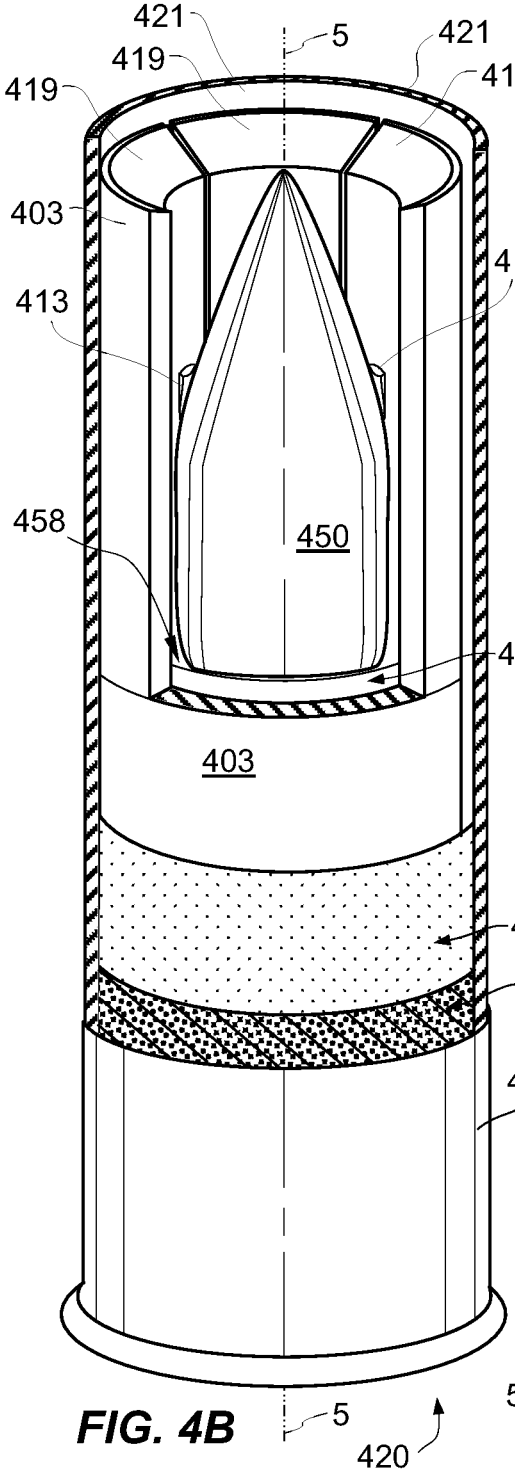
FIGS. 4A, 4B, 4C, 4D, 4E, 4F, 4G, 4H, 4I, 4J, 4K, 4L, and 4M, collectively
Figure 4A:
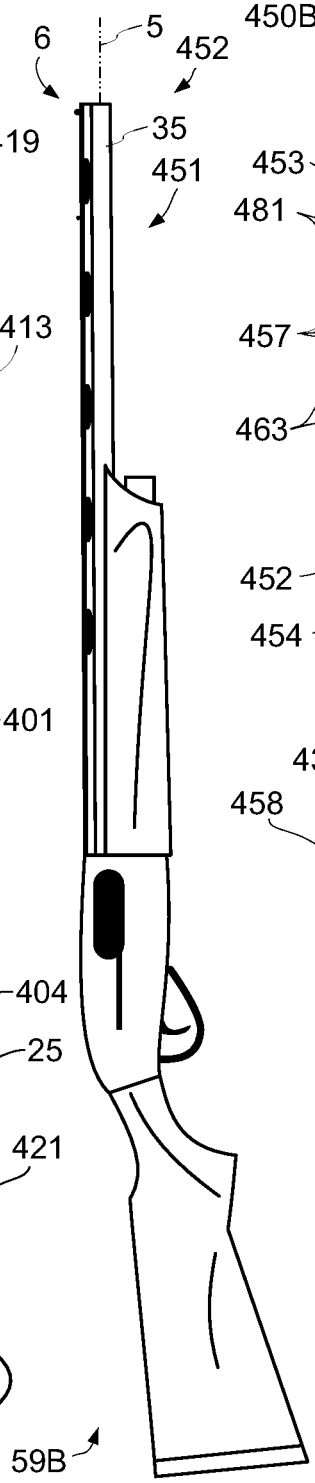

As illustrated by FIGS. 4A and 4B, the system 452 comprises an example shotgun 451 and an example cartridge 420 that is compatible with the shotgun 451 and that comprises the projectile 450. In the illustrated example embodiment, the shotgun 451 comprises a 12 gauge, smoothbore shotgun that shoots both pellets, for instance birdshot or buckshot, and the projectile 450. The shotgun 451 comprises a barrel 35 with an axis 5 along which the projectile 450 accelerates. In some example embodiments, the shotgun barrel 35 comprises a cylinder bore or an improved cylinder choke; other embodiments may have other bore tapers. As an alternative to 12 gauge, in some example embodiments, the shotgun 451 can be chambered in 10 gauge, 16 gauge, 20 gauge, 28 gauge, or .410 bore, to mention some representative sizes without limitation. As an alternative to smoothbore, in some example embodiments, the shotgun 451 comprises a barrel 35 that is fully rifled (see FIG. 1B for an example of a rifled barrel denoted with reference number 35A) or that may be partially rifled, such as with a rifled choke tube (not illustrated) that fastens a rifled insert in the muzzle 6 of the barrel 35.

FIG. 4B illustrates a perspective, partial-cutaway view of an example cartridge 420, in a representative embodiment of a shotgun shell, that the shotgun 451 shoots. The illustrated cartridge 420 comprises a case 421, in the representative embodiment of a hull. In some example embodiments, the cartridge 420 comprises a 12 gauge cartridge in 2¾ inch length, 3 inch magnum, or 3½ inch magnum. In the illustrated example, the case 21 houses solid propellant 25, a gas seal 404, a sabot 403, a rigid plastic disk 402 (hidden behind the sabot 403 in the view of FIG. 4B, visible in FIG. 4D), an elastomeric disk 401, and the projectile 450. In the illustrated embodiment of FIG. 4B, the projectile 450 can be characterized as a shotgun slug. The example sabot 403 comprises four petals 491 that collectively surround the projectile 450 and secure the projectile 450. One of the four petals 491 is not visible in FIG. 4B due its removal by the cutaway of the view. As illustrated in FIGS. 4E and 4F (further discussed below) the projectile 450 comprises an example rotor 475 and an example drive 410 that rotates the rotor 475. The sabot 403 secures the projectile 450 to avoid unintended rotation of the entire projectile 450 associated with the drive 410 applying torque to the rotor 475 while driving rotation of the rotor 475. As illustrated in FIG. 4B, each petal 419 of the sabot 403 comprises a respective projection 413 that projects inward and embraces the projectile 450 and secures the projectile 450 against unintended rotation. The projectile 450 and the sabot 403 are thus locked or fixed into a common angular orientation and can travel through the shotgun barrel 35 in that angular orientation. Once the shotgun 451 expels the gas seal 404, the sabot 403, the rigid plastic disk 402, the elastomer disk 401, and the projectile 450 from the barrel 35, air resistance opens the sabot petals 419 to release the projectile 450. The sabot 403 discards, and the projectile 450 continues alone along the axis 5 towards a target or other destination.

In some example embodiments, the sabot 403 is sized according to a .30 caliber projectile. In such embodiments, a cartridge 420 housing the sabot 403 and this .30 caliber projectile can be a 10 gauge cartridge, a 12 gauge cartridge, a 16 gauge cartridge, a 20 gauge cartridge, a 28 gauge a cartridge, or .410 bore cartridge (sometimes referred to as "four-ten gauge"), to mention some representative sizes without limitation. In some embodiments, this .30 caliber projectile can comprise the projectile 450 sized appropriately. In some embodiments, this .30 caliber projectile can comprise any of the example .30 caliber projectiles that the written description discloses.

Example embodiments of the cartridge 420 illustrated by FIG. 4B that are compatible with smoothbore shotguns can be produced by modifying commercially available sabot slug shotgun cartridges their manufacturers have engineered to be used exclusively with rifled shotgun barrels. More specifically, commercial sabot slug cartridges that are limited to usage in rifled-barrel shotguns can be reconfigured for use in smoothbore barrels by swapping out their slugs with an embodiment of the projectile 450, which comprises a mass that spins independently of the projectile's exterior as further discussed below. To facilitate the swap, the exterior of the projectile 450 can be contoured to match the contours of the commercial slug. Hornady Manufacturing Company of Grand Island, Nebraska supplies such commercial cartridges under the product designator #86236 in packaging labeled "Hornady. SUPERFORMANCE [,] 12 GA SLUG 2¾" [,] 300 gr MONOFLEX® [,] FOR RIFLED BARRELS." An example embodiment of the illustrated cartridge 420 of FIG. 4 that is configured for smoothbore operation can be produced by replacing the slug that comes in the Hornady #86236 cartridge with the projectile 450 that FIG. 1 illustrates. Likewise modifiable for smoothbore operation are the slug cartridges Hornady designates as #8623 and supplies in packaging labeled "Hornady. SHOTGUN, 12 GA 2¾" [,] 300 gr SST® SLUG [,] FOR RIFLED BARRELS". Hornady states, "SST® Slugs are designed for use in fully rifled barrels only." on the product page of the company's website (top-level domain name hornady.com) as accessed 11 Nov. 2020.

"HORNADY", "MONOFLEX", "SUPERFORMANCE", and "SST" are registered trade names of Hornady Manufacturing Company. Commas in brackets, i.e. [,], have been added in three places in each of the two packaging label excerpts in the immediately preceding paragraph to denote line separations. The text "Hornady." is stylized on both packaging labels. The letter capitalization in both excerpts is consistent with the original. Hornady's website displays the statement "SST® Slugs are designed for use in fully rifled barrels only." in font that is bolded and italicized.

Referring now to FIG. 4, example embodiments will be further discussed. FIGS. 4C and 4D respectively illustrate two projectiles 450B and 450C that operably couple to the sabot 403 using features distinguishing over the projectile 450 as discussed above. After discussing the projectiles 450B and 450C of FIGS. 4C and 4D and their respective couplings with the sabot 403, example internal features of the projectile 450 of FIG. 4A will be discussed with reference to FIGS. 4E, 4F, 4G, 4H, 4I, 4J, and 4K.

Figure 4C:
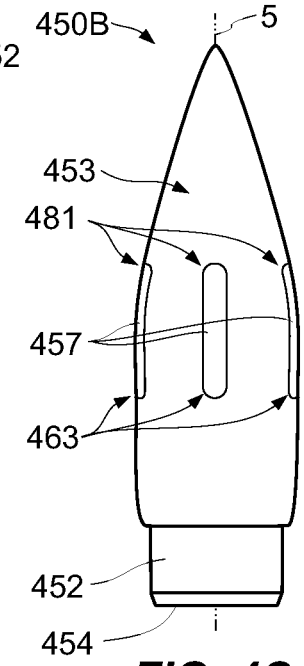

Turning now to FIG. 4C, in some example embodiments, it can be useful to facilitate axial movement of a projectile 450B within the sabot 403 during acceleration 4 (see FIG. 1I for an illustration of an example embodiment) through the shotgun barrel 35 while limiting rotation of the projectile 450B. The example projectile 450B that FIG. 4C illustrates can move axially within the sabot 403 in support of generating stabilizing spin. As illustrated by FIG. 4C, the projectile 450B comprises a member 452 that is generally cylindrical and comprises a trailing surface 454. As illustrated, the member 452 comprises an example embodiment of a plunger. In the illustrated configuration of FIG. 4C, the member 452 extends rearward from the projectile 450B. In operation, the member 452 can move axially into the projectile 450B. During launch of the projectile 450B, the member 452 plunges forward into the projectile 450B so that less of the member 452 extends rearward from the projectile 450B. In some example embodiments, the member 452 can move sufficiently into the projectile 450B to provide a flush condition or can move farther into the projectile 450B to create an open cavity, so that the trailing surface 454 is recessed within the projectile 450 to form a bottom of the open cavity.

Figures 14A, 14B, 14C:
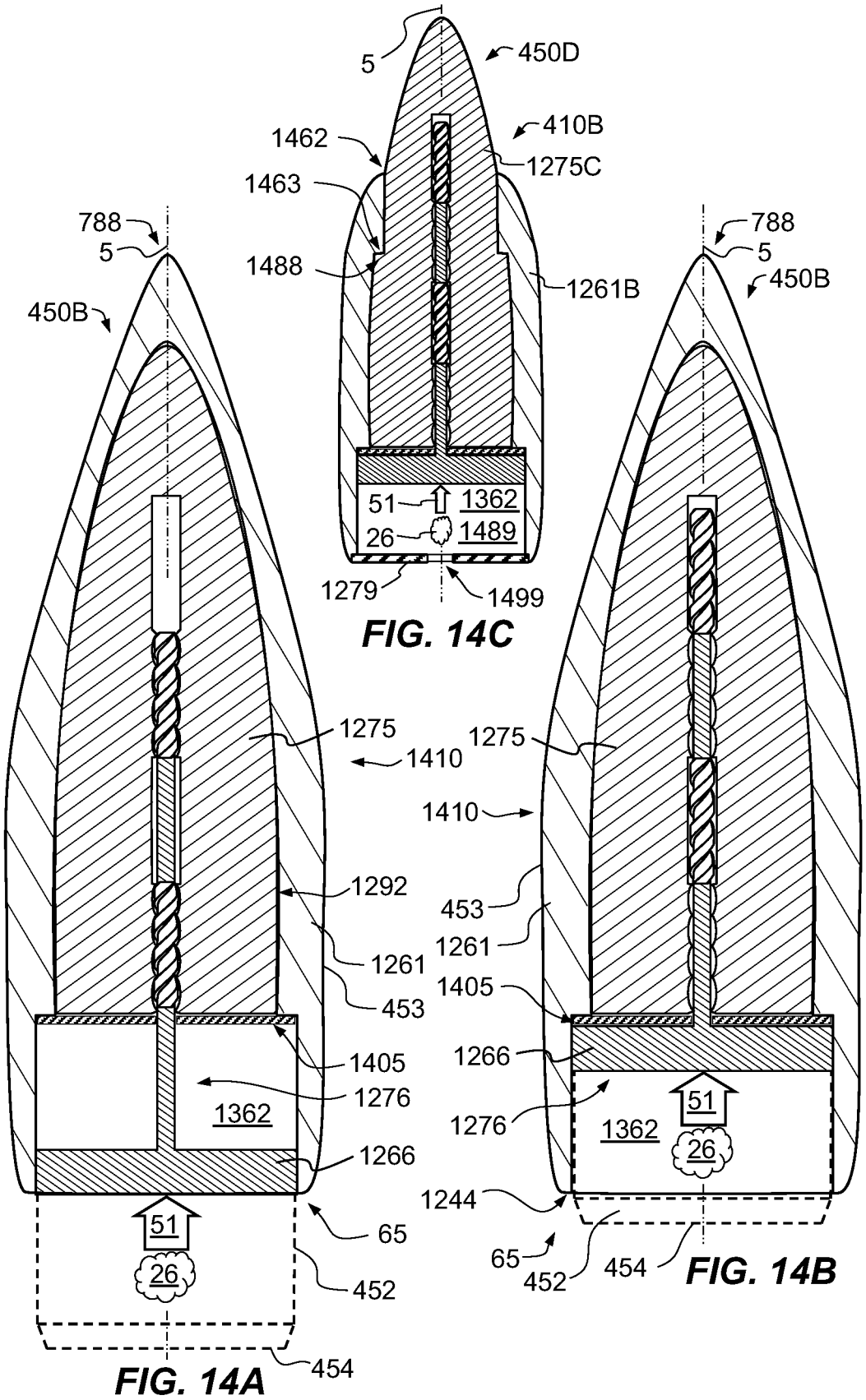
FIGS. 14A, 14B, and 14C, collectively

As illustrated in FIG. 4C, an exterior 453 of the projectile 450B comprises four channels 457 that extend lengthwise on example 90 degree spacing about the axis 5. (One of the four channels 457 is hidden in the view of FIG. 4C.) Once the projectile 450B is mounted in the sabot 403 during cartridge assembly, the four sabot petal projections 413 (illustrated in FIG. 4B) extend into trailing ends 463 of the four channels 457, and the trailing surface 454 of the member 452 abuts the forward surface 458 of the elastomer disk 401. In some embodiments, the elastomer disk 401 and the rigid plastic disk 402 may not be incorporated, in which case the trailing surface 454 abuts the sabot 403. The sabot projections 413 and the channels 457 engage with one another to effectively key the sabot 403 and projectile 450B to one another and prevent unintended independent rotation during projectile launch. During acceleration 4 of the sabot 403 and the projectile 450B, inertial force 85 (illustrated by FIG. 1I in an example embodiment) forces the projectile 450B rearward within the sabot 403, while the sabot projections 413 remain in the channels 457. The projectile 450B thus move rearward within the sabot 403, while the projections 413 and channels 457 maintain rotational alignment between the sabot 403 and the projectile 450B. With the rearward motion of the projectile 450B and its channels 457, the projections 413 slide along the channels 457 with relative motion towards the leading ends 481 of the channels 457. The engagement of the channels 457 and the sabot projections 413 thus restricts rotation between the sabot 403 and the projectile 450B while permitting axial motion between the sabot 403 and the projectile 450B. The illustrated coupling between the projectile 450B and the sabot 403 comprises an example embodiment of a keyed joint. As the projectile 450B moves rearward within the sabot 403, the member 452 plunges into the projectile 450B. A drive of the projectile 450B converts the plunging movement of the member 452 into rotation of a rotor mounted within the projectile 450B for gyroscopic stabilization of the projectile 450B. FIGS. 14A and 14B (discussed below, inter alia) illustrate example internal features of the projectile 450B, including the drive and the rotor, respectively denoted with reference numbers 1410 and 1275.

Figure 4D:
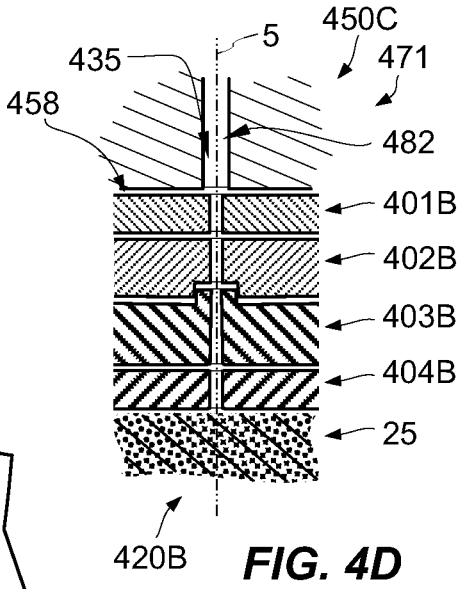
Figure 4E:
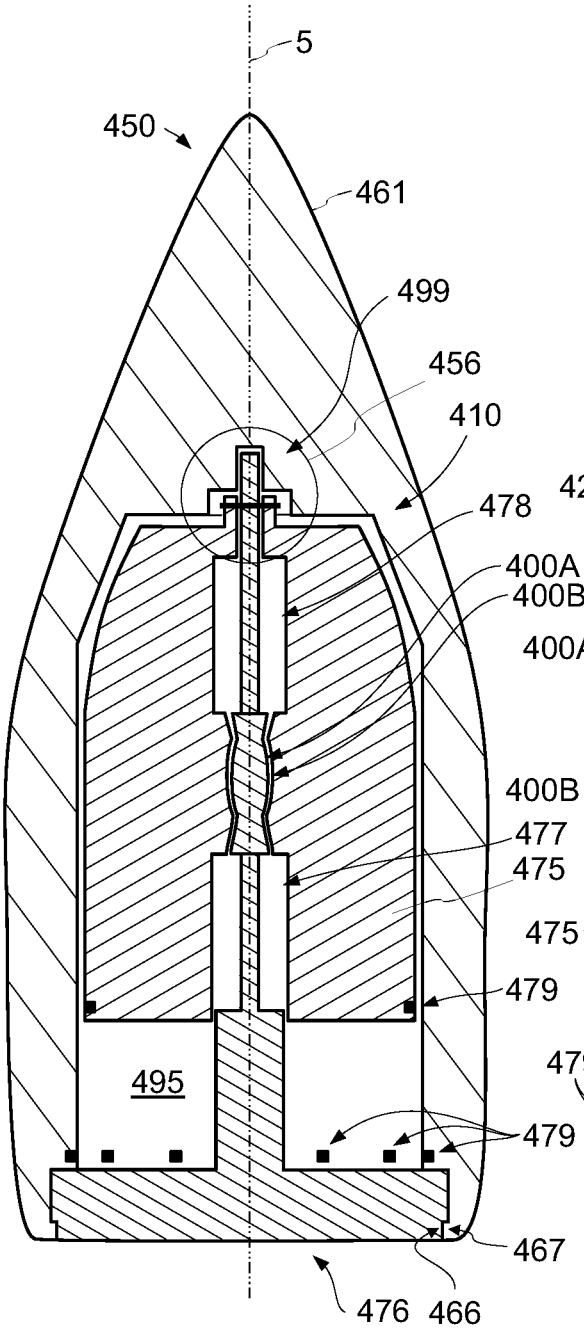
Figure 4F:
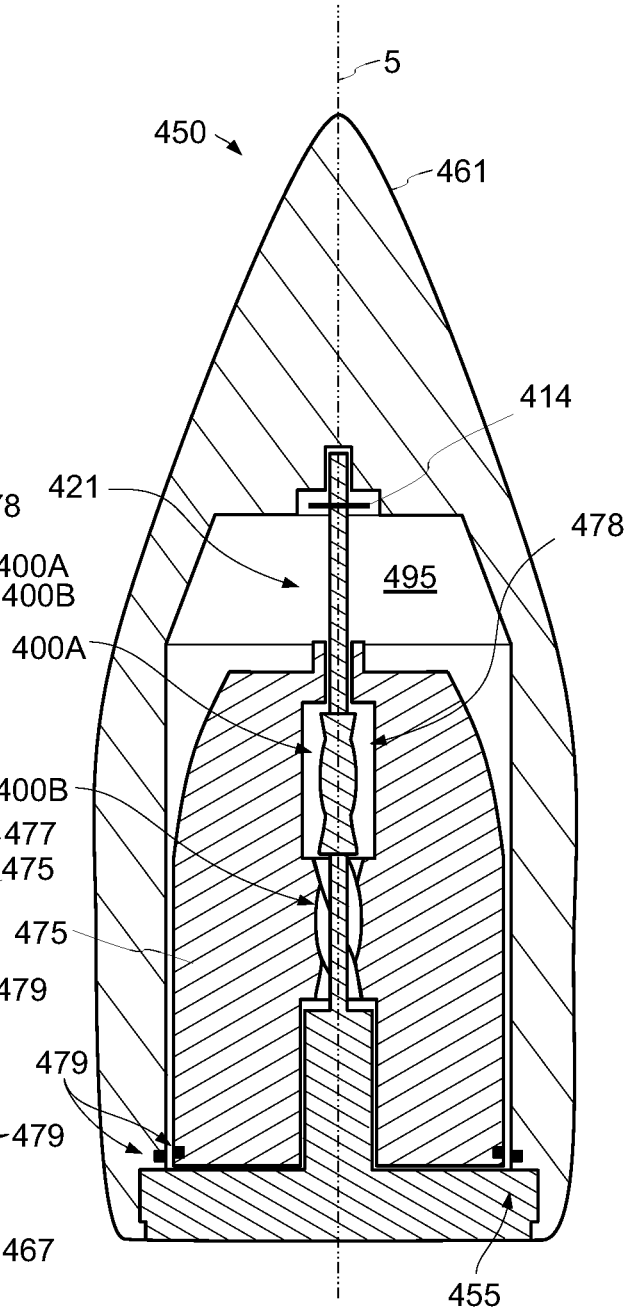

Turning now to FIG. 4D, this figure illustrates a detail view of a central portion of an example cartridge 420B, in cross section with the cutting plane of the view including an axis 5 of the cartridge 420B. The cartridge 420B corresponds to the cartridge 420 that FIG. 4B illustrates, with the cartridge 420 and the cartridge 420B comprising corresponding configurations. The cartridge 420B of FIG. 4D comprises an example projectile 450C seated in an example sabot 403B centered on the axis 5. The cartridge 420B further comprises a case 420 housing the projectile 450C and the sabot 403, with the case 420 outside the view of FIG. 4D but illustrated by FIG. 4A. The detail view of FIG. 4D includes an illustration of a rear central portion 471 of the projectile 450C, which is further illustrated by FIGS. 19A and 19B (discussed below).

Figure 19A:
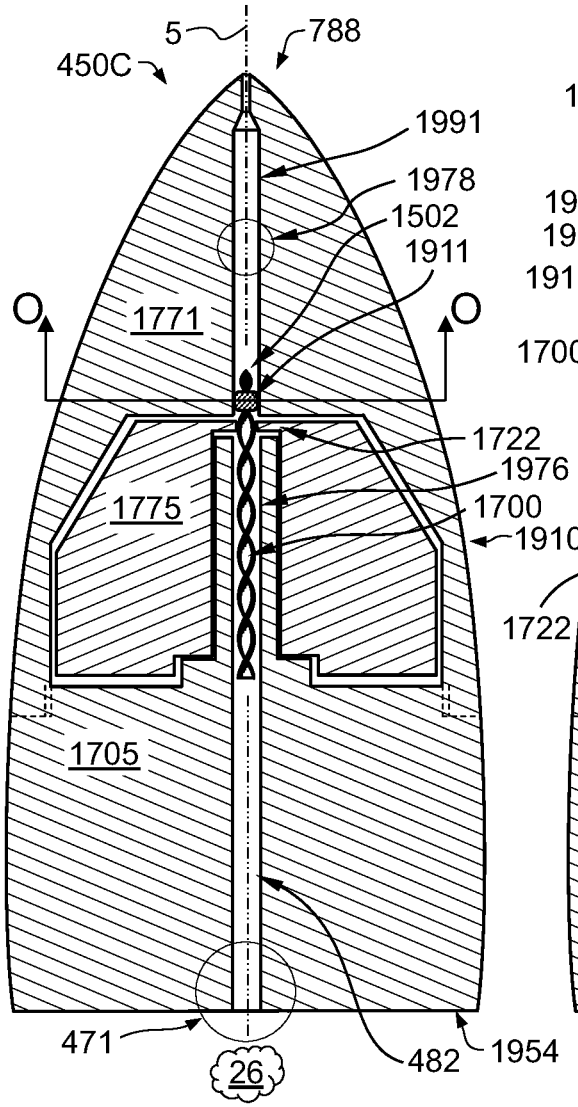
FIGS. 19A, 19B, 19C, and 19D, collectively
Figure 19B:
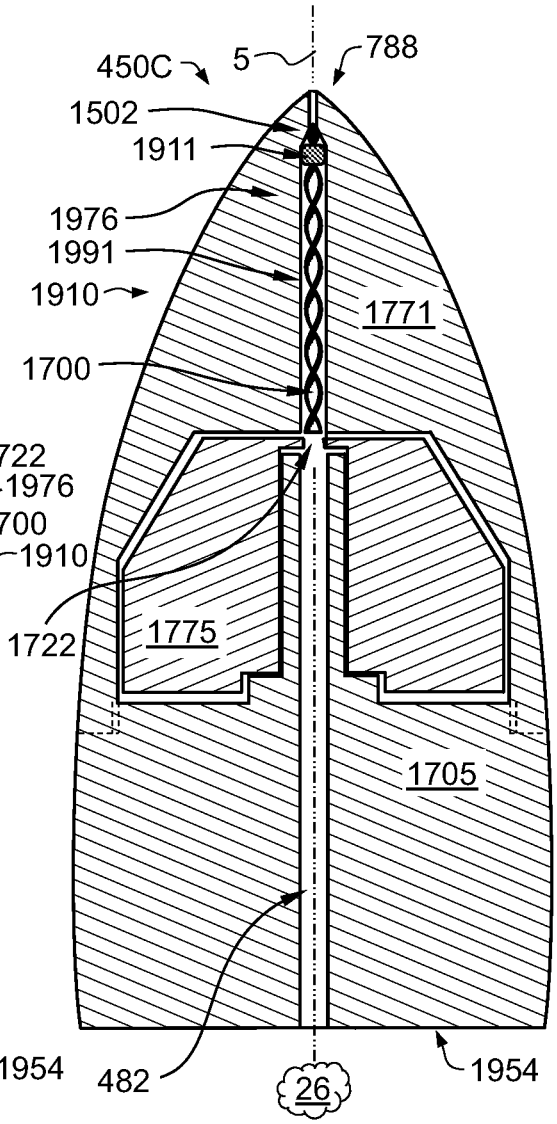

As illustrated in FIG. 4D, the projectile 450C is disposed on an elastomeric disk 401B, that is disposed on a rigid disk 402B, that is disposed on the sabot 403B, that is disposed on a gas seal 404B, that is disposed adjacent solid powder 25. The projectile 450C, the elastomeric disk 401B, the rigid disk 402B, the sabot 403B, the gas seal 404B, and the solid powder 25 respectively correspond to the projectile 450, the elastomeric disk 401, the rigid disk 402, the sabot 403, and the gas seal 404, and the solid propellant 25 that FIG. 4B illustrates as discussed above. As a distinction, each of the elastomeric disk 401B, the rigid disk 402B, the sabot 403B, and the gas seal 404B comprises a respective hole aligned with the axis 5 to form a channel 435. The channel 435 provides a path for expanding propellant gas 26, which combustion of the solid propellant 25 produces, to flow to the projectile 450C. (FIG. 1I illustrates an example embodiment of expanding propellant gas 26.) The projectile 450C comprises a rear gas channel 482 that is aligned with the channel 435 to receive the expanding propellant gas 26 from the channel 435. As illustrated in FIGS. 19A and 19B and discussed below, the projectile 450C comprises a drive 1910 that uses the expanding propellant gas 26 to rotate a rotor 1775 for gyroscopic stabilization of the projectile 450C.

In some example embodiments, sheets of gasket material (not illustrated) having holes aligned with the channel 435 can be inserted for promoting confinement of the expanding propellant gas 26 to the channel 435. For example, a sheet can be inserted between the gas seal 404B and the sabot 403B, another sheet between the sabot 403 and the rigid disk 402B, another sheet between the rigid disk 402B and the elastomeric disk 401B, and another sheet between the elastomeric disk 401B and the projectile 450C. In some example embodiments, a coating of gasket material can be applied in place of the sheets. In some example embodiments, the elastomeric disk 401B, the rigid disk 402B, the sabot 403B, and the gas seal 404B can be fused together. In some example embodiments, the elastomeric disk 401B and the rigid disk 402B can be eliminated, and the gas seal 404B can be combined with the sabot 403B. In some example embodiments, a filter can added to filter out particulate material from flowing into the rear gas channel 482 of the projectile 450C. In some example embodiments, such a filter comprises a sintered metal filter. In some example embodiments, the cartridge 420B can be formed by drilling a hole through the elastomeric disk 401, the rigid disk 402, the sabot 403, and the gas seal 404 of the cartridge 420 illustrated in FIG. 4B and discussed above, and replacing the projectile 450 with the projectile 450C.

Figure 4G:
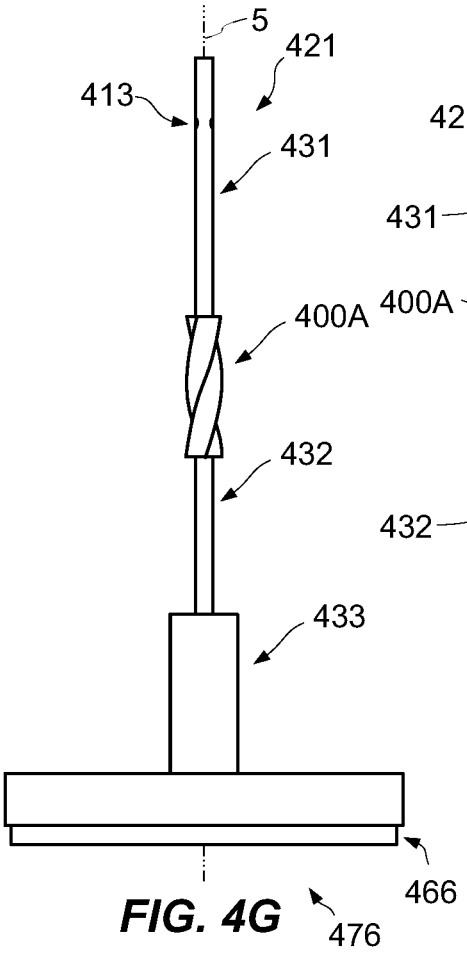
Figure 4H:
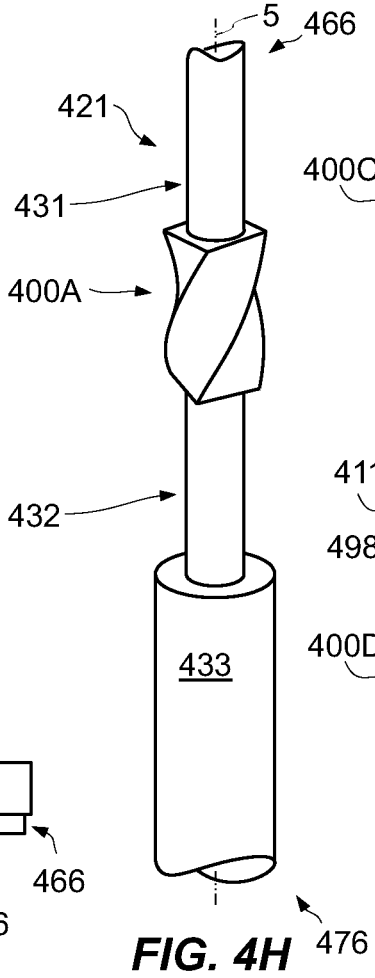
Figure 4I:
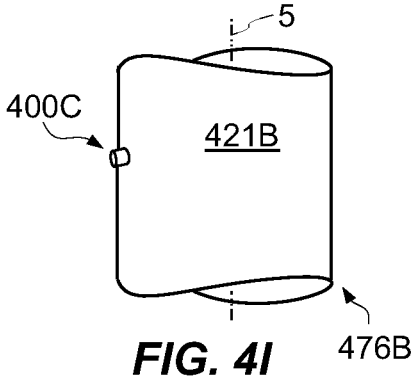
Figure 4J:
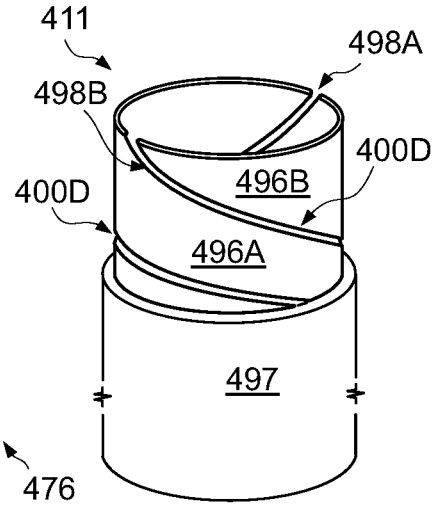
Figure 4L:
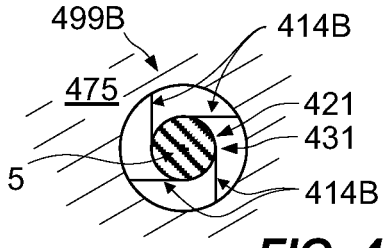
Figure 4M:
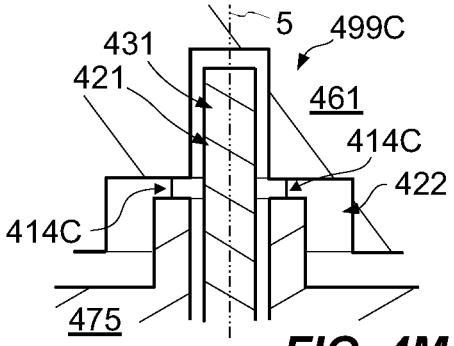
Figure 4K:
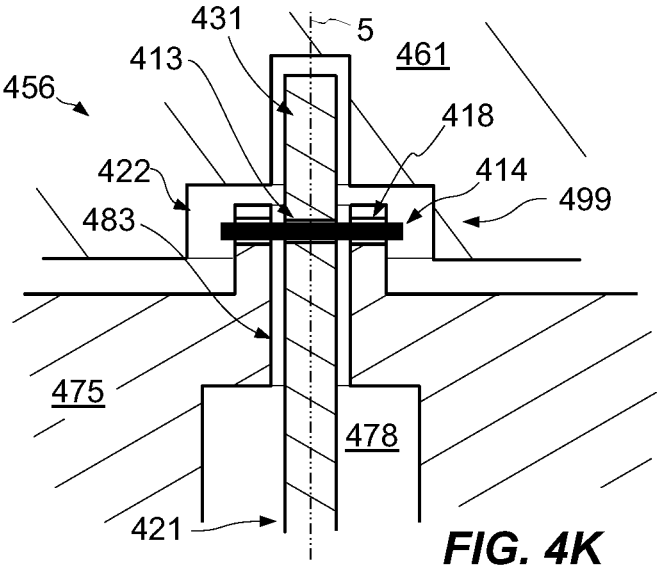

Referring now to FIGS. 4E, 4F, 4G, 4H, and 4K, an example embodiment of the projectile 450, which FIG. 4B illustrates as packaged in a cartridge 420, will be further discussed. FIGS. 4E and 4F are cross sectional illustrations of the example projectile 450 with an axis 5 of the projectile 450 in the cutting plane of the view, respectively illustrating two example modes according to some embodiments. FIGS. 4G and 4H illustrate an example trailing member 476 that the projectile 450 comprises. FIG. 4K illustrates a detail cross sectional view of an example portion 456 of the projectile 450.

In the illustrated example embodiment of FIGS. 4E, 4F, 4G, 4H, and 4K, the projectile 450 comprises a drive 410 that rotates a rotor 475 as inertial force 85 (see FIG. 1I for an illustration of an example embodiment) moves the rotor 475 rearward during projectile launch. The inertial force 85 can, for example, result from acceleration 4 (see FIG. 1I for an illustration of an example embodiment) of the projectile 450 occurring as the projectile 450 accelerates through the barrel 35 of the shotgun 451.

Example embodiments of the drive 410 can be incorporated in projectiles of guns, smoothbore guns, firearms, smoothbore firearms, light firearms, smoothbore light firearms, crew-served firearms, smoothbore crew-served firearms, light-gas guns, air guns, smoothbore air guns, railguns, or archery devices, including the disclosed examples thereof (not an exhaustive list). Example embodiments of the drive 410 can further be incorporated in other aeronautical systems, including in the disclosed examples of aeronautical systems FIG. 4E illustrates the rotor 475 in an example forward position, such as when the cartridge 420 is loaded in the shotgun 451 before firing the shotgun 451. FIG. 4F illustrates the rotor 475 in an example rear position, such as once the shotgun 451 has fired and the projectile 450 is accelerating or has accelerated down the barrel 35 of the shotgun 451. The projectile 450 comprises an example embodiment of a mechanism.

As illustrated in FIGS. 4E and 4F, the rotor 475 is disposed in a cavity 495 formed by a leading member 461 and the trailing member 476. In operation, the rotor 475 moves in the cavity 495 from the forward position of FIG. 4E to the rearward position of FIG. 4F. In assembly, the leading member 461 receives the trailing member 476 in the cavity 495 and comprises a lip 467 that projects inward to retain the trailing member 476. Assembly can comprise pressing the trailing member 476 into the cavity 495 until the lip 467 snaps into an indentation 466 of the trailing member 475, for example using an arbor press (not illustrated). Once pressed together, the trailing member 476 and the leading member 461 can be locked together in a manner that avoids any unwanted rotation of the trailing member 476 relative to the leading member 461. In some embodiments, the trailing member 476 and the leading member 461 are pinned together, keyed, spot-welded, or otherwise appropriately fastened to one another.

As illustrated, the trailing member 476 comprises a bar 421 that extends through the rotor 475 and comprises an axle for the rotating rotor 475. In the illustrated embodiment, the bar 421 comprises a first cylindrical member 431, a helix 400A rearward of the first cylindrical member 431, a second cylindrical member 432 rearward of the helix 400A, and a third cylindrical member 433 rearward of the second cylindrical member 432 and rearward of the helix 400A. The rotor 475 and the locked-together leading and trailing members 461, 476, which includes the extending bar 421, comprise an example embodiment of a helical pair.

In the illustrated example, the third cylindrical member 433 is diametrically larger than the helix 400A, is diametrically larger than the first cylindrical member 431, and is diametrically larger than the second cylindrical member 432. In the illustrated example, the first cylindrical member 431 and the second member 432 are of like diameters and are diametrically smaller than the helix 400A.

The illustrated example rotor 475 comprises a first aperture section 483, a second aperture section 478, a helix 400B, and a third aperture section 477. As illustrated, the first aperture section 483 diametrically corresponds to the first cylindrical member 431 of the bar 421 of the trailing member 476. In operation, the first cylindrical member 431 functions as an axle with respect to the first aperture section 483 of the rotor 475.

The second aperture section 478 of the rotor 475 is diametrically larger than the helix 400A of the trailing member's bar 421 to provide annular clearance for unimpeded rotation of the rotor 475 with the helix 400A in the rearward position of FIG. 4F. The helix 400B of the rotor engages with the helix 400A of the bar 421 to produce rotation of the rotor 475 as the rotor 475 move rearward. The third aperture section 477 of the rotor 475 diametrically corresponds to the third cylindrical member 433 of the trailing member 476. In operation, the third cylindrical member 433 of the bar 421 of the trailing member 476 functions as an axle with respect to the third aperture section 477 of the rotor 475.

In some example embodiments, other dimensions and geometries can be utilized. For instance, in some example embodiments, the second cylindrical member 432 and the third cylindrical member 433 of the trailing member 476 can have the same diameter, so the second cylindrical member 432 may continue rearward where the third cylindrical member 433 is illustrated. In such an embodiment, a bushing and/or bearing (not illustrated) can be inserted in the third aperture section 477 of the rotor 475 to provide an inner diameter corresponding to the reduced diameter of the third cylindrical member 433 and to provide an axle for rotation of the rotor 475. Insertion of such a bushing or bearing during projectile assembly can further facilitate assembly of the projectile 450 in this configuration. More generally, assembly of the bar 421 into the rotor 475 in various geometries can, for example, be facilitated by providing the rotor 475 as two or more parts and/or the bar 421 of the trailing member 476 as two or more parts that are joined during assembly.

The projectile 450 further comprises an example retainer 455 comprising magnets 479 that retain the rotor 475 in the rearward position illustrated by FIG. 4F between the time the projectile 450 exits the muzzle 6 of the shotgun 451 and the time that the projectile 450 arrives at a target or other destination. For example, the magnets 479 can retain the rotor 475 against forward inertial force associated with deceleration of the projectile 450 due to air resistance or drag.

In some other example embodiments, the retainer 455 can comprise a shoulder (see FIG. 1, example element 110), a clip (see FIG. 2C, example element 291), suction (see FIG. 3B, example element 399 and FIG. 16C, example element 399), an interface (see FIG. 5B, example element 591), a spring (see FIG. 6B, example element 617), a wedge (see FIG. 7B, example element 799, FIG. 8B, example element 899, and FIG. 19B, example element 1502), a plug-and-socket connection (see FIG. 15B, example elements 1501 and 1502, and FIG. 18B, example elements 1501, 1502), an interfering ring or stop (see FIG. 17B, example element 1714), or other embodiment disclosed herein (not an exhaustive list).

Some example embodiments of retainers for retaining the rotor 475 of the projectile 450 in the forward position of FIG. 4E will now be discussed. FIGS. 4K, 4L, and 4M illustrate three example retainer embodiments, respectively retainer 499, retainer 499B, and retainer 499C, for retaining the rotor 475 in the forward position of FIG. 4E prior to launch, for example during routine handling and loading of the shotgun 451. Each of the illustrated example retainers 499, 499B, and 499C comprises an example of a conditional-release retainer that prevents the drive 410 of the projectile 450 from operating until a predetermined condition occurs. The predetermined condition can, for example, comprise the rotor 475 experiencing a threshold level of inertial force 85 directed rearward. As illustrated, in each of the retainers 499, 499B, and 499C, an example conditional release comprises a member that extends between the rotor 475 and another part of the projectile 450, wherein the member retains the rotor 475 in place and releases the rotor 475 when the inertial force 85 reaches the threshold. In some example embodiments, the member can release responsive to a threshold level of mechanical stress, shear load, tensile load, a combination of tensile and shear load, shock, concussion, heat, chemical reaction, or oxidation (some representative examples, not an exhaustive list). In some example embodiments, the member can comprise soft metal or nonmetal material, malleable metal or nonmetal material, brittle metal or nonmetal, spring metal or nonmetal, elastic material, or frangible metal or nonmetal (some representative examples, not an exhaustive list). In some example embodiments, the member comprises a material that returns to its original shape after being deformed by an external force, for example a spring. In some embodiments, the member releases when a predetermined tensile load causes failure. In some embodiments, the member releases responsive to a predetermined shear load. In some example embodiments, the member is frangible. In the example retainer 499 of FIG. 4K, the member comprises a shear pin. In the example retainer of 499B of FIG. 4L and the example retainer of 499C of FIG. 4M, the member comprises a pin or a wire 414B, 414C that is largely under tensile load and that may be under a combination of shear and tensile loading.

Referring now to FIG. 4K, in the illustrated example embodiment, the example shear pin 414 extends through an aperture 413 in the first cylindrical member 431 of the bar 421 of the trailing member 476. In some example embodiments, the shear pin 414 can be soldered, brazed, or pressed in place in the aperture 413. The shear pin 414 further extends through an aperture 418 in the rotor 475 at the first aperture section 483 of the rotor 475. In the illustrated example, the shear pin 414, the aperture 413, and the aperture 418 are in an example orientation of perpendicular to the axis 5. Other orientations may be utilized as may be deemed appropriate for some applications. The leading member 461 comprises an opening 422 that accommodates the shear pin 414.

When the projectile 450 accelerates and the inertial force 85 reaches a threshold level, the shear pin 415 deforms and releases the rotor 475. In some example embodiments, the threshold level can be in a range of 0.25 to 10 percent of the inertial force 85 (a representative, non-limiting range that is among others the written description supports). In some example embodiments, the threshold level can be in a range of 1 to 50 newtons of force (a representative, non-limiting range that is among others the written description supports).

As the rotor 475 rotates and moves rearward, the shear pin 475 bends and separates from the aperture 418 in the first aperture section 483 of the rotor 475. As illustrated in FIG. 4F, in the illustrated example, after the rotor 475 moves sufficiently rearward, the shear pin 415 remains in the aperture 413 in the first cylindrical member 431 of the bar 421. In some example embodiments, the shear pin 414 comprises spring steel or other elastic material and returns to its original shape once the rotor 475 has moved rearward as illustrated in FIG. 4F. In some example embodiments, the shear pin 414 comprises copper or lead that permanently deforms. In some example embodiments, one or more shear pins (not illustrated) extend between the rotor 475 and the leading member 461.

In some example embodiments, one or both of the apertures 413, 418 comprises one or more holes. In some example embodiments, one or both of the apertures 413, 418 comprises one or more slots or grooves. In some example embodiments, one or both of the apertures 413, 418 comprises one or more channels.

In some example embodiments, the shear pin 414 is attached to brazed or soldered in the aperture 413 and in the apertures 418. The attachments can be sufficiently robust that the shear pin 414 fails and breaks between the attachments points when subjected to a threshold level of stress. In some such embodiments, the shear pin 414 can be made relatively thin or may comprise a wire, which can be flexible, rigid, or brittle.

Referring now to FIG. 4L, this figure illustrates a detail view of a portion of an embodiment of the projectile 450 corresponding to the portion 456 that FIG. 4K illustrates. FIG. 4L illustrates a cross sectional view in which the cutting plane is perpendicular to the axis 5 of the projectile 450. Thus, the view of FIG. 4L is perpendicular to the view of FIG. 4K. In FIG. 4L, the retainer 499B is incorporated rather than the retainer 499 that FIG. 4K illustrates.

In the illustrated embodiment of FIG. 4L, the example retainer 499B comprises four wires 414B that extend radially from the first cylindrical member 431 of the bar 421 of the projectile 450 to the rotor 475 of the projectile 450. Each wire 414B is firmly attached at one end to the first cylindrical member 431 and at the other end to the rotor 475, for example via soldering, brazing, or welding. In operation, inertial force 85 drives the rotor 475 to move rearward and rotate, while the wires 414B restrain the rotor 475 by resisting the rearward and rotational motion. When the tensile load reaches a threshold level, the wires 414B fail and release the rotor 475. Thus, under inertial force 85, the rotor 475 can pull on the wires 414B or stretch the wires 414B, thereby subjecting the wires 414B to tensile stress. When the tensile stress exceeds the ultimate tensile strength of the wires 414B, the wires 414B break and release the rotor 475. In some example embodiments, the wires 414B comprise pins. In some example embodiments, the wires 414B comprise rods, for example in large artillery applications. In some example embodiments, the wires 414B are stiff and may be subjected to a combination of shear load and tensile load. In some embodiments, the wires 414B comprise a central section of reduced thickness, for example a tapered segment, that is designed as a failure point.

Referring now to FIG. 4M, this figure illustrates a detail view of a portion of an embodiment of the projectile 450 corresponding to the portion 456 that FIG. 4K illustrates. FIG. 4M illustrates a cross sectional view in which the axis 5 is in the cutting plane is perpendicular to the axis 5 of the projectile. The view of FIG. 4M corresponds to the view of FIG. 4K. In FIG. 4M, the retainer 499C is incorporated rather than the retainer 499 that FIG. 4K illustrates.

In the illustrated embodiment of FIG. 4M, the example retainer 499C comprises two wires 414C that extend longitudinally from the leading member 461 of the projectile 450 to the rotor 475 of the projectile 450. Each wire 414C is firmly attached at one end to the leading member 461 and at the other end to the rotor 475, for example via soldering, brazing, or welding. In operation, inertial force 85 drives the rotor 475 to move rearward and rotate, while the wires 414C restrain the rotor 475 by resisting the rearward and rotational motion. When the tensile load reaches a threshold level, the wires 414C fail and release the rotor 475. Thus, under inertial force 85, the rotor 475 can pull on the wires 414C or stretch the wires 414C, thereby subjecting the wires 414C to tensile stress. When the tensile stress exceeds the ultimate tensile strength of the wires 414C, the wires 414C break and release the rotor 475. In some example embodiments, the wires 414C comprise pins. In some example embodiments, the wires 414C comprise rods, for example in some artillery applications. In some example embodiments, the wires 414C are stiff and may be subjected to a combination of shear load and tensile load. In some embodiments, the wires 414C comprise a central section of reduced thickness, for example a tapered segment, that is designed as a failure point.

In some other example embodiments, the retainer 499 can comprise a magnet (see FIG. 1K, example element 175 and FIG. 3A, example element 379), an elastomeric band and/or friction (see FIG. 2A, example element 279), a serrated interface (see FIG. 5D), a spring (see FIG. 6A, example element 617), a breakable filament connection (see FIG. 7A, example element 791), a jammed-against shoulder and/or elastic deformation (see FIGS. 11A and 11B, example element 1159), a threaded connection (see FIG. 23A, example elements 2361, 2362), or other embodiment disclosed herein (not an exhaustive list).

Referring now to FIGS. 4E and 4F, once the retainer 499 of FIG. 4K (or the retainer 499B of FIG. 4L or the retainer 499C of FIG. 4M) releases the rotor 475, inertial force 85 moves the rotor 475 rearward along a path of the axis 5. The drive 410 converts the rotor's axial movement into rotation of the rotor 475. The drive 410 comprises an example embodiment of an inertial drive. In the illustrated embodiment of FIG. 4, the rotor 475 moves linearly rearward. In some example embodiments, the rotor 475 can move rearward along a path that is curved or otherwise deviates from a straight line.

As may be best seen in FIG. 4H, in the illustrated example, the helix 400A comprises a helical form that is square in cross section perpendicular to the axis 5, with the square spiraling about the axis 5. In some example embodiments, the helix 400A can be fabricated by mechanically twisting square bar stock or key stock that has a square cross section. In some example embodiments, the helix 400A can be formed via CNC machining.

As illustrated in FIGS. 4E and 4F, the helix 400A and the helix 400B comprise complementary geometrical forms, so they engage with one another. That is, the helix 400B can correspond in form to the helix 400A. In the illustrated example, the helices 400A, 400B comprise an example embodiment of a multi-start configuration. As the rotor 475 move rearward, the helical engagement between the helices 400A and 400B produces rotation of the rotor 475. Once the rotor 475 moves sufficiently rearward, the helices 400A and 400B disengage and the rotor 475 spins freely with the helix 400B disposed adjacent the second cylindrical member 432 of the trailing member 476.

In some example embodiments, the projectile 450 comprises one or more thrust bearings that support an axial load of the rotor 475 and provide a low-friction interface for spinning of the rotor 475. Example embodiments of suitable thrust bearings are discussed herein with reference to various other figures. Some example embodiments of the projectile 450 can incorporate bearings disposed at adjoining surfaces subject to relative movement and load. Bearings can, for example, be disposed where contact between the rotor 475 and other portions of the projectile 450 occurs or could occur without bearings. The written description, including the figures and accompanying textual discussion, describes suitable bearing embodiments in detail with accompanying detailed teaching for implementation and practice. In some example embodiments, such bearings can comprise one or more aero spiral groove bearings that may, in some embodiments, be supported by one or more associated gas channels and/or one or more associated cavities from which gas may be drawn. In some example embodiments, such bearings can comprise one or more aerostatic bearings. In some example embodiments, the aerostatic bearings comprise one or more channels that direct expanding propellant gas 26 between the adjoining surfaces to provide a layer of pressured gas that provides a low-friction, load-bearing interface.

Turning now to FIGS. 4I and 4J, some more embodiments of the drive 10 will be discussed. FIG. 4I illustrates an example section of a bar 421B of an alternative trailing member 476B of the projectile 450, where the bar 421B of the trailing member 476B corresponds to the bar 421 of the trailing member 476 illustrated in FIGS. 4G and 4H as discussed above. The bar 421B comprises two cylindrical projections 400C that correspond to the helix 400A that FIG. 4H illustrates. One of the two cylindrical projections 400C is visible in the view, and the other cylindrical projection 400C is diametrically opposite the visible one and thus hidden in the view.

FIG. 4J illustrates a helical insert 411 comprising a helix 400D that corresponds to the helix 400B that FIGS. 4E and 4F illustrate as discussed above. In the illustrated example of FIG. 4J, the helical insert 411 comprises two spiraling channels 498A, 498B that form the helix 400D. In example embodiments, the helix 400D can have a constant helical rate or a helical rate that progressively tightens. As illustrated, the helical insert 411 comprises two members 496A, 496B that are separated by the spiraling channels 498A, 498B. As illustrated, the helical insert 411 further comprises a cylindrical shell 497 that circumscribes a lower portion of the two elements 496A, 496B and is attached to the two elements 496A, 496B, thereby supporting them in their relative positions. While FIG. 4J illustrates the members 496A, 496B protruding from the cylindrical shell 497, in some example embodiments, the cylindrical shell 497 fully encases the members 496A, 496B circumferentially.

The helical insert 411 and the trailing member 476B comprise an example embodiment of a helical pair. The rotor 475 of the projectile 450 can be outfitted with the helical insert 411 by replacing the helix 400B with a bore having an internal diameter corresponding to the outer diameter of the helical insert 411. The helical insert 411 can be inserted or pressed into the bore and attached via welding, brazing, press fit, or other suitable attachment process. In some example embodiments, the helical insert 411 can be made of steel, bearing brass, or another material having mechanical properties suited to driving rotation or to fabrication, while the material into which the helical insert 411 is inserted can have mechanical properties selected for density, cost, or another factor, for instance lead, tungsten, aluminum, or copper. Once inserted and attached, the helical insert 411 provides the rotor 475 with the helix 400D. So outfitted with the helix 400D, the rotor 475 can be positioned so that the bar 421B of the trailing member 476B of FIG. 4I extends through the helical insert 411. The cylindrical projections 400C of the bar 421 can respectively extend into the channels 498A, 498B of the helical insert 411, so the cylindrical projections 400C and the helix 400D are in helical engagement. The trailing member 476B and the combined helical insert 411 and rotor 475 comprise an example embodiment of a helical pair.

FIGS. 4I and 4J illustrate an example embodiment of a two-start configuration. When inertial force 85 drives the rotor 475 rearward, the cylindrical projections 400C can progress through the channels 498A, 498B to produce rotation of the rotor 475.

Figure 5D:
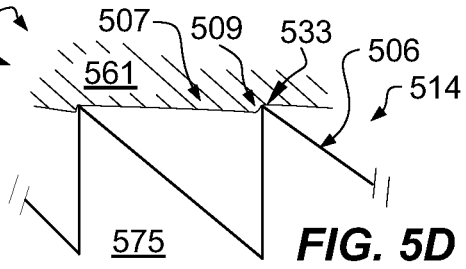
FIGS. 5A, 5B, 5C, and 5D, collectively
Figure 5C:
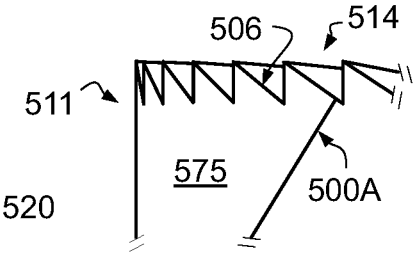
Figure 5A:
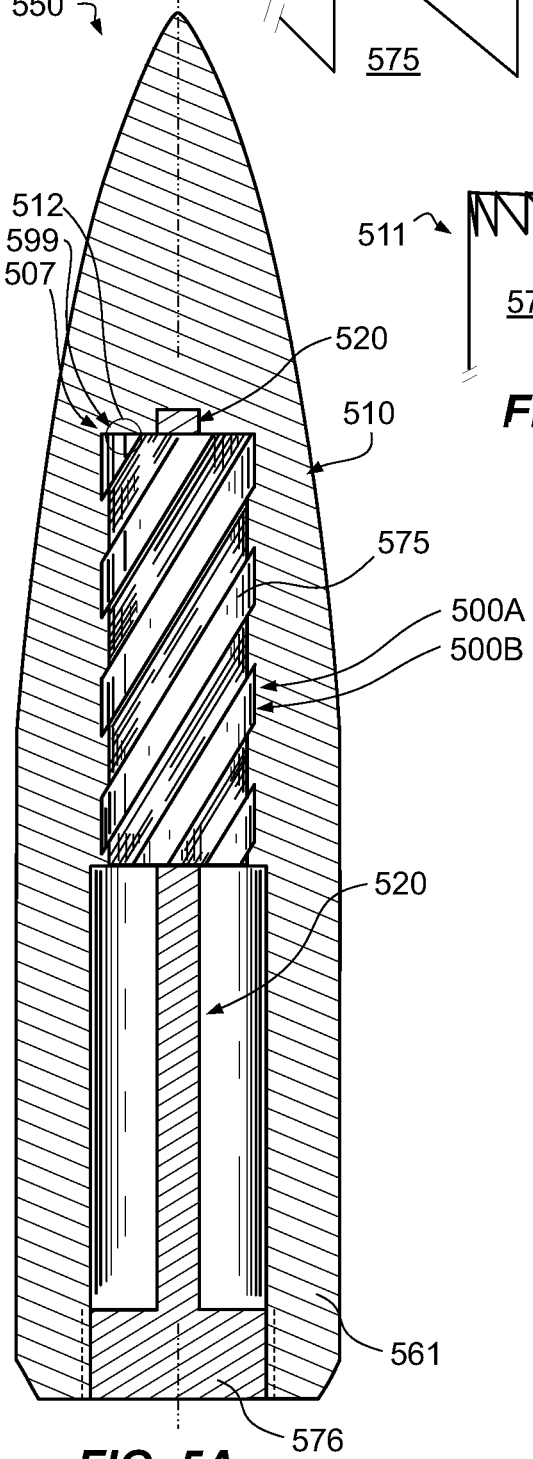
Figure 5B:
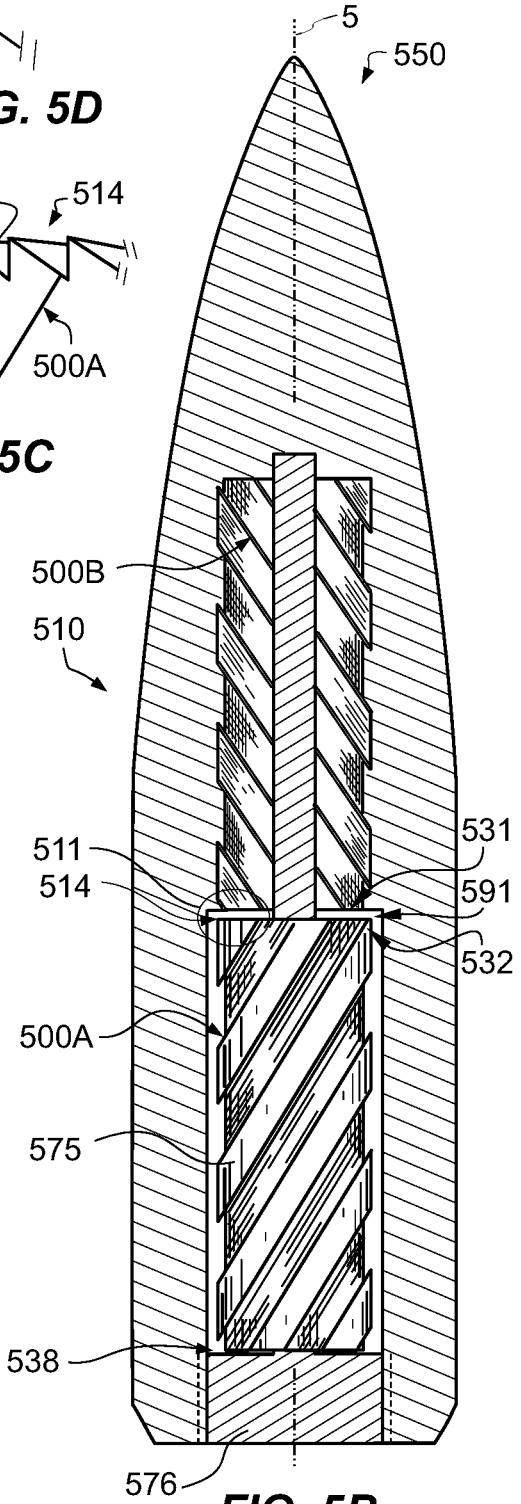

Turning now to FIGS. 5A, 5B, 5C, and 5D, some example embodiments will be discussed with reference to these figures, which illustrate an example projectile 550 according to some embodiments of the disclosure. FIG. 5A illustrates the projectile 550 in an example mode in which a rotor 575 of the projectile 550 is in a forward position within the projectile 550. FIG. 5B illustrates the projectile 550 in an example mode in which a rotor 575 of the projectile 550 is in a rear position within the projectile 550. FIG. 5C illustrates a detail view of a portion 511 of the rotor 575. FIG. 5D illustrates a detail view of a portion 512 of the projectile 550 that comprises a retainer 599.

Some example embodiments of the projectile 550 can comprise a gun projectile, a smoothbore gun projectile, a firearm projectile, a smoothbore firearm projectile, a light firearm projectile, a smoothbore light firearm projectile, a crew-served firearm projectile, a smoothbore crew-served firearm projectile, a light-gas gun projectile, an air gun projectile, a smoothbore air gun projectile, a railgun projectile, or an archery device projectile (not an exhaustive list).

As illustrated, the example projectile 550 comprises a leading member 561 and a trailing member 576 that form an enclosure in which the rotor 575 is disposed. As illustrated, the trailing member 576 comprises a bar 520 that extends lengthwise along an axis 5 of the projectile 550 and through the rotor 575. The example bar 520 comprises an axle for rotation of the rotor 575. The projectile 550 comprises an example embodiment of a mechanism.

In the example mode illustrated by FIG. 5A, the rotor 575 is positioned forward, for instance prior to launching through a gun such as the gun 50 illustrated in FIG. 1A or a piece of artillery. In the illustrated example position of FIG. 5A, respective helices 500A, 500B of the rotor 575 and the leading member 561 are engaged with one another. As illustrated, the helices 500A, 500B comprise a drive 510 that rotates the rotor 575. Acceleration 4 during launch creates inertial force 85 (see FIG. 1I for illustrations of example embodiments) that forces the rotor 575 rearward. As the rotor 575 moves rearward, the drive 510 rotates the rotor 575 to produce angular momentum for gyroscopically stabilizing the projectile 550. The drive 510 comprises an example embodiment of an inertial drive. The rotor 575 and the leading member 561 comprise an example embodiment of a helical pair. The rotor 575 and the combined leading member 561 and trailing member 576 comprise an example embodiment of a helical pair.

Example embodiments of the drive 510 can be incorporated in projectiles of guns, smoothbore guns, firearms, smoothbore firearms, light firearms, smoothbore light firearms, crew-served firearms, smoothbore crew-served firearms, light-gas guns, air guns, smoothbore air guns, railguns, or archery devices, including the disclosed examples thereof (not an exhaustive list). Example embodiments of the drive 510 can further be incorporated in other aeronautical systems, including in the disclosed examples of aeronautical systems.

As illustrated in FIGS. 5C and 5D, the projectile 550 comprises a retainer 599 that retains the rotor 575 in the forward position and releases the rotor 575 responsive to a launch event. The example retainer 599 comprises a conditional-release retainer that prevents the drive 510 of the projectile 550 from operating until a predetermined condition occurs. In the illustrated example embodiment, the retainer 599 comprises serrations 506 formed in the leading face 514 of the rotor 575. In the illustrated example embodiment, the serrations 506 radiate outward from the axis 5. As illustrated in FIG. 5D, the serrations 506 bite into an adjoining face 507 of the leading member 561 of the projectile 550 to retain the rotor 575 in the forward position of FIG. 5A.

In assembly, the rotor 575 can be positioned inside the leading member 561 with the helix 500A of the rotor 575 engaging with the helix 500B of the leading member 561. Using a spanner (not illustrated) or other appropriate tool, an assembler can screw the rotor 575 forward until the rotor's leading face 514 contacts the face 507 of the projectile's leading member 561. The assembler can then apply a predetermined amount of torque to the rotor 575 so the rotor face 507 advances. As the rotor face 507 advances, each serration 506 forms a bite 509 in the adjoining face 507 of the projectile's leading member 561. In some example embodiments, the serrations 506 can have a harder composition than the adjoining face 507 of the leading member 561. For example, the rotor serrations 506 can comprise carbon steel or tungsten carbide while the leading member's adjoining face 507 comprises lead or copper. In some example embodiments, the leading member 561 is coated with a relatively soft material. In some example embodiments, the leading member 561 and the rotor 575 have a common material composition, and the rotor serrations 506 may be work hardened or tempered while the rotor 575 is annealed. In some example embodiments, the serrations 506 are formed in the face 507 of the leading member 571.

At launch, responsive to the projectile 550 experiencing a level of acceleration 4, the rotor 575 experiences a level of inertial force 85 (see FIG. 1I for an illustration of an example embodiment). When the projectile acceleration 4 exceeds a threshold, the rotor inertial force 85 exceeds a threshold, the bite 509 releases, and the retainer 599 releases the rotor 575 to move rearward and rotate. Release of the bite 509 can, for example, comprise deformation and/or breaking of the tips 533 of the serrations 506, yielding, ultimate failure, elastic deformation, and/or gouging of the surface 507 of the leading member 561.

In some other example embodiments, the retainer 599 can comprise a magnet (see FIG. 1K, example element 175 and FIG. 3A, example element 379), an elastomeric band and/or friction (see FIG. 2A, example element 279), a shear pin (see FIG. 4K, example element 414), a pin or wire under tension (see FIG. 4L, example element 414B, FIG. 4M, example element 414C, and FIG. 18A, example element 791), a breakable filament connection (see FIG. 7A, example element 791), a jammed-against shoulder and/or elastic deformation (see FIGS. 11A and 11B, example element 1159), a threaded connection (see FIG. 23A, example elements 2361, 2362), or other embodiment disclosed herein (not an exhaustive list).

In the illustrated embodiment of FIG. 5, the projectile comprises another retainer 591 for retaining the rotor 575 in the rear position that FIG. 5B illustrates. As illustrated, the retainer 591 comprises the trailing end 531 of the helix 500B and the leading end 532 of the helix 500A. Once the rotor 575 moves rearward to the position of FIG. 5B, the helices 500A, 500B are disengaged, and the rotor 575 is rotating in a direction opposite from the rotational direction that would advance the rotor 575 into the leading member. Accordingly, the helices 500A, 500B can keep the rotor 575 in the rear position. In some example embodiments, the projectile 550 can comprise another embodiment of a retainer disclosed herein for maintaining the rotor 575 in the rear position, for example an embodiment illustrated in the figures and/or described textually. In some such embodiments, the retainer 591 can comprise a shoulder (see FIG. 1, example element 110), a clip (see FIG. 2C, example element 291), a magnet (see FIG. 3B, example element 379 and FIG. 4F, example element 479), suction (see FIG. 3B, example element 399 and FIG. 16C, example element 399), a spring (see FIG. 6B, example element 617), a wedge (see FIG. 7B, example element 799, FIG. 8B, example element 899, and FIG. 19B, example element 1502), a plug-and-socket connection (see FIG. 15B, example elements 1501 and 1502, and FIG. 18B, example elements 1501, 1502), an interfering ring or stop (see FIG. 17B, example element 1714), or other embodiment disclosed herein (not an exhaustive list).

In some example embodiments, the projectile 550 comprises a thrust bearing (not illustrated) at the rear interface 538 between the rotor 575 and the trailing member 576. For example, the projectile 550 can comprise one of the thrust bearing embodiments disclosed herein, as illustrated in the figures and/or described in text. In some example embodiments, the rear interface 538 comprises a gas bearing. In some example embodiments, the rear interface 538 comprises an aerostatic bearing. In some example embodiments, the rear interface 538 comprises an aerodynamic bearing. In some example embodiments, the rear interface 538 comprises a hybrid aerostatic-aerodynamic bearing. In some example embodiments, the rear interface 538 comprises a spiral groove bearing. In some example embodiments, the rear interface 538 comprises an aero spiral groove bearing. In some example embodiments, the interface 538 of the projectile 550 comprises a gas cushion in accordance with the example illustrations of FIG. 3 and the associated textual description, which references the gas cushion 399.

Figure 6A:
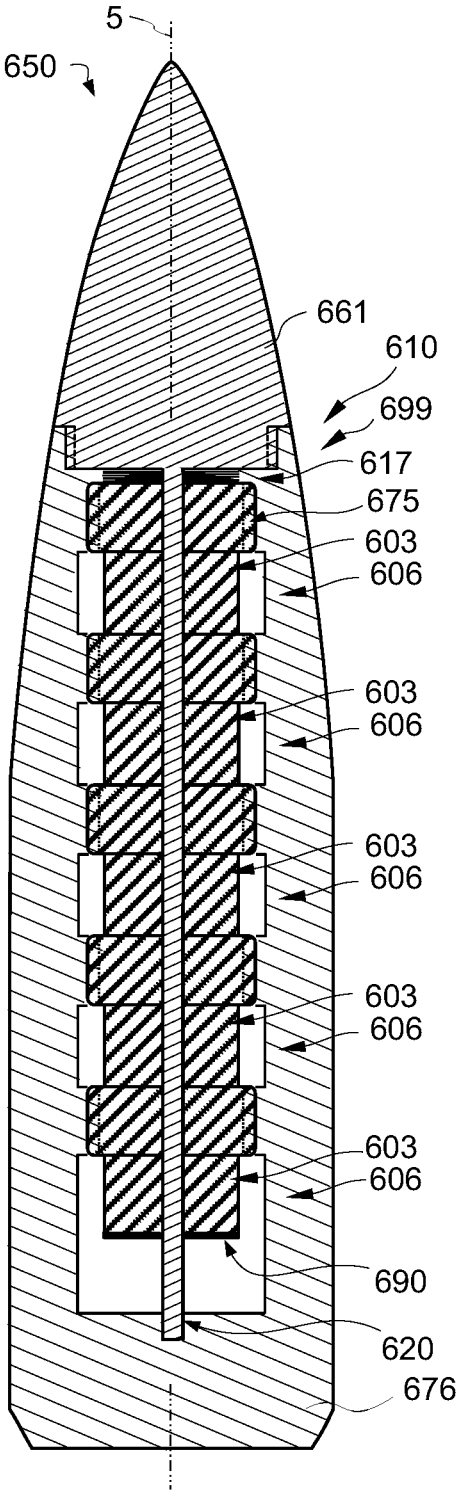
FIGS. 6A, 6B, 6C, 6D, 6E, and 6F, collectively
Figure 6B:
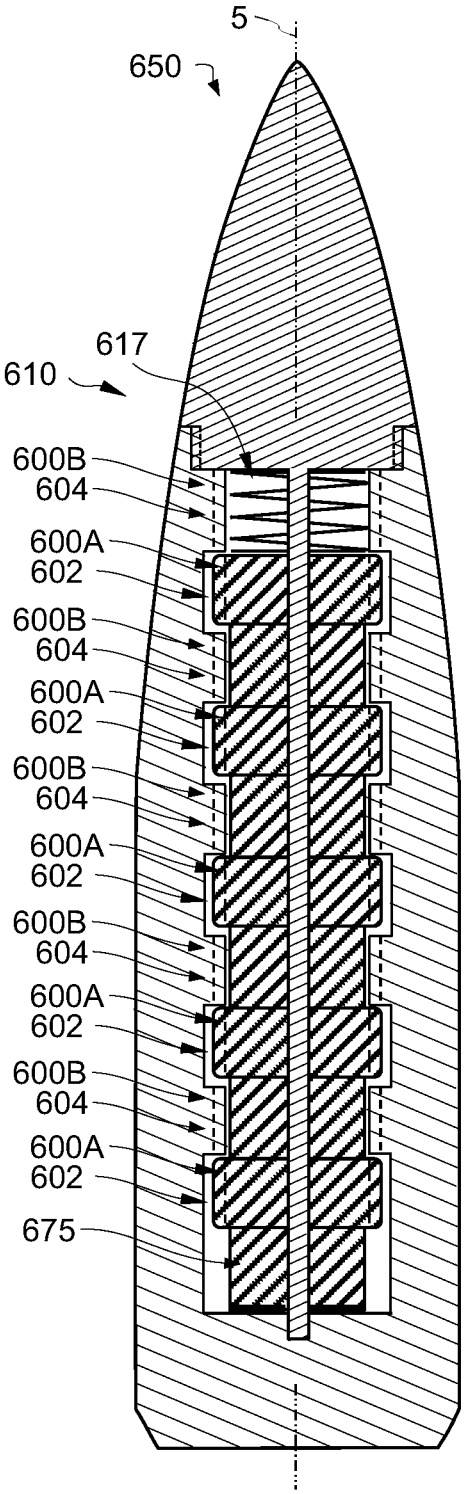

Turning now to FIGS. 6A, 6B, 6C, 6D, 6E, and 6F, some example embodiments will be discussed with reference to these figures, which illustrate an example projectile 650 according to some embodiments of the disclosure. FIGS. 6A and 6B respectively illustrate the projectile 650 in two example modes according to some embodiments. In FIG. 6A, a rotor 675 of the projectile 650 is in a forward position, for example prior to projectile launch. In FIG. 6B, the rotor 675 is in a rear position, for example during or following projectile launch. FIGS. 6C, 6D, 6E, and 6F illustrate example springs 617, 617B, 617C that the projectile 650 may comprise according to some embodiments.

In the illustrated example, the projectile 650 comprises a leading member 661 comprising a bar 620 that extends along an axis 5 of the projectile 650 through the rotor 675. The bar 620 comprises an axle about which the rotor 675 rotates. The projectile 650 further comprises a trailing member 676 that, together with the leading member 661, forms an enclosure in which the rotor 675 is disposed. The projectile 650 comprises an example embodiment of a mechanism. The rotor 675 and the combined leading and trailing members 661, 676 comprise an example embodiment of a helical pair.

As best seen in FIG. 6B, the rotor 675 comprises helical sections 602 with helices 600A interleaved with sections 603 of reduced diameter. In the illustrated example, the sections 603 of reduced diameter are without helices. The trailing member 676 has an interior that comprises helical sections 604 with helices 600B interleaved with sections 606 of enlarged diameter. In the illustrated example, the sections 606 of enlarged diameter are without helices. When the rotor's helical sections 602 are aligned with the trailing member's helical sections 604, the helices 600A and 600B are engaged, for example as illustrated in FIG. 6A. When the helical rotor sections 602 are aligned with the trailing member's sections 606, the helices 600A and 600B are disengaged, for example as illustrated in FIG. 6B.

In operation, when the projectile 650 undergoes acceleration 4, inertial force 85 moves the rotor 675 out of the forward position that FIG. 6A illustrates and to the rear position that FIG. 6B illustrates. As the rotor 675 moves axially rearward, the helices 600A, 600B convert the axial motion of the rotor 675 into rotational motion of the rotor 675. As the rotor 675 moves rearward, the helical sections 602 of the rotor 675 move into the enlarged-diameter sections 606 of the trailing member 676. The enlarged-diameter sections 606 are oversized relative to the helices 600A. The helices 600A, 600B are thus disengaged once the helical sections 602 of the rotor 675 are in the enlarged-diameter sections 606 of the trailing member 676, and the rotor 675 can spin freely. As the rotor 675 moves rearward, the reduced-diameter sections 603 of the rotor 675 further move into the helical sections 604 of the trailing member 676. The reduced-diameter sections 603 of the rotor 675 are undersized relative to the helices 600B, thus providing clearance for free rotation of the rotor 675 in the rear position illustrated in FIG. 6B. Accordingly, the projectile 650 comprises a drive 610 for spinning the rotor 675, which can produce a gyroscopic effect for stabilizing the projectile 650.

Example embodiments of the drive 610 can be incorporated in projectiles of guns, smoothbore guns, firearms, smoothbore firearms, light firearms, smoothbore light firearms, crew-served firearms, smoothbore crew-served firearms, light-gas guns, air guns, smoothbore air guns, railguns, or archery devices, including the disclosed examples thereof (not an exhaustive list). Example embodiments of the drive 610 can further be incorporated in other aeronautical systems, including in the disclosed examples of aeronautical systems.

In the illustrated example of FIG. 6, the projectile 650 further comprises a thrust bearing 690 that provides a load-bearing, low-friction interface for the spinning rotor 675. The thrust bearing 690 can comprise various embodiments disclosed herein, as illustrated in the figures and/or described in text. In some example embodiments, the thrust bearing 690 comprises a gas bearing. In some example embodiments, the thrust bearing 690 comprises an aerostatic bearing. In some example embodiments, the thrust bearing 690 comprises an aerodynamic bearing. In some example embodiments, the thrust bearing 690 comprises a hybrid aerostatic-aerodynamic bearing. In some example embodiments, the thrust bearing 690 comprises a spiral groove bearing. In some example embodiments, the thrust bearing 690 comprises an aero spiral groove bearing. In some example embodiments, the thrust bearing 690 comprises a gas cushion in accordance with the example illustrations of FIG. 3 and the associated textual description, which references the gas cushion 399. In some example embodiments, the thrust bearing 690 comprises a thrust washer that may be formed of bearing bronze, sintered bronze impregnated with graphite or oil, porous iron or copper or other appropriate metal in which interconnecting pores are filled with a lubricant, copper or bronze with plugs of graphite, or a matrix of PTFE and a metal such as copper, brass, or bonze (some representative examples, not an exhaustive list).

As illustrated by FIGS. 6A and 6B, the projectile 650 further comprises a retainer 617 for retaining the rotor 675 in the rear position that FIG. 6B illustrates. The retainer 617 can maintain the rear position of the rotor 675 while the projectile 675 is decelerating in route to a target due to air resistance. As illustrated, the retainer 617 comprises a spring, embodiments of which are illustrated by FIGS. 6C, 6D, 6E, and 6F. In operation, the spring is fully compressed when the rotor 675 is in the forward position of FIG. 6A. When the rotor 675 is in the rear position of FIG. 6B, the spring is partially compressed to apply sufficient force on the rotor 675 to overcome the forward inertial force on the rotor 675 due to drag-based deceleration of the projectile 650.

Figure 6C:
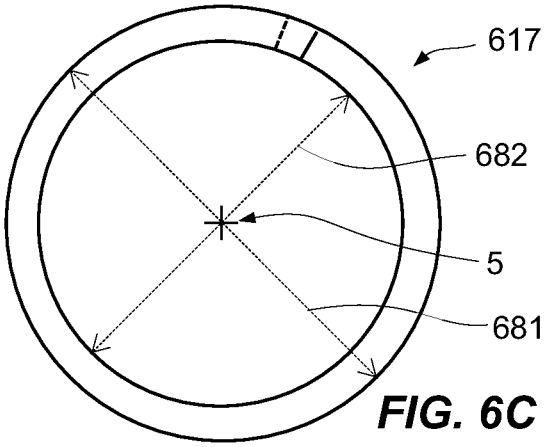
Figure 6D:
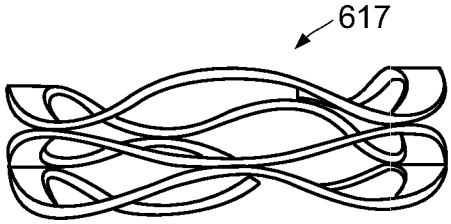
Figure 6E:
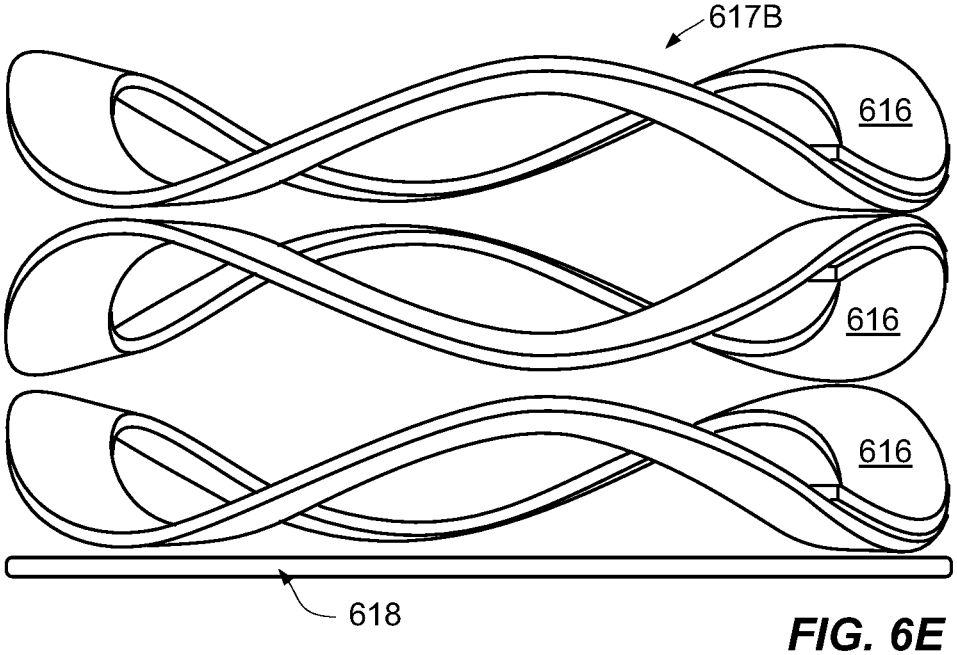
Figure 6F:
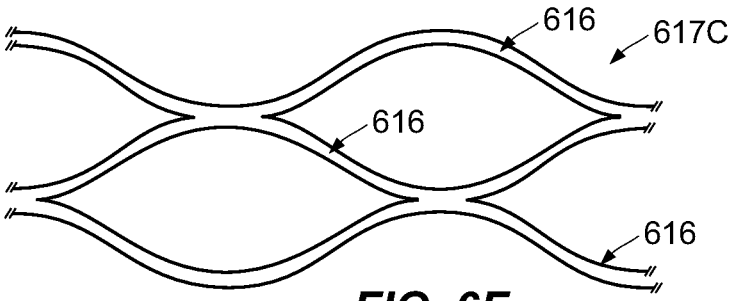

FIGS. 6C and 6D respectively illustrate an overhead view and a side view of an embodiment of the retainer 617 comprising a multi-turn wave spring. In some representative examples, the embodiment of FIGS. 6C and 6D (and the embodiments of FIGS. 6E and 6F) can be dimensioned to provide an inside diameter 682 corresponding to the bar 620 and an outside diameter 681 corresponding to the section 603 of the rotor 675. In the example embodiment of FIG. 6E, the retainer 617B comprises three single-turn wavy springs or wave disk springs 616 stacked on top on one another and a thrust washer 618 that provides a low-friction interface and supports the axial load of the forward inertial force of deceleration. In the example embodiment of FIG. 6F, the three single-turn wavy springs or wave disk springs 616 are welded together to form the retainer 617C, which can be accompanied by the thrust washer 618 illustrated in FIG. 6E.

As illustrated, the projectile 650 further comprises an example retainer 699 for retaining the rotor 675 in the forward position of FIG. 6A prior to projectile launch. In the illustrated example embodiment of the retainer 699, once the projectile 650 is assembled as shown in FIG. 6A, the rotor 675 can be tightened by turning the rotor 675 in a rotational direction that is opposite from the rotational direction provided by the drive 610 during projectile launch. In other words, torque can be applied to the rotor 675 to advance the rotor 675 forward into the retainer 617. The torque can elastically deform the helices 600A, 600B, the leading and trailing members 661, 676, the retainer 617, and/or the rotor 675. The deformation can create a binding effect that locks the rotor 675 in the forward direction. Perturbation, shock, and/or inertial forces produced during projectile launch can release the rotor 675, so the rotor 675 can move rearward and spin to provide gyroscopic stabilization.

Turning now to FIGS. 7A, 7B, 7C, 7D, 7E, 7F, 7G, 7H, 7I, 7J, 7K, 7L, 7M, 7N, and 7O, some example embodiments will be discussed with reference to these figures, which illustrate an example projectile 750 according to some embodiments of the disclosure. FIGS. 7A and 7B respectively illustrate the projectile 750 in two example modes according to some embodiments. FIG. 7A illustrates the projectile 750 in a pre-launch mode, for example with the projectile 750 stored, disposed in a magazine, or a chambered in preparation for discharge. FIG. 7B illustrates the projectile 750 in a post-launch mode or a mode occurring during a later phase of launch. FIGS. 7C, 7D, and 7E illustrate some example features that the projectile 750 comprises according to some embodiments. FIGS. 7F, 7G, 7H, 7I, 7J, 7M, 7N, and 7O illustrate some other example features that the projectile 750 can comprise according to some embodiments. FIGS. 7K and 7L illustrate some other example features that the projectile 750 can comprise according to some embodiments.

Referring now to FIGS. 7A, 7B, and 7C, the example projectile 750 comprises a leading member 761 and a trailing member 776 that are joined together to form a housing. The leading and trailing members 761, 776 can be fastened to one another via threads, welding, brazing, pins, press fit, or another appropriate fastening approach. Joined together, the leading and trailing members 761, 776 provide an interior space that extends lengthwise along an axis 5 of the projectile 750 and that comprises an elongated forward space 742, a forward recessed space 743, a major space 723, and a rear recess space 741. In the illustrated example of FIGS. 7A and 7B, the elongated forward space 742 is forward of the forward recessed space 743, the major space 723, and the rear recess space 741; the forward recessed space 743 is forward of the major space 723 and the rear recess space 741; and the major space 723 is forward of the rear recess space 741.

The example projectile 750 further comprises an example rotor 775, comprising a helix 700A, that is disposed in the major space 723. The rotor 775 comprises a forward surface 739 disposed at an interface 731 between the rotor 775 and the leading member 761. A surface 737 of the leading member 761 faces the forward surface 739 of the rotor 775 at the interface 731. The rotor 775 further comprises a rear surface 733 disposed at an interface 732 between the rotor 775 and the trailing member 776. A surface 729 of the trailing member 776 faces the rear surface 733 of the rotor 775 at the interface 732.

The example projectile 750 further comprises an example drive member 728. As illustrated, the drive member 728 comprises a bar 721, which comprises an elongate member in the example embodiment of FIG. 7, and an end member 722 that comprises a helix 700B. In the example mode of FIG. 7A, the drive member 728 is positioned forward in the projectile 750. In this mode, the bar 721 of the drive member 728 is disposed forward in the elongated forward space 742, and the end member 722 of the drive member 728 is disposed partially in the forward recessed space 743 and partially in a central aperture 736 of the rotor 775, with the helix 700B of the end member 722 engaged with the helix 700A of the rotor 775. The drive member 728 and the rotor 775 comprise an example embodiment of a helical pair. The projectile comprises a drive 710. As illustrated by FIGS. 7A and 7B and discussed below, the drive 710 comprises an example embodiment of an inertial drive. The projectile 750 comprises an example embodiment of a mechanism.

As illustrated in the cross sectional view of FIG. 7C that is taken at Section A-A perpendicular to the axis 5, the example bar 721 of the drive member 728 and the elongated forward space 742 of the leading member 761 have square geometries. In cross section perpendicular to the axis 5, the elongated forward space 742 is square with rounded corners 792. In cross section perpendicular to the axis 5, the bar 721 is square with rounded corners 781 and is sized to fit in the elongated forward space 742. The elongated forward space 742 is sized to accommodate the bar 721, and the bar 721 can move axially within the elongated forward space 742. The matching square geometries of the bar 721 and the elongate space maintain rotational alignment between the bar and the leading and trailing members 761, 776 as the projectile 750 transitions from the mode of FIG. 7A to the mode of FIG. 7B. Accordingly, the drive member 728 and the exterior of the projectile 750 can maintain a consistent angular orientation relative to one another as the drive member 728 moves rearward within the projectile 750. In some example embodiments, for instance with the projectile 750 being .30 caliber, an annular gap existing between the bar 721 and the elongated forward space 742 may have an annular dimension in a range of 0.0005 to 0.002 inches or 12.5 to 51 microns (a nonlimiting, example range that is among others supported by the written description).

In the example embodiment that FIGS. 7A, 7B, and 7C illustrate, the cross sectional profiles of the bar 721 and the elongated forward space 742 have a consistent angular orientation throughout their longitudinal lengths or along the axis 5. The elongate member 721 and the elongated forward space 742 can, for example, be fabricated to a design specification that calls for their respective corners 781, 792 to extend lengthwise along the axis 5 without intentional spiral.

Alternatively, the bar 721 and the elongated forward space 742 can spiral lengthwise. FIG. 7K illustrates a representative section of such a helical bar 721B that spirals lengthwise about the axis 5. In this configuration, the drive 710 comprises an example embodiment of a compound helical drive. The example helical bar 721B of FIG. 7K comprises a square profile with corners 781B twisting about the axis 5 as the helical bar 721B extends lengthwise. Thus, the helical bar 721B comprises a helix 700C. FIG. 7L illustrates a representative section of a helical elongated forward space 742B that corresponds to the illustrated section of the helical bar 721B and that spirals about the axis 5 synchronously with the spiraling of the helical bar 721B. To facilitate visualization of example features of the helical elongated forward space 742B, FIG. 7L depicts the section of helical elongated forward space 742B as an opaque solid. That is, FIG. 7L illustrates the section of helical elongated forward space 742B as an opaque casting of the section. As illustrated in FIG. 7L, the helical elongated forward space 742B comprises a square profile with corners 782B twisting about the axis 5 as the helical elongated forward space 742B extends lengthwise. Thus, the helical elongated forward space 742B comprises a helix 700D.

In assembly, the helical bar 721B of FIG. 7K is disposed in the helical elongated forward space 742B of FIG. 7L in keeping with the configuration that FIG. 7A illustrates. So disposed, the helix 700C and the helix 700B are engaged. In the embodiment of FIGS. 7K and 7L, as the helical bar 721B moves rearward (from the mode of FIG. 7A to the mode of FIG. 7B), the helical bar 721B rotates. The helix 700C and the helix 700B comprise an example embodiment of a helical pair. The rotation 797 of the helical bar 721B can compound with the rotation of the rotor 775 due to rearward movement of the drive member 728 (further discussed below).

Referring now to FIGS. 7A and 7B, the illustrated example projectile 750 further comprises a retainer 789 that maintains the drive member 728 in the forward position of FIG. 7A during handling of the projectile 750, for instance while the projectile 750 is chambered or accidentally dropped or jostled during routine handling. In the illustrated embodiment, the retainer 789 comprises a member 791 that extends between the leading member 761 and the leading end of the bar 721 of the drive member 728. In the illustrated example embodiment, opposing ends of the member 791 are fastened to the bar 721 and to the leading member 761, for example via welding, wire bonding, soldering, brazing, pinning, or other appropriate fastening approach. In the illustrated embodiment of FIGS. 7A and 7B, the member 791 comprises a metal filament or wire. In some example embodiments, a hole (not illustrated) can be drilled into a tip 788 of the projectile 750 to facilitate access for attachment of the member 791. In some embodiments, this hole is filled with a pointed insert.

As illustrated by FIGS. 7A and 7B, the example retainer 789 comprises a conditional-release retainer that prevents the drive 710 of the projectile 750 from operating until a predetermined condition occurs. The member 791 can withstand a predetermined level of stress to retain the drive member 728 in the forward position of FIG. 7A during projectile handling. When the stress exceeds a threshold level indicative of a launch event, the member 791 fails, for example breaking or parting into two pieces 791A, 791B as illustrated in FIG. 7B. For example, when acceleration 4 of the projectile 775 produces of threshold level of inertial force 85 acting on the drive member 728, the member 791 fails, and the retainer 789 releases the drive member 728. Once released, the drive member 728 moves rearward along the axis 5 and produces rotation of the rotor 775 as further discussed below.

In the embodiment that FIGS. 7A and 7B illustrate, as the drive member 728 moves axially rearward due to inertial force 85 (see FIG. 1I for an illustration of an example embodiment) acting on the drive member 728, the end member 722 of the drive member 728 moves axially rearward through the central aperture 736 of the rotor 775. The fitted square geometries of the bar 721 and the elongated forward space 742 (illustrated in FIG. 7C) maintain axial alignment between end member 722 and the projectile's leading member 761 and trailing member 776 that form an exterior of the projectile 750. As inertial force 85 drives the end member 722 rearward, the end member's helix 700B produces rotation of the rotor 775 within the projectile 750 relative to the leading and trailing members 761, 776. The resulting rotation of the rotor 775 can provide gyroscopic stabilization of the projectile 750 and/or other effects in accordance with the disclosure provided herein.

In some example embodiments, the helix 700A of the rotor 775 can have a helical rate that progressively tightens. Accordingly, as the end member 722 moves rearward, each increment of axial movement of the end member 722 can produce progressively more rotation of the rotor 775.

In some example embodiments, the drive 710 of the projectile 750 comprises a soft starter that softly starts rotation of the rotor 775. In some example embodiments, the soft starter can comprise a forward section of the helix 700A that has no helical rate followed by a progressively increasing helical rate. With this example soft starter embodiment, the end member 722 can initially move rearward without rotating the rotor 775. After the end member 722 starts moving rearward, the progressively increasing helical rate can ramp rotation of the rotor 775. In some example embodiments of the soft starter, the helix 700A comprises a progressively tightening helical rate in which a forward end of the helix 700 provides an initial helical rate and a rear end of the helix 700A provides a final helical rate, wherein the initial helical rate is no more than ten percent of the final helical rate. In other example soft starter embodiments, the initial helical rate may be more than 10 percent of the final helical rate.

Example embodiments of the drive 710 can be incorporated in projectiles of guns, smoothbore guns, firearms, smoothbore firearms, light firearms, smoothbore light firearms, crew-served firearms, smoothbore crew-served firearms, light-gas guns, air guns, smoothbore air guns, railguns, or archery devices, including the disclosed examples thereof (not an exhaustive list). Example embodiments of the drive 710 can further be incorporated in other aeronautical systems, including in the disclosed examples of aeronautical systems.

As discussed above with reference to FIGS. 7K and 7L, in some example embodiments of the projectile 750, the leading member 761 comprises the helical elongated forward space 742B, which FIG. 7L illustrates, and the drive member 728 comprises the helical bar 721B, which FIG. 7K illustrates. In such embodiments, as the drive member 728 moves axially rearward, the helical bar 721B rotates, and thus the end member 722 and the helix 700B rotate. The rotation 797 of the helical bar 721B and the end member 722 and the helix 700B can be in a rotational direction that amplifies rotor rotation. For example, with the end member 722 held in a fixed angular orientation (as illustrated in FIG. 7C), an axial movement of the end member 722 can produce a number of clockwise rotations of the rotor 775. With the end member 722 itself rotating clockwise as the end member 722 axially moves (as provided by the embodiment that FIGS. 7K and 7L illustrate) the resulting number of clockwise rotations of the rotor 775 increases. The embodiment of FIGS. 7K and 7L thus provides compound rotation of the rotor 775 and comprises an example embodiment of a compound helical drive.

In some example embodiments, the helix 700D of the helical elongated forward space 742B can comprise a progressive helical rate. Accordingly, as the end member 722 moves rearward, each increment of axial movement of the end member 722 can produce progressively more rotation of the end member 722. The bar 721 can have a geometry adapted to facilitate such an embodiment. In an example embodiment, a forward section 798 of the bar 721 can have a square geometry, as illustrated in FIG. 7C, that engages the helical elongated forward space 742B along the progressive helical rate. Rear of the forward section 798, the bar 721 can have a circular cross section or a cylindrical form that is thin relative to the helical elongated forward space 742B. In this configuration, engagement between the bar 721 and the helical elongated forward space 742B can be limited to the forward section 798 of the bar 721. This configuration can help avoid binding and/or promote smooth operation in some example applications.

In the example embodiment that FIGS. 7A and 7B illustrate, the projectile 750 further comprises a retainer 799 that retains the drive member 728 in the rear position that FIG. 7B illustrates. The retainer 799 can retain the drive member 728 while the projectile 750 is traveling in open air and is decelerating due to air resistance or drag. Thus, the retainer 799 can restrain the drive member 728 from moving forward within the projectile 750 while the drive member 728 is subject to forward inertial force associated with deceleration. In the illustrated retainer embodiment of FIG. 7B, the rear recess space 741 is tapered so that the drive member 728 wedges into the rear recess space 741 and is captured. In some example embodiments, the retainer 799 can comprise a latch or catch mechanism. The retainer 799 can, for example, comprise a spring-loaded receptacle (not illustrated) that receives the end member 722 and closes to retain the end member 722 or otherwise traps the end member 722 in the receptacle.

Turning now to FIGS. 7D and 7E, these figures illustrate example features of an embodiment of the rear surface 733 of the rotor 775 (denoted 733A in FIGS. 7D and 7E), which is disposed at the interface 732 between the rotor 775 and the trailing member 776. FIG. 7D illustrates the rear surface 733 A in a view looking forward along the axis 5 (as if the observer was on the axis 5 looking towards the tip 788 of the projectile 750). FIG. 7E illustrates the rear surface 733 A of the projectile 750 in a perspective view. In the example illustrations, the rotor's rear surface 733A is patterned with features that provide an example embodiment of an aero spiral groove bearing 787. In some example embodiments, the rear surface 733A of the rotor 785 (and/or other surfaces of the rotor 785) is coated with grease, oil, graphite powder, PTFE powder or other suitable lubricant that facilitates rotation and promotes gas flow.

In an example embodiment, the aero spiral groove bearing 787 that FIGS. 7D and 7E illustrate comprises a fluid bearing. In an example embodiment, the aero spiral groove bearing 787 that FIGS. 7D and 7E illustrate comprises a gas bearing. In an example embodiment, the aero spiral groove bearing 787 that FIGS. 7D and 7E illustrate comprises an aerodynamic bearing. In an example embodiment, the aero spiral groove bearing 787 that FIGS. 7D and 7E illustrate comprises a spiral groove bearing. In an example embodiment, the aero spiral groove bearing 787 that FIGS. 7D and 7E illustrate comprises a thrust bearing.

As illustrated by FIGS. 7D and 7E, the example aero spiral groove bearing 787 comprises eight grooves 753 that spiral inward towards the central aperture 735 of the rotor 775, which is illustrated as centered on the axis 5. Adjacent grooves 753 are separated by lands 754, so that eight lands 754 are interleaved with eight grooves 753. In some example .30 caliber embodiments of the projectile 750, the aero spiral groove bearing 787 can comprise a number of grooves 753 in a range of six to twenty grooves and a corresponding number of lands (a representative, nonlimiting range that is among others supported by the written description). In some example embodiments, the grooves 753 spiral logarithmically. In some example embodiments, the grooves 753 can spiral according to an Archimedean spiral, a Euler spiral, an involute spiral, or a hyperbolic spiral (not an exhaustive list). As illustrated by FIGS. 70 and 7N and discussed below, in some example embodiments, grooves of an aero spiral groove bearing can follow a straight line or have a form that is triangular or rectangular or another appropriate geometry.

In the illustrated example of FIGS. 7D and 7E, each groove 753 comprises a mouth 756 at a peripheral edge 752 of the rotor's rear surface 733A and a tail 751 opposite the mouth 756. As illustrated, each groove 753 progressively tapers between its mouth 756 and its tail 751. In some example embodiments, each groove 753 becomes progressively shallower in its tail 751. The tails 751 collectively define a central region 734 that is coplanar or substantially coplanar with the lands 754. Thus, the grooves 753 spiral about the central region 734. In the illustrated embodiment, at the peripheral edge 752, the mouth 756 of each groove 753 is of a chord width 794 that is substantially equal to a cord width 795 of each land 754. In some example .30 caliber embodiments of the projectile 750, at the peripheral edge 752, the groove cord width 794 can be in range of one to six times the land cord width 794 (a representative, nonlimiting range that is among others supported by the written description). As illustrated, each groove 753 extends a radial distance 782 that is a fraction of the overall radius 786 of the rear surface 733 A of the rotor 775. In some example .30 caliber embodiments of the projectile 750, this fraction is in a range of 0.15 to 0.75 (a representative, nonlimiting range that is among others supported by the written description).

In the illustrated embodiment of FIGS. 7D and 7E, each groove 753 extends an angle 755 of approximately 63 degrees as it spirals inward. In some example .30 caliber embodiments of the projectile 750, the angle 755 of groove extension is a range of 50 to 100 degrees (a representative, nonlimiting range that is among others supported by the written description). In some example embodiments, each groove 753 has a depth 793 of approximately 45 microns. In some example .30 caliber embodiments of the projectile 750, the depth 793 of each groove 753 is a range of 10 to 90 microns (a representative, nonlimiting range that is among others supported by the written description).

In some example embodiments, the grooves 753 can be formed utilizing photolithography. In some example embodiments, the grooves 753 can be formed utilizing selective acid etching. In some example embodiments, the grooves 753 can be formed utilizing ion beam etching or ion beam milling. In some example embodiments, the grooves 753 can be formed utilizing laser machining. In some example embodiments, the grooves 753 can be formed utilizing diamond machining.

In operation, when the rotor 775 rotates with counterclockwise rotation 757, the groove mouths 756 catch gas and the grooves 753 pump the gas towards the groove tails 751. The groove tails 751 direct the gas flow into the interface 732 to form a layer of pressurized gas that supports the axial load of the rotor 775 due to inertial force 85 (see FIG. 1I for an illustration of an example embodiment) and supports low-friction rotation. The layer of pressurized gas can provide separation between the rear surface 733A of the rotor 775 and the trailing member 776 so that the interface 732 can comprise a non-contacting interface. In some example embodiments, gas pressure at the interface 732 increases with increased rotational speed of the rotor 775 to support an increasing inertial load.

In some example embodiments, the surface 729 of the trailing member 776 comprises a spiral groove pattern that comprises a mirror image of the rear surface 733 A of the rotor 775 that FIGS. 7D and 7E illustrate as discussed above. One or both of the rear surface 733A and the surface 729 can comprise a spiral groove pattern according to some embodiments.

In some example embodiments, the interface 731 of the projectile 750 comprises an aero spiral groove bearing in accordance with FIGS. 7D and 7E and the foregoing discussion. This aero spiral groove bearing can support a forward axial load of inertia due to deceleration of the projectile 750 in open air due to air resistance or drag while supporting low-friction rotation of the rotor 775. In some example embodiments, one or both of the rotor's forward surface 739 and the leading member's surface 737 at the interface 731 comprises a spiral groove pattern.

Figure 7M:
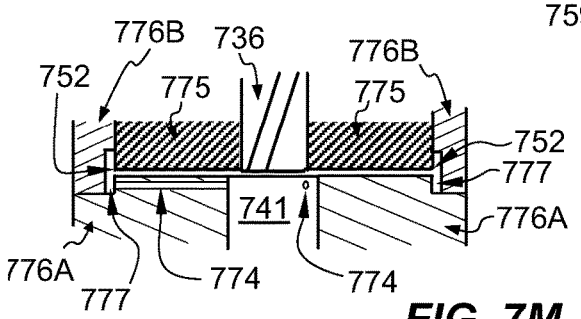
Figure 7G:
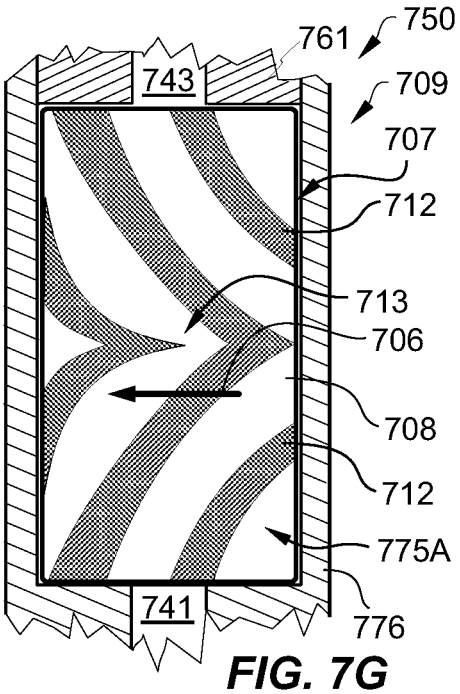
Figure 7H:
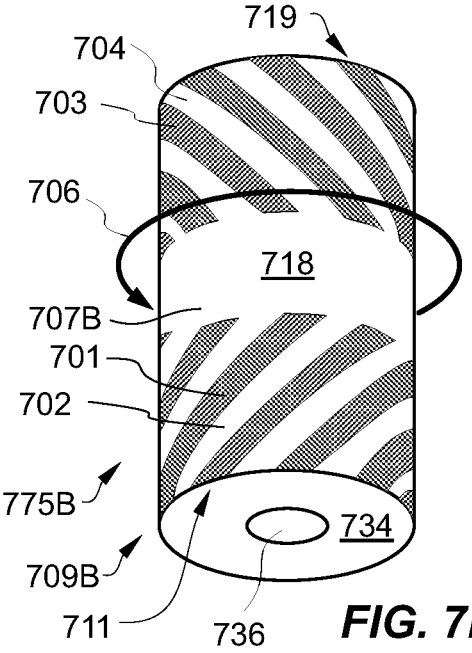
Figure 7I:
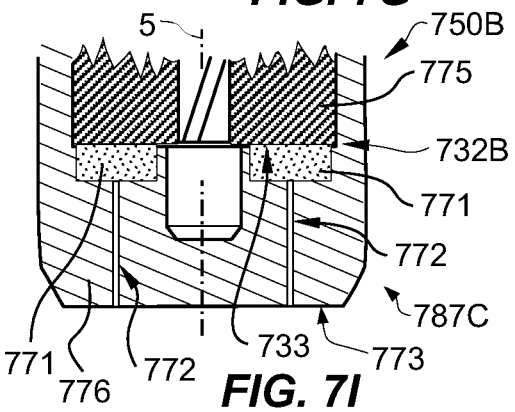
Figure 7J:
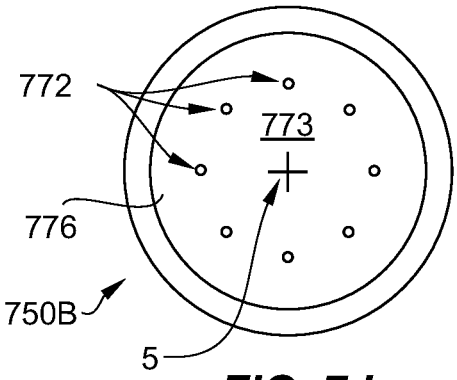
Figure 7K:
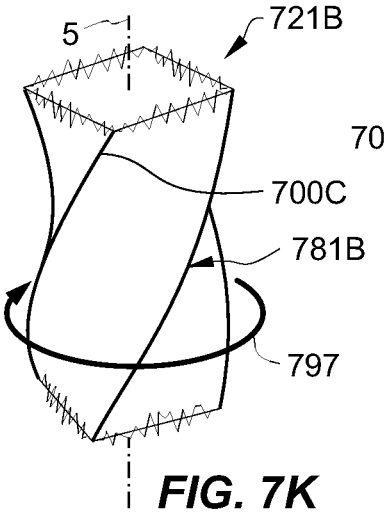
Figure 7L:
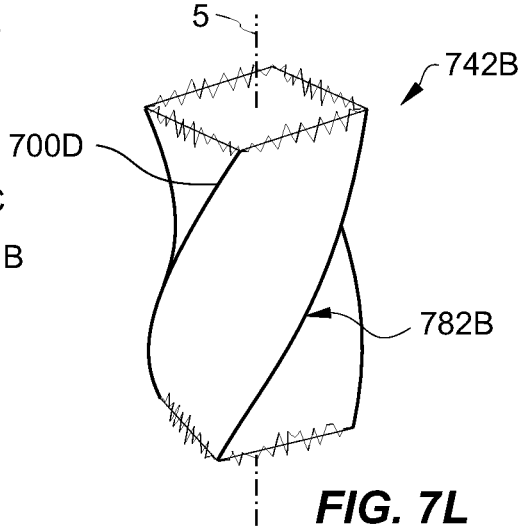

As illustrated in FIG. 7M, in some example embodiments, a small cavity 777 formed in the trailing member 776 circumscribes the peripheral edge 752 of the rotor 775. In operation, the aero spiral groove bearing 787 can draw gas from the cavity 777. In the illustrated embodiment of FIG. 7M, three channels 774 extend axially between the cavity 777 and the rear recess space 741 on 120 degree spacing. The channels 774 can transmit gas between the rear recess space 741 and the cavity 777. In the cross sectional view of FIG. 7M, two of the three channels 774 are visible, as the third channel is in front of the cutting plane. In the embodiment of FIG. 7M, the trailing member 776 comprises part 776A and part 776B that are joined together via threads, welding, brazing, or other appropriate joining approach. Dividing the trailing member 776 into two parts 776A, 776B can provide access for fabricating the channels 774 in some example embodiments.

Turning now to FIG. 7F, this figure illustrates an example aero spiral groove bearing 787B that the projectile 750 can comprise as an alternative to the embodiment that FIGS. 7D and 7E illustrate. Each groove 753 of the aero spiral groove bearing 787B comprises two mouths 756, 759 and a vertex 758. The mouth 756 catches gas in keeping with the foregoing discussion of FIG. 7D. The mouth 759 is oriented towards the central aperture 736 of the rotor 775 and catches gas from the central aperture 736. In operation, with counterclockwise rotation 757 of the rotor surface 733B, each groove 753 pumps gas from the mouth 756 towards the vertex 758 and from the mouth 759 to the vertex 758. The vertex 758 effectively diverts the resulting pressure into the interface 732 to provide a load-bearing, low-friction layer of pressurized gas. The aero spiral groove bearing 787B thus supports the rotor 775 as the rotor 775 spins under load.

In some example embodiments, the grooves 753 can be dimensioned according to the relevant dimensional values discussed above with reference to FIGS. 7D and 7E. In keeping with the foregoing discussion about the aero spiral groove bearing 787, the aero spiral groove bearing 787B can be applied to the interface 732 and/or the interface 731 and can be implemented at each interface 731, 732 as a single patterned surface or as a pair of patterned surfaces.

In an example embodiment, the aero spiral groove bearing 787B that FIG. 7F illustrates comprises a fluid bearing. In an example embodiment, the aero spiral groove bearing 787B that FIG. 7F illustrates comprises a gas bearing. In an example embodiment, the aero spiral groove bearing 787B that FIG. 7F illustrates comprises an aerodynamic bearing. In an example embodiment, the aero spiral groove bearing 787B that FIG. 7F illustrates comprises a spiral groove bearing. In an example embodiment, the aero spiral groove bearing 787B that FIG. 7F illustrates comprises a thrust bearing.

Figure 7O:
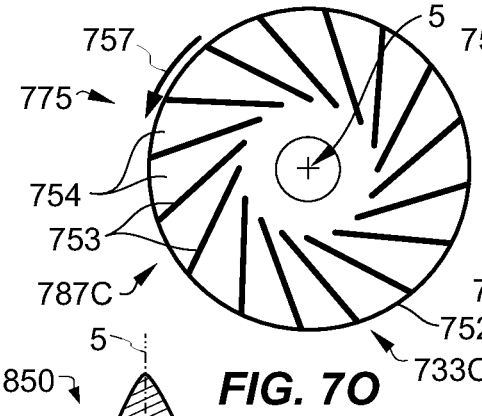
Figure 7N:
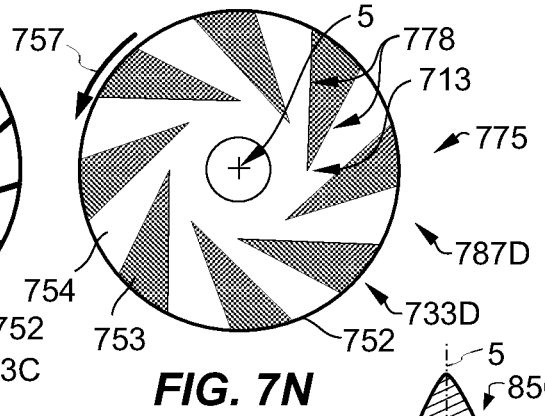

Turning now to FIG. 7O, this figure illustrates an example aero spiral groove bearing 787C that the projectile 750 can comprise as an alternative to the embodiment that FIGS. 7D and 7E illustrate. In the illustrated embodiment of FIG. 7O, each groove 753 of the aero spiral groove bearing 787C extends linearly or rectilinearly across the rotor surface 733C. As illustrated, each groove 753 is linear and straight. With extension from the rotor's peripheral edge 752, each groove 753 becomes closer to the rotor's axis 5. Lands 754 separate adjacent grooves 753. The rotor surface 733C is flat or substantially planar. The grooves 753 spiral about the axis 3 on the rotor surface 733C. In this illustrated example embodiment, the width of each groove 753 in the aero spiral groove bearing 787C is constant. That is, as each groove 753 extends across the rotor surface 733C, the groove width is uniform. In operation, with counterclockwise rotation 757 of the rotor surface 733C, each groove 753 pumps gas inward along its linear path to provide a load-bearing, low-friction layer of pressurized gas. The aero spiral groove bearing 787C thus can support the rotor 775 as the rotor 775 spins under load about the axis 5.

In an example embodiment, the aero spiral groove bearing 787C that FIG. 7O illustrates comprises a fluid bearing. In an example embodiment, the aero spiral groove bearing 787C that FIG. 7O illustrates comprises a gas bearing. In an example embodiment, the aero spiral groove bearing 787C that FIG. 7O illustrates comprises an aerodynamic bearing. In an example embodiment, the aero spiral groove bearing 787C that FIG. 7O illustrates comprises a spiral groove bearing. In an example embodiment, the aero spiral groove bearing 787C that FIG. 7O illustrates comprises a thrust bearing.

Turning now to FIG. 7N, this figure illustrates an example aero spiral groove bearing 787D that the projectile 750 can comprise as an alternative to the embodiment that FIGS. 7D and 7E illustrate. In the illustrated embodiment of FIG. 7N, each groove 753 has a triangular form. In the illustrated example triangular form, each groove 753 has two sides 778 that extend inward linearly or rectilinearly from the rotor's peripheral edge 752 and meet to form a vertex 713. As illustrated, the sides 787 are linear and straight. Lands 754 separate adjacent grooves 753. The rotor surface 733D is flat or substantially planar. The grooves 753 spiral about the axis 3 on the rotor surface 733D. In operation, with counterclockwise rotation 757 of the rotor surface 733D, each groove 753 pumps gas inward towards its vertex 713 to provide a load-bearing, low-friction layer of pressurized gas.

The aero spiral groove bearing 787D thus can support the rotor 775 as the rotor 775 spins under load about the axis 5.

In an example embodiment, the aero spiral groove bearing 787D that FIG. 7N illustrates comprises a fluid bearing. In an example embodiment, the aero spiral groove bearing 787D that FIG. 7N illustrates comprises a gas bearing. In an example embodiment, the aero spiral groove bearing 787D that FIG. 7N illustrates comprises an aerodynamic bearing. In an example embodiment, the aero spiral groove bearing 787D that FIG. 7N illustrates comprises a spiral groove bearing. In an example embodiment, the aero spiral groove bearing 787D that FIG. 7N illustrates comprises a thrust bearing.

FIG. 7G illustrates an embodiment of the projectile 750 in a partial cross sectional view that exposes an embodiment of the rotor 775A, including a circumferential surface 707 of the rotor 775A. In keeping with FIGS. 7A and 7B and the foregoing associated discussion, the rotor 775A is disposed between the leading member 761 and the trailing member 776, and between the rear recess space 741 and the forward recessed space 743. In the example illustrated by FIG. 7G, the circumferential surface 707 is patterned with grooves 712 and lands 708 that comprise an example embodiment of an aero spiral groove bearing 709. In some example embodiments, each groove 712 has a depth of approximately 45 microns. In some example .30 caliber embodiments of the projectile 750, the depth of each groove 712 is a range of 10 to 90 microns (a representative, nonlimiting range that is among others supported by the written description). In operation, rotation 706 of the rotor 775A pumps gas from the opposing ends of each groove 712 towards a vertex 713 of each groove 712. The vertex 713 effectively directs the resulting gas pressure radially outward so that a layer of pressurized gas circumscribes and circumferentially covers the rotor's circumferential surface 707. Accordingly, the circumferential surface 707 of the rotor 775A is provided with a low-friction, load bearing interface.

In an example embodiment, the aero spiral groove bearing 709 that FIG. 7G illustrates comprises a fluid bearing. In an example embodiment, the aero spiral groove bearing 709 that FIG. 7G illustrates comprises a gas bearing. In an example embodiment, the aero spiral groove bearing 709 that FIG. 7G illustrates comprises an aerodynamic bearing. In an example embodiment, the aero spiral groove bearing 709 that FIG. 7G illustrates comprises a spiral groove bearing.

FIG. 7H illustrates an embodiment of the rotor 775B that comprises an example aero spiral groove bearing 709B. In this illustrated example, the aero spiral groove bearing 709B comprises two sets of grooves 703, 701, with respectively corresponding lands 704, 702 formed in the circumferential surface 707B of the rotor 775B. In some example embodiments, each groove 701, 703 has a depth of approximately 45 microns. In some example .30 caliber embodiments of the projectile 750, the depth of each groove 701, 703 is a range of 10 to 90 microns (a representative, nonlimiting range that is among others supported by the written description). In rotation 706 of the rotor 775B, rear mouths 711 of the grooves 701 capture gas from rear of the rotor 775B while front mouths 719 capture gas from forward of the rotor 775B. The grooves 701, 703 pump the gas towards a central surface area 718 where the grooves 701, 702 terminate. The pumped gas builds a layer of pressured gas that circumscribes and circumferentially covers the surface 707B of the rotor 775B. Accordingly, the circumferential surface 707B of the rotor 775B is provided with a low-friction, load bearing interface.

In an example embodiment, the aero spiral groove bearing 709B that FIG. 7H illustrates comprises a fluid bearing. In an example embodiment, the aero spiral groove bearing 709B that FIG. 7H illustrates comprises a gas bearing. In an example embodiment, the aero spiral groove bearing 709B that FIG. 7H illustrates comprises an aerodynamic bearing. In an example embodiment, the aero spiral groove bearing 709B that FIG. 7H illustrates comprises a spiral groove bearing.

Turning now to FIGS. 7I and 7J, these figures illustrate an example embodiment of the projectile 750 that FIGS. 7A, 7B, and 7C illustrate, denoted here as projectile 750B. As further discussed below, the illustrated projectile 750B of FIGS. 7I and 7J comprises an example embodiment of an aerostatic bearing 787C. FIG. 7I illustrates a cross sectional view of a rear portion of the projectile 750B comprising the aerostatic bearing 787C, where the axis 5 of the projectile 750B is in the cutting plane of the view. FIG. 7J illustrates the projectile 750B, in a view taken rear of the projectile 750B on the axis 5 looking towards a rear surface 773 of the projectile 750B.

As illustrated in FIGS. 7I and 7J, the projectile 750 comprises eight channels 772 that extend through the rear surface 773 to a porous member 771. In the illustrated example embodiment, the porous member 771 comprises a hollow cylindrical body that extends circumferentially around the axis 5. Thus, the porous member 771 can comprise a geometrical form of a ring or a washer (see FIG. 1R, for example). Each channel 772 is configured to transmit expanding propellant gas 26 (see FIG. 1I for an illustration of an example embodiment). In some example embodiments, the expanding propellant gas 26 is produced by combustion of solid propellant 25 housed in a cartridge 420B in which the projectile 750 is mounted. (See, for example, FIG. 1D and FIGS. 4B and 4D.) The porous member 771 receives the expanding propellant gas 26 and spreads the gas 26 across the rear surface 733 of the rotor 785 at an interface 732B. The porous member 771 comprises a distribution of pores at the interface 732B, wherein each pore comprises a gas outlet that emits the expanding propellant gas 26. Accordingly, the porous member 771 can equalize the delivered pressure across the rear surface 733 at the interface 732B. In some example embodiments, the porous member 771 further comprises a filter that filters particulates from the expanding propellant gas 26.

In some example embodiments, the porous member 771 comprises porous graphite. For example, commercial graphite stock material that is readily available for electrical discharge machining ("EDM") applications can be machined to form the porous member 771. Porous graphite stock is commercially available from Entegris, Inc. of Billerica, Massachusetts under the product designators "ZXF-5Q," "ACF-10Q," "AXF-5Q," "AXM-5Q," and "AXZ-5Q." In some example embodiments, the porous member 771 comprises porous ceramic material. In some example .30 caliber embodiments of the projectile 750B, the porous member 771 is formed of porous ceramic material in which pore size is specified in a range of 0.5 to 10 microns (a representative, nonlimiting range that is among others supported by the written description). In some example embodiments, the porous member 771 comprises sintered metal that is porous, for example sintered stainless steel, sintered brass, sintered bronze, or sintered copper. In some example .30 caliber embodiments of the projectile 750B, the porous member 771 is formed of filter-grade sintered metal with a porosity rating in a range of 5 to 40 microns (a representative, nonlimiting range that is among others supported by the written description).

Figure 13A:
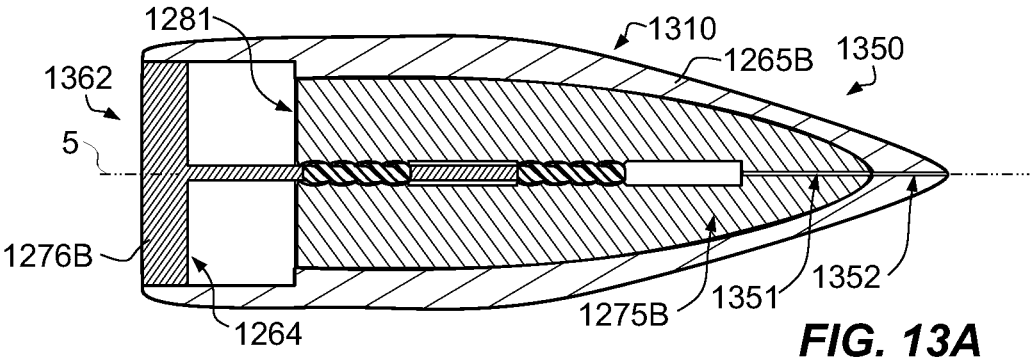
FIGS. 13A, 13B, 13C, and 13D, collectively

In some embodiments, the projectile 750B comprises a gas output channel extending from the elongated forward space 742 to the projectile's tip 788, like the channel 1352 in the projectile 1350 that FIG. 13A illustrates. The gas output channel can provide a pressure drop between ends of the rotor 775 that facilitates formation of a layer of pressured gas between the rotor 775 and the porous member 771. As illustrated, the projectile 750B has eight channels 772, which is an example, nonlimiting number. Some example .30 caliber projectile embodiments can comprise channels numbering in a range of three to eighteen, with each channel comprising a drilled hole of a diameter in a range of 0.3 to 2 millimeters (representative, nonlimiting ranges among others supported by the written description).

In some example embodiments, the porous member 771 extends rearward from the rear surface 733 of the rotor 750B to the rear surface 773 of the projectile 750B, so the projectile's rear surface 773 is made of the porous member 771. In some such embodiments where the porous member 771 extends to the rear surface 773, the channels 722 as drilled holes may be eliminated. In some such embodiments where the porous member 771 extends to the rear surface 773, the channels 722 may be embodied in inherent pores that extend through the porous member 771. In some such embodiments where the porous member 771 extends to the rear surface 773, the channels 722 may be formed in the porous member 771 as drilled holes that extend partially into the porous member 771, for example to a depth in a range of 25 to 75 percent through the porous member 771 (a representative, nonlimiting range that is among others supported by the written description).

In operation, the expanding propellant gas 26 provides a layer of pressurized gas at the interface 732B that provides low-friction, load-bearing support for the rotor 775 as the rotor 775 spins and is under inertial load associated with launch acceleration 4.

In an example embodiment, the aerostatic bearing 787C that FIGS. 7I and 7J illustrate comprises a fluid bearing. In an example embodiment, the aerostatic bearing 787C that FIGS. 7I and 7J illustrate comprises a gas bearing. In an example embodiment, the aerostatic bearing 787C that FIGS. 7I and 7J illustrate comprises a thrust bearing.

In some example embodiments, the rear surface 733 of the rotor 775 is patterned with spiral grooves 753 as illustrated in FIG. 7D and discussed above. That is, the rotor 775 of FIG. 7I can comprise the patterned rear surface 733A that FIG. 7D illustrates. Accordingly, the projectile can comprise a fluid bearing that is a hybrid aerostatic-aerodynamic bearing. In such an embodiment, gas pressure supplied by the expanding propellant gas 26 can provide initial support for the rotor 775, and the spinning rotor can provide ongoing gas pressure for when the expanding propellant gas 26 has diminished or is no longer available. For example, the expanding propellant gas 26 can provide support during projectile launch when inertial force 85 of acceleration 4 (see FIG. 1I for illustrations of example embodiments) is greatest, and the aero spiral groove bearing 787 can provide sustained gas for support once acceleration 4 has declined or once the projectile 750 is traveling in open air towards a target or other destination. Accordingly, in some example embodiments, the projectile 750B that FIG. 7I illustrates can comprise the aero spiral groove bearing 787 that FIGS. 7D and 7E illustrate as described herein. The term "hybrid aerostatic-aerodynamic bearing," as used herein, generally refers to a bearing that can be characterized as an aerostatic bearing and can be characterized as an aerodynamic bearing.

Further, in some example embodiments, the projectile 750B that FIG. 7I illustrates can comprise the aero spiral groove bearing 787B that FIG. 7F illustrates as described herein. In some example embodiments, the projectile 750B that FIG. 7I illustrates can comprise the aero spiral groove bearing 787 or the aero spiral groove bearing 787B and can further comprise the aero spiral groove bearing 709 that FIG. 7G illustrates as described herein. In some example embodiments, the projectile 750B that FIG. 7I illustrates can comprise the aero spiral groove bearing 787 or the aero spiral groove bearing 787B and can further comprise the aero spiral groove bearing 709B that FIG. 7H illustrates as described herein.

Figure 8A:
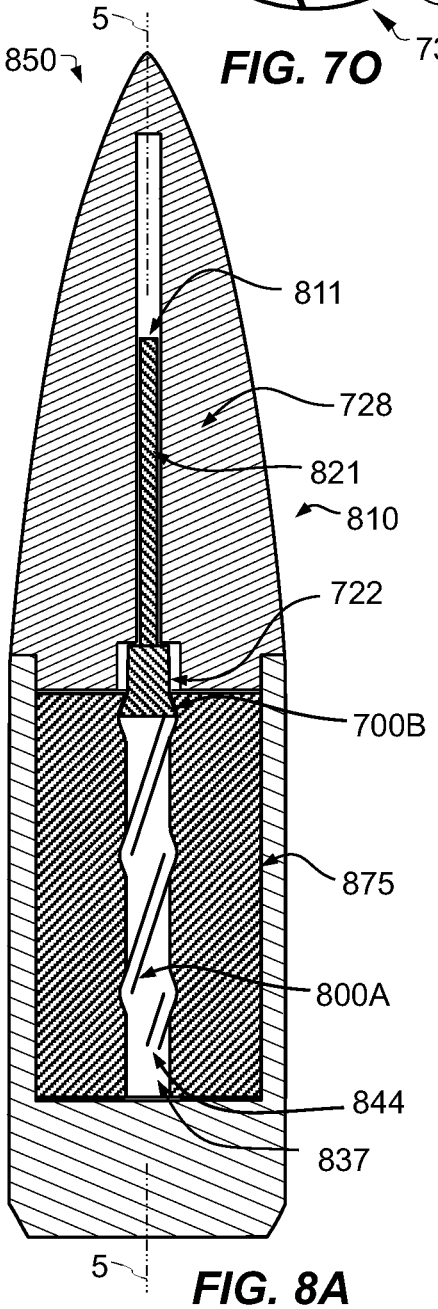
FIGS. 8A and 8B, collectively
Figure 8B:
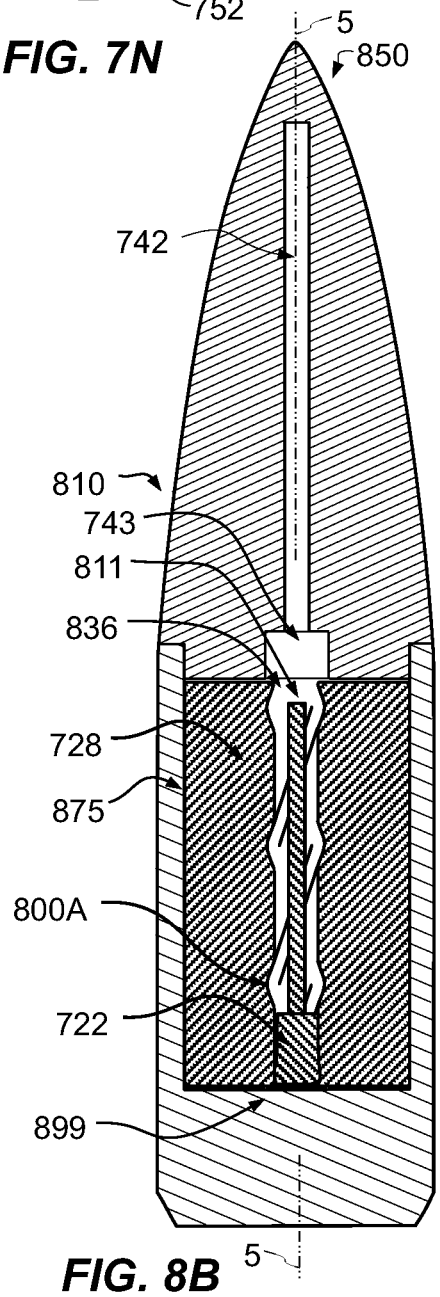

Turning now to FIGS. 8A and 8B, these figures illustrate an example projectile 850 that shares features with the projectile 750 that FIG. 7 illustrates as discussed above. Accordingly, the foregoing discussion referencing FIGS. 7A, 7B, 7C, 7D, 7E, 7F, 7G, 7H, 7I, 7J, 7K, and 7L applies generally to the projectile embodiment of FIGS. 8A and 8B. Features shared by the projectile 850 and the projectile 750 are discussed above with reference to FIGS. 7A, 7B, 7C, 7D, 7E, 7F, 7G, 7H, 7I, 7J, 7K, and 7L. FIGS. 8A and 8B illustrate cross sectional views of the projectile 850 in two respective example modes according to some embodiments of the disclosure. The mode of the projectile 850 that FIG. 8A illustrates corresponds generally to the mode of the projectile 150 illustrated by FIG. 1K as discussed above. The mode of the projectile 850 that FIG. 8B illustrates corresponds generally to the mode of the projectile 150 illustrated by FIG. 1L as discussed above. As discussed below, the projectile 850 comprises a drive 810 and a retainer 899 associated with the illustrated modes of the projectile 850. The projectile 850 comprises an example embodiment of a mechanism.

Example embodiments of the drive 810 can be incorporated in projectiles of guns, smoothbore guns, firearms, smoothbore firearms, light firearms, smoothbore light firearms, crew-served firearms, smoothbore crew-served firearms, light-gas guns, air guns, smoothbore air guns, railguns, or archery devices, including the disclosed examples thereof (not an exhaustive list). Example embodiments of the drive 810 can further be incorporated in other aeronautical systems, including in the disclosed examples of aeronautical systems.

Like the projectile 750, the example projectile 850 comprises a drive member 728 comprising a bar 821 having a forward end 811 and an end member 722 having a helix 700B. In the example mode of FIG. 8A, the bar 821, which is shortened relative to the embodiment of FIG. 7, is disposed in an elongated forward space 742. In cross section perpendicular to the projectile axis 5, the bar 821 and the elongated forward space 742 have mating square geometries that prevent rotation of the bar 821 in the elongated forward space 742 as illustrated in FIG. 7C and discussed above. In the mode of FIG. 8A, the end member 722 is partially disposed in a forward recessed space 743 and partially disposed in a central aperture 836 of a rotor 875 that the projectile 875 comprises.

The rotor 875 of the projectile 850 of FIGS. 8A and 8B corresponds to the rotor 775 of the projectile 750. The rotor 875 comprises a helix 800A that extends lengthwise in the central aperture 836 of the rotor 875 and ends in a rear section 837 of the central aperture 836. In the illustrated example embodiment of FIGS. 8A and 8B, the central aperture 836 and helix 800A of the rotor 875 are like the central aperture 736 and helix 700A of the rotor 775, except in the rear section 837 of the central aperture 836. The helix 800A does not continue through the rear section 837 of the central aperture 836 of the rotor 875 and has an end 844 in the rear section 837.

Under launch acceleration 4 of the projectile 850 of FIGS. 8A and 8B, inertial force 85 (see FIG. 1I for an illustration of an example embodiment) drives the drive member 728 rearward along the axis 5. The drive member 728 moves rearward from the starting position that FIG. 8A illustrates with the helix 700B of the end member 722 engaged with the helix 800B of the rotor 875. As the drive member 728 moves rearward, the engaged helices 800A, 700B drive rotation of the rotor 875. Once the forward end 811 of the bar 821 enters the forward recessed space 743, the mating square geometries of the bar 821 and the elongated forward space 742 no longer constrain the drive member 728 from rotating. Thus, when the bar 821 moves out of the elongated forward space 742, the drive member 728 becomes free to rotate. Then, the bar 821 can rotate with the rotor 825. The drive member 728 and the rotor 875 comprise an example embodiment of a helical pair.

In the illustrated example embodiment of FIGS. 8A and 8B, the drive member 728, the forward recessed space 743, and the rotor 875 are dimensioned so that the bar 821 exits the elongated forward space 742 and becomes free to rotate while the end member 722 is forward of the rear section 837 where the helix 800A ends. Thus, the helices 800A, 700B remain engaged when the drive member 728 becomes free to rotate. The drive member 728 can thus rotate within the rotor 875 and continue moving rearward. Inertial force 85 continues driving the end member 722 towards the rear section 837 while the helices 800A, 700B are engaged. As the drive member 728 moves rearward with the helices 800A, 700B engaged, the drive member 728 may rotate slightly faster than rotor 875 to advance rearward. Once the end member 722 enters the rear section 837, the helix 700B on the end member 722 encounters the end 844 of the helix 800A. At this encounter, the helix 700B jams against the rear section 837 of the rotor's central aperture 836 and wedges, thereby preventing farther rearward movement of the end member 722. The drive member 728 and the rotor 875 can thus spin in unison at the same rotational speed. The wedging of the helix 700B in the rear section 837 further provides a retaining function. With the helix 700B wedged, the retainer 899 retains the drive member 728 and prevents forward movement of the drive member 728 under the forward inertial force produced by deceleration of the projectile 850 due to air resistance or drag.

Some example embodiments of the projectile 850 can incorporate bearings disposed at adjoining surfaces subject to relative movement and load. Bearings can, for example, be disposed where contact between the rotor 875 and other portions of the projectile 850 occurs or could occur without bearings. The written description, including the figures and accompanying textual discussion, describes suitable bearing embodiments in detail with accompanying detailed teaching for implementation and practice. In some example embodiments, such bearings can comprise one or more aero spiral groove bearings that may, in some embodiments, be supported by one or more associated gas channels and/or one or more associated cavities from which gas may be drawn. In some example embodiments, such bearings can comprise one or more aerostatic bearings. In some example embodiments, the aerostatic bearings comprise one or more channels that direct expanding propellant gas 26 between the adjoining surfaces to provide a layer of pressured gas that provides a low-friction, load-bearing interface.

Figures 9A, 9B, 9C:
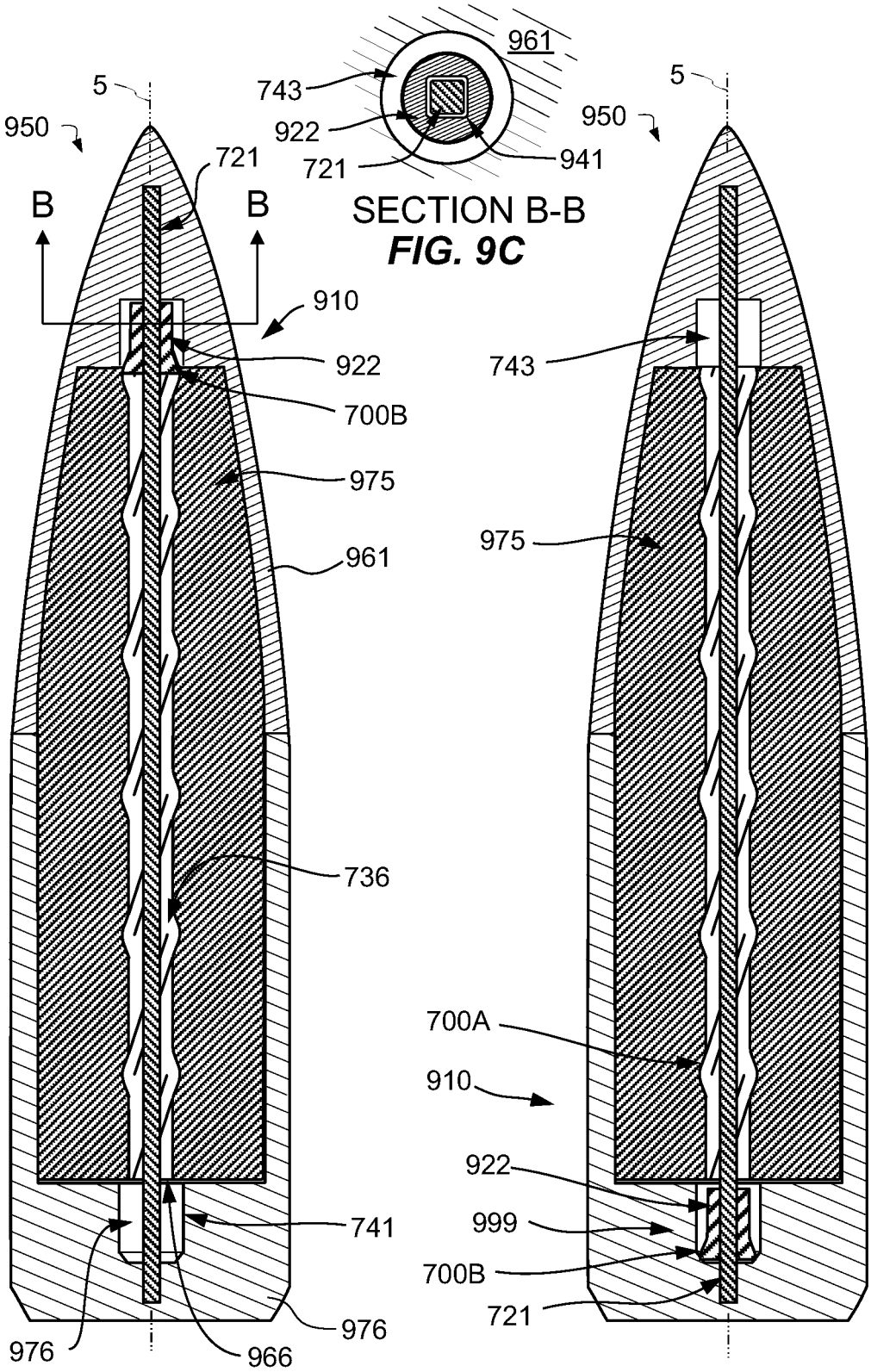
FIGS. 9A, 9B, and 9C, collectively

Turning now to FIGS. 9A, 9B, and 9C, these figures illustrate an example projectile 950 according to some embodiments of the disclosure. FIGS. 9A and 9B illustrate cross sectional views of the projectile 950, in two respective two modes according to some embodiments. FIG. 9C is a cross sectional illustration of the projectile 950 at Section B-B according to some embodiments. As discussed below, the projectile 950 comprises a drive 910 that converts axial movement into rotation. The projectile 950 comprises an example embodiment of a mechanism.

Example embodiments of the drive 910 can be incorporated in projectiles of guns, smoothbore guns, firearms, smoothbore firearms, light firearms, smoothbore light firearms, crew-served firearms, smoothbore crew-served firearms, light-gas guns, air guns, smoothbore air guns, railguns, or archery devices, including the disclosed examples thereof (not an exhaustive list). Example embodiments of the drive 910 can further be incorporated in other aeronautical systems, including in the disclosed examples of aeronautical systems.

The illustrated example projectile 950 comprises an example rotor 975 housed between a leading member 961 and a trailing member 976. As discussed above, bearings (not detailed in FIG. 9) can support the load of forces acting on the rotor 975 and provide a low-friction interface. As illustrated, the rotor 975 comprises a central aperture 736 that extends lengthwise through the rotor 975 along an axis 5 of the projectile 950. The rotor 975 further comprises a helix 700A that extends along the central aperture 736 and spirals about the axis 5.

An example bar 721 comprising a square cross section extends lengthwise through the central aperture 736 of the rotor 975. The bar 721 is anchored at opposing ends to the leading member 961 and to the trailing member 976. Thus in the illustrated example embodiment, the bar 721 and the projectile's exterior are rotationally fixed to one another. The bar 721 can be rotationally anchored to the leading member 961 by inserting the bar 721 into a square aperture formed in the leading member 961 as illustrated in FIG. 7C (in which reference number 742 points to a square aperture). The bar 721 can be rotationally anchored to the trailing member 976 in like manner.

The projectile 950 further comprises a drive member 922, which is disposed in a forward recessed space 743 in the mode that FIG. 9A illustrates. The drive member 922 comprises a square aperture 941 through which the bar 721 extends. The square aperture 941 is sized to accommodate the square cross sectional geometry of the bar 721. The square aperture 941 of the drive member 922 is further sized so that the drive member 922 can axially move smoothly along the bar 721. While clearance exists for axial movement of the drive member 922, the matching square cross sections of the square aperture 941 and the bar 721 prevent rotation of the drive member 922 about the bar 721. Thus, the geometries of the bar 721 and the drive member 922 provide for relative axial motion without relative rotation.

The drive member 922 further comprises a helix 700B. With the projectile 950 in the mode that FIG. 9A illustrates, the drive member 922 is retained in the forward recessed space 743 with the drive member's helix 700B engaged with the rotor's helix 700A. Responsive to detection of a predefined event or condition, the drive member 922 is released from retention in the forward recessed space 743. The projectile 950 can incorporate a conditional-release retainer that implements this conditional-release operation, for example a retainer comprising a magnet (see FIG. 1L, element 175), an elastomeric band (see FIG. 2A, element 279), a shear pin (see FIG. 4F, element 414), a serrated interface (see FIG. 5D), a breakable filament connection (see FIG. 7A, element 791), or other embodiment disclosed herein.

Once the drive member 922 is released, the drive member 922 can move rearward along a predefined path. In the illustrated example of FIGS. 9A and 9B, the bar 721 defines the predefined path of rearward motion, which is along the axis 5. Inertial force 85 (see FIG. 1I for an illustration of an example embodiment) moves the drive member 922 rearward with the rotational orientation of the drive member 922 fixed by the matching square cross sections of the bar 721 and the drive member's square aperture 941. As the drive member 922 moves rearward, the helix 700B of the drive member 922 rotates the rotor 975. The drive member 922 and the rotor 975 comprise an example embodiment of a helical pair. The drive member 922 continues driving rotation of the rotor 975 until the drive member 922 exits the rear end 966 of the central aperture 736. When the drive member 922 exits the central aperture's rear end 966, the helices 700A, 700B disengage and the drive member 922 enters a rear recess space 741 of the projectile 950. A section 976 of the bar 721 that is disposed in the rear recess space 741 tapers so that the bar's cross sectional size gradually increases as the bar 721 extends rearward in the rear recess space 741. The tapered section 976 slows the drive member's rearward movement and stops the drive member. The tapered section 976 of the bar 721 wedges in the drive member's square aperture 941. So wedged, the drive member 922 is retained in the rear position that FIG. 9B illustrates. Accordingly, a retainer 999 of the projectile 950 retains the drive member 992 against forward inertial force associated with air resistance decelerating the projectile 950 while the projectile 950 is traveling in open air.

In some example embodiments, the drive member 922 is composed of one metal and the rotor 975 is composed of another metal, wherein the metal of the drive member 922 is at least twice as dense as the metal of the rotor 975. For example, the drive member 922 can be formed of tungsten, while the rotor 975 is formed of carbon steel, copper, or copper alloy.

Some example embodiments of the projectile 950 can incorporate bearings disposed at adjoining surfaces subject to relative movement and load. Bearings can, for example, be disposed where contact between the rotor 975 and other portions of the projectile 950 occurs or could occur without bearings. The written description, including the figures and accompanying textual discussion, describes suitable bearing embodiments in detail with accompanying detailed teaching for implementation and practice. In some example embodiments, such bearings can comprise one or more aero spiral groove bearings that may, in some embodiments, be supported by one or more associated gas channels and/or one or more associated cavities from which gas may be drawn. In some example embodiments, such bearings can comprise one or more aerostatic bearings. In some example embodiments, the aerostatic bearings comprise one or more channels that direct expanding propellant gas 26 between the adjoining surfaces to provide a layer of pressured gas that provides a low-friction, load-bearing interface.

Figures 10A, 10B:
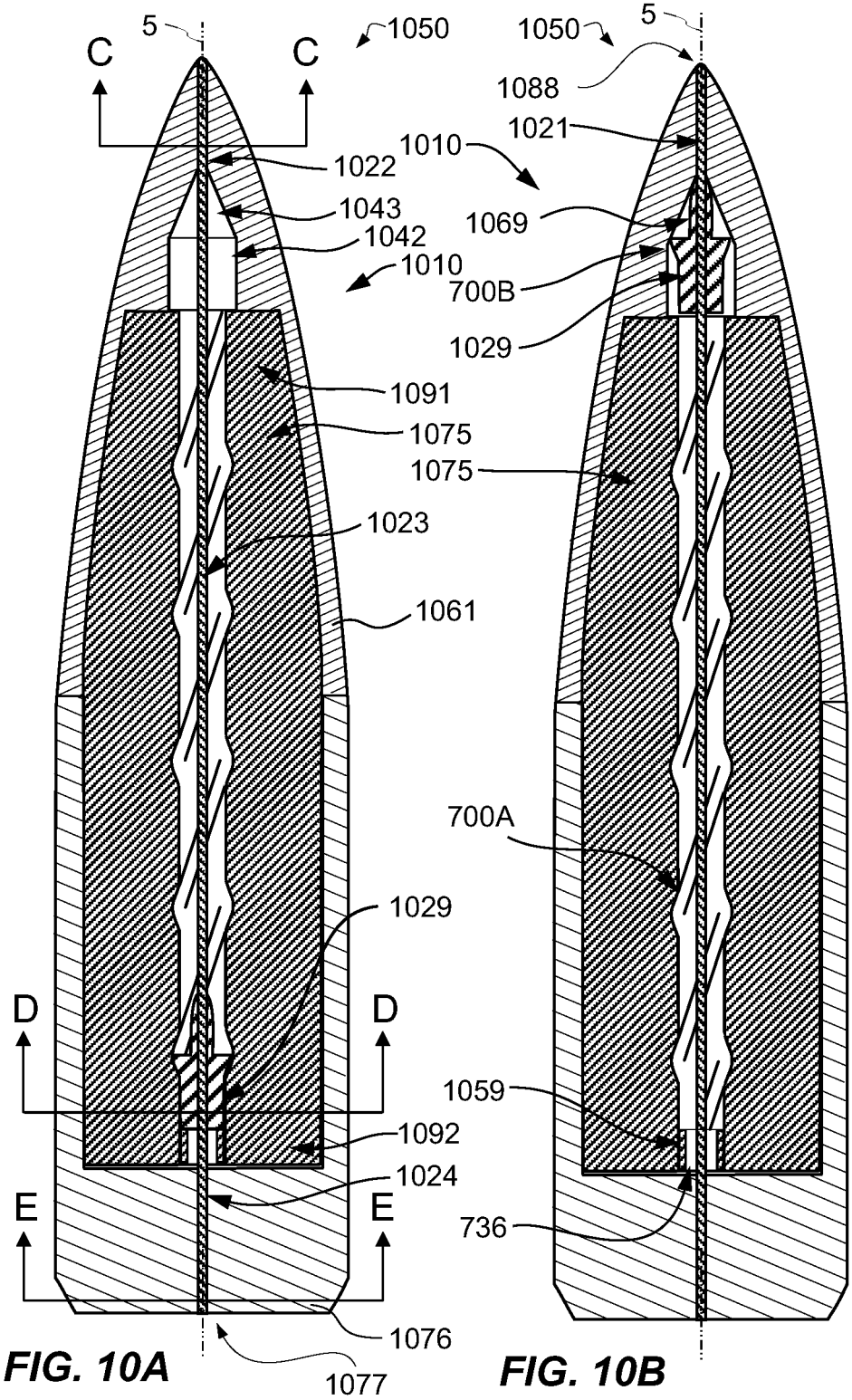
FIGS. 10A,10B, 10C, 10D, and 10E, collectively
Figure 10C:
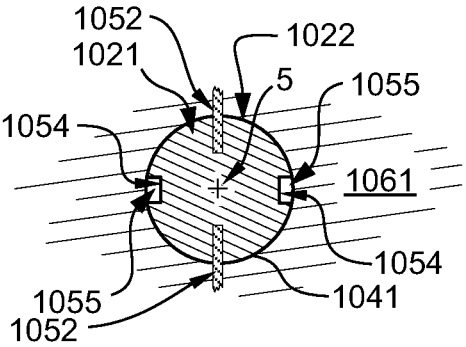
Figure 10D:
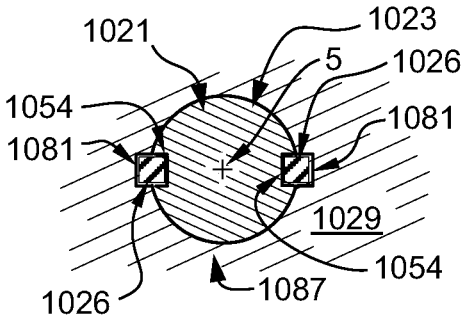
Figure 10E:
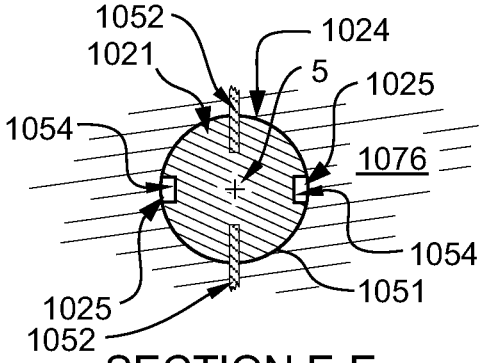

Turning now to FIGS. 10A,10B, 10C, 10D, and 10E, these figures illustrate an example projectile 1050 according to some embodiments of the disclosure. As discussed below, the projectile 1050 comprises an example embodiment of a drive 1010 that rotates a rotor 1075 of the projectile 1050. In the illustrated example as discussed below, the drive 1010 comprises an example embodiment of a gas drive. FIGS. 10A and 10B illustrate cross sectional views of the projectile 1050 in two respective example modes according to some embodiments. FIG. 10A illustrates an example mode prior to initiation of launch of the projectile 1050, for instance while the projectile 1050 is stored or is chambered in preparation for launching. FIG. 10B illustrates an example mode that can occur following launch of the projectile 1050, for instance while the projectile 1050 is travelling in open air towards a target or other destination. FIG. 10C illustrates a detail cross sectional view of a central region the projectile 1050 at Section C-C according to some embodiments. FIG. 10D illustrates a detail cross sectional view of a central region of the projectile 1050 at Section D-D according to some embodiments. FIG. 10E illustrates a detail cross sectional view of a central region of the projectile 1050 at Section E-E according to some embodiments. The projectile 1050 comprises an example embodiment of a mechanism.

The illustrated example projectile 1050 comprises an example bar 1021 that extends lengthwise along the axis 5 from a tip 1088 of the projectile 1050 to a trailing surface 1077 of the projectile 1050. The illustrated example bar 1021 comprises a cylindrical rod with two grooves 1054 that extend lengthwise. As illustrated in FIG. 10C, the bar 1021 extends through an axially disposed round hole 1041 in a leading member 1061 of the projectile 1050. As illustrated in FIG. 10E, the bar 1021 further extends through an axially disposed round hole 1051 in a trailing member 1076 of the projectile 1050. The axially disposed round holes 1041, 1051 are aligned with one another in the illustrated example. The leading and trailing members 1061, 1076 are fastened to one another and form an exterior of the projectile 1050 and house internal elements of the projectile 1050.

As further illustrated in FIG. 10C, example pins 1052 extend radially into the bar 1021 to rotationally anchor the bar 1021 to the leading member 1061 of the projectile 1050. As further illustrated in FIG. 10E, additional example pins 1052 also extend radially into the bar 1021 to rotationally anchor the bar 1021 to the trailing member 1076 of the projectile 1050. In some example embodiments, the bar 1021 is rotationally anchored to the leading and trailing members 1061, 1076 via welding, press fit, brazing, epoxy, or other another appropriate approach.

As illustrated in FIGS. 10A and 10B, the example bar 1021 extends through the rotor 1075 and a drive member 1029 that the projectile 1050 comprises. The drive member 1029 and the rotor 1075 comprise an example embodiment of a helical pair. The rotor 1075 comprises a central aperture 736 in which the drive member 1029 is disposed. A helix 700A formed in the rotor's central aperture 736 engages with a helix 700B formed on the drive member 1029. The drive member 1029 comprises an axial projection 1069 through which the drive member 1029 extends. In some example embodiments, the axial projection 1069 can be formed of relatively soft material, for example lead, PTFE, or an elastomer such as silicone, while the remainder of the drive member 1029 can be formed of a harder material, such as carbon steel, copper, or brass. In some example embodiments, the entire drive member 1029 can be formed of one material, for instance copper or PTFE.

The illustrated example bar 1021 comprises an example forward portion 1022, an example central portion 1023, and an example rear portion 1024. FIG. 10C provides a cross sectional view illustrating an example of the forward portion 1022 of the bar 1021. FIG. 10D provides a cross sectional view illustrating an example of the central portion 1023 of the bar 1021. FIG. 10E provides a cross sectional view illustrating an example of the rear portion 1024 of the bar 1021.

In the illustrated example, the forward portion 1022 of the bar 1021 extends from the tip 1088 of the projectile 1050 rearward to a forward axial region 1091 of the projectile 1050 that is rear of where the drive member 1029 is disposed when the drive member 1029 is in a forward position as illustrated in FIG. 10B. In the illustrated example, the rear portion 1024 of the bar 1021, extends from the trailing surface 1077 of the projectile 1050 forward to a rear axial region 1092 of the projectile 1050 where the drive member 1029 is disposed when the drive member 1029 is in a rear position as illustrated in FIG. 10A. In the illustrated example, the central portion 1023 of the bar 1021 extends between the forward and rear portions 1022, 1024 of the bar 1021.

In the illustrated example, the two grooves 1054 of the bar 1021 extend on opposing sides of the bar 1021 throughout the forward, central, and rear bar portions 1022, 1023, 1024. FIGS. 10C, 10D, and 10E provide example cross sectional views of the bar 1021 illustrating an example embodiment of the grooves 1054. In some example embodiments, each of the grooves 1054 comprises a respective keyseat. As illustrated by FIG. 10D, a respective key 1026 is seated in each groove 1054 in the central portion 1023 of the bar 1021. Each illustrated example key 1026 comprises bar stock or a bar having a square cross section. Each key 1026 is pressed into one of the grooves 1054 and is retained in the groove 1054 via mechanical interference. In length, the two keys 1026 extend throughout the central portion 1023 of the bar 1021, while the grooves 1054 are open in the forward and rear portions 1022, 1024 of the bar 1021. Thus, the central portion 1023 of the bar 1021 is keyed, while the forward and rear portions 1022, 1024 of the bar 1021 comprise open grooves 1054.

As illustrated in the cross sectional view of FIG. 10D, the drive member 1029 comprises two example grooves 1081 that extend lengthwise on opposite sides of the axis 5. The grooves 1081 are disposed and sized to receive the two keys 1026. The grooves 1081 are further oversized relative to the keys 1026 so that the drive member 1029 can move axially along the axis 5 with the keys 1026 disposed in the grooves 1081 of the drive member 1029 to prevent uncontrolled rotation of the drive member 1029. In some example embodiments, the grooves 1081 in the drive member 1029 comprise keyways. In the illustrated example, the projectile 1050 comprises an example keyed joint 1087. The keyed joint 1087 allows relative axial motion between the drive member 1029 and the bar 1022 and between the drive member 1029 and the leading and trailing projectile members 1061, 1076. The keyed joint 1087 further prevents uncontrolled relative rotational motion between the drive member 1029 and the bar 1021 and between the drive member 1029 and the leading and trailing projectile members 1061, 1076.

In the illustrated embodiment, the keys 1026 extend linearly. In some example embodiments (not illustrated by FIG. 10), the keys 1026 spiral about the axis 5 to provide rotation of the drive member 1029 during axial movement of the drive member 1029. Thus, the drive member 1029 can rotate while moving forward. Such rotation of the drive member 1029 can provide a compounding effect on rotation of the rotor 1075, for example. So configured, the drive 1010 can comprise an example embodiment of a compound helical drive. In some example embodiments, the spiraling keys 1026 have a constant helical rate. In some example embodiments, the spiraling keys 1026 have a progressively tightening helical rate.

Example embodiments of the drive 1010 can be incorporated in projectiles of guns, smoothbore guns, firearms, smoothbore firearms, light firearms, smoothbore light firearms, crew-served firearms, smoothbore crew-served firearms, light-gas guns, air guns, smoothbore air guns, railguns, or archery devices, including the disclosed examples thereof (not an exhaustive list). Example embodiments of the drive 1010 can further be incorporated in other aeronautical systems, including in the disclosed examples of aeronautical systems.

Referring now to FIG. 10E and FIGS. 10A and 10B, the open grooves 1054 in the rear portion 1024 of the bar 1021 provide channels 1025 that extend in the trailing member 1076 of the projectile 1050 from the trailing surface 1077 of the projectile 1050 to the central aperture 736 of the rotor 1075. The illustrated example channels 1025 further provide a passageway for gas flow in the rear axial region 1092 of the projectile 1050. In the illustrated embodiment, the channels 1025 are configured to transmit expanding propellant gas 26 (see FIG. 1I for an illustration of an example embodiment) from outside the projectile 1050 (rear of the projectile 1050), along the axis 5, and into the central aperture 736 of the rotor 1075.

Referring now to FIG. 10C and FIGS. 10A and 10B, the open grooves 1054 in the front portion 1022 of the bar 1021 provide channels 1055 that extend in the leading member 1061 of the projectile 1050 from the central aperture 736 of the rotor 1075 to the tip 1088 of the projectile 1050. The illustrated example channels 1055 further provide a passageway for forward gas flow out of the forward axial region 1091 of the projectile 1050. In the illustrated embodiment, the channels 1055 are configured to transmit expanding propellant gas 26 from the central aperture 736 of the rotor 1075, along the axis 5 to the tip 1088 of the projectile 1050, and outside of the projectile 1050 forward of the projectile 1050.

Referring now to FIG. 10D and FIGS. 10A and 10B, the central aperture 736 of the rotor 1075 provides a channel for expanding propellant gas 26 to transmit from the channels 1025 to the channels 1055. Thus, expanding propellant gas 26 can flow into the projectile 1050 through the channels 1025, lengthwise through the central aperture 736 of the rotor 1075, and out of the projectile 1050 through the channels 1055. The drive member 1029, however, obstructs gas flow through the central aperture 736 of the rotor 1075. Pressure of the expanding propellant gas 26 thus drives the drive member 1029 forward, so the drive member 1029 moves axially within the central aperture 736 of the rotor 1075. As illustrated and discussed, the drive member 1029 comprises an example embodiment of a piston. As discussed above, the drive member 1029 is keyed to the bar 1021. Accordingly, the drive member 1029 maintains a fixed or controlled angular orientation as the drive member 1029 moves axially along the central portion 1023 of the bar 1021. As the drive member 1029 moves forward from the position of FIG. 10A towards the position of FIG. 10B, engagement between the helix 700A and the helix 100B produces rotation of the rotor 1075.

In some example embodiments, the drive member 1029 is composed of one metal and the rotor 1075 is composed of another metal, wherein the metal of the rotor 1075 is at least twice as dense as the metal of the drive member 1029. For example, the rotor 1075 can be formed of tungsten, while the drive member 1029 is formed of carbon steel, copper, or copper alloy.

The resulting rotation of the rotor 1075 can gyroscopically stabilize the projectile 1050 in some example embodiments. Some example embodiments of the projectile 1050 comprise bearings for supporting load and rotation of the rotor 1075. Some example embodiments of the projectile 1050 can incorporate bearings disposed at adjoining surfaces subject to relative movement and load. Bearings can, for example, be disposed where contact between the rotor 1075 and other portions of the projectile 1050 occurs or could occur without bearings. The written description, including the figures and accompanying textual discussion, describes suitable bearing embodiments in detail with accompanying detailed teaching for implementation and practice. In some example embodiments, such bearings can comprise one or more aero spiral groove bearings that may, in some embodiments, be supported by one or more associated gas channels and/or one or more associated cavities from which gas may be drawn. In some example embodiments, such bearings can comprise one or more aerostatic bearings. In some example embodiments, the aerostatic bearings comprise one or more channels that direct expanding propellant gas 26 between the adjoining surfaces to provide a layer of pressured gas that provides a low-friction, load-bearing interface.

As illustrated by FIGS. 10A and 10B, the rotor 1075 of the projectile 1050 comprises a rear insert 1059 that is disposed in the rotor's central aperture 736 and that provides a shoulder adjoining the drive member 1029 in the mode that FIG. 10A illustrates. The illustrated rear insert 1059 comprises a retainer that retains the drive member 1029 in the rear position of FIG. 10A. Drive-member retention can be set during projectile assembly. In some example embodiments (not illustrated), the rotor 1075 can comprise multiple sections that facilitate access to the rotor's central aperture 736 and that are joined to one another during projectile assembly. In the illustrated embodiment, during assembly, the rotor 1075 can be manually rotated in a rotational direction that is opposite the rotational direction produced by the forward movement of the drive member 1029 that occurs when the projectile transitions from the mode of FIG. 10A to the mode of FIG. 10B. Such manual rotation of the rotor 1075 can advance the drive member 1029 rearward against the rear insert 1059. The resulting force between the rear insert 1059 and the drive member 1029 can lodge the drive member 1029 against the rear insert 1050. Influx of pressure from the expanding propellant gas 26 during projectile launch can dislodge the drive member 1029, so the dislodged drive member 1029 can move forward and produce rotation of the rotor 1075. The rear insert 1059 can be fixed into the central aperture 736 of the rotor 1075 by press fit, adhesive, brazing, pinning, threads, or other appropriate approach. As an alternative to the retainer that FIGS. 10A and 10B illustrate, the projectile 1050 can comprise another retainer embodiments provided by the present written description.

As illustrated by FIGS. 10A and 10B, the example leading member 1061 comprises a forward recessed space 1042 through which the forward portion 1022 of the bar 1021 extends. As discussed above, the forward portion 1022 of the bar 1021 comprises two grooves 1054 that are open and provide channels 1055 for gas flow. The forward recessed space 1042 is sized to receive the drive member 1029 as illustrated in FIG. 10B. In the illustrated embodiment, the forward recessed space 1042 comprises a tapered region 1043 with an internal diameter that gradually decreases with forward extension. In operation, the expanding propellant gas 26 drives the drive member 1029 in the central aperture 736 of the rotor 1075 to drive rotation of the rotor 1075. The expanding propellant gas 26 further expels the drive member 1029 out of the central aperture 736 and into the forward recessed space 1042. Once the drive member 1029 is disposed in the forward recessed space 1042, the expanding propellant gas 26 drives the axial projection 1069 of the drive member 1029 into the tapered region 1043. Driven by the expanding propellant gas 26, the axial projection 1069 wedges into the tapered region 1043 and further deforms into the grooves 1054. Accordingly, the grooves 1054 are obstructed and the channels 1055 are sealed. The drive member 1029 is further captured in the forward recessed space 1042 and the rotor 1075 is provided sufficient clearance to spin freely.

Figure 11C:
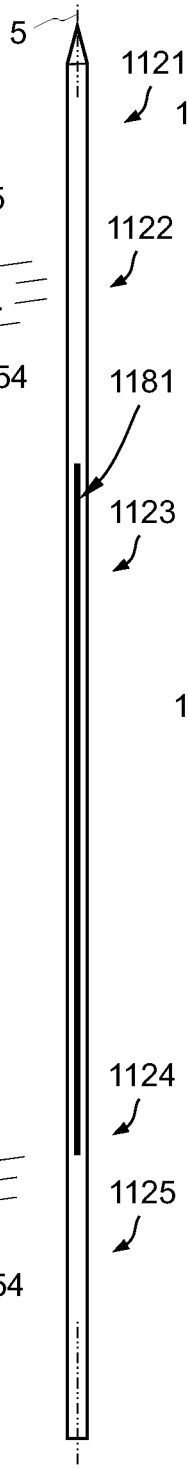
FIGS. 11A, 11B, 11C, 11D, 11E, 11F, and 11G, collectively
Figure 11D:
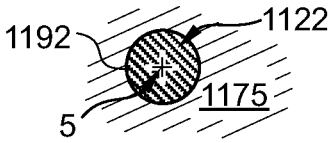
Figure 11E:
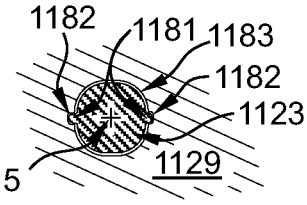
Figure 11F:
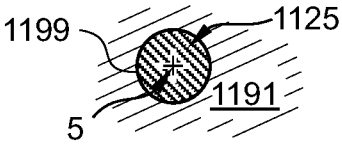
Figure 11G:
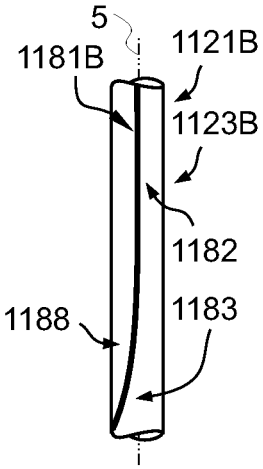
Figures 11A, 11B:
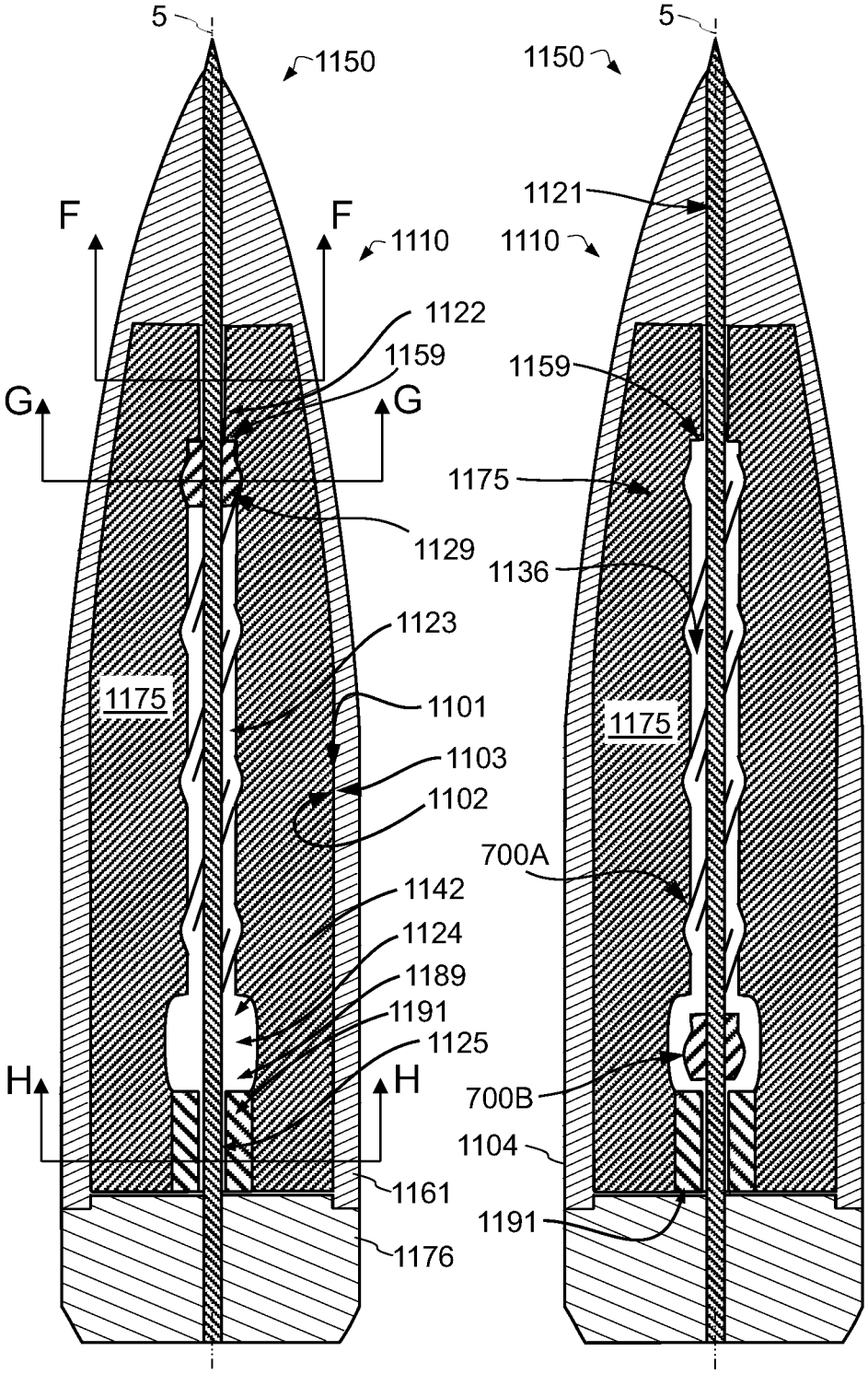

Turning now to FIGS. 11A, 11B, 11C, 11D, 11E, 11F, and 11G, these figures illustrate an example projectile 1150 according to some embodiments of the disclosure. FIGS. 11A and 11B illustrate cross sectional views of the projectile 1150 in two respective example modes according to some embodiments. FIG. 11C illustrates an example bar 1121 that the projectile 1150 comprises according to some embodiments. FIG. 11D illustrates a detail cross sectional view of a central region of the projectile 1150 at Section F-F showing an example forward portion 1122 of the bar 1121 according to some embodiments. FIG. 11E illustrates a detail cross sectional view of a central region of the projectile 1150 at Section G-G showing an example central portion 1123 of the bar 1121 according to some embodiments. FIG. 11F illustrates a detail cross sectional view of a central region of the projectile 1150 at Section H-H showing an example rear portion 1125 of the bar 1121 according to some embodiments. FIG. 11G illustrates a section of an example bar 1121B that the projectile 1150 may comprise as an alternative to the bar 1121 that FIG. 11C illustrates according to some embodiments. The projectile 1150 comprises an example embodiment of a mechanism.

The illustrated example projectile 1150 comprises a leading member 1161 and a trailing member 1176 that are attached to one another, for example via threads or welding. So attached, the leading and trailing members 1161, 1176 form a housing or an enclosure with an exterior surface 1104. Attached together as illustrated, the leading and trailing members 1161, 1176 house and enclose a drive 1110 that comprises an example rotor 1175 and an example drive member 1129. In the illustrated example of FIGS. 11A and 11B, the rotor 1175 is annularly spaced from the leading member 1161. That is, the projectile 1150 comprises a gap or annulus 1101 between the rotor's exterior side surface 1102 and the leading member's interior surface 1103.

As illustrated in FIGS. 11A and 11B, the bar 1121 extends along an axis 5 of the projectile 1150 and is anchored to the leading and trailing members 1161, 1176 at opposing ends of the projectile 1150. In some example embodiments, forward and rear portions 1122, 1125 of the bar 1121 can be anchored respectively to the leading and trailing members 1161, 1176 via welding, brazing, soldering, or press fitting. In the illustrated embodiment of FIG. 11, the bar 1121, the leading member 1161, and the trailing member 1176 are positionally anchored together so they move as a unit. That is, the bar 1121, the leading member 1161, and the trailing member 1176 are anchored to one another to inhibit or to generally prevent relative rotational or axial motion among the bar 1121, the leading member 1161, and the trailing member 1176. Accordingly, the exterior surface 1104 of the projectile 1150 is rotationally fixed with respect to the bar 1121 in the example embodiment that FIG. 11 illustrates.

The bar 1121 extends through an example central aperture 1136 of the rotor 1175 and through the drive member 1129, which is disposed within the central aperture 1136 in the illustrated embodiment. The drive member 1129 and the rotor 1175 comprise an example embodiment of a helical pair. The rotor 1175 comprises a bushing 1191, a cavity 1142 that is forward of the bushing 1191, a helix 700A that is formed in the central aperture 1136 and that is forward of the cavity 1142, and a narrowed bore region 1192 that is forward of the helix 700A.

The forward portion 1122 of the bar 1121 extends through the narrowed bore region 1192 of the rotor 1175 and comprises an axle for the rotor 1175. As illustrated in FIG. 11D, the bar's forward portion 1122 is cylindrical and comprises a circular cross section. As further illustrated, the rotor's narrowed bore region 1192 comprises a circular cross section that is sized to receive the bar's forward portion 1122. In the illustrated example embodiment, the narrowed bore region 1192 provides a bearing surface for the forward portion 1122 of the bar 1121. In operation, the bar's forward portion 1122 and the narrowed bore region 1192 can cooperatively support the rotor 1175 while the rotor 1175 rotates. In some example embodiments, the projectile 1150 comprises a bearing disposed where the narrowed bore region 1192 adjoins the forward portion 1122 of the bar 1121. The written description discloses embodiments of such bearings suitable for incorporation in the projectile 1150.

Some example embodiments of the projectile 1150 can incorporate bearings disposed at adjoining surfaces subject to relative movement and load. Bearings can, for example, be disposed where contact between the rotor 1175 and other portions of the projectile 1150 occurs or could occur without bearings. The written description, including the figures and accompanying textual discussion, describes suitable bearing embodiments in detail with accompanying detailed teaching for implementation and practice. In some example embodiments, such bearings can comprise one or more aero spiral groove bearings that may, in some embodiments, be supported by one or more associated gas channels and/or one or more associated cavities from which gas may be drawn. In some example embodiments, such bearings can comprise one or more aerostatic bearings. In some example embodiments, the aerostatic bearings comprise one or more channels that direct expanding propellant gas 26 between the adjoining surfaces to provide a layer of pressured gas that provides a low-friction, load-bearing interface.

In the illustrated example, the bushing 1191 is insertable into the central aperture 1136 of the rotor 1175 during projectile assembly. Accordingly, the drive member 1129 can be inserted into the rotor's central aperture 1136 prior to insertion of the bushing 1191. During projectile assembly, the drive member 1129 can be rotated in a direction that advances the drive member 1129 forward towards a shoulder 1159 within the rotor 1175. The drive member 1129 can be rotated farther until the drive member 1129 jams against the shoulder 1159. So jammed, the drive member 1129 can be retained in the forward position that FIG. 11A illustrates until launch of the projectile 1150. Launch of the projectile 1150 can dislodge the drive member 1129 for rearward axial motion as discussed below.

As illustrated, the rear portion 1125 of the bar 1121 extends through the bushing 1191 of the rotor 1175 and comprises an axle for the rotor 1175. As illustrated in FIG. 11F, the bar's rear portion 1125 is cylindrical and comprises a circular cross section. As further illustrated, the rotor's bushing 1191 comprises a bore 1199 of circular cross section that is sized to receive the bar's rear portion 1125. In the illustrated example embodiment, the bushing 1191 provides a bearing surface for the rear portion 1125 of the bar 1121. In operation, the bar's rear portion 1125 and the bushing 1191 can cooperatively support the rotor 1175 while the rotor 1175 is spinning. In some example embodiments, the bushing 1191 comprises a bearing. The written description discloses embodiments of such bearings suitable for incorporation in the projectile 1150.

In the illustrated example embodiment, the bushing 1191 is pressed into the central aperture 1136 of the rotor 1175 so the bushing 1191 effectively becomes part of the rotor 1175. Relative rotational motion can accordingly occur between the bushing 1191 and the bar's rear portion 1125. As alternative to pressing the bushing 1191 into the central aperture 1136, in some example embodiments, the bushing 1191 comprises external threads, the central aperture 1136 comprises internal threads, and the bushing 1191 screws into the rotor 1175 via these threads. In some example embodiments, the rotor 1175 is internally machined to provide the dimensions of the bushing 1191 without utilizing the bushing 1191. To facilitate access to the central aperture 1136 during projectile assembly in such an embodiment, the rotor 1175 can be fabricated as two threaded components (not illustrated by FIG. 11) that are screwed together during projectile assembly. In some example embodiments, the bar's rear portion 1125 is pressed into the bushing 1191 so the bushing 1191 effectively becomes part of the bar 1121. Relative rotational motion can accordingly occur between the bushing 1191 and the rotor 1175. In some example embodiments, the rear portion 1125 of the bar 1121 is diametrically enlarged rather than utilizing the bushing 1191. For example, the rear portion 1125 of the bar 1121 can be machined to provide a seamless step change in diameter with contours and dimensions corresponding to the bushing 1191.

The central portion 1123 of the bar 1121 extends through the central aperture 1136 of the rotor 1175. The bar's central portion 1123 further extends through an aperture 1183 of the drive member 1129. As illustrated, the drive member 1129 can move axially with respect to the central portion 1123 of the bar 1121 while rotational movement is controlled or prevented. The illustrated connection between the drive member 1129 and the bar's central portion 1123 comprises an example embodiment of a keyed joint. The illustrated connection between the drive member 1129 and the bar's central portion 1123 further comprises an example embodiment of a spline joint. As illustrated by FIG. 11E, the central portion 1123 of the bar 1121 comprises two radial projections 1181 that are disposed on opposing sides of the bar 1121 and that extend lengthwise along the axis 5. As illustrated, the radial projections 1181 comprise an embodiment of a key and further comprise an embodiment of a spline. The radial projections 1181 extend respectively into two grooves 1182 formed in the aperture 1183 of the drive member 1129. As illustrated, the grooves 1182 and the radial projections 1181 are mated to one another. The grooves 1182 comprise keyways in the illustrated embodiment. The aperture 1183 and grooves 1182 of the drive member 1129 and the central portion 1123 and radial projections 1181 of the bar 1121 are fitted so that the drive member 1129 is axially moveable and rotationally fixed with respect to the central portion 1123 of the bar 1121.

In the illustrated example embodiment, the bar 1121 comprises an intermediate portion 1124 that is disposed between the bar's rear portion 1125 and the bar's central portion 1123. As illustrated in FIGS. 11A and 11B, the intermediate portion 1124 of the bar 1121 is disposed in the cavity 1142 of the rotor 1175. In the bar's intermediate portion 1124, with rearward extension of the bar 1121, the radial projections 1181 gradually increase in size and then end just forward of where the bar 1121 enters the bore 1199 of the bushing 1191. That is, as the intermediate portion 1124 of the bar 1121 extends rearward from the bar's central portion 1123 towards the bar's rear portion 1125, the radial projections 1181 can progressively grow in size. The growth in size can comprise an increase in height and/or width of each radial projection 1181. As the radial projections 1181 increase in size, clearance between the intermediate portion 1124 of the bar 1121 and the drive member 1129 decreases. With this increase in size, the intermediate portion 1124 of the bar 1121 and the drive member 1129 mechanically interfere with one another at a rear portion 1189 of the cavity 1142.

In an example operation, the projectile 1150 can be launched from the mode that FIG. 11A illustrates, in which the drive member 1129 is disposed in a forward position against the shoulder 1159 of the rotor 1175. Launch forces can release the drive member 1129 from the forward position. With forward acceleration 4 of the projectile 1150, inertial force 85 (see FIG. 1I for an illustration of an example embodiment) drive the released drive member 1129 rearward within the central aperture 1136 of the rotor 1175. The drive member 1129 moves axially along the central portion 1123 of the bar 1121, while the mated projections 1181 and grooves 1182 keep the drive member 1129 and the bar 1121 in a common rotational orientation. As discussed above, the bar 1121, the forward member 1161, and the trailing member 1176 are anchored to one another and move as a unit that includes the exterior surface 1104 of the projectile 1150. The drive member 1129 thus moves axially relative to the bar 1121, the forward member 1161, the trailing member 1176, and the projectile's exterior surface 1104. The drive member 1129 maintains a fixed rotational orientation relative to the bar 1121, the forward member 1161, the trailing member 1176, and the projectile's exterior surface 1104 during axial motion.

The helix 700B of the drive member 1129 and the helix 700A of the rotor 1175 are engaged as the drive member 1129 moves rearward. The helical engagement drives rotation of the rotor 1175 about the axis 5 of the projectile. The forward and rear portions of the bar 1122 comprise an axle or axles that support the rotor 1175 as the rotor 1175 gains rotational speed. Bearings, embodiments of which are described herein in detail, can further support the rotor 1175 during and following rotational acceleration.

Once the drive member 1129 moves sufficiently rearward towards the rear position that FIG. 11B illustrates, the drive member 1129 enters the cavity 1142 of the rotor 1175. When the drive member 1129 enters the cavity 1142, the drive member's helix 700B separates from the rotor's helix 700A. The helices 700A, 700B thus disengage. With the helices 700A, 700B disengaged, the rotor 1175 spins freely. The annulus 1101 between the exterior side surface 1102 of the rotor 1175 and the interior surface 1103 of the leading member 1161 avoids contact at the exterior side surface 1102 of the spinning rotor 1175 for low-friction rotation in some example embodiments. The spinning rotor 1175 can produce sufficient angular momentum to gyroscopically stabilize the projectile 1150 in some example embodiments.

As the drive member 1129 moves rearward within the rotor's cavity 1142, the progressively increasing size of the radial projections 1181 on the intermediate portion 1124 of the bar 1121 brake the drive member's axial motion. In some example embodiments, braking friction increases gradually to slow the drive member 1129 gradually. Mechanical interference between the drive member 1129 and the intermediate portion 1124 of the bar 1121 occurs in the rear portion 1189 of the rotor's cavity 1142. The intermediate portion 1124 of the bar 1121 thus wedges into the aperture 1183 of the drive member 1129, and the projectile 1150 assumes the mode that FIG. 11B illustrates. So wedged, the drive member 1129 is retained in the rear position of FIG. 11B. The wedging of the drive member 1129 can retain the rear position while the projectile 1150 travels in open air and decelerates due to air resistance or drag.

In some example embodiments, the helix 700A inside the rotor 1175 comprises a progressive helical rate. The drive 1110 can comprise a soft starter that reduces or manages load and torque for starting rotation of the rotor 1175 and building rotational speed. The soft starter can reduce mechanical stress associated with starting rotation of the rotor 1175 and accelerating the rotor 1175. In some example embodiments of the soft starter, the helix 700A starts without any twist and then progressively gains twist with rearward extension. In such an embodiment, the drive member 1129 can start moving rearward (from the forward position of FIG. 11A) without rotating the rotor 1175. Thus, the drive member 1129 can start moving rearward unencumbered by a load of applying torque to the rotor 1175. After the drive member 1129 has started moving rearward, a progressively increasing helical rate of the helix 700A can drive accelerated rotation of the rotor 1175.

Example embodiments of the drive 1110 can be incorporated in projectiles of guns, smoothbore guns, firearms, smoothbore firearms, light firearms, smoothbore light firearms, crew-served firearms, smoothbore crew-served firearms, light-gas guns, air guns, smoothbore air guns, railguns, or archery devices, including the disclosed examples thereof (not an exhaustive list). Example embodiments of the drive 1110 can further be incorporated in other aeronautical systems, including in the disclosed examples of aeronautical systems.

Turning now to FIG. 11G, some example embodiments of the drive 1110 comprising a soft starter will be discussed and some example embodiments comprising a compound helical drive will be discussed. FIG. 11G illustrates an example embodiment of a bar 1121B that comprises a helix 1188 and that replaces the bar 1121 illustrated by FIGS. 11A, 11B, 11C, 11D, 11E, and 11F as discussed above. FIG. 11G illustrates a representative section of a central portion 1123B of the bar 1121B corresponding to the central portion 1123 of the bar 1121. Other than different central portions 1123, 1123B, the illustrated bars 1121 and 1121B have common features. The central portion 1123B of the bar 1121B comprises two radial projections 1181B that spiral about the axis 5 and form the helix 1188. The two radial projections 1181B are on opposite sides of the bar 1121B, so that one of the two radial projections 1181B is visible in the view of FIG. 11G, while the other is hidden. In some example embodiments, when viewed in a cross section taken perpendicular to the axis 5 (corresponding to the cross sectional view of FIG. 11E), the radial projections 1181B of the bar 1121B and the radial projections 1181 of the bar 1121 have common geometries.

The bar 1121B that FIG. 11G illustrates comprises an example embodiment of a soft starter that manages load and torque for starting and accelerating rotation of the rotor 1175. As illustrated by FIG. 11G, the helix 1188 comprises a forward section 1182 in which each of the radial projections 1181 extends linearly along the axis 5 and a rear section 1183 in which the radial projections 1181 spiral about the axis 5. The helix 1188 gradually transitions from linear to spiraling between the forward and rear sections 1182, 1183. In an example soft-start operation, the drive member 1129 axially moves rearward over the forward section 1182 of the helix 1188 without rotating and begins rotating about the axis 5 as the drive member 1129 moves from the forward section 1182 to the rear section 1183 of the helix 1188.

While the drive member 1129 is moving over the forward section 1183 of the helix 1188, engagement between the helix 700A and the helix 700B rotates the rotor 1175 consistent with the foregoing discussion of FIGS. 11A, 11B, 11C, 11D, 11E, and 11F. When the drive member 1129 is moving over the rear section 1182 of the helix 1188, the drive member 1129 rotates about the axis 5 as the drive member 1129 moves rearward. As part of the drive member 1129, the helix 700B rotates about the axis 5 along with the drive member's rotation about the axis 5. Rotation of the rotor 1175 is thus driven by the axial motion of the helix 700B and by the rotation of the helix 700B about the axis. The two effects compound with a result of amplifying the rotor's rotational speed. Driving rotation of the rotor 1175 using a compound helical drive can increase the rotational rate of the rotor 1175.

In the rear section 1183, the helix 1188 can comprise a progressive helical rate in some embodiments. Accordingly, initial torque applied to the rotor 1175 can be relatively low, and torque can progressively increase as the rotor 1175 is driven to a target rotational rate or a target speed of rotation. Peak load and mechanical stresses associated imparting the projectile 1150 with angular momentum can be reduced. The resulting reduction of mechanical stresses can facilitate a broader range of material selections and configurations that might not be compatible with higher stresses.

In the foregoing discussion of FIGS. 11A, 11B, 11C, 11D, 11E, 11F, and 11G, acceleration 4 of the projectile 1150 during launch produces inertial force 85 (see FIG. 1I for an illustration of an example embodiment) that drives the drive member 1129 rearward from the forward position that FIG. 11A illustrates to the rear position that FIG. 11B illustrates. Alternatively, expanding propellant gas 26 (see FIG. 1I for an illustration of an example embodiment) can drive the drive member 1129 from a rear position to a forward position, with the forward motion producing rotor rotation. FIGS. 10A, 10B, 10C, 10D, and 10E illustrate an example projectile embodiment that can operate on this principle as discussed above. The projectile 1150 illustrated by FIGS. 11A and 11B can be reconfigured so that expanding propellant gas 26 moves the drive member 1129 forward and the drive member's forward movement produces rotor rotation. In an example embodiment, the reconfiguration can comprise flipping the internal elements of the projectile 1150 so that rear elements are moved to the front and front elements are moved to the rear. With the internal elements so flipped, a rear channel can channel the expanding propellant gas 26 into the projectile 1150 and a forward channel can channel the expanding propellant gas 26 out of the projectile 1150.

Figure 12A:
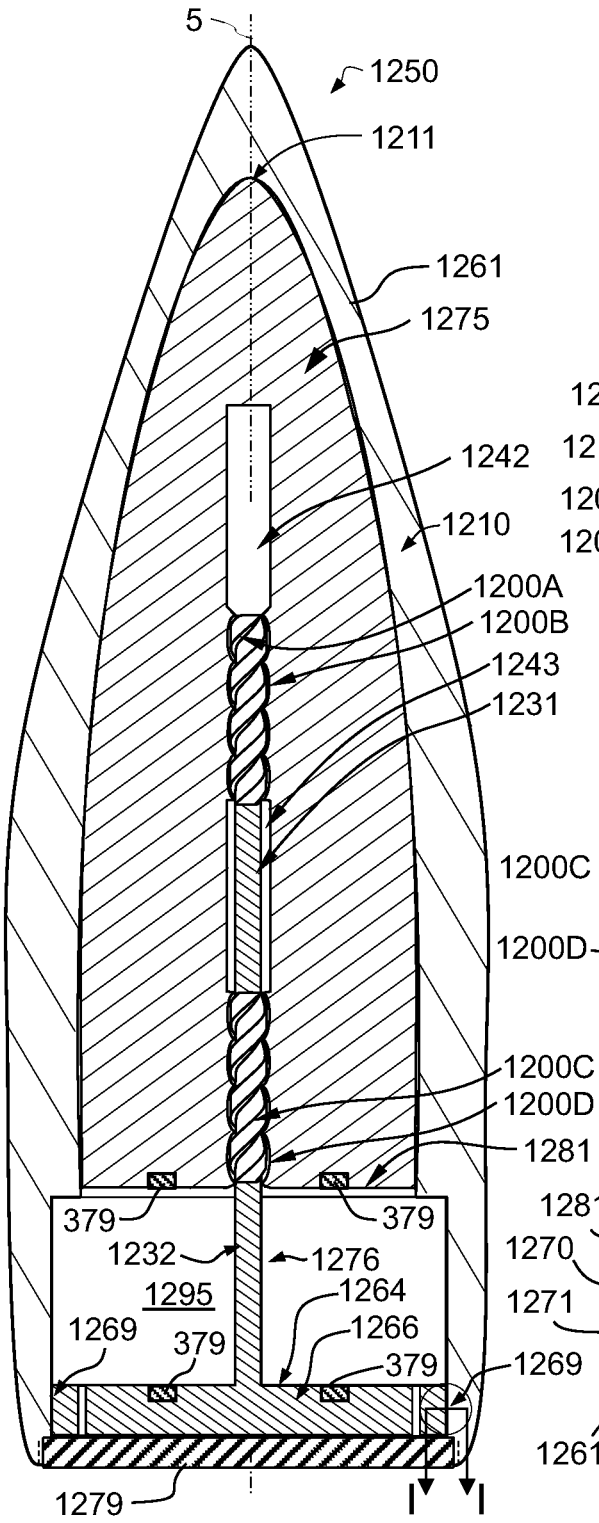
FIGS. 12A, 12B, 12C, 12D, 12E, 12F, 12G, 12H, and 12I, collectively
Figure 12B:
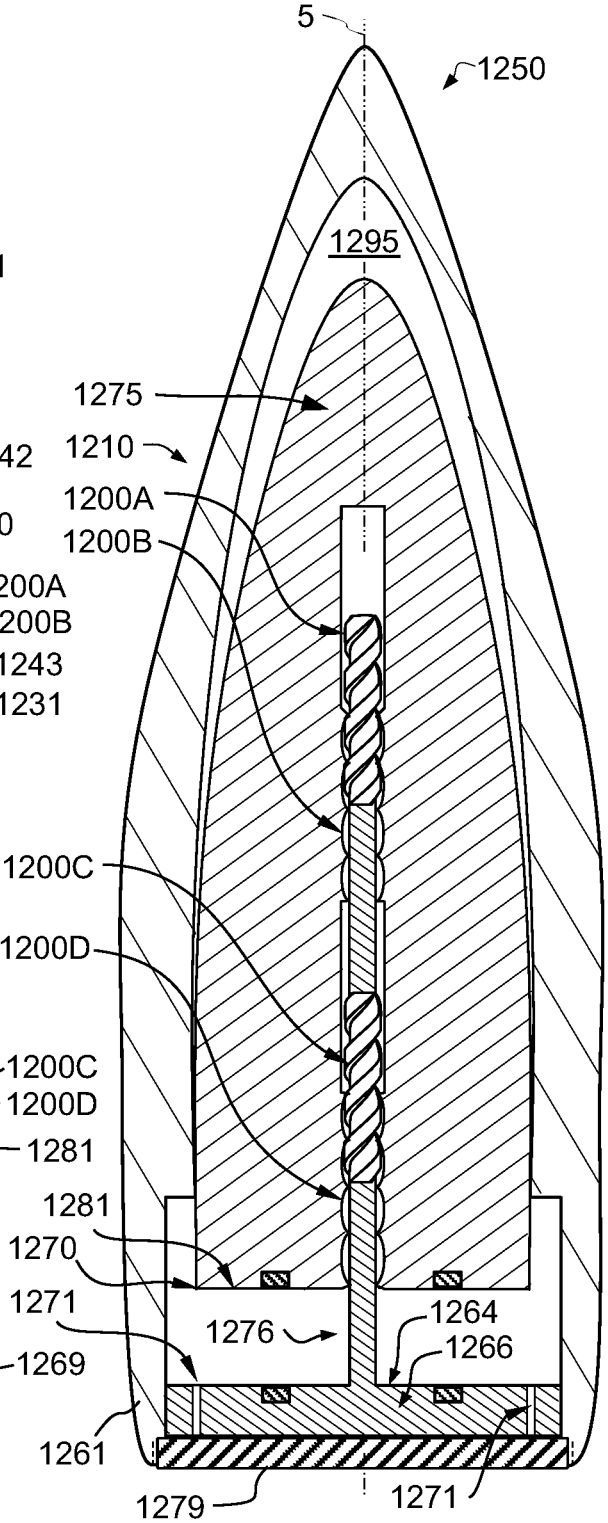
Figure 12C:
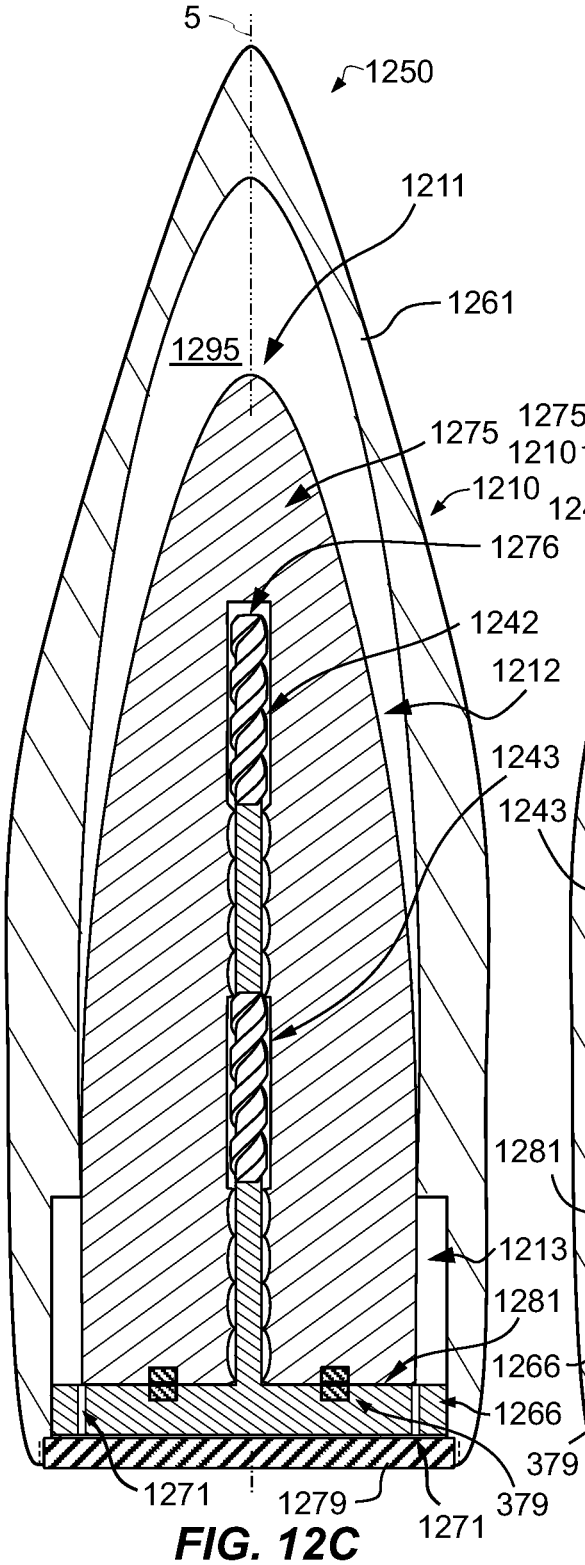
Figure 12D:
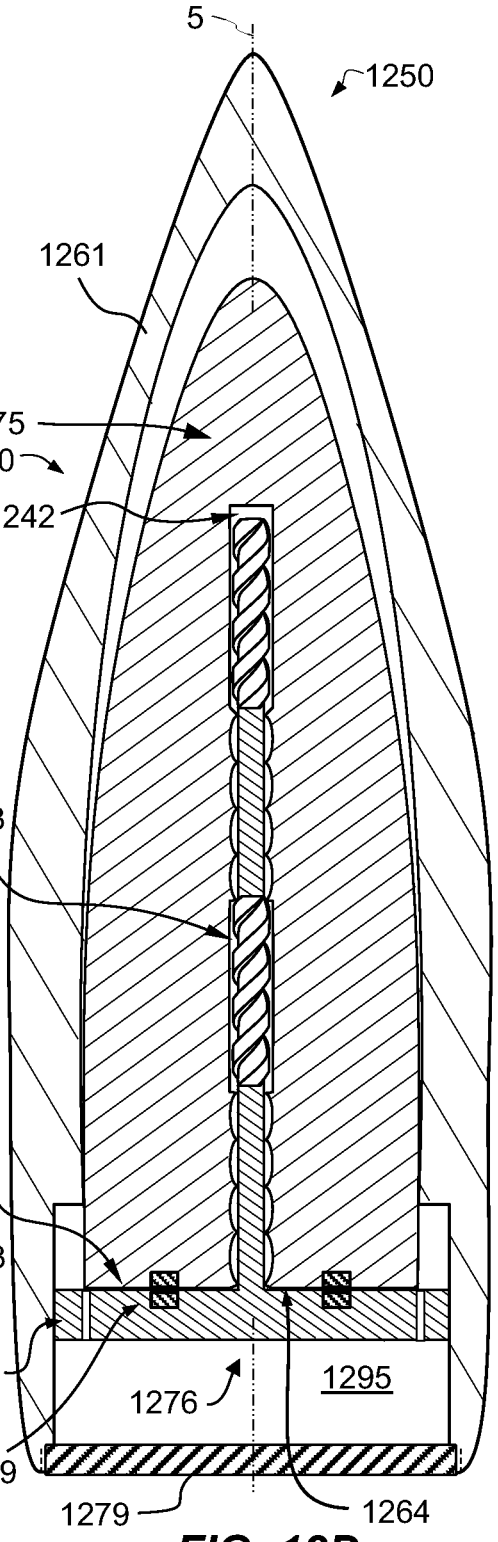
Figure 12E:
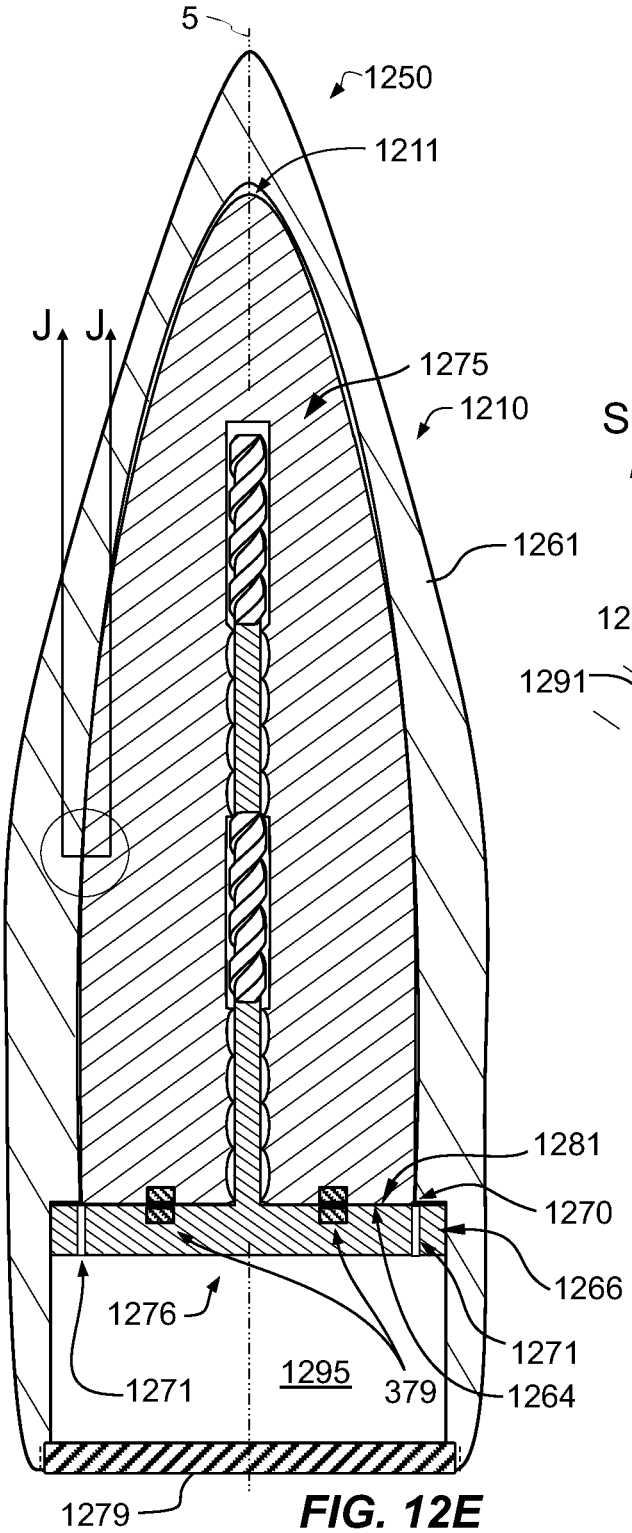
Figure 12F:
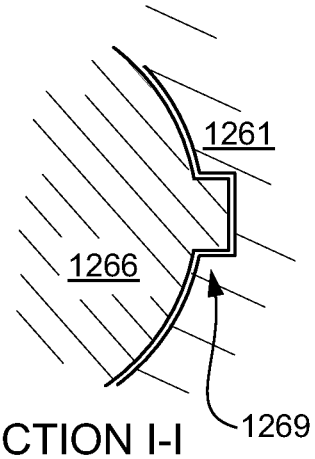
Figure 12G:
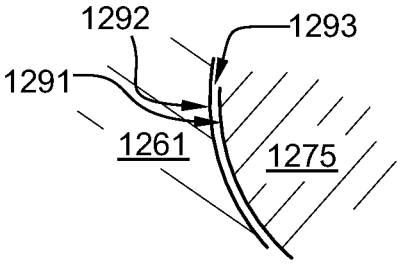
Figure 12H:
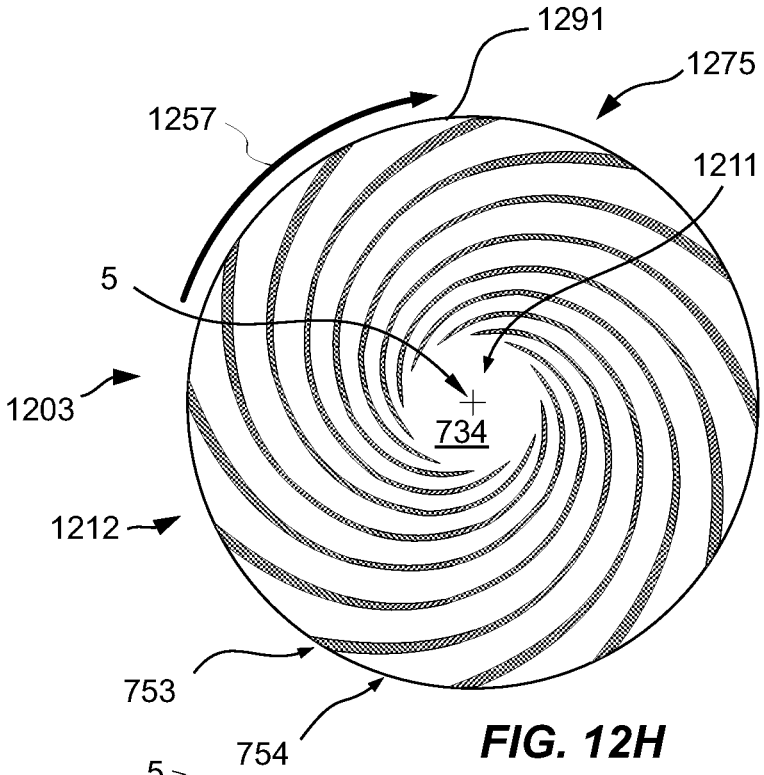
Figure 12I:
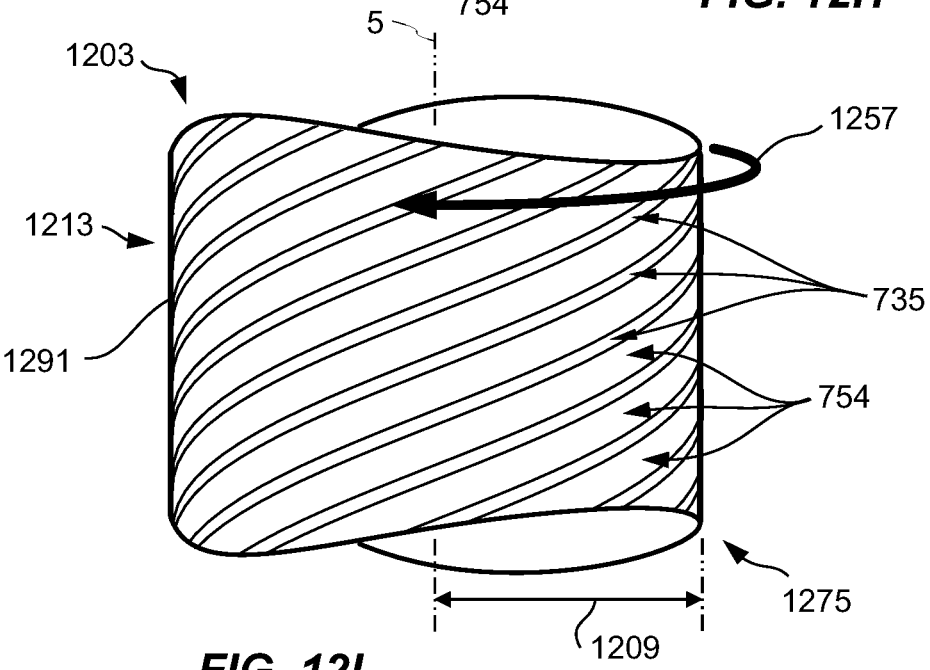

Turning now to FIGS. 12A, 12B, 12C, 12D, 12E, 12F, 12G, 12H, and 12I, these figures illustrate an example projectile 1250 according to some embodiments of the disclosure. FIGS. 12A, 12B, 12C, 12D, and 12E respectively illustrate example progressive modes of the projectile 1250 in cross sectional view, where an axis 5 of the projectile 1250 is in the view cutting plane, according to some embodiments. The illustrated projectile 1250 comprises an example rotor 1275 and an example drive member 1276. As illustrated, the drive member 1276 comprises an example forward helix 1200A and an example rear helix 1200C. The illustrated rotor 1275 comprises an example forward helix 1200B and an example rear helix 1200D. FIGS. 12A, 12B, 12C, and 12D illustrate the helices 1200A and 1200C without sectioning. That is, in FIGS. 12A, 12B, 12C, and 12D, the cutting plane of the view exposes the helices 1200A and 1200C without cutting through the helices 1200A and 1200C. FIGS. 12A, 12B, 12C, and 12D accordingly illustrate example features of the helices 1200A and 1200C that are in front of the cutting plane. FIG. 12F illustrates an example detail cross sectional view of the projectile 1250 at Section I-I, which FIG. 12A shows, according to some embodiments. FIG. 12G illustrates an example detail cross sectional view of the projectile 1250 at Section J-J, which FIG. 12E shows, according to some embodiments. FIG. 12H illustrates example surface features of the rotor 1275 with the view taken from a perspective of an observer positioned forward of the rotor 1275 looking down the axis 5 of the projectile 1250 towards a leading tip 1211 of the rotor 1275 according to some embodiments. FIG. 12I illustrates example surface features of the rotor 1275 in a side view according to some embodiments.

The projectile 1250 of FIG. 12 comprises an example embodiment of a drive 1210, example features and operations of which are discussed below. In the embodiment that FIG. 12 illustrates, the drive 1210 comprises an example embodiment of an inertial drive. The projectile 1250 further comprises an example embodiment of a mechanism.

Example embodiments of the drive 1210 can be incorporated in projectiles of guns, smoothbore guns, firearms, smoothbore firearms, light firearms, smoothbore light firearms, crew-served firearms, smoothbore crew-served firearms, light-gas guns, air guns, smoothbore air guns, railguns, or archery devices, including the disclosed examples thereof (not an exhaustive list). Example embodiments of the drive 1210 can further be incorporated in other aeronautical systems, including in the disclosed examples of aeronautical systems.

As illustrated by FIGS. 12A, 12B, 12C, 12D, and 12E, the projectile 1250 comprises an example leading member 1261 that is internally threaded and an example trailing member 1279 is externally threaded. In the illustrated embodiment, the trailing member 1279 is screwed into the leading member 1261. Fastened together, the leading member 1261 and the trailing member 1279 enclose an example interior space 1295 in which the rotor 1275 and the drive member 1276 are disposed. The leading member 1261 comprises an interior surface 1292 that faces an outer surface 1291 of the rotor 1275 in the Section J-J that FIG. 12G illustrates in cross section. A gap or annulus 1293 between the leading member's interior surface 1292 and the rotor's outer surface 1291 helps avoid contact between the two surfaces 1292, 1291 in the illustrated example embodiment. The leading member's interior surface 1292 is further oriented towards the projectile's axis 5 and faces the projectile's interior space 1295. The rotor's outer surface 1291 is further oriented away from the projectile's axis 5 and away from the interior space 1295.

The drive member 1276 comprises a flange 1266 that is operably coupled to the leading member 1261 by a keyed joint 1269, an example embodiment of which FIG. 12F illustrates in cross section. FIG. 12F illustrates example features that the keyed joint 1269 comprises on one side of the projectile 1250. In the example projectile 1250, the features that FIG. 12F illustrates are symmetrically duplicated on the opposite side of the projectile 1250. That is, the keyed joint 1269 of the projectile 1250 can have symmetry in keeping with the keyed joint 1087 that FIG. 10D illustrates as discussed above. Further, the projectile 1250 can comprise the features of FIG. 12F repeated about the axis 5 of the projectile 1250 with 180 degree spacing, 90 degree spacing, 60 degree spacing, 45 degree spacing, etc. In operation, the keyed joint 1269 permits axial motion of the drive member 1276 within the projectile 1250 relative to the leading member 1261 while maintaining rotational alignment between the drive member 1276 and the leading member 1261. In the illustrated example embodiment, the keyed joint 1269 can prevent uncontrolled rotation of the drive member 1276 within the interior space 1295 of the projectile 1250 relative to the leading member 1261. In some example embodiments, the features illustrated by FIG. 12F extend linearly along the projectile's axis 5 without spiraling. In some example embodiments of the projectile 1250, the features illustrated by FIG. 12 spiral about the axis 5 of the projectile 1250 to provide controlled rotation of the drive member 1276 as the drive member 1276 axially moves within the projectile 1250. Thus, the keyed joint 1261 can extend helically relative to the projectile's axis 5 so that with axial movement of the drive member 1276 within the projectile 1250, the keyed joint 1269 makes the drive member 1272 rotate in a controlled manner.

In the illustrated example embodiment of FIG. 12, the drive member 1276 comprises the flange 1266, a rear cylindrical member 1232 that extends forward from the flange 1266, the rear helix 1200C that extends forward from the rear cylindrical member 1232, a forward cylindrical member 1231 that extends forward from the rear helix 1200C, and the forward helix 1200A that extends forward from the forward cylindrical member 1231. In the illustrated example, the drive member 1276, the drive member's flange 1266, the drive member's rear cylindrical member 1232, the drive member's rear helix 1200C, the drive member's forward cylindrical member 1231, and the drive member's forward helix 1200A are disposed on the axis 5 of the projectile 1250. As illustrated by FIG. 12, the forward helix 1200A of the drive member 1276 comprises an example embodiment of an external helix, and the rear helix 1200C of the drive member 1276 comprises an example embodiment of an external helix. As illustrated by FIG. 12, the forward helix 1200A of the drive member 1276 further comprises an example embodiment of a male helix, and the rear helix 1200C of the drive member 1276 comprises an example embodiment of a male helix.

In the illustrated example embodiment of FIG. 12, the rotor 1275 comprises a rear surface 1281, the rear helix 1200D that extends forward within the rotor 1275 from the rear surface 1281, a rear cavity 1243 that extends forward within the rotor 1275 from the rear helix 1200D, the forward helix 1200B that extends forward within the rotor 1275 from the rear cavity 1243, and a forward cavity 1242 that extends forward within the rotor 1275 from the forward helix 1200B. In the illustrated example, the rotor 1275, the rotor's rear helix 1200D, the rotor's rear cavity 1243, the rotor's forward helix 1200B, and the rotor's forward cavity 1242 are disposed on the axis 5 of the projectile 1250 rearward from the rotor's tip 1211. As illustrated by FIG. 12, the forward helix 1200B of the rotor 1275 comprises an example embodiment of an internal helix, and the rear helix 1200D of the rotor 1275 comprises an example embodiment of an internal helix.

In some example embodiments, the leading member 1261 of the projectile 1250 comprises a pointed projection (not illustrated by FIG. 12) that extends rearward into the interior space along the axis 5. In such an embodiment, the tip 1211 of the rotor 1275 can comprise an aperture (not illustrated) into which the pointed projection extends.

FIG. 12A illustrates the projectile 1250 in an example mode prior to initiating a projectile launch. For example, in the illustrated mode, the projectile 1250 might be mounted in a cartridge 20, 420 that is stowed in a shipping container, loaded in a magazine, or chambered in a chamber of a gun 50, 451 in preparation for firing the gun 50, 451 (see FIGS. 1A, 1D, 4A, and 4B). In the illustrated mode, the drive member 1276 is in a rear position and the rotor 1250 is in a forward position. The projectile 1250 can incorporate one or more retainers, suitable embodiments of which the written description describes in detail with accompanying detailed teaching for implementation and practice, for maintaining the drive member 1276 and the rotor 1250 in their respective positions and for conditional release.

In the illustrated example mode of FIG. 12A, the flange 1266 of the drive member 1276 abuts the trailing member 1279 of the projectile 1250, the rear cylindrical member 1232 of the drive member 1276 extends forward through the interior space 1295 to the rear surface 1281 of the rotor 1275, the rear helices 1200C and 1200D are engaged, the forward cylindrical member 1231 of the drive member 1276 is disposed in the rear cavity 1243 of the rotor 1275, the forward helices 1200A and 1200B are engaged, and the forward cavity 1242 of the rotor 1275 is vacant. In the example engagement that FIG. 1A illustrates, the forward and rear helices 1200A, 1200C of the drive member 1276 project radially into the forward and rear helices 1200B, 1200D of the rotor 1275. The forward and rear helices 1200A, 1200C of the drive member 1276 comprise example embodiments of male helices. The forward and rear helices 1200B, 1200D of the rotor 1275 comprise example embodiments of female helices. In the engagement embodiment that FIG. 1A illustrates, the forward and rear helices 1200A, 1200C of the drive member 1276 are respectively mated with the forward and rear helices 1200B, 1200D of the rotor 1275 in an example male-female configuration.

In the illustrated example mode of FIG. 12B, launch has initiated. For instance, the gun 50 may have just fired the cartridge 20 comprising the projectile 1250 with solid propellant 25 producing expanding propellant gas 26 propelling the projectile 1250 forward through the gun's barrel 35. (See FIGS. 1A, 1D, and 1I for illustrations of example embodiments.) As the projectile 1250 accelerates through the barrel 35, inertial force 85 on the rotor 1275 begins moving the rotor 1275 rearward. (See FIG. 1I for illustrations of example embodiments.) Contact between the projectile's trailing member 1279 and the drive member's flange 1266 keeps inertial force 85 acting on the drive member 1276 from moving the drive member 1276 rearward. As the rotor 1275 moves rearward, the rear surface 1281 of the rotor 1275 moves towards the flange 1266 of the drive member 1276, the drive member's rear helix 1200C begins moving into the rotor's rear cavity 1243, and the drive member's forward helix 1200A begins moving into the rotor's forward cavity 1242. Rearward axial motion of the rotor 1275 while the rear helices 1200C and 1200D and the forward helices 1200A and 1200B are engaged produces rotation of the rotor 1275. The rotor 1275 and the drive member 1276 comprise an example embodiment of a helical pair.

In some example embodiments, the trailing member 1279 comprises a hole on the axis 5 or an array of holes disposed about the axis 5 (not illustrated by FIG. 12). In such embodiments, expanding propellant gas 26 can transmit through the hole or holes and drive the flange 1266 forward, for example while the inertial force 85 drive the rotor 1275 rearward. Such embodiments are further discussed below with reference to FIGS. 13A, 13B, 13C, and 13D and with reference to FIG. 14C.

In the illustrated example mode of FIG. 12C, inertial force 85 of acceleration 4 has forced the rotor 1275 fully rearward. In a representative gun application, the projectile 1275 may have this mode as the projectile 1275 approaches the muzzle 6 of a gun barrel 35 or is expelled from the muzzle 6. (See FIGS. 1A and 1I for example embodiments.) The rear helices 1200C and 1200D and the forward helices 1200A and 1200B have rotationally accelerated the rotor 1275 as the rotor 1275 has moved rearward from the mode of FIG. 12B. The rear surface 1281 of the rotor 1275 is disposed adjacent a forward surface 1264 of the flange 1266 of the drive member 1276. Magnetic attraction occurs between magnets 379 in the rotor 1275 and the flange 1266 of the drive member 1276. In the illustrated example mode of FIG. 12C, the rotor 1275 can spin freely. As illustrated by FIG. 12C, the drive member's rear cylindrical member 1232 is disposed in the rotor 1275 adjacent the rotor's rear helix 1200D. In this position, the rotor's rear helix 1200D extends circumferentially around and spirals about the rear cylindrical member 1232 of the drive member 1276 with annular clearance for free rotation of the rotor 1275. The drive member's rear helix 1200C is disposed in the rotor's rear cavity 1243 with annular clearance for free rotation of the rotor 1275. The drive member's forward cylindrical member 1231 is disposed in the rotor 1275 adjacent the rotor's forward helix 1200B. In this position, the rotor's forward helix 1200B extends circumferentially around and spirals about the forward cylindrical member 1231 of the drive member 1276 with annular clearance for free rotation of the rotor 1275. The drive member's forward helix 1200A is disposed in the rotor's forward cavity 1242 with annular clearance for free rotation of the rotor 1275.

In the illustrated example mode of FIG. 12D, rearward inertial force 85 of acceleration 4 on the rotor 1250 no longer presses the rotor 1250 towards the trailing member 1279 of the projectile. Forward inertial force associated with deceleration of the projectile 1250 has moved the rotor 1250 and the drive member 1276 forward together. In some example embodiments, the rearward inertial force 85 has ceased and been replaced by forward inertial force, for instance after the barrel muzzle 6 (see FIG. 1A) expels the projectile 1250, and the projectile 1250 begins decelerating due to air resistance or drag. The magnets 379 help keep the rotor 1250 and the drive member 1276 together, to facilitate forward movement as a unit. Coordinating the forward movement of the rotor 1250 and the forward movement of the drive member 1276 can keep the drive member's forward helix 1200A in the rotor's forward cavity 1242 and the drive member's rear helix 1200C in the rotor's rear cavity 1243, thereby avoiding incidental engagement between the drive member's helices 1200A, 1200C and the rotor's helices 1200B, 1200D.

The projectile 1250 can incorporate one or more bearings, suitable embodiments of which the written description describes in detail with accompanying detailed teaching for implementation and practice. Such bearings can comprise low-friction, load-bearing interfaces between moving surfaces of the projectile 1250. Bearings can, for example, be disposed to provide support between the outer surface 1291 of the rotor 1275 and the interior surface 1292 of the forward member 1276. Bearings can, for example, be disposed to provide support between the rear surface 1281 of the rotor 1275 and the forward surface 1264 of the drive member's flange 1266.

In some example embodiments of the projectile 1250, relative motion and load between the rear surface 1281 of the rotor 1275 and the forward surface 1264 of the flange 1266 is supported by a bearing embodiment in accordance with FIG. 7 and the forgoing discussion of FIG. 7. In some example embodiments, the projectile 1250 comprises an aero spiral groove bearing disposed where the rear surface 1281 of the rotor 1275 interfaces with the forward surface 1264 of the flange 1266. For example, in some embodiments, the rear surface 1281 of the rotor 1275 comprises the aero spiral groove bearing 787 that FIGS. 7D and 7E illustrate as discussed above. In some example embodiments, the rear surface 1281 of the rotor 1275 comprises the aero spiral groove bearing 787B that FIG. 7F illustrates as discussed above.

As illustrated in FIGS. 12A, 12B, 12C, 12D, and 12E, the projectile 1250 comprises example gas channels 1271 that extend through the flange 1266 and are aligned with a trailing corner 1270 of the rotor 1275. When the projectile 1250 is in the mode of FIG. 12E, the gas channels 1271 can draw gas from the interior space 1295 that is between the projectile's trailing member 1279 and the drive member's flange 1266. The gas channels 1271 can feed the gas to the spiral groove bearing 787 or the spiral groove bearing 787B as applied to the rear surface 1281 of the rotor 1275. The spiral groove bearing 787 can receive gas from the gas channels 1271 and pump the gas along the rotor's rear surface 1281 radially inward towards the axis 5 of the projectile. The pumped gas can provide a layer of pressured gas that provides a low-friction, load bearing interface as discussed above with reference to FIG. 7, inter alia.

In the illustrated embodiment of FIG. 12, the gas channels 1271 are disposed about the projectile's axis 60 with angular spacing of 60 degrees. Thus, the flange 1266 comprises six gas channels 1271 respectively disposed at 0, 60, 120, 180, 240, and 300 degrees around the axis 60, with the gas channels at 0 and 180 degrees in the cutting plane of the cross sectional view of FIG. 12 and thus visible in the view. In some example .30 caliber embodiments of the projectile 1250, the number of gas channels 1271 is a range of four to eighteen (a representative, nonlimiting range that is among others supported by the written description). In some example .30 caliber embodiments of the projectile 1250B, each gas channel 1271 comprises a drilled hole with a diameter in a range of 0.3 to 2 millimeters (a representative, nonlimiting range that is among others supported by the written description).

FIGS. 12H and 12I illustrate an example embodiment of the rotor 1275 in which the outer surface 1291 of the rotor 1275 is patterned with grooves 753 and lands 754 that comprise an example embodiment of an aero spiral groove bearing 1203. In the end-on view of FIG. 12H, the tip 1211 and a tapered forward portion 1212 of the rotor 1275 are visible. In the side view of FIG. 12I, a portion 1213 of the rotor 1275 that is cylindrical with vertical sides is visible. In the illustrated embodiment, the grooves 753 and lands 754 extend continuously and smoothly between the cylindrical portion 1213 and the tapered forward portion 1231 of the rotor 1275. Thus, the grooves 753 and the lands 754 that FIG. 12I illustrates are also illustrated in FIG. 12H. In the illustrated embodiment, the grooves 753 and lands 754 extend forward from the trailing corner 1270 of the rotor 1275 while spiraling about the axis 5. In forward extension, the grooves 753 and lands 754 converge towards the axis 5 and end near the tip 1211 of the rotor 1275 to define a smooth region 734 on the rotor's outer surface 1291. In the view of FIG. 12H, the grooves 753 and lands 754 radiate from the smooth region 734 with the tip 1211 centered in the smooth region 734 on the axis 5.

In some example embodiments, in the tapered forward portion 1212 of the rotor 1275, the grooves 753 spiral logarithmically as projected onto a plane that is perpendicular to the axis 5. That is, in the view of FIG. 12H, the grooves spiral logarithmically. In some example embodiments, in projection, the grooves 753 can spiral according to an Archimedean spiral, a Euler spiral, an involute spiral, or a hyperbolic spiral (not an exhaustive list).

In example operation, with rotation 1257 of the rotor 1275, the grooves 753 pump gas from the trailing corner 1270 of the rotor 1275 forward along the outer surface 1291 of the rotor 1275. The gas escapes from the grooves 753 and creates a layer of pressurized gas in the gap or annulus 1293 between the leading member's interior surface 1292 and the rotor's outer surface 1291. In the illustrated example embodiment, the layer of pressurized extends over the rotor's tip 1211, over the rotor's smooth region 734, over the rotor's tapered forward portion 1212, and over the rotor's cylindrical portion 1213. The layer of pressurized gas supports load of the rotor 1275 and provides a low-friction interface that can be contact free.

In the illustrated example, the aero spiral groove bearing 1203 comprises 12 grooves 753 and 12 lands 754, with the grooves 753 and lands 754 interleaved. As best seen in FIG. 12H, the 12 grooves 753 are separated from one another by a common angle, which is 30 degrees in the illustrated example (360 degrees divided by 12 equals 30 degrees). In some .30 caliber embodiments of the projectile 1250, the aero spiral groove bearing 1203 has a number of grooves 753 in a range of 8 to 30 grooves (a representative, nonlimiting range that is among others supported by the written description).

In the illustrated example embodiment of FIGS. 12H and 12I, each groove 753 extends more than fully about the axis 5 as each groove spirals forward from the trailing corner 1270 of the rotor 1275 to the smooth region 734. As illustrated in FIG. 12H, in the rotor's tapered forward portion 1212, each groove 753 extends approximately 217 degrees or approximately 0.6 revolutions about the axis 5. As illustrated in FIG. 12I, in the rotor's cylindrical portion 1213, for each revolution about the axis 5, each groove 753 traverses a length of the axis 5 corresponding to 2.5 times the rotor's radius 1209. That is, in the cylindrical portion 1213, for each revolution about the rotor 1275 and the rotor 1275 having a given radius 1209, the groove 753 covers approximately 2.5 radiuses of axial length.

In some .30 caliber embodiments of the projectile 1250, from the trailing corner 1270 to the smooth region 734, each groove 753 spirals about the axis 5 a number of revolutions in a range of 1.5 to 4 revolutions (a representative, nonlimiting range that is among others supported by the written description). In some .30 caliber embodiments of the projectile 1250, in the rotor's tapered forward portion 1212, each groove 753 spirals about the axis 5 a number of revolutions in a range of one half of a revolution to one full revolution (a representative, nonlimiting range that is among others supported by the written description). In some .30 caliber embodiments of the projectile 1250, in the rotor's cylindrical portion 1213, each grove 753 spirals about the axis 5 a number of revolutions in a range of one revolution to three revolutions (a representative, nonlimiting range that is among others supported by the written description).

In the illustrated example embodiment of FIGS. 12H and 12I, the grooves 735 have constant width in the rotor's cylindrical portion 1213 and progressively narrow in the rotor's tapered forward portion 1212. In some .30 caliber embodiments of the projectile 1250, the grooves 753 and lands 754 cover respective areas of the rotor's outer surface 1291 with dimensions such that the surface area of groove 753 is in range of one half to twice the surface area of each land (a representative, nonlimiting range that is among others supported by the written description).

In some example embodiments, each groove 753 has a depth (corresponding to the depth 793 illustrated on FIG. 7E) of approximately 20 microns. In some example .30 caliber embodiments of the projectile 1250, the depth of each groove 753 is a range of 10 to 50 microns (a representative, nonlimiting range that is among others supported by the written description).

In some example embodiments, the tapered forward portion 1212 of the rotor 1275 that is patterned with grooves 753 and lands 754 comprises or is a strict cone or a frustrum of a cone, without curving as illustrated by FIGS. 12A, 12B, 12C, 12D and 12E. In some example embodiments, the entire rotor 1275 comprises or is a strict cone or a frustrum of a cone. In some example embodiments, the cylindrical portion 1213 of the rotor 1275 is or comprises a strict cylinder. In some example embodiments, the cylindrical portion 1213 of the rotor 1275 comprises a strict cylinder, and the tapered forward portion 1212 of the rotor 1275 comprises a strict cone, with the strict cone and the strict cylinder meeting at an edge that may be sharp or curved. The term "strict cylinder," as used herein, generally refers to a cylindrical body with sides that are straight and parallel. The term "strict cone," as used herein, generally refers to conical body with sides that taper linearly.

Turning now to FIGS. 13A, 13B, 13C, and 13D, these figures illustrate an example projectile 1350 according to some embodiments of the disclosure. FIGS. 13A, 13B, 13C, and 13D respectively illustrate example progressive modes of the projectile 1350 in cross sectional view, where an axis 5 of the projectile 1350 is in the view cutting plane, according to some embodiments.

The projectile 1350 comprises an example drive 1310 that, in the illustrated example embodiment, converts axial motion into rotation as discussed below. Gas pressure, inertial force, or a combination of gas pressure and inertial force can produce the axial motion within the projectile. In the example embodiment illustrated by FIGS. 13A, 13B, 13C, and 13D, the drive 1310 comprises an example of an inertial drive. In the example embodiment illustrated by FIGS. 13A, 13B, 13C, and 13D, the drive 1310 comprises an example of a gas drive. In the example embodiment illustrated by FIGS. 13A, 13B, 13C, and 13D, the drive 1310 comprises an example of a hybrid gas-inertial drive. The projectile 1350 further comprises an example embodiment of a mechanism.

Example embodiments of the drive 1310 can be incorporated in projectiles of guns, smoothbore guns, firearms, smoothbore firearms, light firearms, smoothbore light firearms, crew-served firearms, smoothbore crew-served firearms, light-gas guns, air guns, smoothbore air guns, railguns, or archery devices, including the disclosed examples thereof (not an exhaustive list). Example embodiments of the drive 1310 can further be incorporated in other aeronautical systems, including in the disclosed examples of aeronautical systems.

As illustrated by FIG. 13, the example projectile 1350 comprises a leading member 1265B generally corresponding to the leading member 1265 of the projectile 1250 that FIG. 12 illustrates as discussed above. As a distinguishing feature, the leading member 1265B comprises a channel 1352 on an axis 5 of the projectile 1350 that can vent pressure within the projectile 1350 as discussed below.

As illustrated by FIG. 13, the example projectile 1350 further comprises an example rotor 1275B generally corresponding to the rotor 1275 of the projectile 1250 that FIG. 12 illustrates as discussed above. As a distinguishing feature, the rotor 1275B comprises a channel 1351 on the axis 5 of the projectile 1350 that can vent pressure within the projectile 1350 as discussed below.

As illustrated by FIG. 13, the example projectile 1350 further comprises an example drive member 1276B generally corresponding to the drive member 1276 of the projectile 1250 that FIG. 12 illustrates as discussed above. The drive member 1276B is disposed in a trailing aperture 1362 of the projectile 1350 and extends forward along the axis 5. The rotor 1275B and the drive member 1276B comprise an example embodiment of a helical pair.

The projectile 1350 further comprises a keyed joint (not illustrated by FIG. 13), consistent with the keyed joint 1269 illustrated by FIG. 12F, that provides for axial motion of the drive member 1276B while inhibiting rotation of the drive member 1276B. In some embodiments, a rearmost portion of the keyed joint of the projectile 1350 comprises a pin or other obstruction (not illustrated by FIG. 13) that blocks rearward movement of the drive member 1276B beyond the position that FIG. 13A illustrates. Example embodiments of the projectile 1350 can comprise one or more retainers that retain positions of the rotor 1275B and the drive member 1276B with conditional release (not illustrated in FIG. 13), suitable embodiments of which the written description describes in detail with accompanying detailed teaching for implementation and practice.

Figure 13B:
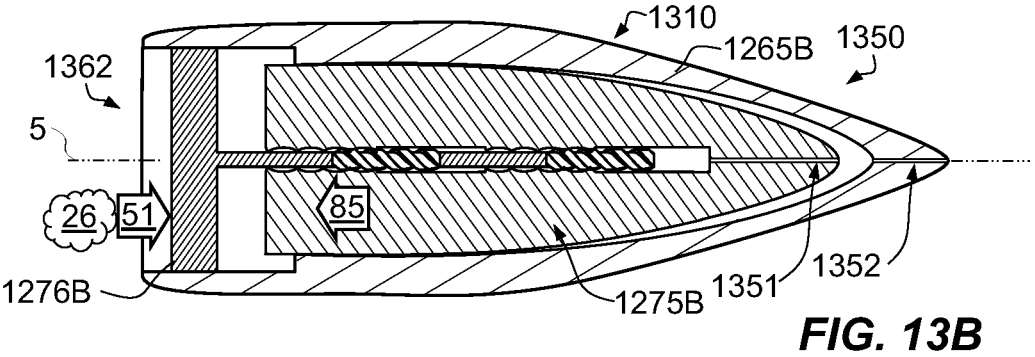
Figure 13C:
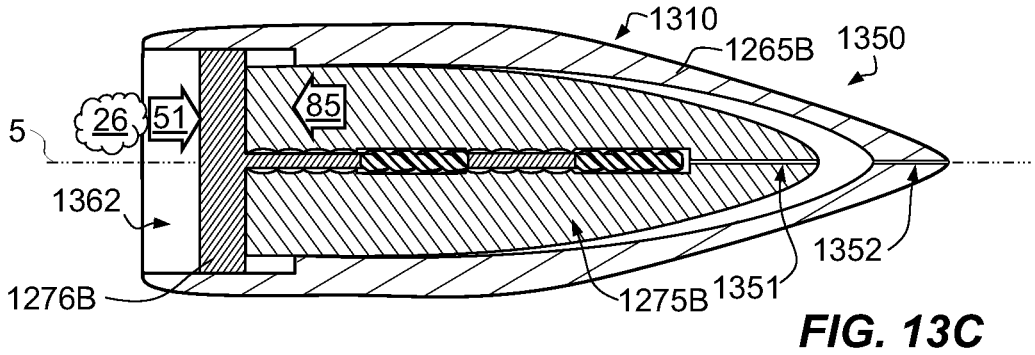
Figure 13D:
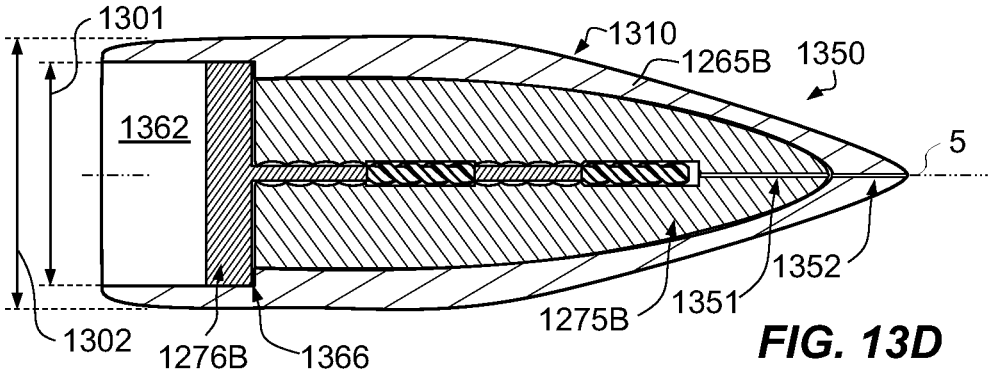

The projectile 1350 can incorporate one or more bearings, suitable embodiments of which the written description describes in detail with accompanying detailed teaching for implementation and practice. In some example embodiments, such bearings can comprise aero spiral groove bearings (not illustrated in FIG. 13) that may, in some embodiments, be supported by one or more associated gas channels and/or one or more associated cavities from which gas may be drawn. For detailed disclosure about example embodiments of such channels and cavities, see the channels 774 and the cavity 777 that FIG. 7M illustrates and the accompanying discussion and the gas channels 1271 that FIG. 12 illustrates and the accompanying discussion, inter alia. The mode of the projectile 1350 that FIG. 13A illustrates corresponds generally to the mode of the projectile 150 illustrated by FIG. 1K as discussed above. The mode of the projectile 1350 that FIG. 13D illustrates corresponds generally to the mode of the projectile 150 illustrated by FIG. 1L as discussed above. In some example embodiments, FIG. 13A illustrates the projectile 1350 in a pre-launch mode. In some example embodiments, FIG. 13D illustrates the projectile 1350 in a post-launch mode. FIGS. 13B and 13C illustrate intermediate modes of the projectile 1350 that can occur during launch of the projectile 1350 in some example embodiments.

In the mode of FIG. 13A, the rotor 1275B is disposed fully in a forward position, and the drive member 1276B is disposed fully in a rear position.

In the mode of FIG. 13B, expanding propellant gas 26 has entered the trailing aperture 1362 of the projectile 1350 and produced forward force on the drive member 1276. The forward force applied by the expanding propellant gas 26 has axially moved the drive member 1276B forward. The expanding propellant gas 26 has further produced acceleration 4 (FIG. 1I illustrates example embodiments) of the projectile 1350. The acceleration 4 of the projectile 1350 has produced inertial force 85 directed rearward on the rotor 1275 (FIG. 1I illustrates example embodiments). The inertial force 85 has produced rearward axial motion of the rotor 1275B. The channel 1351 in the rotor 1275B and the channel 1352 in the leading member 1265 can vent or regulate pressure within the projectile 1350 to avoid any unwanted inhibition of the axial motion of the drive member 1265B and the rotor 1275. With the forward axial motion of the drive member 1276B and the rearward axial motion of the rotor 1275B the drive member 1275B moves into the rotor 1275B. As discussed above with reference to FIG. 12, the motion of the drive member 1275B within the rotor 1275B produces rotation of the rotor 1275B.

In some example embodiments, the diameter 1301 of the drive member 1276B relative to the diameter 1302 of the projectile 1350 can be selected to apportion the total propulsive force 51 provided by the expanding propellant gas 26 between driving the drive member 1276B forward and driving the rotor 1275B rearward. Increasing the diameter 1301 of the drive member 1276B as a fraction of the diameter 1302 of the projectile 1350 can increase the forward force on the drive member 1276B, in some example embodiments.

In the mode of FIG. 13C, the inertial force 85 of acceleration 4 has driven the rotor 1275B farther rearward, and the expanding propellant gas 26 has driven the drive member 1276B farther forward. A forward surface 1264 of the drive member 1276B and a rear surface 1281 of the rotor 1275B have met. In some example embodiments, the drive member 1276B and the rotor 1275B are magnetically attracted to one another to help keep them together. (See for example the magnets 379 illustrated in FIG. 12 as discussed above.) As illustrated in FIG. 13C, relative to the mode of FIG. 13B, the drive member 1276B has moved farther into the rotor 1275B, resulting in acceleration of the rotation of the rotor 1275B.

In the mode of FIG. 13D, the expanding propellant gas 26 has driven the drive member 1276B and the rotor 1275 fully forward. When the drive member 1276 moves fully forward, mechanical interference 1366 occurs between the drive member 1276 and the leading member 1265B, and the drive member 1276 wedges into the trailing aperture 1362. In some example embodiments, this wedging seals the trailing aperture 1262 to avoid any inadvertent gas flow through the channel 1351 in the rotor 1275B and the channel 1352 in the leading member 1265. In some example embodiments, the projectile 1350 remains in the mode of FIG. 13D while the projectile 1350 travels in open air towards a target or other destination.

In some example embodiments, the projectile 1350 comprises a trailing member (not illustrated by FIG. 13) that is disposed in the trailing aperture 1362 rear of the drive member 1276B. For example, the trailing member 1279 illustrated by FIGS. 12A, 12B, 12C, 12D, and 12E can be screwed into the trailing aperture 1362. In such an embodiment, a hole can be drilled in the trailing member 1279 on the axis 5 to provide an inlet, port, or orifice for the expanding propellant gas 26 to enter the trailing aperture 1362. FIG. 14C, discussed below, illustrates an example embodiment of a projectile so configured. In some embodiments, the trailing member 1279 is drilled with an array of holes that collectively form a circle around the axis 5. (For an example drilling pattern, see the array of channels 772 illustrated by FIG. 7J.) The diameter of the hole or holes can be configured to regulate the propulsive force 51 that the expanding propellant gas 26 applies to the trailing member 1279. For instance, increasing the hole diameter or number of holes can provide more propulsive force 51 on the drive member 1276B in some embodiments. In some example embodiments, the addition of the trailing member 1279 with one or more drilled holes can provide a pressure chamber within the projectile 1350 that controls the buildup of propulsive force 51 on the drive member 1276B. Pressure can increase more gradually inside the pressure chamber than outside the pressure chamber rear of the projectile 1350, thereby softening the application of propulsive force 51 on the drive member 1276B. For example, in an application in which the expanding propellant gas 26 produces an abrupt increase in pressure in the chamber 99 of a gun 50 (see FIG. 1A), the increase of pressure in the pressure chamber of the projectile 1350 can be less abrupt or more gradual. In this embodiment, decreasing hole diameter or decreasing the number of holes can provide more damping while increasing hole diameter or increasing the number of holes can provide less damping. In some example .30 caliber embodiments of the projectile 1350, the trailing member 1279 is fastened to the projectile 1350 so the trailing member 1279 covers the trailing aperture 1362 as discussed in the present paragraph, the trailing member 1279 is drilled with six to nine holes that are disposed symmetrically about the axis 5, and each hole has a diameter in a range of 0.5 to 1.5 millimeters (a representative, nonlimiting range that is among others supported by the written description).

In some example embodiments, the projectile 1350 of FIGS. 13A, 13B, 13C, and 13B comprises a support member (not illustrated by FIG. 13) that is disposed adjacent and rear of the rear surface 1281 of the rotor 1275B. So disposed, the support member supports the rotor 1275B and comprises a stop that blocks rearward motion of the rotor 1275B while accommodating forward motion of the drive member 1264. As discussed below, FIGS. 14A, 14B, and 14C illustrate two examples of such embodiments, in which an example support member is identified with reference number 1405.

Turning now to FIGS. 14A, 14B, and 14C, these figures illustrate an example projectile according to some embodiments of the disclosure. FIGS. 14A and 14B respectively illustrate two example modes of the projectile 450B in cross sectional view, in which an axis 5 of the projectile 450B is in the view cutting plane, according to some embodiments. FIG. 14C illustrates a different embodiment of the projectile 450B, denoted 450D, according to some embodiments.

Example embodiments of the projectile 450B and the projectile 450D comprise features corresponding to features of the projectile 1250 and the projectile 1350 as discussed above and as illustrated in FIGS. 12 and 13. Accordingly, the projectile 450B and the projectile 450D can comprise conditional-release retainers, bearings, keyed joints, pressure venting channels, and other appropriate features according to the disclosure provided in the foregoing illustrations and the foregoing text, inter alia.

Referring now to FIGS. 14A and 14B, FIG. 14A illustrates the projectile 450B in a mode corresponding to the mode of FIG. 13A as discussed above. FIG. 14B illustrates the projectile 450B in a mode corresponding to the mode of FIG. 13D as discussed above. The projectile 450B comprises an example embodiment of a mechanism.

As illustrated by FIGS. 14A and 14B, the example projectile 450B comprises a leading member 1261 comprising a tip 788, a trailing end 65 of the projectile 450B, an exterior surface 453 of the leading member 1261 that extends from the tip 788 to the projectile's trailing end 65, and an example embodiment of a rotor 1275 disposed between the tip 788 and the trailing end 65. The illustrated rotor 1275 is internal to the projectile 450B and is confined between an interior surface 1292 of the leading member 1261 and the support member 1405. As illustrated, the support member 1405 supports the rotor 1275 and comprises a stop that stops rearward motion of the rotor 1275. An example embodiment of a drive member 1276 is disposed in a trailing aperture 1362 of the projectile 450B, rearward of the support member 1405. As illustrated in FIG. 14, the drive member 1276 extends along the axis 5, through the support member 1405, and into the rotor 1275. The rotor 1275 and the drive member 1276 comprise an example embodiment of a helical pair.

FIGS. 14A and 14B illustrate two example embodiments of the drive member 1276. The dashed lines that are connected to the reference number 452 are specific to the second embodiment and can be omitted with respect to discussion of the first embodiment of the drive member 1276. These two example embodiments will be further discussed below in turn.

In the first illustrated embodiment of the drive member 1276, propellant force 51 provided by expanding propellant gas 26 applies to a flange 1266 of the drive member 1276. The propellant force 51 drives the drive member 1276 forward along the axis 5. Responsive to the propellant force 51, the drive member 1276 plunges into the trailing aperture 1362 of the projectile 450B, and a drive 1410 of the projectile 450 produces rotation of the rotor 1275.

Example embodiments of the drive 1410 can be incorporated in projectiles of guns, smoothbore guns, firearms, smoothbore firearms, light firearms, smoothbore light firearms, crew-served firearms, smoothbore crew-served firearms, light-gas guns, air guns, smoothbore air guns, railguns, or archery devices, including the disclosed examples thereof (not an exhaustive list). Example embodiments of the drive 1410 can further be incorporated in other aeronautical systems, including in the disclosed examples of aeronautical systems.

In the illustrated embodiment, the drive 1410 comprises a gas drive. The drive member 1276 comes to rest in the forward position that FIG. 14B illustrates. In the resulting mode, which FIG. 14B illustrates in an example embodiment, the flange 1266 of the drive member 1276 is recessed within the trailing aperture 1362, the trailing member 1362 is butted against, is disposed adjacent to, or adjoins the support member 1405, and the trailing aperture 1362 comprises an open cavity.

The forward motion of the drive member 1276 from the mode of FIG. 14A to the mode of FIG. 14B shifts the projectile's center of mass forward. Thus, with the projectile 450B in a first mode (for example as illustrated by FIG. 14A), the projectile 450B has a first center of mass; with the projectile 450B in a second mode (for example as illustrated by FIG. 14B), the projectile 450B has a second center of mass; and the second center of mass is forward of the first center of mass. In some example embodiments, moving the projectile's center of mass forward can serve stabilization of the projectile 450B. In the first mode, the projectile 450B can, for example, be chambered in a gun 50 (see FIG. 1A) in preparation for firing, shooting, or discharging the gun 50. In the second mode, the projectile 450 can, for example, be traveling between the gun 50 and a target or a destination responsive to firing, shooting, or discharging the gun 50. In some example embodiments, the first mode of the projectile 450B can comprise a pre-launch mode, and the second mode of the projectile 450B can comprise a post-launch mode. In some example embodiments, the projectile 450B assumes the second mode during projectile launch, for example while the projectile 450B is accelerating within a gun barrel 35 (see FIG. 1A).

In some example embodiments, the projectile has a center of mass ("CM") and a center of pressure ("CP"); prior to forward motion of the drive member 1276, the CM is disposed at a first CM location on the axis 5 and the CP is disposed at a first CP location on the axis 5, with a first separation between the first CM location and the first CP location; and responsive to forward motion of the drive member 1276, the CM is disposed at a second CM location on the axis 5 and the CP is disposed at a second CP location on the axis 5, with a second separation between the second CM location and the second CP location; wherein the first separation is greater than the first separation. In some such example embodiments, the first CM location is rearward of the first CP location and the second CM location is forward of the second CP location.

In addition to moving the projectile's center of mass forward, the forward motion of the drive member 1276 can concentrate the mass of the projectile 450B along the axis 5, so the axial distribution of the projectile's mass becomes more focused. As prophetically discussed below, this result can change an aspect of the projectile's moment of inertia in a manner that facilitates gyroscopic stabilization of the projectile 450B with a reduced level of angular momentum.

Moment of inertia of an object generally depends on mass of the object and on how that mass is distributed within the object relative to one or more axes of rotation. The projectile 450B has a moment of inertia that can be generally characterized in two aspects. The first aspect concerns rotation of the projectile 450B about the projectile's longitudinal axis 5. The second aspect concerns rotation of the projectile 450B about pitch and roll axes (not illustrated by FIG. 14) that are perpendicular to the longitudinal axis 5. The first aspect will be briefly discussed. The discussion will then turn to the second aspect and how manipulation of the second aspect may facilitate projectile stabilization with reduced angular momentum.

The first aspect of the projectile's moment of inertia generally relates to a rotation of the projectile 450B about the projectile's longitudinal axis 5. This aspect can be viewed as describing resistance of the projectile 450B to rotational acceleration about the longitudinal axis 5 of the projectile 450B or as describing how much torque is needed to achieve a desired rate of change in rotational rate of the projectile 450B about the axis 5. When the projectile's drive member 1276 moves forward, the distribution of the drive member's mass about the projectile's longitudinal axis 5 remains substantially constant. Thus, for the example projectile 450B, this first aspect of the projectile's moment of inertia remains substantially uniform during the forward motion of the drive member 1276.

The second aspect of the projectile's moment of inertia generally relates to pitching or yawing of the projectile 450B. With the projectile 450B oriented so the projectile's longitudinal axis 5 is level, pitching involves rotating the projectile 5 about a horizontal axis that is perpendicular to the projectile's longitudinal axis, while yawing involves rotating the projectile 5 about a vertical axis that is perpendicular to the projectile's longitudinal axis 5. This second aspect of the projectile's moment of inertia can be viewed as describing resistance of the projectile 450B to rotational acceleration about the vertical axis or the horizontal axis or as describing how much torque is needed to achieve a desired rate of change in rotational rate of the projectile 450B about the axis or horizontal axes. The second aspect can inform about the difficulty of executing a rapid change in pitch or yaw of the projectile 450B or about the effort needed to resist an unwanted pitch or yaw. For simplistic insight, suppose a hypothetical scenario in which the projectile 450B is traveling towards a target and tends to pitch and overturn, as if the projectile 450B wants to rotate about the horizontal axis so the projectile's trailing end 65 flips forward. The projectile's spinning rotor 1275, however, produces sufficient angular momentum to resist this tendency of the projectile 450B to tumble. The rotor's angular momentum thus overcomes the overturning moment, so the projectile's tip 788 remains aimed towards the target. Spreading the projectile's mass out along the projectile's longitudinal axis 5, can result in a relatively high moment of inertia that increases the level of angular momentum needed from the rotor 1275. Once the drive member 1276 moves forward, the projectile's moment of inertia decreases, and the angular momentum needs decrease.

The second example embodiment of the drive member 1276 illustrated by FIGS. 14A and 14B will now be further discussed. In the second embodiment, the flange 1266 of the drive member 1276 has been extended by addition of the member 452, which FIGS. 14A and 14B represent with dashed lines 452. In some example embodiments, the member 452 can be fastened to the drive member's flange 1266 with screws or other appropriate fasteners. In some example embodiments, the drive member 1276 is fabricated so the member 452 is an integral part of the flange 1266, so the flange 1266 seamlessly incorporates the member 452.

With the member 452 extending the drive member's flange 1266, the drive member 1267 projects rearward from the trailing end 65 of the projectile 450B. The projectile 450B can be mounted with the trailing surface 454 of the member 452 disposed against a surface, for instance within a sabot 403 as discussed above with reference to FIGS. 4B and 4C. As further discussed above, launching the projectile 450B can comprise accelerating the surface forward. With the trailing surface 454 of the member 452 abutting the accelerating surface, the drive member 1276 accelerates forward along with the surface. The remainder of the projectile 450 resists the forward acceleration 4, resulting in the drive member 1267 plunging forward into the rotor 1275 and producing rotation of the rotor 1275. Thus, the forward acceleration 4 produces rearward inertial force 85 that drives the rotor 1275, the leading member 1261, and the support member 1405 rearward relative to the forward-accelerating drive member 1267. In this embodiment, the drive 1410 of the projectile 1250 comprises an inertial drive.

In some example embodiments, the projectile 450B comprises the member 452, the member 452 comprises an extension of the flange 1266, and the member 452 extends rearward less than illustrated by FIGS. 14A and 14B. For example, in some embodiments, the member 452 may be dimensioned so that with the projectile 450B in the mode of FIG. 14B, the member's trailing surface 454 is flush with the rim 1244 of the projectile's trailing aperture 1362. In some embodiments, the member 452 is farther shortened such that with the projectile 450B in the mode of FIG. 14B, the member's trailing surface 454 is recessed within the trailing aperture 1362. In such embodiments, placing the projectile 450B in the mode of FIG. 14B may entail moving the member 452 forward past the position where the member's trailing surface 454 is flush with the rim 1244 of the projectile's trailing aperture 1362. To implement the mode of FIG. 14B, launching the projectile 450B may comprise mounting the projectile 450B on a pedestal (not illustrated by FIG. 14) that is diametrically sized for insertion in the trailing aperture 1362 and rapidly driving the pedestal forward so the pedestal propels the projectile 450B forward and fully depresses the drive member 1276. As another implementation example, a combination of propellant force 51 and inertial force 85 (FIG. 1I illustrates example embodiments) can move the drive member 1276 fully forward to achieve the mode that FIG. 14B illustrates. The inertial force 85 and the propellant force 51 can apply concurrently in some embodiments. In some embodiments, the propellant force 51 can act alone once the trailing surface 454 of the member 452 starts recessing in the trailing aperture 1362.

Referring now to FIG. 14C, this figure illustrates a projectile 450D that comprises some example variations of the projectile 450B. FIG. 14C illustrates the projectile 450D in the same mode that FIG. 14B illustrates. In the example embodiment of FIG. 14C, a leading member 1261B of the projectile 450B comprises an aperture 1462 and an associated neck 1463. A rotor 1275C extends through the aperture 1462 and comprises a shoulder 1488 that adjoins the neck 1463. The neck 1463 and the shoulder 1488 effectively capture the rotor 1275C in the projectile 450D.

With the projectile 450 in the illustrated mode and traveling in open air towards a target, the rotor 1275C is frontally exposed and mostly enclosed while spinning. The spinning rotor 1275 is thus largely isolated from viscous interaction with open air. Shielding most of the spinning rotor 1275 from exposure to open air avoids precision-compromising levels of the Magnus effect, gyroscopic drift, aerodynamic jump, and related phenomena. Additionally, the shielding can help maintain the rotor's rotational velocity.

As illustrated, the example projectile 450D further comprises a trailing member 1279 that covers the trailing aperture 1362 and forms a gas chamber 1489. The trailing member 1279 comprises a hole 1499 disposed on the projectile's axis 5 that comprises an inlet for expanding propellant gas 26. As discussed above with reference to FIGS. 13A, 13B, 13C, and 13D, this configuration controls propellant forces 51 that the projectile's drive 410B utilizes for rotor rotation and can damp a pressure impulse.

Example embodiments of the drive 1410B can be incorporated in projectiles of guns, smoothbore guns, firearms, smoothbore firearms, light firearms, smoothbore light firearms, crew-served firearms, smoothbore crew-served firearms, light-gas guns, air guns, smoothbore air guns, railguns, or archery devices, including the disclosed examples thereof (not an exhaustive list). Example embodiments of the drive 1410B can further be incorporated in other aeronautical systems, including in the disclosed examples of aeronautical systems.

Figure 15C:
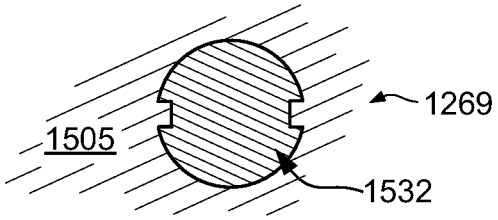
FIGS. 15A, 15B, and 15C, collectively
Figure 15A:
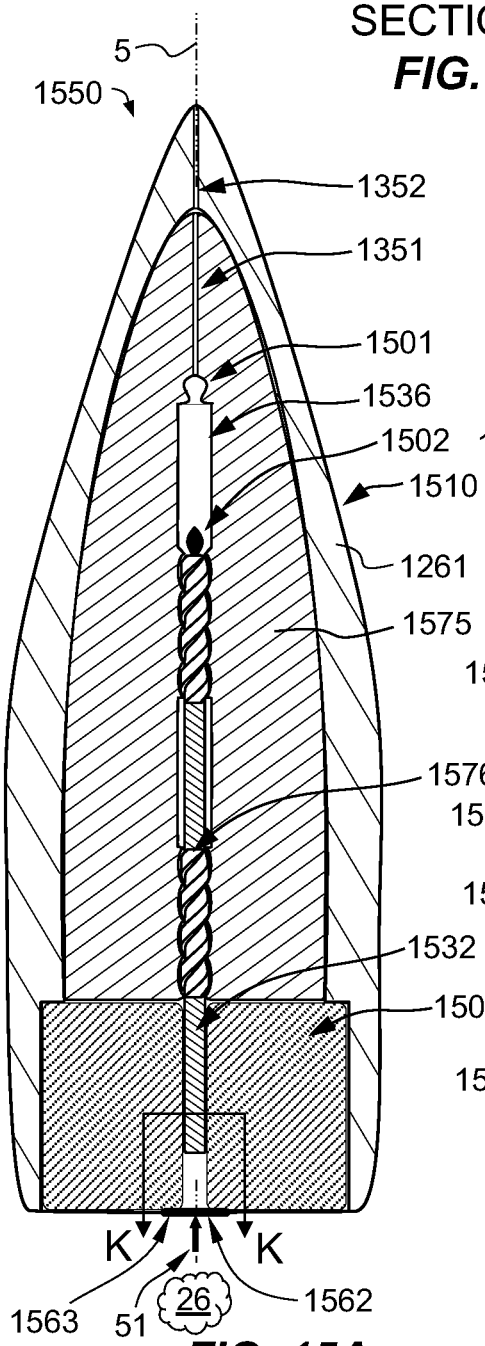
Figure 15B:
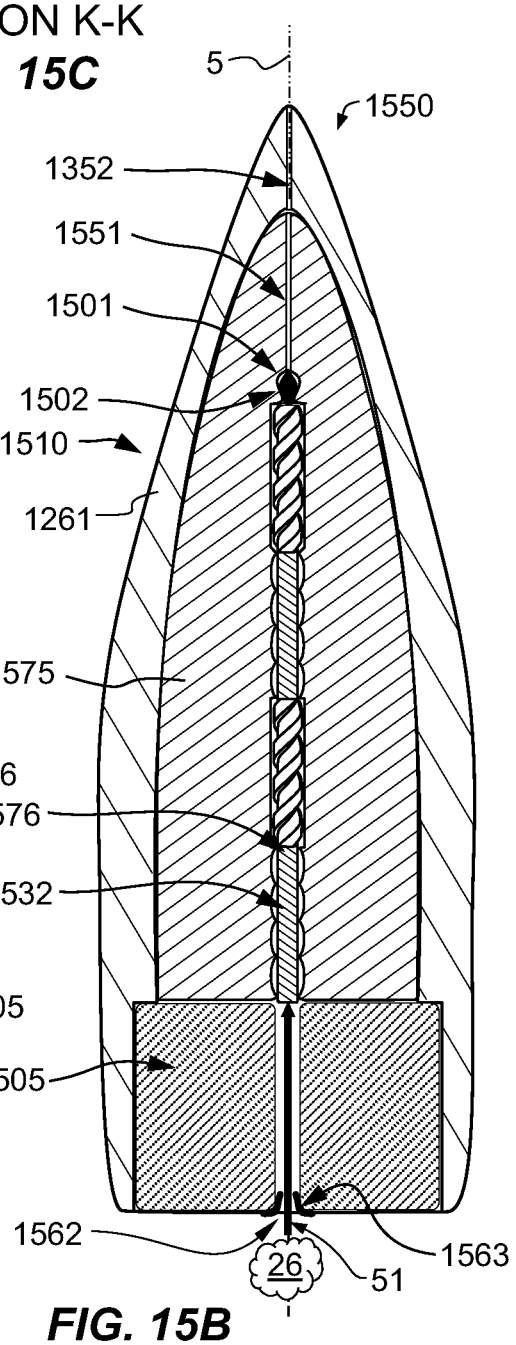

Turning now to FIGS. 15A, 15B, and 15C, these figures illustrate an example projectile 1550 according to some embodiments of the disclosure. FIGS. 15A and 15B respectively illustrate two example modes of the projectile 1550 in cross sectional view, in which an axis 5 of the projectile 1550 is in the view cutting plane, according to some embodiments. FIG. 15C illustrates a detail cross sectional view of an example central region of the projectile 1550 taken at Section K-K according to some embodiments.

The illustrated example embodiment of the projectile 1550 comprises features corresponding to features of the projectiles 1250, 1350, and 450B as discussed above and as illustrated in FIGS. 12, 13, and 14. Accordingly, the projectile 1550 can comprise conditional-release retainers, bearings, keyed joints, pressure venting channels, and other appropriate features according to the disclosure provided in the foregoing illustrations and the foregoing text, inter alia.

Referring now to FIGS. 15A, 15B, and 15C, the mode of the projectile 1550 that FIG. 15A illustrates corresponds generally to the mode of the projectile 150 illustrated by FIG. 1K as discussed above, and the mode of the projectile 1550 that FIG. 15B illustrates corresponds generally to the mode of the projectile 150 illustrated by FIG. 1L as discussed above. The projectile 1550 comprises an example embodiment of a mechanism.

As illustrated, the projectile 1550 comprises a leading member 1261 housing an example rotor 1575 supported by an example trailing member 1505. The trailing member 1505 comprises an aperture 1562 comprising a channel. In the illustrated example embodiment, a rupture disk 1563 covers the aperture 1562. In some other example embodiments, the rupture disk 1563 is omitted. In the illustrated example, the trailing member 1505 is rotationally fixed to the trailing member 1505, for example by threads, one or more pins, welding, press fit, or other appropriate fastening approach. The rotor 1575 comprises a forwardly disposed channel 1351 centered on an axis 5 of the projectile 1550. The rotor 1575 further comprises an example socket 1501 on the axis 5 and an example central aperture 1536 on the axis 5. As illustrated, the rotor's channel 1351 extends forward from the socket 1501. The leading member 1261 comprises a forwardly disposed channel 1352 centered on the projectile's axis 5 and aligned with the channel 1351.

In the illustrated example embodiment of FIG. 15, the leading member's channel 1352, the rotor's channel 1351, the rotor's socket 1501, the rotor's central aperture 1536, and the trailing member's aperture 1562 are axially aligned to one another and form a gas channel that extends along the axis 5 end-to-end of the projectile 1550.

The projectile 1550 further comprises an example drive member 1576 centered on the axis 5 and comprising a rearwardly disposed example bar 1532 and a forwardly disposed example plug 1502. The rotor 1575 and the drive member 1576 comprise an example embodiment of a helical pair. FIG. 15C illustrates an example keyed joint 1269 operably coupling the bar 1532 and the trailing member 1505 to one another.

The illustrated projectile 1550 comprises an example embodiment of a drive 1510. As illustrated and discussed below, the drive 1510 comprises an example embodiment of a gas drive. A discussion of an example embodiment of a method of operation of the drive 1510, from the mode of FIG. 15A to the mode of FIG. 15B, follows.

In the example mode illustrated by FIG. 15A, the drive member's bar 1532 extends rearward into the trailing member 1505. Forward of the bar 1532, the drive member 1576 extends into the central aperture 1536 of the rotor 1575, with the drive member 1576 and the rotor 1575 helically engaged with one another. In some example embodiments, air, nitrogen, or other gas is disposed in the central aperture 1536 of the rotor 1575 and in the channel 1351 and the channel 1352. In some other example embodiments, the projectile 1550 can be internally evacuated and hermetically sealed.

Expanding propellant gas 26 is provided rear of the projectile 1550. In some example embodiments, a cartridge 20 can comprise the projectile 1550 mounted in a case 21 with accompanying solid propellant 25, and combustion of the solid propellant 25 can produce the expanding propellant gas 26. (FIG. 1I illustrates example embodiments.) In some example embodiments, the expanding propellant gas 26 comprises gas that has been mechanically compressed, for instance by an air gun.

As discussed above, in some embodiments, the projectile 1550 comprises the rupture disk 1563 sealing the aperture 1562. In embodiments of the projectile 1550 that comprise the rupture disk 1563, when the expanding propellant gas 26 reaches a specified pressure, the rupture disk 1563 ruptures. In some example embodiments, the rupture disk 1563 serves a primary function of protecting the aperture 1562 against inadvertent ingress and may, for instance, be configured to rupture at a relatively low pressure, such as in a range of 1.25 to 3 atmospheres of pressure (a representative, nonlimiting range that is among others supported by the written description). In some example embodiments, the rupture disk 1563 controls the pressure of the expanding propellant gas 26 entering the aperture 1562 to reduce round-to-round pressure variation. In some example embodiments, the rupture disk 1563 provides controlled resistance against the expanding propellant gas 26, so that pressure builds up behind the rupture disk 1563 prior to rupture of the rupture disk 1563. In such embodiments, the rupture disk 1563 can increase the initial pressure acting on the drive member 1576 and further can steepen the pressure wave of the expanding propellant gas 26. In some example embodiments, the rupture disk 1563 can provide a pressure impulse for dislodging the drive member 1576 or for initiating forward motion or overcoming stiction.

In some example embodiments of the projectile 1550, the rupture disk 1563 is replaced with a gas chamber that damps or softens abrupt changes in pressure. FIG. 14C illustrates an example embodiment of a gas chamber, identified with reference number 1489, which is discussed above.

The expanding propellant gas 26 enters the aperture 1562 and expands forward along the axis 5 towards the bar 1532. The expanding propellant gas 26 exerts propellant force 51 on the drive member 1576. The propellant force 51 drives the drive member 1576 forward along the axis 5. The forward axial motion of the drive member 1576 rotates the rotor 1575. As discussed above, in some embodiments pre-existing gas is disposed in the rotor's central aperture 1536 and the channel 1351 and the channel 1352. As the drive member 1576 moves axially forward, the drive member 1576 pushes the pre-existing gas forward through the channels 1351, 1352 and out of the projectile 1550. Thus, the channels 1351, 1352 can vent pre-existing gas and/or can avoid a buildup of gas pressure forward of the drive member 1576 that might hinder forward motion of the drive member 1576. In some example embodiments, a lubricant, for example powdered graphite or powdered PTFE, is disposed in the channel 1352 and is blown forward out of the projectile 1550 by gas venting through the channel 1352. Once blown out of the channel 1352, the lubricant can lubricate a smoothbore 45 of a barrel 35B or a rifled bore 40 of a rifled barrel 35A (see FIGS. 1A, 1B, and 1C) to reduce friction between the projectile 1550 and the bore 40, 45 as the projectile 1550 is propelled through the bore 40, 45.

As the drive member 1576 moves forward within the central aperture 1536 of the rotor 1575, the keyed joint 1269 maintains rotational alignment between the drive member 1576 and the trailing member 1505. In some example embodiments, the keyed joint 1269 comprises a helix (not illustrated by FIG. 15) that rotates the drive member 1576 during forward movement to amplify the rotation of the rotor 1575. In such embodiments, the drive 1510 can comprise a compound helical drive.

Example embodiments of the drive 1510 can be incorporated in projectiles of guns, smoothbore guns, firearms, smoothbore firearms, light firearms, smoothbore light firearms, crew-served firearms, smoothbore crew-served firearms, light-gas guns, air guns, smoothbore air guns, railguns, or archery devices, including the disclosed examples thereof (not an exhaustive list). Example embodiments of the drive 1510 can further be incorporated in other aeronautical systems, including in the disclosed examples of aeronautical systems.

As the drive member 1576 moves into the forward position that FIG. 15B illustrates, the drive member's bar 1532 moves out of the trailing member 1505, and the keyed joint 1269 releases. That is, as the drive member 1576 moves fully into the central aperture 1536 of the rotor 1575, the bar 1532 separates from the trailing member 1505 and the keyed joint 1269 no longer maintains rotational alignment between the trailing member 1505 and the trailing member 1505. Thus, the bar 1532 can rotate with the rotor 1575. As the drive member 1576 moves into the forward position that FIG. 15B illustrates, the plug 1502 of the drive member 1576 plugs into the socket 1501 of the rotor 1575. In some example embodiments, the socket 1501 comprises a narrow-mouth cavity and the plug 1502 comprises a ball-shaped extension that deforms to enter the narrow-mouth cavity. Upon mating of the socket 1501 and the plug 1502, the plug 1502 thus obstructs, occludes, or seals the channel 1351 to avoid ongoing gas transmission, and the socket 1501 retains the plug 1502. The drive member 1576 can thus rotate with the rotor 1575 as the projectile 1550 travels in open air towards a target or other destination.

In some example embodiments (not illustrated by FIG. 15), the bar 1532 of the drive member 1576 is longer than in the illustrated embodiment of FIG. 15 and extends farther rearward into the trailing member 1505 than illustrated by FIG. 15A; and the plug 1502 and the socket 1501 are eliminated. After the expanding propellant gas 26 drives the drive member 1576 forward to the position of FIG. 15B, a rear portion of the bar 1532 remains in the trailing member 1505. A projection, pin, or other appropriate obstruction blocks farther forward movement of the drive member 1576. For example, the bar 1532 can comprise a rearwardly disposed radial projection (not illustrated by FIG. 15) that extends into a lengthwise-extending groove (not illustrated by FIG. 15) broached into the trailing member 1505 without extending all the way through the trailing member 1505. The ending of the lengthwise-extending groove provides a stop. When the drive member 1556 moves sufficiently forward, the radial projection encounters the groove ending, and farther forward movement is checked. In such embodiments, the rotor 1575 thus spins freely in the forward position of FIG. 15B, and drive member 1576 retains a fixed orientation with the trailing member 1505.

Figures 16D, 16E, 16F:
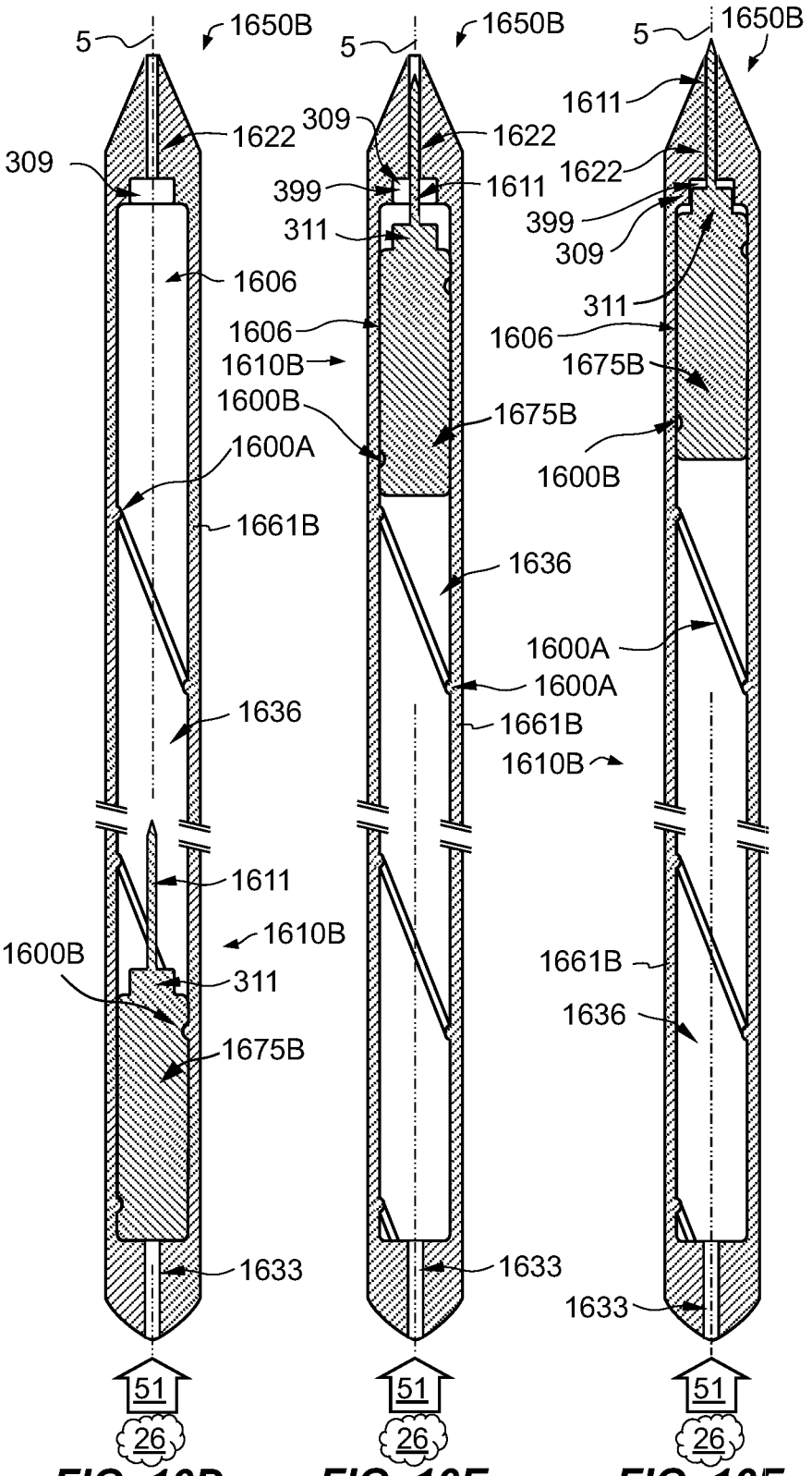

Turning now to FIGS. 16A, 16B, 16C, 16D, 16E, and 16F, these figures illustrate two example projectiles 1650, 1650B comprising corresponding features, common features, and distinguishing features, as discussed below. FIGS. 16A, 16B, and 16C illustrate an example embodiment of the projectile 1650, while FIGS. 16D, 16E, and 16F illustrate an example embodiment of the projectile 1650B. Each projectile 1650, 1650B comprises a respective example embodiment of a mechanism.

Turning now to FIGS. 16A, 16B, and 16C, these figures illustrate the example projectile 1650 according to some embodiments of the disclosure. FIGS. 16A, 16B, and 16C respectively illustrate example progressive modes of the projectile 1650 in cross sectional view, where an axis 5 of the projectile 1650 is in the view cutting plane, according to some embodiments. FIG. 16A illustrates the projectile 1650 in a mode corresponding to the mode of FIG. 13A, to the mode of FIG. 14A, and to the mode of FIG. 15A as discussed above. The mode of the projectile 1650 that FIG. 16A illustrates further corresponds generally to the mode of the projectile 150 illustrated by FIG. 1K as discussed above. FIG. 16C illustrates the projectile 1650 in a mode corresponding to the mode of FIG. 13D, to the mode of FIG. 14B, and to the mode of FIG. 15B as discussed above. The mode of the projectile 1650 that FIG. 16C illustrates further corresponds generally to the mode of the projectile 150 illustrated by FIG. 1J as discussed above. FIG. 16B illustrates the projectile 1650 in an intermediate mode that can occur between the mode of FIG. 16A and the mode of FIG. 16C.

In the illustrated example embodiment, the projectile 1650 comprises a drive 1610 that comprises an inertial drive. Example embodiments of the drive 1610 can be incorporated in projectiles of guns, smoothbore guns, firearms, smoothbore firearms, light firearms, smoothbore light firearms, crew-served firearms, smoothbore crew-served firearms, light-gas guns, air guns, smoothbore air guns, railguns, or archery devices, including the disclosed examples thereof (not an exhaustive list). Example embodiments of the drive 1610 can further be incorporated in other aeronautical systems, including in the disclosed examples of aeronautical systems.

As illustrated, the example projectile 1650 comprises a member 1661 that extends lengthwise along an axis 5 of the projectile 1650 and forms an enclosure defining an interior 1636 of the projectile 1650. The projectile 1650 further comprises a rotor 1675 that is disposed in the projectile's interior 1636 on the axis 5. The rotor 1675 and the member 1661 comprise an example embodiment of a helical pair. In the illustrated embodiment, gas, for example air or nitrogen, is disposed in the interior 1636 along with the rotor 1675.

In some example embodiments, the projectile 1650 is fabricated using a 3-D printing process in which the member 1661 and the rotor 1675 are printed concurrently, so the member 1661 builds up around the rotor 1675 as the rotor 1675 and the member 1661 are printed. In some example embodiments, the projectile 1650 is fabricated utilizing metal-removing processes, for example using a CNC lathe. The rotor 1675 and the member 1661 can be machined separately and then assembled. To facilitate assembly and/or to provide access to the interior 1636 for insertion of the rotor 1675, the member 1661 can be fabricated as two or more parts that are fastened together.

The rotor 1675 comprises a helix 1600B externally disposed on the rotor 1675. As formed in the rotor 1675 and viewed in cross section as illustrated by FIGS. 16A, 16B and 16C, the helix 1600B has a concave form. In the illustrated example embodiment, the helix 1600B comprises a groove that spirals about the rotor 1675 and about the axis 5 while facing away from the axis 5; wherein the groove, in cross sectional outline, is concave with a curved contour. In the illustrated example embodiment, the helix 1600B comprises an external helix.

The member 1661 comprises a helix 1600A that is internally disposed and comprises a convex form when viewed in cross section as illustrated by FIGS. 16A, 16B and 16C. In the illustrated example embodiment, the helix 1600A comprises a projection that extends into the interior 1636 of the projectile 1650 towards the axis 5 and spirals about the axis 5. In cross sectional outline, as illustrated, the projection of the helix 1600A is convex with a curved contour. In the illustrated example embodiment, the helix 1600A comprises an internal helix.

As illustrated by FIGS. 16A, 16B, and 16C, the helix 1600A and the helix 1600B are configured to mate with one another in a male-female configuration in which the helix 1600A extends into the helix 1600B. FIG. 16A illustrates the helix 1600A and the helix 1600B so mated. In the illustrated embodiment of FIGS. 16A, 16B, and 16C, the helix 1600A comprises a male helix. In the illustrated embodiment of FIGS. 16A, 16B, and 16C, the helix 1600B comprises a female helix.

FIGS. 16A, 16B, and 16C illustrate an example embodiment in which the helix 1600A and the helix 1600B engage in a single-start configuration. In some example embodiments, the projectile 1550 comprises a multi-start helical configuration. In some examples of such a configuration, the rotor 1675 can comprise two or more instances of the illustrated helix 1600B that spiral synchronously about the rotor 1675, and the member 1661 can comprise two or more instance of the illustrated helix 1600A that spirally synchronously within the member 1661.

In the illustrated example of FIGS. 16A, 16B, and 16C, the helix 1600A extends rearward along the axis 5 and ends in a tail 1607. The helix 1600A tapers off in the tail 1607 as the helix 1600A ends. FIG. 1M illustrates an example embodiment of a tail in which the trailing end 102 of the helix 100 is tapered to form a tail as discussed above with reference to FIG. 1M. Rearward of the tail 1607, the member 1661 comprises a surface region 1606. The helix 1600A ends forward of the surface region 1606.

In the illustrated example, forward of the surface region 1606, the member 1661 comprises two grooves 1662 that extend lengthwise within the member 1661 along the interior and form gas-carrying channels. One of the two grooves 1662 is visible in the cross sectional view of FIGS. 16A, 16B, and 16C, while the second gas-carrying groove is in front of the cutting plane of the view and thus not visible. As illustrated, the two grooves 1662 are disposed on opposite sides of the axis 5 and extend parallel to the axis 5 and parallel to one another. Some other example embodiments may have more than two grooves 1662 (or just one) that may or may not extend linearly. In the illustrated example embodiment, the grooves 1662 end in the surface region 1606, without extending the full length of the projectile's interior 1636. In some example embodiments, the grooves 1662 become gradually more shallow in the surface region 1606.

In some example embodiments of the projectile 1650, a retainer retains the rotor 1675 in the forward position that FIG. 16A illustrates and releases the rotor 1675 conditionally, for instance responsive to an occurrence of an event. Example embodiments of the retainer can comprise a magnet (see FIG. 1L, element 175), an elastomeric band (see FIG. 2A, element 279), a shear pin (see FIG. 4F, element 414), a serrated interface (see FIG. 5D), a breakable filament connection (see FIG. 7A, element 791), or other embodiment disclosed herein.

Once the rotor 1675 is released, acceleration 4 of the projectile 1650 produces inertial force 85 that moves the rotor 1675 rearward along the axis 5. As the rotor 1675 moves rearward, engagement between the helices 1600A, 1600B produces rotation of the rotor 1675. The drive 1610 thus drives rotation of the rotor 1675 over a physical interval that extends from the forward rotor position that FIG. 16A illustrates to the helix tail 1607 and over a corresponding time interval that extends from the time of the rotor 1675 releasing from the forward position to the time of the helices 1600A, 1600B disengaging at the helix tail 1607. The grooves 1662 comprise channels for gas flow within the projectile's interior 1636. As the rotor 1675 moves rearward with the helices engaged, gas flows through the grooves 1662 from rear of the rotor 1675 to forward of the rotor 1675 to avoid unduly inhibiting the rotor's rearward movement.

The grooves 1662 can be dimensioned to control gas flow, and the number of grooves 1662 can be increased to provide more gas flow.

Referring now to FIG. 16B, as the rotor 1675 moves rearward into the surface region 1606, the helices 1600A, 1600B disengage and the rotor 1675 can spin freely. The grooves 1662 become more shallow and thus have a diminishing capacity to convey gas. Gas pressure gradually builds up rear of the rotor 1675 and gradually decelerates the rotor's 1675 rearward movement. With the helices 1600A, 1600B separated, the rotor's helix 1600B, which comprises a groove as discussed above, provides a channel for transmitting some gas from rear of the rotor 1675 to forward of the rotor 1675. The rotor 1675 comprises a projection 311 that is undersized relative to the grooves of the helix 1600B. Thus in the illustrated example embodiment, the projection 311 lacks the helix 1600B. The projection 311 extends rearward along the axis 5 and is aligned to an aperture 309 centered on the axis 5. Once the rotor 1675 moves sufficiently rearward, the projection 311 enters the aperture 309 and confines gas in the aperture. As the projection 311 moves progressively deeper into the aperture 309, gas pressure builds rear of the projection 311. In some example embodiments, the projection 311 can be extended relative to the illustrated embodiment of FIGS. 16A, 16B, and 16C to form a spindle. The term "spindle," as used herein, generally refers to a projection of an object that rotates, wherein the projection rotates with the object, supports the object during rotation, is on the object's axis of rotation, and comprises a diameter and a length that is at least twice the diameter.

In the mode of FIG. 16C, the rotor 1675 has moved sufficiently rearward that the projection 311 is disposed in the aperture 309. A gas cushion 399 has formed within the aperture 309. The gas cushion 399 provides a low-friction interface for rotation of the rotor 1675 and supports an axial load of the rotor 1675. Example embodiments of the gas cushion 399 and further implementation details are discussed above with reference to FIGS. 3A and 3B, inter alia. In some example embodiments, the projectile 1650 comprises one or more spiral groove bearings, example embodiments of which are illustrated by FIGS. 7D, 7E, 7F, 7G, 7H, 12H, and 12I as discussed above with reference to those figures, inter alia. In some example embodiments, the rotor 1675 is circumferentially patterned with grooves comprising a spiral groove bearing. In some example embodiments, the rotor 1675 is rearwardly patterned with grooves comprising a spiral groove bearing. In some example embodiments, all surfaces of the projection 311 are patterned with grooves comprising a spiral groove bearing. In some example embodiments, the projection 311 is conical or bullet shaped, the aperture 309 has a corresponding shape that receives the projection 311, and the projection 311 is patterned with grooves forming a spiral groove bearing that pumps gas towards a vertex of the aperture to provide and sustain a pressurized layer of gas supporting the projection 311. See, for example, FIG. 12 and associated discussion, inter alia.

In some example embodiments, the projectile 1650 comprises a cylindrical rod (not illustrated by FIGS. 16A, 16B, 16C) that is centered on the axis 5 and extends lengthwise through the projectile's interior 1636. The cylindrical rod further extends through an aperture (not illustrated by FIGS. 16A, 16B, 16C) in the rotor 1675 that is centered on the axis 5. In example operation, as the rotor 1675 moves rearward progressing from the mode of FIG. 16A to the mode of FIG. 16C and spins, the rotor 1675 moves along the cylindrical rod and spins about the cylindrical rod. The cylindrical rod comprises an example embodiment of an axle.

In some example embodiments, the member 1661 comprises a sabot that opens to release the rotor 1675 once launch is complete. The released rotor 1675 can then travel forward towards a target or other destination, while the sabot is discarded. The member 1661 can comprise three component members, each extending lengthwise, with the component members frangibly joined together. For example, the member 1661 can be formed from a first component member that extends circumferentially from 0 degrees to 120 degrees while extending lengthwise; a second component member that extends circumferentially from 120 degrees to 240 degrees while extending lengthwise; and a third component member that extends circumferentially from 240 degrees to 360 degrees while extending lengthwise, wherein a first frangible connection connects the first component member and the second component member to one another, a second frangible connection connects the second component member and the third component member to one another, and a third frangible connection connects the third component member and the first component member to one another. With the member 1661 so formed, the projectile 1650 can be accelerated through a tube (or between rails) that holds the member 1661 together, wherein the frangible joints fail once the projectile 1650 is expelled from the tube or rails and the component members open to release the rotor 1675. In some example embodiments, the projectile 1650 is accelerated using electromagnetic propulsion. The projectile 1650 can comprise a railgun projectile. In some example embodiments, the projectile 1650 is accelerated using mechanically pressurized gas. In some example embodiments, the projectile 1650 is accelerated using gas provided by combustion of a solid or liquid propellant.

Turning now to FIGS. 16D, 16E, and 16F, these figures illustrate the example projectile 1650B according to some embodiments of the disclosure. FIGS. 16D, 16E, and 16F respectively illustrate example progressive modes of the projectile 1650B in cross sectional view, where an axis 5 of the projectile 1650B is in the view cutting plane, according to some embodiments. FIG. 16D illustrates the projectile 1650B in a mode corresponding to the mode of FIG. 16A. FIG. 16F illustrates the projectile 1650B in a mode corresponding to the mode of FIG. 16C. FIG. 16E illustrates the projectile 1650B in an intermediate mode that can occur between the mode of FIG. 16D and the mode of FIG. 16F and that corresponds to the mode of FIG. 16B.

The example projectile 1650B comprises a helix 1600A, a helix 1600B, an interior 1636, a rotor projection 311, a surface region 1606, and an aperture 309 as discussed above with reference to FIGS. 16A, 16B, and 16C. The projectile 1650B further comprises a member 1661B corresponding to the member 1661 of the projectile 1650 as discussed above. In the example embodiment illustrated by FIGS. 16E, 16F, and 16G, the member 1661B comprises a rear gas channel 1633 and a forward gas channel 1622. The projectile 1650B further comprises a rotor 1675B corresponding to the rotor 1675 of the projectile 1650 as discussed above. In the example embodiment illustrated by FIGS. 16E, 16F, and 16G, the rotor 1675B comprises a projection 1611 that extends forward. The rotor 1675B and the member 1661B comprise an example embodiment of a helical pair.

In the example embodiment illustrated by FIGS. 16D, 16E, and 16F, the projectile 1650B comprises a drive 1610B that comprises a gas drive. Example embodiments of the drive 1610B can be incorporated in projectiles of guns, smoothbore guns, firearms, smoothbore firearms, light firearms, smoothbore light firearms, crew-served firearms, smoothbore crew-served firearms, light-gas guns, air guns, smoothbore air guns, railguns, or archery devices, including the disclosed examples thereof (not an exhaustive list). Example embodiments of the drive 1610B can further be incorporated in other aeronautical systems, including in the disclosed examples of aeronautical systems.

In the mode that FIG. 16D illustrates, the rotor 1675B is in a rear position. In some example embodiments of the projectile 1650B, a retainer retains the rotor 1675B in the rear position that FIG. 16D illustrates and releases the rotor 1675B conditionally, for instance responsive to an occurrence of an event. In a representative embodiment, the event can comprise a launch event, for example. Example embodiments of the retainer can comprise a magnet (see FIG. 1L, element 175), an elastomeric band (see FIG. 2A, element 279), a shear pin (see FIG. 4F, element 414), a serrated interface (see FIG. 5D), a breakable filament connection (see FIG. 7A, element 791), or other embodiment disclosed herein.

Some example embodiments of the projectile 1650B can incorporate bearings disposed at adjoining surfaces subject to relative movement and load. Bearings can, for example, be disposed where contact between the rotor 1675B and other portions of the projectile 1650B occurs or could occur without bearings. The written description, including the figures and accompanying textual discussion, describes suitable bearing embodiments in detail with accompanying detailed teaching for implementation and practice. In some example embodiments, such bearings can comprise one or more aero spiral groove bearings that may, in some embodiments, be supported by one or more associated gas channels and/or one or more associated cavities from which gas may be drawn. In some example embodiments, such bearings can comprise one or more aerostatic bearings. In some example embodiments, the aerostatic bearings comprise one or more channels that direct expanding propellant gas 26 between the adjoining surfaces to provide a layer of pressured gas that provides a low-friction, load-bearing interface.

In the illustrated embodiment, with the projectile 1650B in the mode of FIG. 16D, expanding propellant gas 26 applies propellant force 51 to the member 1661B and enters the interior 1636 of the projectile 1650B through the rear gas channel 1633 and applies propellant force 51 to the rotor 1675B. Responsive to the propellant force 51, the rotor 1675B moves forward along the projectile's axis 5, and the projectile 1650B begins transitioning from the mode that FIG. 16D illustrates to the mode that FIG. 16E illustrates. The forward gas channel 1622 vents gas that the rotor 1675B pushes forward during the rotor's forward movement. The forward gas channel 1622 thus avoids an undue buildup of gas pressure forward of the rotor 1675B that might unduly impede the forward movement of the rotor 1675B. As the expanding propellant gas 26 drives the rotor 1675B forward, the rotor 1675B rotates as discussed above with reference to FIGS. 16A, 16B, and 16C. The rotor 1675B comprises an example embodiment of a piston.

Referring now to FIG. 16E, once the rotor 1675B moves sufficiently forward to enter the surface region 1606, the helices 1600A, 1600B disengage as discussed above with reference to FIGS. 16A, 16B, and 16C. The projection 1611 that extends forward from the rotor 1675B moves into the forward gas channel 1622 and begins obstructing gas flow out of the projectile' interior 1636. The projection 1611 tapers to gradually close the gas channel 1622 as the projection 1611 moves farther into the forward gas channel 1622. Pressure rises forward of the rotor 1675B and a gas cushion 399 forms.

Referring now to FIG. 16F, once the projection 311 enters the aperture 309 the concave grooves of the helix 1600B are obstructed from transmitting gas into or out of the aperture 309. Thus, the gas cushion 399 becomes increasingly confined. As discussed above with reference to FIG. 16C, inter alia, the rotor 1675B can spin freely supported by the gas cushion 399. In some example embodiments, the projectile 1650B can travel in open air towards a target or other destination in the mode that FIG. 16F illustrates. With the projectile 1650B in the mode of FIG. 16F traveling on a trajectory in open air towards a target or other destination, the projectile 1650B can have a center of mass and a center of pressure, with the center of mass forward of the center of pressure.

In some example embodiments, the rear gas channel 1633 is restricted to limit ingress of the expanding propellant gas 26. In some example embodiments, the rear gas channel 1633 is enlarged to promote unrestricted ingress of the expanding propellant gas 26. In some example embodiments, the rear gas channel 1663 comprises an open rear of the interior 1636. That is, the rear gas channel 1663 can comprise a continuation of the projectile's interior 1636 with like internal diameters.

In some example embodiments, the member 1661B comprises an arrow shaft, and the projectile 1650B is shot through an air gun. In such an embodiment, the expanding propellant gas 26 can comprise mechanically compressed air.

In some example embodiments, combustion of solid propellant 25 produces the expanding propellant gas 26. In such an embodiment, the projectile 1650B can be shot through a gun 50. The gun 50 can comprise a barrel 35B with a smoothbore 45. See FIGS. 1A, 1C, 1D, and 1I, for example. As the projectile 1650B accelerates down the barrel 35B, interaction between the smoothbore 45 and the projectile 1650B can prevent uncontrolled rotation of the projectile 1650B associated with rotational acceleration of the rotor 1675B.

Turning now to FIGS. 17A, 17B, 17C, 17D, 17E, 17F, 17G, 17H, and 17I, these figures illustrate an example projectile 1750 according to some embodiments of the disclosure. The illustrated projectile 1750 comprises an example embodiment of a drive 1710. As illustrated and discussed below, the drive 1710 comprises an example embodiment of an inertial drive. Example embodiments of the drive 1710 can be incorporated in projectiles of guns, smoothbore guns, firearms, smoothbore firearms, light firearms, smoothbore light firearms, crew-served firearms, smoothbore crew-served firearms, light-gas guns, air guns, smoothbore air guns, railguns, or archery devices, including the disclosed examples thereof (not an exhaustive list). Example embodiments of the drive 1710 can further be incorporated in other aeronautical systems, including in the disclosed examples of aeronautical systems.

Figure 17F:
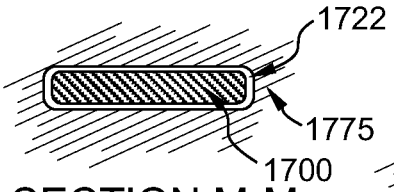
Figure 17G:
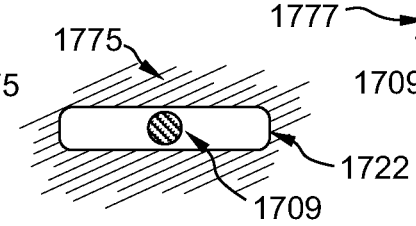
Figure 17E:
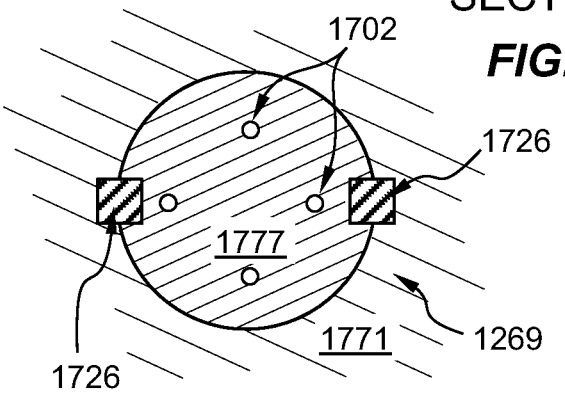
Figure 17H:
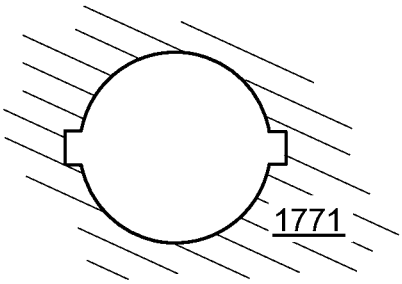
Figure 17I:
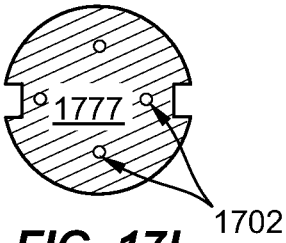
Figure 17D:
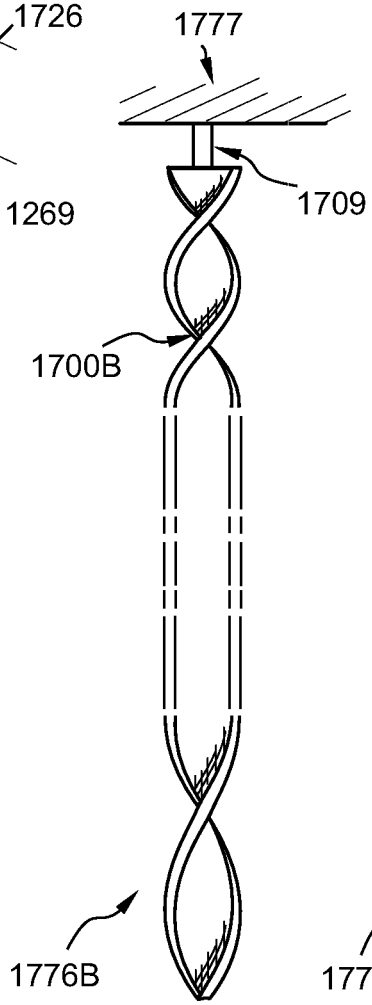
Figure 17C:
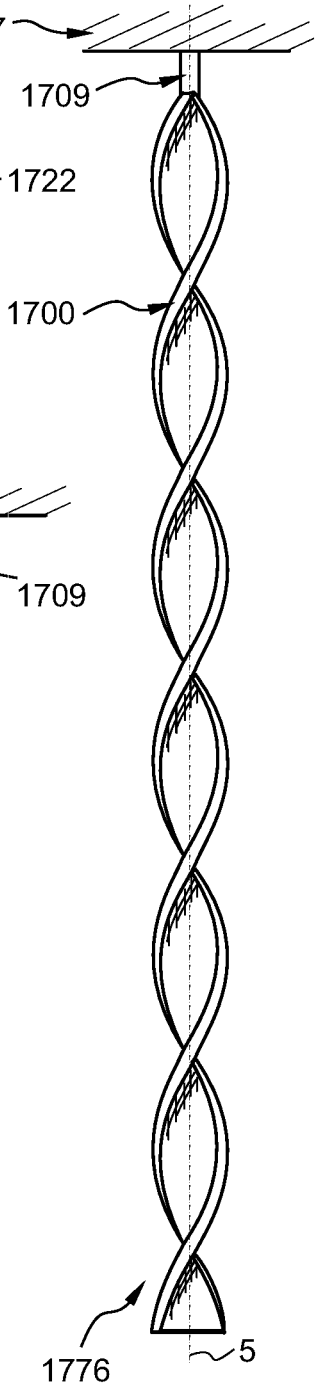

FIGS. 17A and 17B respectively illustrate two example modes of the projectile 1750 in cross sectional view, in which an axis 5 of the projectile 1750 is in the view cutting plane, according to some embodiments. FIGS. 17A and 17B illustrate an example helix 1700 of the projectile 1750 without sectioning, thus illustrating example features of the helix 1700 that are in front of the cutting plane. FIG. 17C illustrates an example drive member 1776 that the projectile 1750 comprises according to some embodiments. FIG. 17D illustrates another drive member 1776B that the projectile 1750 comprises according to some embodiments. FIGS. 17E, 17F, and 17G illustrate example central regions of the projectile 1750 in cross section, respectively at Section L-L, Section M-M, and Section N-N according to some embodiments. FIGS. 17H and 17I illustrate example cross sectional views further describing example features illustrated by FIG. 17E according to some example embodiments. The projectile 1750 comprises an example embodiment of a mechanism.

In the example mode of FIG. 17A, an example drive member 1776 of the projectile 1750 is in a forward position. The projectile 1750 can be characterized as being in a pre-launch mode. The drive member 1776 is retained in the forward position by a shear pin (not visible) or other retainer. In the illustrated example, the drive member 1776 comprises an inertial member 1777, a cylindrical member 1709, and a helix 1700. A leading member 1771 of the projectile 1750 forms a cavity 1778 in which the inertial member 1777 is forwardly retained. The helix 1700 extends rearward along an axis 5 of the projectile 1750 through a slot 1722 centrally formed in a rotor 1775 of the projectile 1750. The rotor 1775 is supported by an axle 1712 that comprises an axle cavity 1711. The axle 1712 extends as part of a trailing member 1705 of the projectile 1750. The projectile's leading and trailing members 1771, 1705 are screwed together or otherwise fastened to one another. As illustrated in FIG. 17C, the example helix 1700 of the drive member 1776 comprises a twisted metallic bar comprising a rectangular cross section, that may be characterized as a twisted strip of metal or as twisted flat bar. In the example embodiment illustrated by FIG. 17C, the helix 1700 has a constant helical rate. FIG. 17D illustrates an alternative drive member 1776B that comprises a helix 1700B comprising an example progressive helical rate.

When the projectile 1750 accelerates during launch, the drive member's inertial member 1777 is released from its forward position in the cavity 1778. Inertial force 85 associated with the acceleration 4 of the projectile 1750 drives the inertial member 1777 rearward within the cavity 1778 along the axis 5. (FIG. 1I illustrates an example embodiment of inertial force 85 and acceleration 4.) Example gas channels 1702 transmit gas within the cavity 1778 from rearward of the inertial member 1777 to forward of the inertial member 1777. As the inertial member 1777 moves rearward, the inertial member 1777 drives the drive member's cylindrical member 1709 and helix 1700 rearward.

As illustrated, the example projectile 1750 comprises a keyed joint 1269 between the inertial member 1777 of the drive member 1776 and the projectile's leading and trailing members 1771, 1705. The keyed joint 1269 maintains rotational alignment between the drive member 1776 and the projectile's leading and trailing members 1771, 1705 as the drive member 1776 moves rearward. FIGS. 17E, 17H, and 17I illustrate cross sectional views of an example embodiment of the keyed joint 1269. As illustrated in FIG. 17E, the example keyed joint 1269 comprises a key 1726 comprising a square cross section and associated features formed in the inertial member 1777 and the leading member 1771. FIG. 17H illustrates example features of the keyed joint 1269 formed in the leading member 1771. FIG. 17I illustrates example features of the keyed joint 1269 formed in the inertial member 1777.

As illustrated by the example view of FIG. 17F, the drive member's helix 1700 and the rotor's slot 1722 have matching cross sectional profiles which are rectangular in the illustrated example. As the drive member 1776 moves rearward, the helix 1700 moves through the slot 1722 and into the axis cavity 1711. The rearward movement of the helix 1700 drives rotation of the rotor 1775 about the axle 1712. In some embodiments, the drive member 1776 of FIG. 17C is replaced by the drive member 1776B of FIG. 17D, whose helix 1700B has a progressive helical rate. With this substitution, as the drive member 1776B moves continuously rearward, increments of motion produce progressively increasing increments of rotor rotation. The rotor 1775 and the drive member 1776 comprise an example embodiment of a helical pair. The rotor 1775 and the drive member 1776B comprise an example embodiment of a helical pair.

As the drive member 1776 moves fully rearward and the projectile 1750 assumes the mode illustrated by FIG. 17B, the helix 1700 moves out of the rotor's slot 1722 and thus disengages from driving rotation of the rotor 1750. The drive member's cylindrical member 1709 moves into the slot 1722. As illustrated by FIG. 17G, the cylindrical member 1709 and the slot 1722 are dimensioned to provide clearance between the cylindrical member 1709 and the slot 1722, so that the rotor 1775 spins freely around the cylindrical member 1709. In the illustration of FIG. 17G, the helix 1700, which is rear of the slot 1722 and behind the viewing plane, has been omitted from the view.

The projectile 1750 can incorporate one or more bearings, suitable embodiments of which the written description describes in detail with accompanying detailed teaching for implementation and practice. Bearings can, for example, be disposed where the rotor 1775 adjoins the axle 1712, wherein the rotor 1775 adjoins the leading member 1771, and/or where the rotor 1775 adjoins the trailing member 1705. In some example embodiments, such bearings can comprise aero spiral groove bearings that may, in some embodiments, be supported by one or more associated gas channels and/or one or more associated cavities from which gas may be drawn.

As the drive member 1776 moves fully rearward and the projectile 1750 assumes the mode illustrated by FIG. 17B, an indented edge 1713 of the inertial member 1777 jams against a stop 1714. In an example embodiment, the stop 1714 comprises a ring spot-welded to the leading member 1771 adjacent the cavity 1778 after the inertial member 1777 is inserted in the cavity 1778 during projectile assembly. With the inertial member 1777 jammed as illustrated by FIG. 17B, forward movement of the inertial member 1777 the projectile 1750 is inhibited. The projectile 1750 can thus remain in the mode illustrated by FIG. 17B as the projectile 1750 travels in open air (or in another medium or in empty space) towards a target or other destination.

With the inertial member 1777 moved fully rearward, the projectile's center of mass shifts rearward and mass of the projectile 1750 becomes relatively concentrated along the axis 5. The movement of the inertial member 1777 further produces a reduction the projectile's moment of inertia, as taken about an axis (not illustrated in FIG. 17) that extends through the projectile's center of mass and that is perpendicular to the longitudinally-extending axis 5. The reduction in moment of inertia can help the rotor 1775 control pitch and yaw of the projectile 1750 and/or can help the rotor 1775 stabilize the projectile 1750 in some example embodiments.

As illustrated by FIG. 17B, the rearward motion of the inertial member 1777 effectively shifts the cavity 1778 forward so the projectile 1750 is largely hollow within the projectile's ogive 122. The hollow ogive 122 can promote expansion of the projectile 1750 during interaction with a target in some example embodiments. In the illustrated embodiment of FIG. 17, the inertial member 1777 has a cylindrical geometry and the cavity 1778 is correspondingly cylindrical. In some other example embodiments, the inertial member 1777 is shaped and enlarged to enlarge the cavity 1778 within the ogive 122.

When the projectile 1750 arrives at and is incident upon the target, forward inertial can dislodge the inertial member 1777 so it moves abruptly forward within the cavity 1778 towards the target.

Figure 18A:
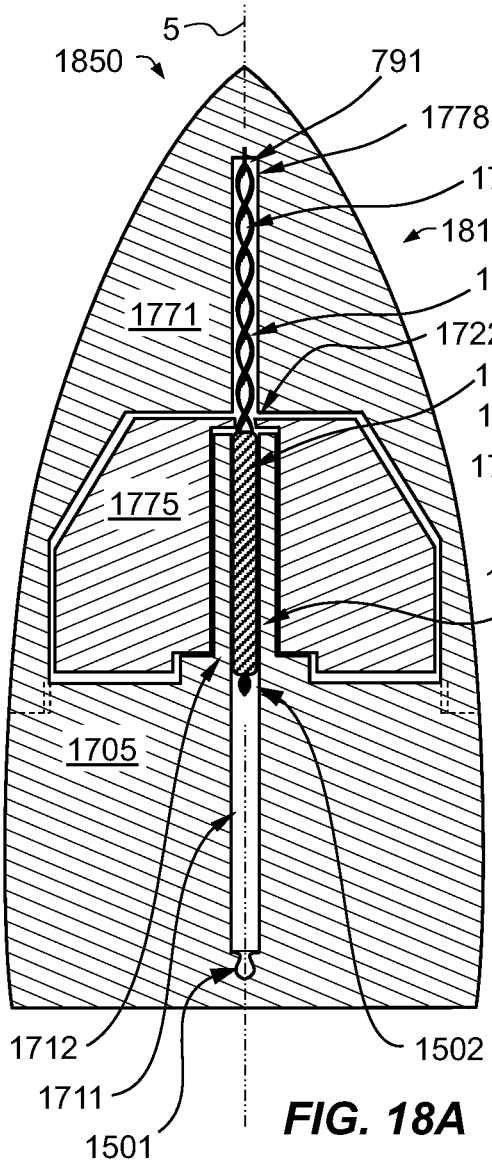
FIGS. 18A, 18B, and 18C, collectively
Figure 18B:
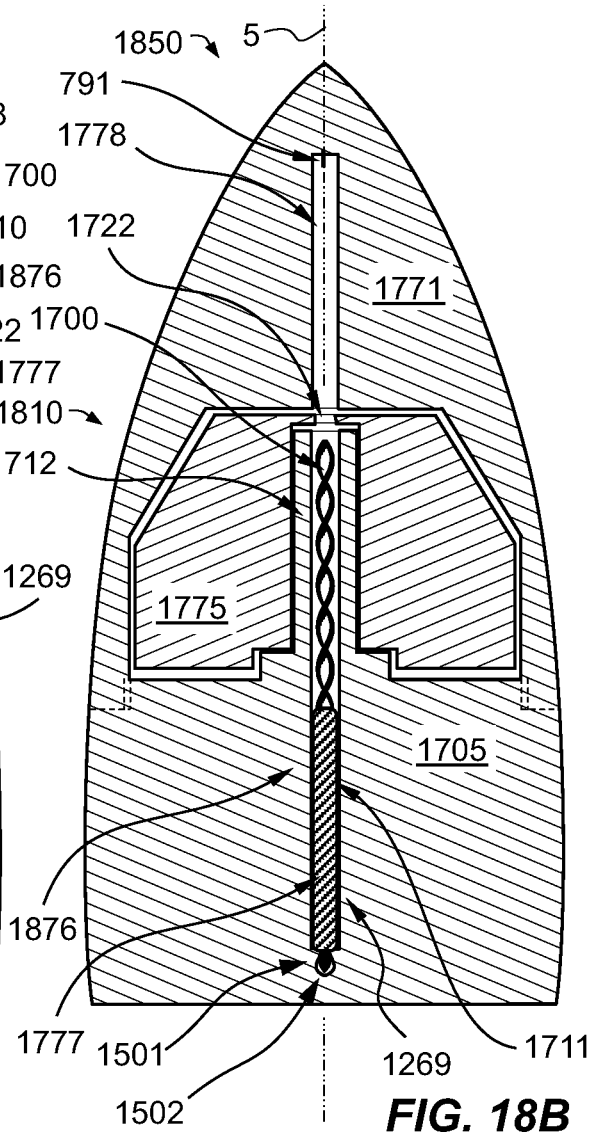
Figure 18C:
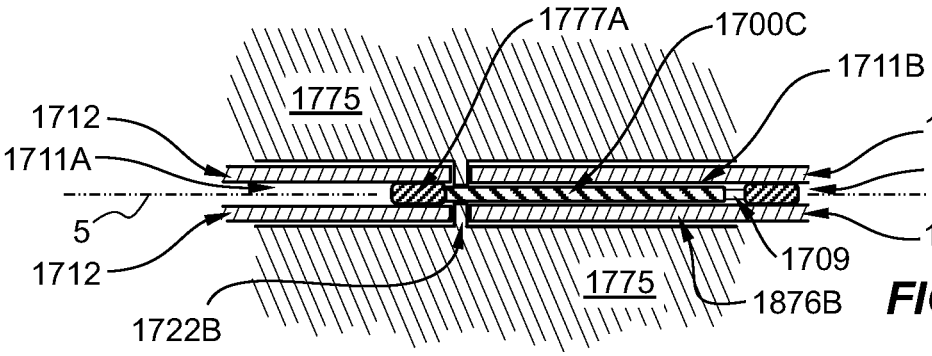

Turning now to FIGS. 18A, 18B, and 18C, these figures illustrate an example projectile 1850 according to some embodiments of the disclosure. FIGS. 18A and 18B respectively illustrate two example modes of the projectile 1850 in cross sectional view, in which an axis 5 of the projectile 1850 is in the view cutting plane, according to some embodiments. FIGS. 18A and 18B illustrate an example helix 1700 of the projectile 1850 without sectioning, thus illustrating example features of the helix 1700 that are in front of the cutting plane. FIG. 18C illustrates a cross sectional view of a central region of an example variation of the projectile 1850, with the projectile 1850 in the mode of FIG. 18A. In the view of FIG. 18C, the projectile 1850 is rotated clockwise 90 degrees relative to the orientation that FIG. 18A illustrates.

The illustrated projectile 1850 comprises an example embodiment of a drive 1810. As illustrated and discussed below, the drive 1810 comprises an example embodiment of an inertial drive.

Example embodiments of the drive 1810 can be incorporated in projectiles of guns, smoothbore guns, firearms, smoothbore firearms, light firearms, smoothbore light firearms, crew-served firearms, smoothbore crew-served firearms, light-gas guns, air guns, smoothbore air guns, railguns, or archery devices, including the disclosed examples thereof (not an exhaustive list). Example embodiments of the drive 1810 can further be incorporated in other aeronautical systems, including in the disclosed examples of aeronautical systems.

The mode of the projectile 1850 illustrated by FIG. 18A corresponds to the mode of the projectile 1750 illustrated by FIG. 17A as discussed above. The mode of the projectile 1850 illustrated by FIG. 18B corresponds to the mode of the projectile 1750 illustrated by FIG. 17B as discussed above. The projectile 1850 comprises an example embodiment of a mechanism.

In the illustrated example embodiment of FIGS. 18A and 18B, the projectile 1850 comprises a leading member 1771 fastened to a trailing member 1705, an axle 1712 with an associated axle cavity 1711 on an axis 5 of the projectile 1850, a rotor 1775 mounted on the axle 1712 and comprising a slot 1722, and a helix 1700 disposed in the slot 1722 as discussed above with reference to FIGS. 17A and 17B. The projectile 1850 further comprises a drive member 1876 that comprises the helix 1700 and an inertial member 1777. The rotor 1775 and the drive member 1876 comprise an example embodiment of a helical pair. The helix 1700 extends axially forward from the slot 1772 in a cavity 1778 formed in the leading member 1771. The inertial member 1777 extends rearward from the helix 1700 in the axle cavity 1711. A keyed joint 1269 extends along the axle cavity 1711 between the inertial member 1777 and the trailing member 1705. The keyed joint 1269 permits rearward axial movement of the inertial member 1777 within the axle cavity 1711 while preventing uncontrolled rotation of the inertial member 1777 relative to the trailing member 1705.

In the mode of FIG. 18A, the drive member 1876 is forward. A metal filament 791 that extends along the axis 5 joins the drive member 1876 to the forward member 1771. The metal filament 791 comprises a retainer that retains the drive member 1876 in the forward position of FIG. 18A. The metal filament 791 breaks responsive to a threshold level of force to release the drive member 1876 for rearward movement as discussed above with reference to FIGS. 7A and 7B, inter alia.

Once the metal filament 791 releases the drive member 1876, inertial force 85 associated with the acceleration 4 of the projectile 1850 forces the inertial member 1777 rearward within the axle cavity 1711 along the axis 5. (FIG. 1I illustrates an example embodiment of inertial force 85 and acceleration 4.) As the inertial member 1777 moves rearward, the inertial member 1777 pulls the helix 1700 through the slot 1777 of the rotor 1775. Gas channels (not illustrated in FIG. 18), which may be formed in the inertial member 1777 or provided in the axle cavity, can carry gas forward out of the axle cavity 1711 during movement of the inertial member 1777 to avoid impeding the movement. Movement of the helix 1700 through the slot 1777 produces rotation of the rotor 1775. When the drive member 1876 moves fully rearward to the mode that FIG. 18B illustrates, a plug 1502 on the inertial member 1777 snaps into a socket 1501 in the trailing member 1705 to retain the drive member 1876 in the rearward position.

In the illustrated projectile embodiment of FIGS. 18A and 18B, mass of the drive member 1876 largely resides in the inertial member 1777. Alternatively, the helix 1700 can be configured to provide a greater portion of the drive member's mass. FIG. 18C illustrates an example in which some features of the projectile 1850 have been changed, including in a manner that redistributes the drive member's mass. As illustrated in FIG. 18C, the helix 1700 has been replaced by a helix 1700C that comprises a metal bar having a square cross section that is twisted to provide a helical geometry as illustrated by FIG. 4H and identified with reference number 400A or as illustrated by FIG. 7K and identified with the reference number 721B. The helix 1700C can, for example, be composed of copper, carbon steel, lead, tungsten, tungsten carbide, or depleted uranium. Members 1777A, 1777B of untwisted square bar stock are attached to the ends of the helix 1700C, with a cylindrical member 1709 of reduced diameter disposed between the member 1777B and the helix 1700C. Each member 1777A, 1777B has a cross sectional geometry that is enlarged relative to the cross section of the helix 1700C. That is, a cross sectional outline of the helix 1700C fits in a cross sectional outline of each member 1777A, 1777B, with clearance. In this example embodiment, the drive member 1876 illustrated by FIGS. 18A and 18B is thus replaced with a drive member 1876B comprising an elongated section of twisted helical bar (comprising the helix 1700C) extending between two short sections of enlarged square bar (comprising the members 1777A, 1777B) and further comprising the cylindrical member 1709.

As illustrated by FIG. 18C, the reconfigured drive member 1876B can be integrated into the projectile 1850 as follows. In the example embodiment of FIG. 18C, the axle cavity 1711 is reconfigured as axle cavity 1711A that comprises a square aperture that receives the member 1777A. The cavity 1778 is similarly reconfigured as axle cavity 1711B that comprises a square aperture that receives the member 1777B at the opposite end of the helix 1700C. The square apertures of the axle cavities 1711A, 1711B and square members 1777A, 1777B of the reconfigured drive member 1876B form a keyed joint, so the reconfigured drive member 1876B can move axially without uncontrolled rotation. The slot 1722 in the rotor 1775 is reconfigured as a square aperture 1722B, through which the twisted helical bar of helix 1700C of the reconfigured drive member 1876B extends. Inertial force drives axial movement of the reconfigured drive member 1876B. Movement of the helix 1700C through the rotor's square aperture 1722B produces rotation of the rotor 1775. The axle cavity 1711A is dimensioned so that the member 1777A encounters the rear end of the axle cavity 1711A as the cylindrical member 1709 enters the rotor's square aperture 1722B. The rear end of the axle cavity 1711A stops farther movement of the drive member 1876B. As the cylindrical member 1709 enters the rotor's square aperture 1722B, the helix 1700C disengages from the square aperture 1722B. Clearance between the cylindrical member 1709 and the square aperture 1722B facilitates free spinning of the rotor 1775.

As a further reconfiguration, as illustrated by FIG. 18C, the rotor's slot 1772 (reconfigured as the square aperture 1722B) is moved axially rearward, from the forward end of the rotor (as illustrated by FIG. 18A) to midway between the rotor's forward and rear ends. The rotor 1775 is supported between two aligned axles 1712, 1712B. The first axle 1712 extends axially into the rotor 1775 from the trailing member 1705 (like illustrated in FIG. 18A, but shorter). The second axle 1712B extends into the rotor 1775 from the leading member 1771.

Some example embodiments of the projectile 1850 can incorporate bearings disposed at adjoining surfaces subject to relative movement and load. Bearings can, for example, be disposed where contact between the rotor 1775 and other portions of the projectile 1850 occurs or could occur without bearings. The written description, including the figures and accompanying textual discussion, describes suitable bearing embodiments in detail with accompanying detailed teaching for implementation and practice. In some example embodiments, such bearings can comprise one or more aero spiral groove bearings that may, in some embodiments, be supported by one or more associated gas channels and/or one or more associated cavities from which gas may be drawn. In some example embodiments, such bearings can comprise one or more aerostatic bearings. In some example embodiments, the aerostatic bearings comprise one or more channels that direct expanding propellant gas 26 between the adjoining surfaces to provide a layer of pressured gas that provides a low-friction, load-bearing interface.

Figure 19C:
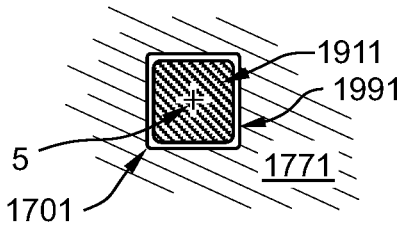
Figure 19D:
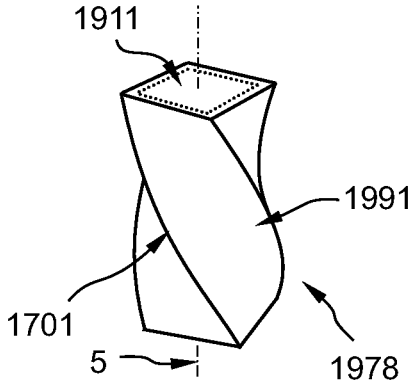

Turning now to FIGS. 19A, 19B, 19C, and 19D, these figures illustrate an example projectile 450C according to some embodiments of the disclosure. FIGS. 19A and 19B respectively illustrate two example modes of the projectile 450C in cross sectional view, in which an axis 5 of the projectile 450C is in the view cutting plane, according to some embodiments. The mode of the projectile 450C illustrated by FIG. 19A corresponds to the mode of the projectile 1850 illustrated by FIG. 18A. The mode of the projectile 450C illustrated by FIG. 19B corresponds to the mode of the projectile 1850 illustrated by FIG. 18B. In FIGS. 19A and 19B, an example helix 1700 of the projectile 450C is illustrated without sectioning, thereby illustrating example features in front of the cross sectional cutting plane. FIG. 19C illustrates an example central region of the projectile 450C in cross section taken at Section O-O according to some embodiments. FIG. 19D illustrates an example central region 1978 of the projectile 450C in a detail perspective view that illustrates example contours of a forward gas channel 1991 in the central region 1978 according to some embodiments. FIG. 4D, discussed above, illustrates an example rear central portion 471 of the projectile 450C that comprises an example rear gas channel 482 according to some embodiments.

As will be apparent from a review of FIGS. 18A and 18B and FIGS. 19A and 19B and the foregoing discussion, the projectile 450C, as illustrated, incorporates features of the projectile 1850. As one distinguishing feature, the projectile 450C illustrated by FIGS. 19A, 19B, 19C, and 19D comprises a drive 1910 that comprises an example embodiment of a gas drive. As illustrated and discussed below, the drive 1910 further comprises a compound helical drive. The projectile 1850 further comprises an example embodiment of a mechanism.

Example embodiments of the drive 1910 can be incorporated in projectiles of guns, smoothbore guns, firearms, smoothbore firearms, light firearms, smoothbore light firearms, crew-served firearms, smoothbore crew-served firearms, light-gas guns, air guns, smoothbore air guns, railguns, or archery devices, including the disclosed examples thereof (not an exhaustive list). Example embodiments of the drive 1910 can further be incorporated in other aeronautical systems, including in the disclosed examples of aeronautical systems.

In the example embodiment illustrated by FIGS. 19A, 19B, 19C, and 19D, the projectile 450C comprises a drive member 1976 that comprises the helix 1700, a piston member 1911, and a plug 1502. As illustrated and discussed herein, the piston member 1911 comprises an example embodiment of a piston. The helix 1700 extends through a slot 1722 in the rotor 1775 as illustrated by FIG. 17 as discussed above. The rotor 1775 and the drive member 1976 comprise an example embodiment of a helical pair. Clearance between the helix 1700 and the walls of the slot 1722 can provide a channel for gas flow through the slot 1722. In some example embodiments, the rotor 1775 comprises holes (not illustrated by FIG. 17F) disposed adjacent the slot 1722 on diametrically opposing sides of the slot 1722. The holes can provide gas channels that supplement gas flow through the slot 1722. In some example embodiments, expanding propellant gas 26 flowing through the holes and/or the slot 1722 creates forward force on the rotor 1775 that counters rearward inertial force 85 on the rotor 1775 produced by acceleration 4 of the projectile 450C. (FIG. 1I illustrates example embodiments of inertial force 85 and acceleration 4.) In some example embodiments, gas flow through the holes and/or the slot 1722 can reduce friction on the rotor 1775 by elevating the rotor 85 while the rotor 85 is rotating.

As illustrated by FIGS. 19A and 19B, the rear gas channel 482 extends forward from a trailing surface 1954 of the projectile 450C, through the projectile's trailing member 1705 along the axis 5, and to the slot 1722 of the rotor 1775. A forward gas channel 1991 extends rearward from a tip 788 of the projectile, through the projectile's leading member 1771 along the axis 5, and to the rotor's slot 1722. The forward gas channel 1991 and the rear gas channel 482 provide a channel that extends through the rotor 1775 adjacent the slot 1722, so expanding propellant gas 26 can flow from the projectile's rear surface 1954 to the projectile's tip 788.

As illustrated by the cross sectional view of FIG. 19C, the example forward gas channel 1991 and the example piston member 1911 comprise matching square cross sections that form a keyed joint. As illustrated by FIGS. 19A, 19B, 19C, and 19D, the piston member 1911 comprises an example embodiment of a piston, and the forward gas channel 1991 comprises and example embodiment of a cylinder in which the piston is disposed.

In some example embodiments, the piston member 1911 and the portion of the leading member 1771 through which the forward gas channel 1991 extends have like metallic compositions or are composed of metals with like thermal expansion properties. In some example embodiments, the piston member 1911 is composed of copper alloy C93200 and the leading member 1771 is composed of copper alloy C22000. In some example .30 caliber embodiments of the projectile 450C and in some example 12 gauge slug embodiments of the projectile 450C, the piston member 1911 is composed of bearing bronze and the leading member 1771 is composed of gilding copper. In some example embodiments, the piston member 1911 and the forward gas channel 1991 are dimensioned to provide a sliding clearance fit or a location clearance fit. In some example .30 caliber embodiments of the projectile 450C, the piston member 1911 and the forward gas channel 1991 are fabricated to an ISO H7/h6 clearance fit under the shaft basis system. In some example .30 caliber embodiments of the projectile 450C, the piston member 1911 and the forward gas channel 1991 are fabricated to an ISO G7/h6 clearance fit under the shaft basis system. In some example 12 gauge slug embodiments of the projectile 450C, the piston member 1911 and the forward gas channel 1991 are fabricated to an ISO H7/h6 clearance fit under the shaft basis system. In some example 12 gauge slug embodiments of the projectile 450C, the piston member 1911 and the forward gas channel 1991 are fabricated to an ISO G7/h6 clearance fit under the shaft basis system.

In some example embodiments, the piston member 1911 comprises a gland (not illustrated by FIG. 19C) in which packing material is disposed to provide a packing seal or an O-ring is disposed for sealing. In some example embodiments, the piston member 1911 comprises a PTFE seal. In some example embodiments air gun embodiments of the projectile 450C, the piston member 1911 is composed of PTFE and the leading member 1771 of the projectile 450C is composed of a metal that comprises copper or lead.

In example operation, as the projectile 450C transitions from the mode of FIG. 19A to the mode of FIG. 19B, expanding propellant gas 26 flows through the rear channel 482 and drives the piston member 1911 forward in the forward gas channel 1991. The piston member 1911 thus pulls the helix 1700 forward through the slot 1722, and the axially moving helix 1700 rotates the rotor 1775.

In the example embodiment that FIGS. 19A, 19B, 19C, and 19D illustrate, the forward gas channel 1991 comprises a helix 1701 that produces rotation of the piston member 1911 as the expanding propellant gas 26 drives the piston member 1911 forward in the forward gas channel 1991. The rotation of the piston member 1911 rotates the entire drive member 1976. Accordingly, the drive member's helix 1700 rotates about the axis 5 while moving forward along the axis 5. The drive member's helix 1700 rotates in a first rotational direction according to the forward gas channel's helix 1701. The forward gas channel's helix 1701 defines the first rotational direction of the drive member's helix 1700. The drive member's helix 1700 defines a second rotational direction of the rotor 1775 due to axial movement of the helix 1700 with the helix 1700 in a fixed rotational orientation. With the first and second rotational directions the same (that is, both clockwise, or both counterclockwise) the rotations compound, with a result of amplifying rotor rotation.

FIG. 19D illustrates an example embodiment of the helix 1701 as comprised by the forward gas channel 1991 in a central portion 1978 of the projectile 450C. FIG. 19D represents the forward gas channel 1991 in the central portion 1978 as an opaque casting. Thus, a representative section of the forward gas channel 1991 is illustrated as an opaque solid that shows an example of the forward gas channel's square cross section extending helically along and about the axis 5. A dashed outline represents an example orientation of the piston member 1911 relative to the forward gas channel 1991. The helix 1701 and the piston member 1911 comprise an example embodiment of a helical pair. As the drive member 1976 moves fully forward and the projectile 450C assumes the mode of that FIG. 19B illustrates, the helix 1700 moves out of the slot 1722 and disengages from the slot 1722. A plug 1502 at the drive member's forward end wedges into the forward gas channel 1991. So wedged, the plug 1502 closes the forward gas channel 1991 from gas transmission and retains the drive member 1976 in the forward position. The projectile 450C can thus travel in open air while decelerating without air entering the projectile 450C through the forward gas channel 1991.

The projectile 450C can incorporate one or more bearings, suitable embodiments of which the written description describes in detail with accompanying detailed teaching for implementation and practice. Bearings can, for example, be disposed where contact between the rotor 1775 and other portions of the projectile 450C occurs or could occur without bearings. In some example embodiments, such a bearing can comprise an aero spiral groove bearing that may, in some embodiments, be supported by one or more associated gas channels and/or one or more associated cavities from which gas may be drawn. In some example embodiments, such a bearing can comprise an aerostatic bearing. In some example embodiments, the aerostatic bearing comprises one or more channels that direct the expanding propellant gas 26 between the rotor 1775 and an adjoining surface of the projectile 450C to provide a layer of pressured gas that provides a low-friction, load-bearing interface.

In some example embodiments of the projectile 450C, the drive member's helix 1700 comprises a progressive helical rate, so the helix 1700 progressively tightens with forward movement of the drive member 1976. In some example embodiments of the projectile 450C, the forward gas channel's helix 1701 comprises a progressive helical rate, so the helix 1701 progressively tightens with forward movement of the drive member 1976. In some example embodiments of the projectile 450C, the helix 1701 comprises a progressive helical rate and the helix 1700 comprises a progressive helical rate, wherein each of the helices 1701, 1700 progressively tightens with forward movement of the drive member 1976.

In some example embodiments of the projectile 450C, a bar (not illustrated by FIG. 19) that comprises a plunger is disposed in the rear gas channel 482 and extends from the trailing surface 1954 to the helix 1700. In example operation, the expanding propellant gas 26 drives the bar forward, and the bar's forward movement can drive the helix 1700 forward.

Figure 20A:
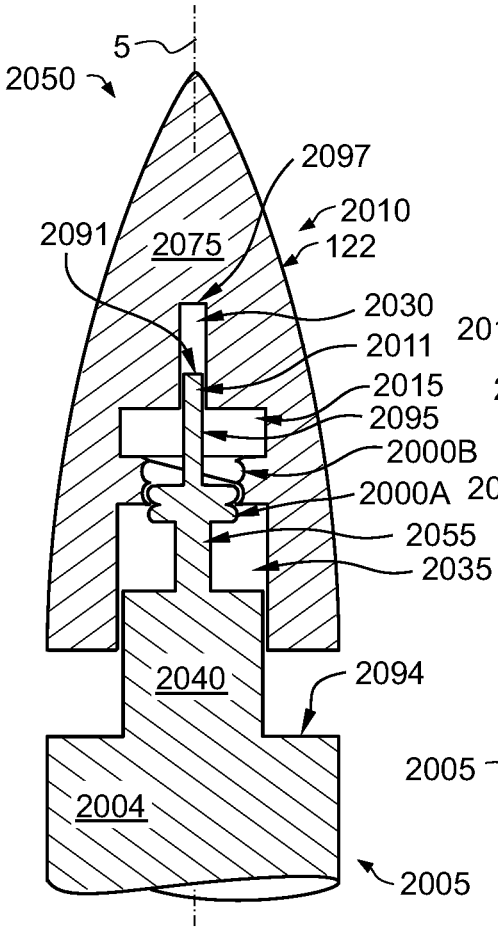
FIGS. 20A and 20B, collectively
Figure 20B:
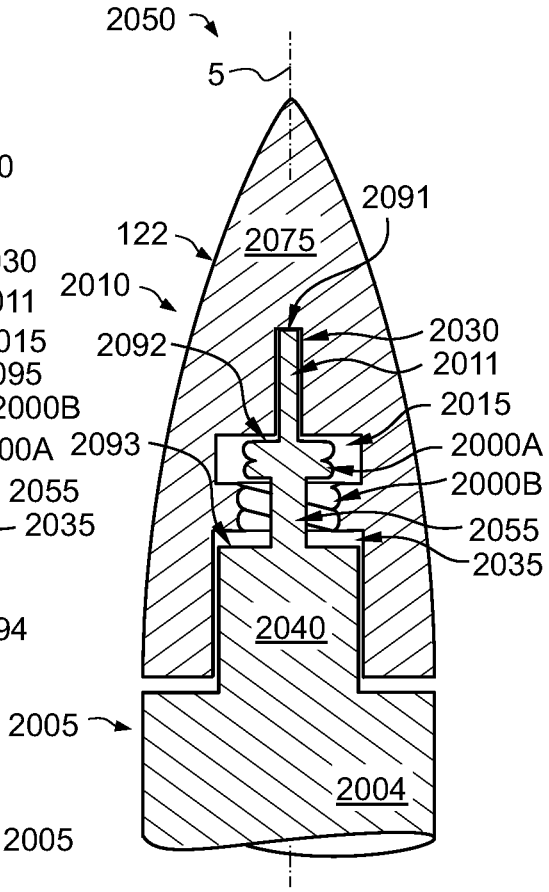

Turning now to FIGS. 20A and 20B, these figures illustrate an example projectile 2050 in two respective modes according to some embodiments of the disclosure. FIGS. 20A and 20B illustrate cross sectional views of the projectile 2050 with an axis 5 of the projectile 2050 in the cutting plane of the view.

The mode of the projectile 2050 that FIG. 20A illustrates corresponds generally to the mode of the projectile 150 illustrated by FIG. 1K as discussed above. The mode of the projectile 2050 that FIG. 20B illustrates corresponds generally to the mode of the projectile 150 illustrated by FIG. 1L as discussed above. The illustrated projectile 2050 comprises an example embodiment of a drive 2010. As illustrated and discussed below, the drive 2010 of the projectile 2050 comprises an example embodiment of an inertial drive. The projectile 2050 comprises an example embodiment of a mechanism.

Example embodiments of the drive 2010 can be incorporated in projectiles of guns, smoothbore guns, firearms, smoothbore firearms, light firearms, smoothbore light firearms, crew-served firearms, smoothbore crew-served firearms, light-gas guns, air guns, smoothbore air guns, railguns, or archery devices, including the disclosed examples thereof (not an exhaustive list). Example embodiments of the drive 2010 can further be incorporated in other aeronautical systems, including in the disclosed examples of aeronautical systems.

The projectile 2050 comprises an example embodiment of a rotor 2075 and an example trailing member 2005 to which the rotor 2075 is mounted. The rotor 2075 and the trailing member 2005 comprise an example embodiment of a helical pair. The example rotor 2075 forms a leading member of the projectile 2050. The rotor 2075 is exposed with the projectile 2050 in the mode of FIG. 20A and in the mode of FIG. 20B. In the illustrated example projectile 2050 of FIGS. 20A and 20B, the entire circumferential surface of the rotor 2075 is exposed. Further, the outer surface of the rotor 2075 forms an exterior surface of the projectile 2050. Further, the rotor 2075 comprises an ogive 122. Further, the rotor 2075 forms an ogive 122 of the projectile 2075. Further, an ogive 122 of the projectile 2075 comprises the rotor 122.

In the illustrated example embodiment of FIGS. 20A and 20B, the projectile's trailing member 2005 comprises an extending member 2004, a rear cylindrical member 2040 of reduced diameter that projects forward from the extending member 2004, an intermediate cylindrical member 2055 of farther reduced diameter that extends forward from the rear cylindrical member 2040, the helix 2000A extending forward from the intermediate cylindrical member 2055, and a forward cylindrical member 2011 of farther reduced diameter that extends forward from the helix 2000A and comprises an axle. In the illustrated example embodiment of FIGS. 20A and 20B, the projectile's rotor 2075 comprises a rear aperture 2035, the helix 2000B extending forward from the rear aperture, a cavity 2015 that extends forward from the helix 2000B, and a forward aperture 2030 that extends forward from the cavity 2015. The forward aperture 2030 is sized to receive the forward cylindrical member 2011, which comprises an axle about which the rotor 2075 spins. The cavity 2015 is sized to receive the helix 2000A with axial and radial clearance for the rotor 2075 to spin freely with the helix 2000A disposed in the cavity 2015. The rear aperture 2035 is sized to receive the helix 2000A and is further sized to receive the rear cylindrical member 2040. The helix 2000B is sized to receive the intermediate cylindrical member 2055 with clearance for the rotor 2075 to spin freely with the helix 2000B rotating about the intermediate cylindrical member 2055.

In the mode that FIG. 20A illustrates, a forward portion of the rear cylindrical member 2040 is disposed in a rear portion of the rear aperture 2035, the intermediate cylindrical member 2055 is disposed in the rear aperture 2035, the helix 2000A is engaged with the helix 2000B, a rear portion of the helix 2000A is disposed in a forward portion of the rear aperture 2035, and the forward cylindrical member 2011 extends forward into and through the cavity 2015 and into the forward aperture 2030. In an example process, the projectile 2050 launches from the mode of FIG. 20A. With the projectile 2050 in the mode of FIG. 20A, the rotor 2075 is fully forward, with the helix 2000A of the trailing member 2005 and the helix 2000B of the rotor 2075 engaged. Acceleration 4 of the projectile 2050 produces inertial force 85 acting on the rotor 2075. (FIG. 1I illustrates some example embodiments of acceleration 4 and inertial force 85.) Responsive to the inertial force 85, the projectile 2050 releases the rotor 2075 from the forward position illustrated by FIG. 20A, and the rotor 2075 begins moving rearward along the projectile's axis 4. In some example embodiments, releasing the rotor 2075 from the forward position comprises shearing a shear pin. (FIG. 4K illustrates an example embodiment of a shear pin 414 as discussed above.) The rearward movement of the rotor 2075 with the helices 2000A, 2000B engaged produces rotation of the rotor 2075.

In the illustrated example embodiment, transition of the projectile 2050 from the mode of FIG. 20A to the mode of FIG. 20B comprises the forward cylindrical member 2011 axially moving farther into the forward aperture 2030, the helices 2000A, 2000B rotating the rotor 2075, the helices 2000A, 2000B disengaging as the helix 2000B moves rearward past the helix 2000A, the helix 2000A axially moving into the cavity 2015, the intermediate cylindrical member 2055 axially moving forward to a position in which the helix 2000B is axially disposed between opposing ends of the intermediate cylindrical member 2055, and the rear cylindrical member 2040 axially moving farther into the rear aperture 2035.

The rotor 2075 can spin freely with the projectile 2050 in the mode of FIG. 20B. In some example embodiments, the projectile 2050 comprises magnets for retaining the rotor 2075 in the illustrated rear position while drag decelerates the projectile 2050 as the projectile 2050 travels through a medium on a trajectory for arriving at a target or destination. FIGS. 3A and 3B illustrate an example embodiment of retention magnets identified with reference number 379 as discussed above.

In the illustrated embodiment, the forward cylindrical member 2011 comprises an axle that supports the spinning rotor 2075 and that can comprise one or more bearing surfaces. In some example embodiments, the circumferential surface 2095 of the forward cylindrical member 2011 comprises a bearing surface. In some example embodiments, a forward face 2091 of the forward cylindrical member 2011 comprises a bearing surface for the spinning rotor 2075. In some example embodiments, the forward face 2091 comprises a point or cone (not illustrated by FIG. 20) and the adjoining surface 2097 of the rotor 2075 comprises a recess (not illustrated by FIG. 20) into which the point or cone is disposed, so the point or cone supports the rotor 2075 when the rotor 2075 is spinning. In some example embodiments, a surface 2092 that extends radially between the forward cylindrical member 2011 and the helix 2000A comprises a bearing surface for the spinning rotor 2075. In some example embodiments, a shoulder 2093 formed between the intermediate cylindrical member 2055 and the rear cylindrical member 2040 comprises a bearing surface for the spinning rotor 2075. In some example embodiments, the trailing member 2005 comprises a shoulder 2094 that is disposed rear of the rotor 2075 comprises a bearing surface for the spinning rotor 2075. The projectile 2050 can incorporate one or more bearings, suitable embodiments of which the written description describes in detail with accompanying detailed teaching for implementation and practice. For instance, in some projectile embodiments, such bearings can comprise aero spiral groove bearings. One or more bearings can, for example, be disposed to support bearing surfaces of the projectile 2050, including the bearing surfaces identified in the present paragraph.

In the illustrated example of FIGS. 20A and 20B, the extending member 2004 of the trailing member 2005 comprises a cylindrical geometry that extends rearward and can form an elongate member, a bar, or a shaft. In some example embodiments, the extending member 2004 is solid, for instance composed of solid metal. In some example embodiments, the extending member 2004 is hollow. In some example embodiments, the projectile 2050 comprises an archery projectile that an archery device shoots. For example, the projectile 2050 can comprise an arrow for a bow or a bolt for a crossbow. The extending member 2004 can comprise a light-weight shaft extending rearward that is made of carbon fiber or a thin tube of aluminum. The rotor 2075 can comprise a point or a tip for an archery projectile. The rotor 2075 can further comprise blades or sharp edges (not illustrated by FIG. 20) that form a broadhead. In some embodiments, the forward cylindrical member 2011 extends forward complete through the rotor 2075 and a broadhead is mounted to the forward cylindrical member 2011 forward of the rotor 2075. In some example embodiments, the projectile 2050 comprises a gun projectile that shoots through a gun barrel 35. (FIGS. 1A and 4A illustrate example embodiments of a gun barrel 35.) The trailing member 2005 can comprise a bearing surface with respect to the gun barrel 35 and can be diametrically larger than the rotor 2075 to avoid contact between the barrel 35 and the spinning rotor 2075. In some example embodiments, the projectile 2050 comprises an air gun projectile, a pellet, or an air pellet. In some example embodiments, the projectile 2050 comprises a firearm bullet. In some example embodiments, the projectile 2050 comprises a railgun projectile.

In an alternative to the embodiment that FIG. 20 illustrates, the projectile 2050 can be reconfigured to provide a keyed joint between the forward cylindrical member 2011 and the element that is identified with "2075" (referred to above as a rotor, but in the present paragraph as "element 2075") and to make the helix 2000A rotatable about the axis 5. The element 2075 can thus move rearward without rotating. And, the helix 2000A is formed on an outer surface of a rotor that can rotate about the axis 5. In this embodiment, inertial force drives the element 2075 rearward and engagement between the helices 2000A, 2000B produces rotation of the rotor upon which the helix 2000A is formed.

Figure 21:
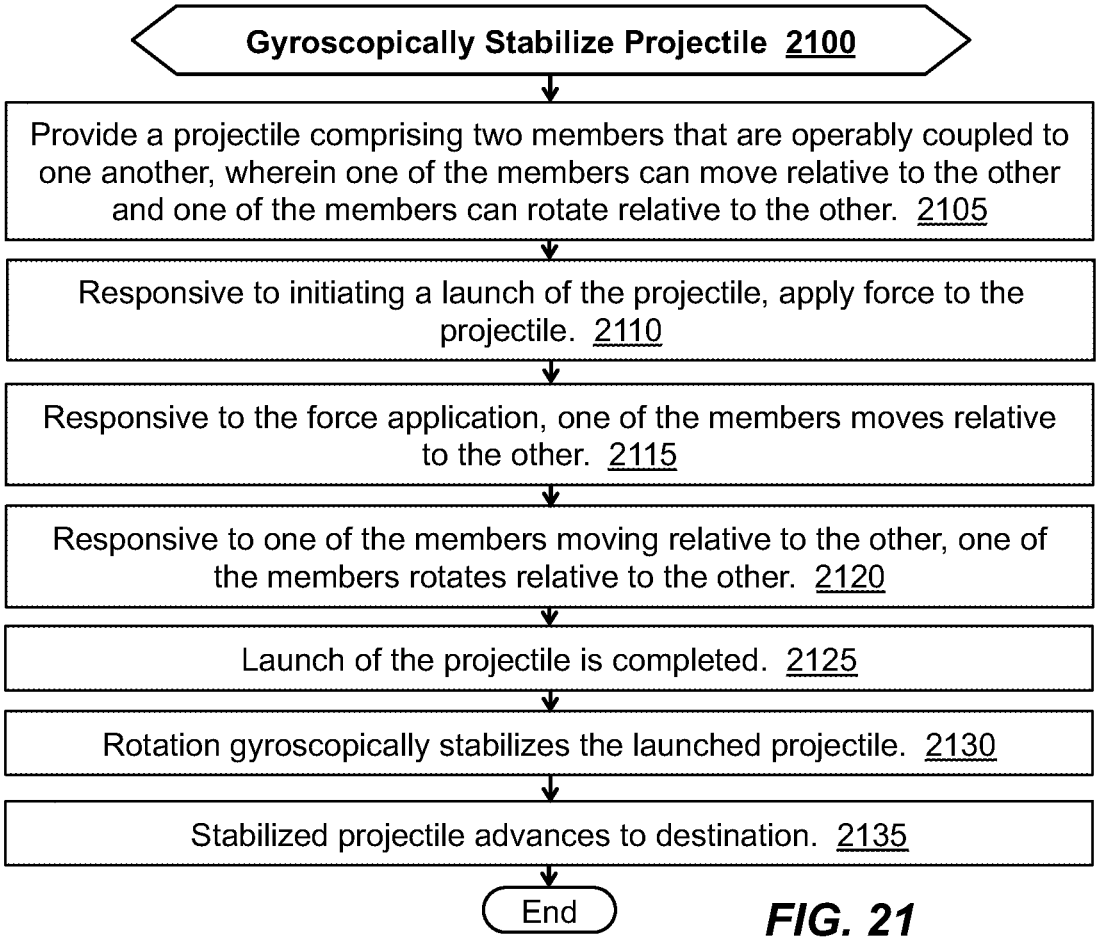
FIG. 21 is a flowchart for a process for gyroscopically stabilizing a projectile in accordance with some example embodiments of the disclosure.

Turning now to FIG. 21, this figure illustrates a flowchart for an example process 2100 for gyroscopically stabilizing a projectile according to some embodiments of the disclosure.

At block 2105 of the process 2100, the example projectile is provided. The example projectile comprises two members that are operably coupled to one another. One of the members can move relative to the other member. One of the members can rotate relative to the other.

In some example embodiments, the member that can move relative to the other member is the same member that can rotate relative to the other member. Thus, the projectile can comprise a first member and a second member, wherein the first member can move relative to the second member and can rotate relative to the second member. For example, the projectile 150 that FIG. 1 illustrates comprises the rotor 75 that can move rearward relative to the bar 120 and that can rotate relative to the bar 120.

In some example embodiments, the member that can move relative to the other member can be viewed as distinct from the member that can rotate relative to the other member. Thus, the projectile can comprise a first member and a second member, wherein the first member can move relative to the second member, and the second member can rotate relative to the first member. For example, the projectile 750 that FIG. 7 illustrates comprises the drive member 728 and the rotor 775, wherein the drive member 728 can move relative to the rotor 775, and the rotor 775 can rotate relative to the drive member 728. As another example, in the projectile 150 illustrated by FIG. 1, the bar 120 can move forward relative to the rotor 75, and the rotor 75 can rotate relative to the bar 120.

At block 2110 of the process 2100, responsive to initiating a launch of the example projectile, force is applied to the example projectile. In some example embodiments, the applied force comprises the propellant force 51 and/or the inertial force 85, for which FIG. 1I illustrates some example embodiments as discussed above. In some example embodiments of block 2110, responsive to initiating the launch of the projectile, the projectile can be propelled through a barrel of a gun, the projectile can be propelled using mechanical energy stored in a limb of an archery device (for instance using a compound bow or a crossbow), the projectile can be propelled using electromagnetic force (for instance using a railgun), the projectile can be propelled using an onboard source of propulsive power (for instance a rocket that is self-propelled utilizing onboard propellant), etc. (some representative examples, not an exhaustive list).

At block 2115 of the process 2100, responsive to the force application, one of the members moves relative to the other member. In some example embodiments, one of the members can move axially. In some example embodiments, one of the members can move along an axis of the projectile. In some example embodiments, one of the members can move linearly. In some example embodiments, one of the members can move along a path. In some example embodiments, the path comprises an axis of the projectile. In some example embodiments, the path is linear. In some example embodiments, the path is not linear. In some example embodiments the path is curved. In some example embodiments, the path comprises curvature or one or more bends. In some example embodiments, the path follows a straight line that diverges from the axis of the projectile or forms an angle with the axis of the projectile.

At block 2120 of the process 2100, responsive to one of the members moving relative to the other member, one of the members rotates relative to the other member. In some example embodiments, the rotating member comprises a rotor. In some example embodiments, the rotating member rotates about the axis of the projectile. In some example embodiments, the rotating member rotates about an axis that is tilted relative to the axis of the projectile or is oriented to form an angle with the axis of the projectile.

At block 2125 of the process 2100, the launch of the projectile is completed. In some example embodiments, the launched projectile can travel through a medium towards a target or other destination.

At block 2130 of the process 2100, rotation gyroscopically stabilizes the launched example projectile.

At block 2135 of the process 2100, the stabilized example projectile advances to a destination. In some example embodiments, stabilized projectile can advance along a trajectory, and the destination can comprise a target.

In the illustrated example flowchart for FIG. 21, process 2100 ends following execution of block 2135. The ending can, for example, comprise arrival of the projectile at its intended destination.

Figure 22:
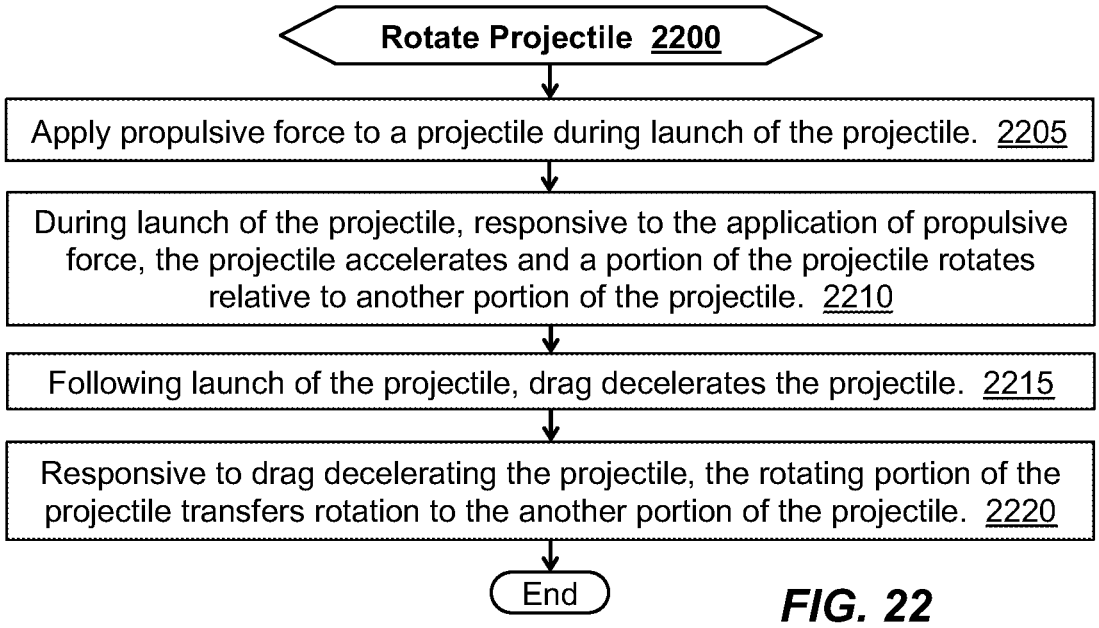
FIG. 22 is a flowchart for a process for rotating a projectile in accordance with some example embodiments of the disclosure.

Turning now to FIG. 22, this figure illustrates a flowchart for an example process 2200 for rotating a projectile according to some embodiments of the disclosure. In some example embodiments, the projectile of the process 2200 and the projectile of the process 2100 are the same projectile. In some example embodiments, the process 2100 of FIG. 21 can execute in parallel with the execution of the process 2200 of FIG. 22.

At block 2205 of the process 2200, propulsive force is applied to the example projectile during launch of the example projectile.

At block 2210 of the process 2200, during launch of the example projectile, responsive to the application of propulsive force, the example projectile accelerates and a portion of the example projectile rotates relative to another portion of the example projectile. In some example embodiments, the projectile comprises an exterior surface and a rotor, wherein the rotor rotates relative to the exterior surface. In some example embodiments, the exterior surface has a rotational orientation during launch that is constrained or fixed. For example, the exterior surface may be constrained to a particular orientation by a sabot or a gun barrel bore.

At block 2215 of the process 2200, following launch of the example projectile, drag decelerates the example projectile. In some example embodiments, the drag comprises air resistance that the projectile experiences while traveling in open air towards a target or other destination.

At block 2220 of the process 2200, responsive to drag decelerating the example projectile, the rotating portion of the example projectile transfers rotation to the another portion of the example projectile. In some example embodiments, a spinning rotor of the projectile transfers rotation to an exterior of the projectile, for instance so that the entire projectile begins rotating.

In the illustrated example flowchart of FIG. 22, process 2200 ends following execution of block 2220. The ending can, for example, comprise arrival of the projectile at its intended destination.

Turning now to FIGS. 23A, 23B, 23C, and 23D and FIG. 24, some further example embodiments will be discussed. As discussed below, a projectile 2350 can comprise elements that respond differently to at least one stimulus during projectile launch. Two or more elements of the projectile 2350 can have different response characteristics to a rotational stimulus. One element can respond more slowly than another to rotation of the projectile 2350 or with a different rise time or lag time or with relative time delay. For example, the projectile 2350 can comprise a mass that is rotatable and an exterior surface 2376 housing the mass. In some example embodiments, the mass comprises the rotor 2375.

Figure 23A:
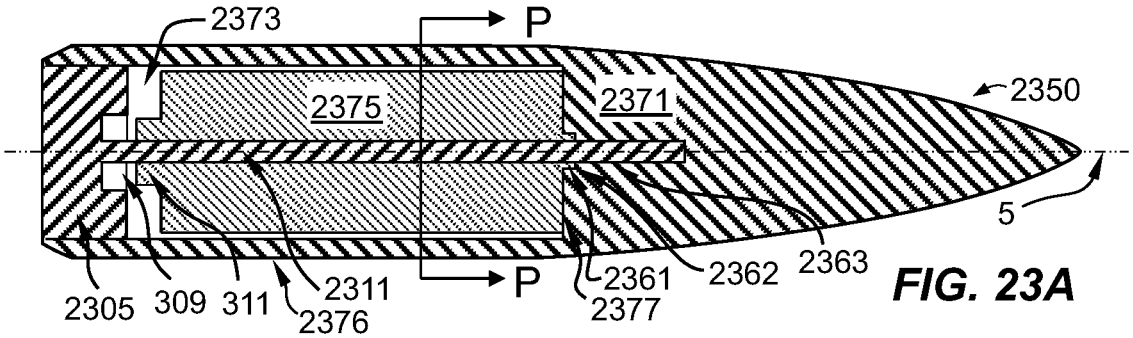
FIGS. 23A, 23B, 23C, and 23D, collectively
Figure 23C:
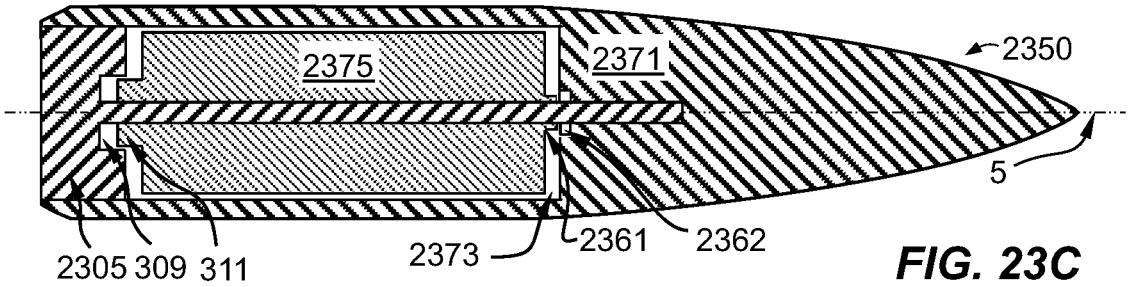
Figure 23B:
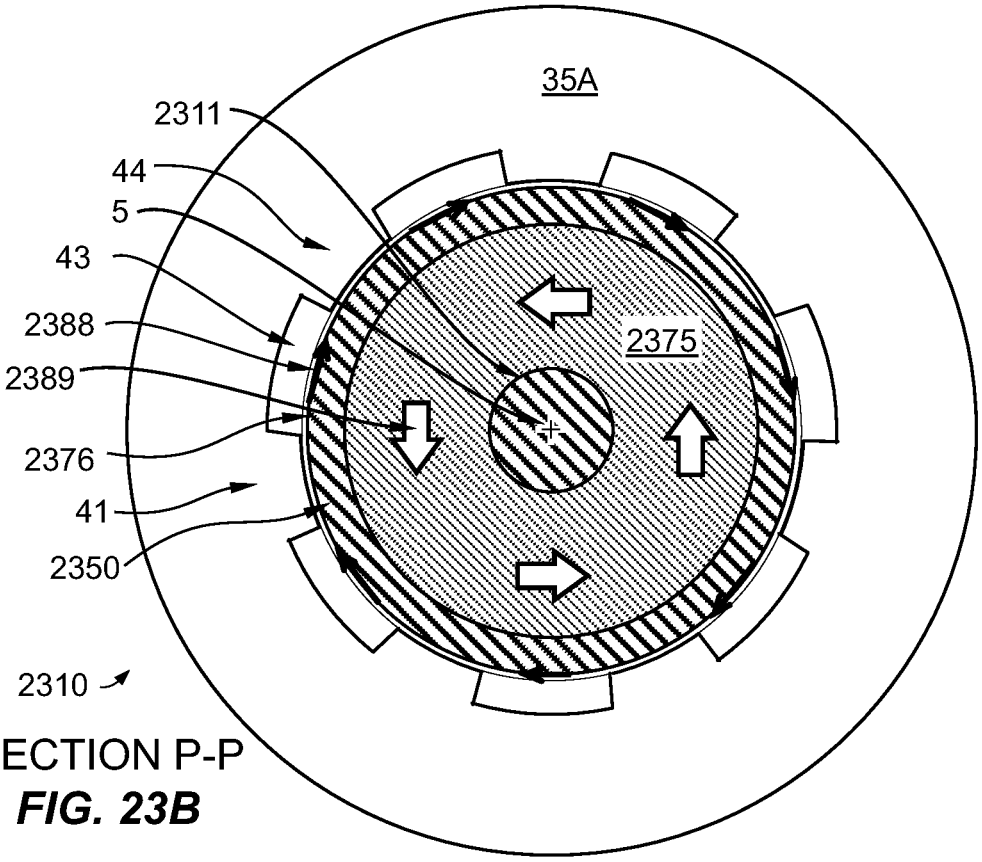
Figure 23D:
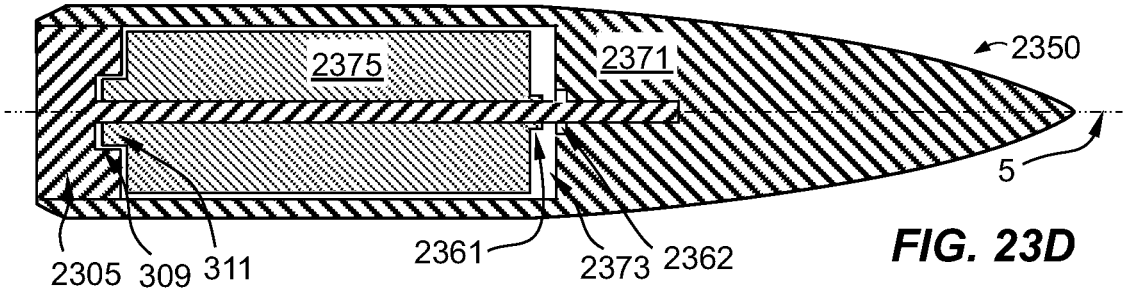
Figure 24:
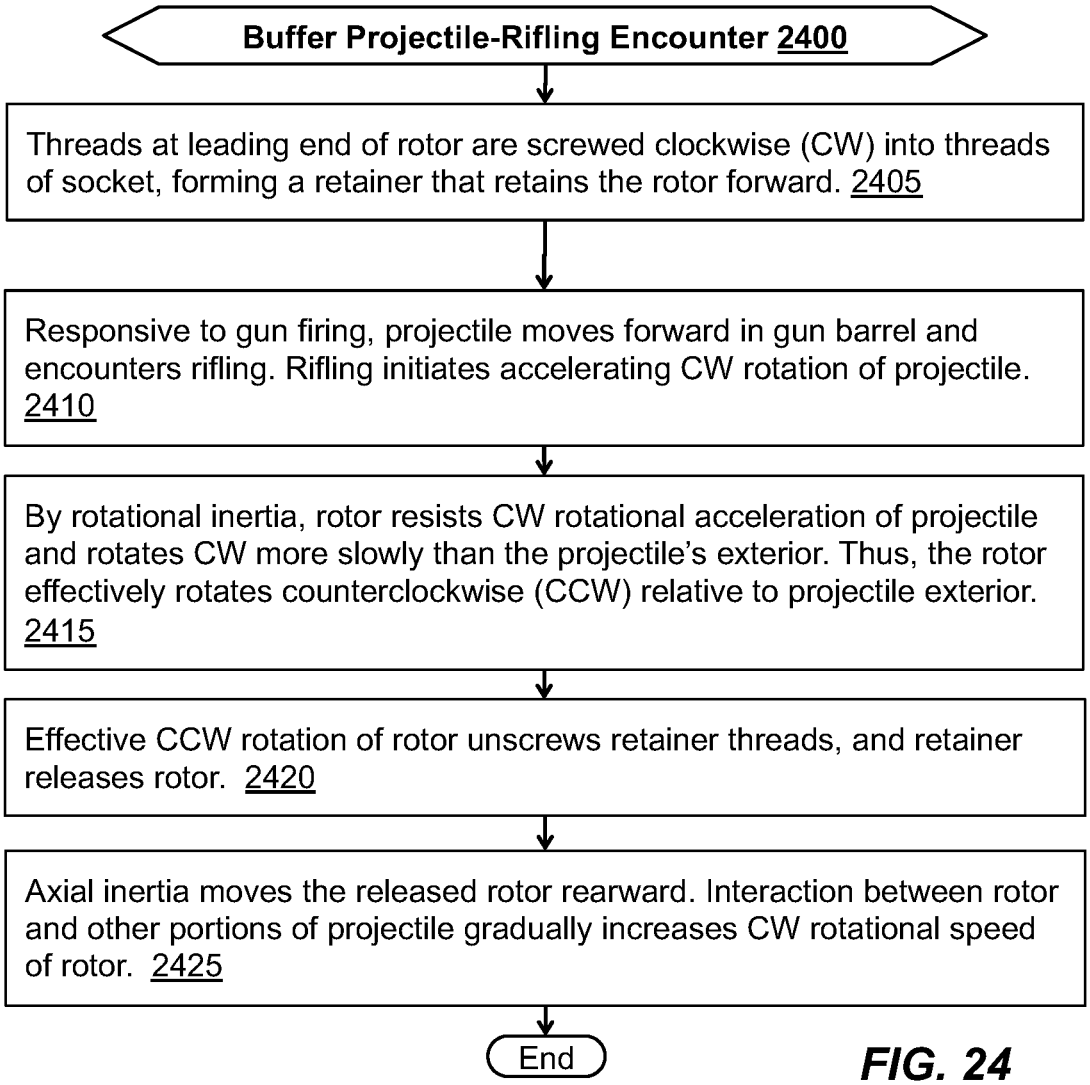
FIG. 24 is a flowchart for a process for buffering an encounter between a projectile and rifling of a rifled barrel in accordance with some example embodiments of the disclosure. The process can comprise progressive modes as illustrated in FIGS. 23A, 23B, 23C, and 23D in accordance with some example embodiments.

FIGS. 23A, 23B, 23C, and 23D and FIG. 24 illustrate an example projectile 2350 and a flowchart for an example process 2400 for rotating the projectile 2350 according to some embodiments of the disclosure. FIGS. 23A, 23B, 23C, and 23D respectively illustrate example progressive modes of the projectile 2350 during an example execution of the process 2400. FIGS. 23A, 23C, and 23D illustrate cross sectional views of the projectile 2350 in which an axis 5 of the projectile 2350 is in the view cutting plane. FIG. 23B illustrates a cross sectional view of the projectile 2350 with the cutting plane of the view cutting the axis 5 perpendicularly at Section P-P as shown in FIG. 23A. The view of FIG. 23B is taken from rear of the projectile 2350, looking forward along the axis 5. In FIG. 23B, the projectile cross section has been overlaid with a reference cross sectional illustration of a rifled gun barrel 35A that has rifling 41 with exaggerated dimensions to facilitate viewing. FIG. 24 illustrates an example flowchart for an example embodiment of the process 2400, which is entitled "Buffer Projectile-Rifling Encounter" without suggesting any limitations. In the illustrated example embodiment of the process 2400, the rifling 41 performs an operation that comprises rotating the projectile 2350, and a rotor 2375 disposed in a cavity 2373 of the projectile 2350 buffers the operation as discussed below.

Referring now to FIGS. 23A and 24, in the illustrated example embodiment, the projectile 2350 comprises a trailing member 2305, a leading member 2371, and the rotor 2375. The leading member 2371 forms an exterior surface 2376 of the projectile 2350 that circumscribes and extends circumferentially around the rotor 2375. The trailing member 2305 comprises an axle 2311 upon which the rotor 2375 is centered and about which the rotor 2375 rotates. The axle 2311 extends forward along an axis 5 of the projectile 2350, through the rotor 2375, and into an aperture 2363 in the leading member 2371. As illustrated, the trailing member 2305 and the leading member 2371 are fastened together and are positionally fixed relative to one another to form a unit that further comprises the exterior surface 2376. The rotor 2375 and the unit can rotate relative to one another about the axis 5 of the projectile 2350. The rotor 2375 and the remainder of the projectile 2350 can rotate at different rates under different angular accelerations. The rotor 2375 is rotatable relative to the projectile's exterior surface 2376; thus the exterior surface 2376 is likewise rotatable about the rotor 2375.

In the illustrated embodiment, the rotor 2375 can make up a substantial portion of the projectile's total mass. In some example embodiments, the rotor 2375 can make up at least one half of the projectile's total mass. In some .30 caliber embodiments of the projectile 1250, the rotor 2375 has a mass that makes up a percentage of the projectile's total mass, and that percentage is in a range of 30 percent to 90 percent (a representative, nonlimiting range that is among others supported by the written description).

As illustrated by FIG. 23A, the aperture 2363 of the leading member 2371 comprises threads 2362. Adjacent the rotor's leading end 2377, the rotor 2375 comprises mating threads 2361 that extend forward. At block 2405 of the process 2400, the rotor's threads 2361 are screwed clockwise into the leading member's threads 2362, for example during projectile assembly. Screwed together as illustrated, the threads 2361, 2362 comprise an example embodiment of a retainer that retains the rotor 2375 in the forward position that FIG. 23A illustrates. In some other example embodiments, the retainer can comprise a magnet (see FIG. 1L, element 175), an elastomeric band (see FIG. 2A, element 279), a shear pin (see FIG. 4F, element 414), a serrated interface (see FIG. 5D), a breakable filament connection (see FIG. 7A, element 791), or other embodiment disclosed herein.

A cartridge 20 housing solid propellant 25 and the projectile 2350 can be loaded in a chamber 99 of a gun 50 having the barrel 35A with rifling 41, which may be of constant twist rate. (FIGS. 1A and 1D illustrate example embodiments of the cartridge 20 and the gun 50.) At block 2410 of the process 2400, responsive to gun firing, the projectile 2350 moves forward in the gun barrel 35A and encounters the rifling 41. At the encounter, the rifling 41 seizes the projectile's exterior surface 2376. As illustrated by FIG. 23B, the rifling 41 applies torque to the projectile's exterior surface 2376 and initiates accelerating clockwise rotation 2388 of the projectile 2350.

At block 2415 of the process 2400, by rotational inertia, the rotor 2375 resists the clockwise rotational acceleration 2388 of the projectile 2350. That is, the rotor 2375 has a moment of inertia that resists clockwise angular acceleration 2388. As illustrated by FIG. 23B, the rotor's rotational inertia causes the rotor 2375 to rotate clockwise more slowly than the projectile's exterior surface 2376. The rotor 2375 effectively has counterclockwise rotation 2389 relative to projectile's exterior 2376. That is, from the perspective of the projectile's exterior surface 2376, the rotor 2376 rotates counterclockwise.

At block 2420 of the process 2400, the effective counterclockwise rotation 2389 of the rotor 2375 unscrews the rotor's threads 2361 from the leading member's threads 2362. That is, the rotor 2375 screws out of the threaded aperture 2363. The rotor 2375 is thus released from the threaded retainer. The released rotor 2375 is free to move rearward as illustrated by FIG. 23C and can rotate.

At block 2425 of the process 2400, axial inertia 85 due to forward acceleration 4 of the projectile 2350 moves the released rotor 2375 rearward. The rotor 2375 moves rearward from the position illustrated by FIG. 23C towards the position illustrated by FIG. 23D. A projection 311 extending rearward from the rotor 2375 moves into an aperture 309 in the trailing member 2305. As discussed above with reference to FIGS. 3A and 3B and with reference to FIGS. 16A, 16B, and 16C, the gas trapped in the aperture 309 can cushion the rotor's rearward movement and form a gas bearing that provides a low-friction interface for rotation between the rotor 2375 and the trailing member 2305. In the embodiment of FIGS. 23A, 23B, 23C, and 23D, the projection 311 and the aperture 309 are dimensioned to provide an annulus through which trapped gas can gradually escape and flow forward. Thus, the rotor 2375 continues moving rearward, and the projection 311 moves progressively deeper into the aperture 309. Through viscous interaction and/or contact the rotating trailing member 2305 gradually transfers rotation to the rotor 2375. The aperture 309, the rotor projection 311, the rotor 2375, and the cavity 2372 can comprise a dashpot or rotary damper that utilizes viscous friction or viscous force to control or damp rotational motion of the rotor 2375 and soften shock. At block 2425, interaction between the rotor 2375 and other portions of the projectile 2350 thus gradually increases clockwise rotational speed of the rotor 2375. In some example embodiments, the projectile 2350 is filled with air, nitrogen, or an inert gas at atmospheric pressure. In some example embodiments, the pressure is elevated to increase viscous interaction between the surfaces within the projectile 2350. In some example embodiments, the projectile 2350 is filled with a liquid, for instance ethanol, water, saltwater, or silicone, that further increases that viscous interaction.

In the illustrated example flowchart of FIG. 24, process 2400 ends following execution of block 2425. The ending can, for example, comprise the rotor 2375 and the other elements of the projectile 2350 rotating at the same rate as the projectile 2350 travels in open air towards a target or other destination.

In some example embodiments of the projectile 2350, the outer, cylindrical surfaces of the rotor 2375 comprise a spiral groove bearing or an aero spiral groove bearing, for example as illustrated by FIGS. 7G and 7H and discussed above. In some example embodiments of the projectile 2350, the rotor 2375 has a bullet-shaped form, for instance like the rotor 1275 illustrated by FIG. 12 and is patterned according to the spiral groove bearing 1203 illustrated by FIGS. 12H and 12I as discussed above.

Some example embodiments will be further discussed below with reference to FIGS. 23A, 23B, 23C, and 23D.

Upon firing the gun 50, expanding propellant gas 26 can propel the projectile 2350 through the barrel 35A. (FIG. 1I illustrates an example embodiment of the expanding propellant gas 26.) When the expanding propellant gas 26 moves the projectile 2350 sufficiently forward, the projectile 2350 can encounter lands 44 and grooves 43 of the rifling 41. When the projectile 2350 encounters the rifling 41, the rifling 41 can engage the exterior surface 2376 of the projectile 2350 and abruptly rotate the exterior surface 2376 about the axis 5 according to the rifling's twist rate. The rotor's reaction to the projectile's encounter with the rifling 41 can be less abrupt than the exterior surface's reaction, as the exterior surface 2376 can start rotating while the rotor 2375 remains rotationally stationary or rotates more slowly. The rotor 2375 can effectively damp the impulse response or the step response of the projectile 2350 as a whole. With projectile's encounter with the rifling 41 considered as a stimulus comprising an input of a step change in rotation, the rotor 2375 can be considered as damping or increasing the time constant of the projectile's step response. The rotor's subdued reaction can moderate the composite reaction of the projectile 2350 and thereby suppress the rifling's tendency to perturb the projectile 2350. The moderating effect of the rotor 2375 can thus serve coincidence and/or collinearity between the axes 5 of the projectile 2350 and the barrel 35A, so the projectile 2350 can remain true with the barrel 35A. The rifling 41 can jerk or jolt the exterior surface 2376 of the projectile 2350 into rotating a specified number of degrees of rotation for each centimeter of barrel length that the projectile 2350 traverses, so the exterior surface 2376 effectively steps from rotationally stationary to rapidly spinning in an instant. Meanwhile, the rotor 2375 of the projectile 2350 can gradually build rotational speed. The projectile 2350 can gain angular momentum progressively as the projectile 2350 travels through the barrel 35A and the rotor's speed of rotation increases. Consequently, the rifling's application of torque on the projectile 2350 can be distributed along the barrel 35A rather than being largely focused where the projectile 2350 makes first contact with the rifling 41. Once the projectile 2350 has advanced sufficiently down the barrel 35A to be fully engaged with the rifling 41, the rifling 41 can support the projectile 2350 more robustly than at the initial rifling encounter. Torque can then be more aggressive without disturbing axial alignment between the projectile 2350 and the barrel 35A.

Additional benefits can be realized in some example embodiments. Mechanical stress can be spread and reduced. Gun parts can be smaller, lighter, and less bulky. Barrels 35A can have lighter construction. Guns 50 and projectiles 2350 can be fabricated from a wider range of materials. Wear can be reduced. Chamber pressures can be reduced. Propellant charges can be increased without exceeding pressure ratings. A broader range of solid propellants can be utilized, for example with faster combustion. Barrel length can be shortened. Chamber configurations and dimensions can be refined. Free travel can be refined, reduced, or eliminated. Rifling profiles can be less aggressive, for example rifling grooves 43 can have less depth. Friction can be reduced. Projectile velocity and precision can be enhanced. Heat production can be reduced. Gun firing rate can be increased.

When a gun 50 fires and the projectile 2350 accelerates linearly through a rifled barrel 35A of the gun 50, the exterior surface 2376 of the projectile 2350 can encounter rifling 41 of the gun barrel 35A, often at or adjacent the barrel's beach end. At this encounter, the rifling 41 can initiate rotational acceleration of the projectile 2350. With its rotatability, the mass's rotational response to the rifling encounter can lag the exterior surface's rotational response. The mass can initially rotate more slowly than the projectile's exterior surface 2376 and can gain rotational speed more gradually than the projectile's exterior surface 2376. The rotational acceleration of the mass can be below the rotational acceleration of projectile's exterior surface 2376, so that the mass may be afforded extended time and extended barrel length to reach a maximum rotational speed of the projectile. Providing extended time and extended barrel length for rotational acceleration of the mass can suppress shock, stress, or concussion associated with the projectile 2350 encountering the rifling 41. Torque spikes can be smoothed, and the rifling 41 can apply less torque over more time and more barrel length. The work that the rifling 41 performs on the projectile 2375 can thereby be distributed over time and distance.

Some example embodiments will be further discussed below with an energy-management perspective.

Spreading of the work performed on the projectile 2350 can serve management of the energy provided by a powder charge in the form of expanding propellant gas 26. The powder charge's energy can have at least two constraints. As a first constraint, the powder charge's size can limit the total amount of available energy, which can correspond to the total amount of work that can be performed. As a second constraint, the energy-delivery rate or power provided by the powder charge can be limited by a pressure rating of the gun's chamber 99, which can correspond to limiting the speed at which work can be performed. This power constraint can be relevant to work performed on the projectile 2350 at its initial encounter with the rifling. Here, the projectile 2350 can be subject to a pulse of rotational acceleration, engraving of the rifling 41, swaging, and linear acceleration 4 (see FIG. 1I), each of which can represent a demand on the powder charge's power as time-compressed work performed on the projectile 2350. Providing extended time for rotational acceleration of the mass can relieve the power demand of initiating rotation of the projectile 2350, so more power is available here for engraving, swaging, and linear acceleration 4 of the projectile 2350. The resulting increase in linear acceleration 4 can expedite moving the projectile 2350 past the rifling encounter and can support a smooth transition through the initial centimeters of barrel. Smoothing the projectile's linear acceleration 4 can help avoid overly confining the expanding propellant gas 26 and can flatten the pressure curve in the gun's chamber 99.

Further improvements can include mechanical stress reduction, smaller and lighter components, utilization of a broader range of construction materials, utilization of a broader range of propellants that may burn faster, extended mechanical life, reduced chamber pressures, shortener barrels 45A, improved chamber configurations, utilization of reduced or no free travel, less aggressive rifling 41, reduced friction, reduced heat generation, higher firing rates, and heightened projectile velocity and precision.

Figure 25A:
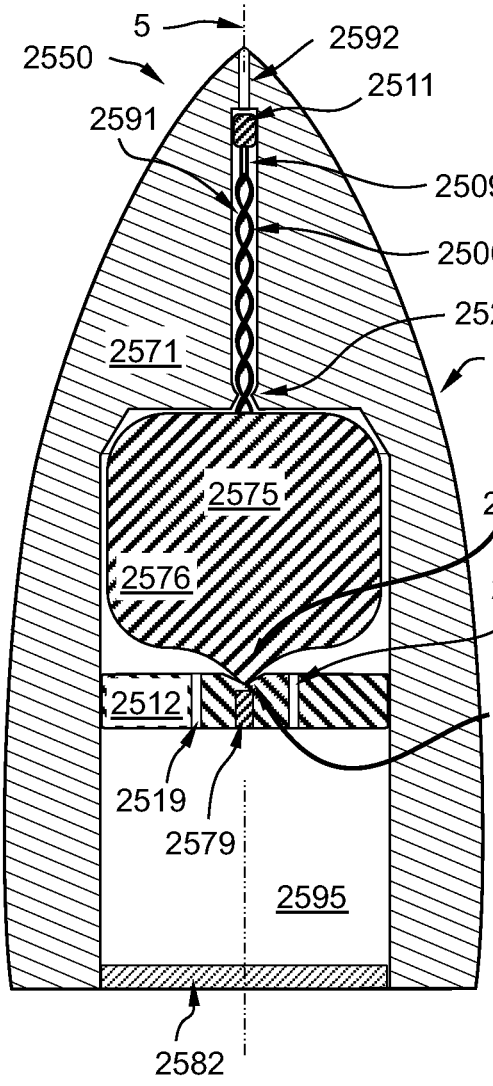
FIGS. 25A and 25B, collectively
Figure 25B:
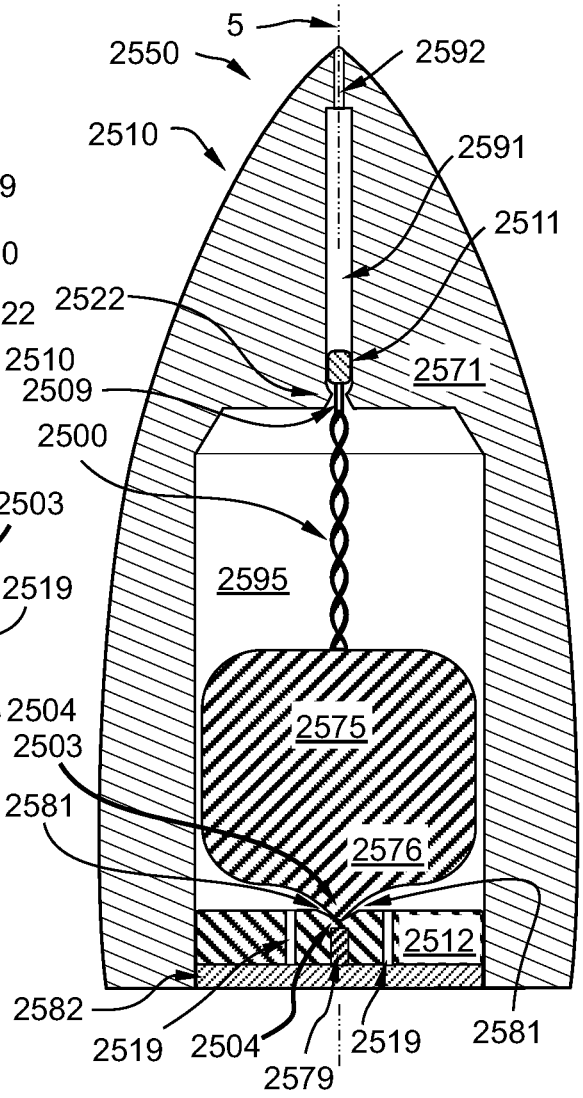

Turning now to FIGS. 25A and 25B, these figures illustrate an example projectile 2550 in two respective modes according to some embodiments of the disclosure. FIGS. 25A and 25B illustrate cross sectional views of the projectile 2550 with an axis 5 of the projectile 2550 in the cutting plane of the view. The mode of the projectile 2550 that FIG. 25A illustrates corresponds generally to the mode of the projectile 150 illustrated by FIG. 1K as discussed above. The mode of the projectile 2550 that FIG. 25B illustrates corresponds generally to the mode of the projectile 150 illustrated by FIG. 1L as discussed above.

The illustrated projectile 2550 comprises an example embodiment of a drive 2510. As illustrated by FIG. 25, the drive 2510 of the projectile 2550 comprises an example embodiment of an inertial drive. The projectile 2550 comprises an example embodiment of a mechanism.

Example embodiments of the drive 2510 can be incorporated in projectiles of guns, smoothbore guns, firearms, smoothbore firearms, light firearms, smoothbore light firearms, crew-served firearms, smoothbore crew-served firearms, light-gas guns, air guns, smoothbore air guns, railguns, or archery devices, including the disclosed examples thereof (not an exhaustive list). Example embodiments of the drive 2510 can further be incorporated in other aeronautical systems, including in the disclosed examples of aeronautical systems.

The projectile 2550 comprises a leading member 2571 that forms a body of the projectile 2550 and that comprises a trailing aperture 2595. A forward aperture 2591 extends forward from the trailing aperture 2595 along the axis 5. In the illustrated embodiment, the forward aperture 2591 comprises a cylindrical hole. A port 2592 in the projectile 2571 extends forward of the forward aperture 2591. The trailing aperture 2595, the forward aperture 2591, and the port 2592 are progressively smaller in diameter in the illustrated example embodiment of FIGS. 25A and 25B The illustrated example projectile 2550 comprises a rotor 2575 that comprises a mass member 2576 having representative cylindrical geometry. The mass member 2576 of the rotor 2575 is disposed on the axis 5 in the trailing aperture 2595, which comprises a cylindrical hole centered on the axis 5 in the illustrated embodiment. The example trailing aperture 2595 is oversized relative to the rotor's mass member 2576 and provides rotational clearance for the mass member 2576. The rotor 2575 further comprises a helix 2500 that extends forward along the axis 5, an intermediate cylindrical member 2509 that extends forward from the helix 2500, and a forward cylindrical member 2511 that extends forward from the intermediate cylindrical member 2509. A sliding member 2512 is disposed in the trailing aperture 2595 rear of the rotor 2575 with a sliding fit. A trailing member 2582 is rearwardly disposed in the trailing aperture 2595 and can be fastened by threading into the trailing aperture 2595, welding, or other appropriate process.

Some example embodiments the helix 2500 can comprise a member having geometry like the helix 1700 that FIG. 17C illustrates, like the helix 1700B that FIG. 17D illustrates, like the helix 400A that FIG. 4H illustrates, like the helix 1200A that FIG. 12A illustrates, or like another appropriate helix disclosed by the written description.

As illustrated by FIGS. 25A and 25B, the rotor 2575 comprises a nib 2503 that extends rearward into a recess 2504 in the trailing member 2512. In the illustrated example embodiment of FIGS. 25A and 25B, the nib 2503 comprises a point, and the recess 2504 is V-shaped, so the nib 2503 seats in the recess 2504 in a self-centering pivot joint. As illustrated, the recess 2504 has an example V-shaped form that provides angular clearance 2581 for an example pointed form of the nib 2503. In some example embodiments, the nib 2503 comprises a ball and the recess 2504 comprises a socket that receives the ball, with the angular clearance 2581 extending radially outward from the ball and the socket. In some example embodiments, the socket captures the ball. In some example embodiments, the ball is seated in the socket without being captured. In some example embodiments, the recess 2504 is formed of bearing bronze and comprises a bearing. In some example embodiments, the sliding member 2512 can comprise an insert (not illustrated by FIGS. 25A and 25B) composed of bearing bronze into which the recess 2504 is formed. In some example embodiments, the sliding member 2512 is composed of bearing bronze.

In the illustrated example, the trailing member 2582 comprises a magnet 2579 that magnetically attracts the rotor 2575. The magnet 2597 can magnetically attract the rotor 2575 to help retain the rotor 2575 in the rear position that FIG. 25B illustrates while the projectile 2550 travels in open air towards a target or other destination and decelerates due to air resistance or drag. In some example embodiments, the magnet 2597 can further provide magnetic attraction between the sliding member 2512 and the trailing member 2582 to help retain the sliding member 2512 in the rearward position that FIG. 25B illustrates.

In the mode of FIG. 25A, the rotor 2575 is forward and the helix 2500 extends forward in the forward aperture 2591. The leading member 2571 comprises a helix 2522 where the forward aperture 2591 and the trailing aperture 2595 meet. The leading member's helix 2522 engages with the rotor's helix 2500. The intermediate cylindrical member 2509 and the forward cylindrical member 2511 are disposed in the forward aperture 2591. The intermediate cylindrical member 2509 is diametrically undersized relative to the helix 2522; so the intermediate cylindrical member 2509 can rotate without interference, with the helix 2522 extending circumferentially around the intermediate cylindrical member 2509. The forward cylindrical member 2511 has clearance in the forward aperture 2591 for rotation and axial movement. In some example embodiments, the forward cylindrical member 2511 and the forward aperture 2591 can be dimensioned to provide a close running fit or a sliding fit.

In example transition from the representative mode of FIG. 25A to the representative mode of FIG. 25B, acceleration of the projectile 2550 associated with projectile launch produces inertial force that drives the rotor 2575 and the sliding member 2512 rearward. In some example embodiments, the rotor 2575 drives the sliding member 2512 rearward. In an example embodiment, the rotor 2575 comprises material that is dense relative to the sliding member 2512. For instance, in some example embodiments, the rotor 2575 can comprise carbon steel while the sliding member 2512 comprises aluminum or porous carbon steel. In some example embodiments, the rotor 2575 can comprise copper or lead embedded with a magnet (not illustrated by FIG. 25) while the sliding member 2512 comprises carbon steel.

In the illustrated example embodiment, the sliding member 2512 comprises channels 2519 that can transmit gas to avoid building up undue gas pressure rear of the sliding member 2512 that might unduly impede rearward motion of the sliding member 2512. In some example embodiments, the projectile 2550 is internally evacuated and hermetically sealed. For example, once the projectile 2550 is assembled and in the mode illustrated in FIG. 25A, air can be sucked out through the port 2592, and the port 2592 sealed using solder, braze, or other appropriate sealing approach.

As the rotor 2512 moves rearward, engagement between the helix 2500 and the helix 2522 drives rotation of the rotor 2512 about the axis 5 and relative to the leading member 2571. In an example embodiment, rotation of the leading member 2571 can be constrained by external contact with a launching device, for instance a rifled gun barrel 35A (FIG. 1B), a smoothbore gun barrel 35B (FIG. 1C), a sabot 403 (FIG. 4B), an archery device, railgun rails, etc. The sliding member 2512 provides rear support for the rotor's rotation. Thus as the rotor 2512 rotates, the rotor's nib 2503 rotates in the recess 2504. As the projectile 2550 transitions into the mode that FIG. 25B illustrates, the helix 2500 and the helix 2522 disengage, and the intermediate cylindrical member 2509 moves axially rearward to the axial position of the helix 2522. In this position, the helix 2522 extends circumferentially around the intermediate cylindrical member 2509 with radial clearance. The intermediate cylindrical member 2509 thus rotates without interference from the helix 2522. The forward cylindrical member 2511 rotates within the forward aperture 2591. The trailing member 2582 stops farther rearward translation of the sliding member 2512.

In some example embodiments, the forward cylindrical member 2511 comprises channels (not illustrated by FIGS. 25A and 25B) that can transmit gas axially forward as the forward cylindrical member 2511 moves rearward in the forward aperture 2591. In some example embodiments, the port 2592 can transmit gas into the projectile 2550. In some example embodiments, the port is closed with a plug (not illustrated by FIGS. 25A and 25B) that comprises a breakable filament fastened to the forward cylindrical member 2511 for retention of the rotor 2575 in the forward position that FIG. 25A illustrates and breaks during projectile launch to release the rotor 2575 for rearward movement. (See FIG. 7A, element 791 for an example embodiment of a breakable connection.)

In some example embodiments, the projectile 2550 comprises one or more spiral groove bearings. For example, a spiral groove bearing can be disposed to support an interface between parallel adjoining surfaces of the rotor's nib 2503 and the sliding member's recess 2504. In some such embodiments, the nib 2503 comprises a frustrum of a cone, the recess 2504 comprises matching female contours that are parallel to and adjoin the nib's contours, and a spiral groove bearing supports the interface. In some other such embodiments, the nib 2503 comprises a ball-shaped tip, the recess 2503 comprises a ball-shaped concavity matching the ball-shaped tip, the ball-shaped tip is disposed in the ball-shaped concavity, and the spiral groove bearing comprises spiral grooves formed on the surface of the ball-shaped tip or the surface of the ball-shaped concavity. In some example embodiments, the nib 2503 comprises an aero spiral groove bearing, such as an embodiment of the aero spiral groove bearing 1203 that FIGS. 12H and 12I illustrate as discussed above.

In some example embodiments, the projectile 2550 can be modified for gas drive operation. In some examples of such an embodiment, the trailing member 2582 can be removed or drilled with holes that transmit expanding propellant gas into the trailing aperture 2595. The trailing member 2582 can alternatively be made from a porous material that transmits expanding propellant gas into the aperture 2595, for example a porous material discussed above with reference to the porous member 771 that FIG. 7I illustrates. As a further modification, the intermediate cylindrical member 2509 can be moved from forward of the helix 2500 (as illustrated) to rear of the helix 2500, with the relocated intermediate cylindrical member 2509 disposed between the mass member 2576 of the rotor 2575 and the helix 2500. In this configuration, the projectile 2550 can be launched with the rotor 2575 and the sliding member 2512 in the rear position that as FIG. 25B illustrates. During launch from this position, expanding propellant gas drives the sliding member 2512 forward; the forward-moving sliding member 2512 drives the rotor 2575 forward; and engagement between the forward-moving helix 2500 and the helix 2522 drives rotation of the rotor 2575. When the rotor 2575 moves forward to the forward position that FIG. 25A illustrates, the helices 2500, 2522 disengage and the relocated intermediate cylindrical member 2509 is disposed radially adjacent to the helix 2522. With radial clearance between the intermediate cylindrical member 2509 and the helix 2522, the rotor 2575 can spin freely. In an example embodiment, the forward cylindrical member 2511 is modified to comprise a forward-extending projection like the projection 1611 that FIGS. 16D, 16E, and 16F illustrate as discussed above. When the rotor 2575 moves forward into the position that FIG. 25A illustrates, the forward-extending projection moves into the port 2592 and blocks gas flow through the port 2592. With the port 2592 obstructed, a cushion of trapped gas can form forward of the forward cylindrical member 2511 to cushion deceleration of the rotor 2575 and form a gas bearing that provides a low-friction interface.

Figure 26C:
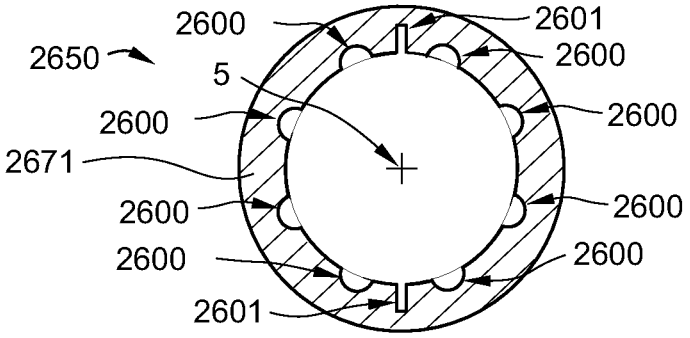
FIGS. 26A, 26B, and 26C, collectively
Figure 26A:
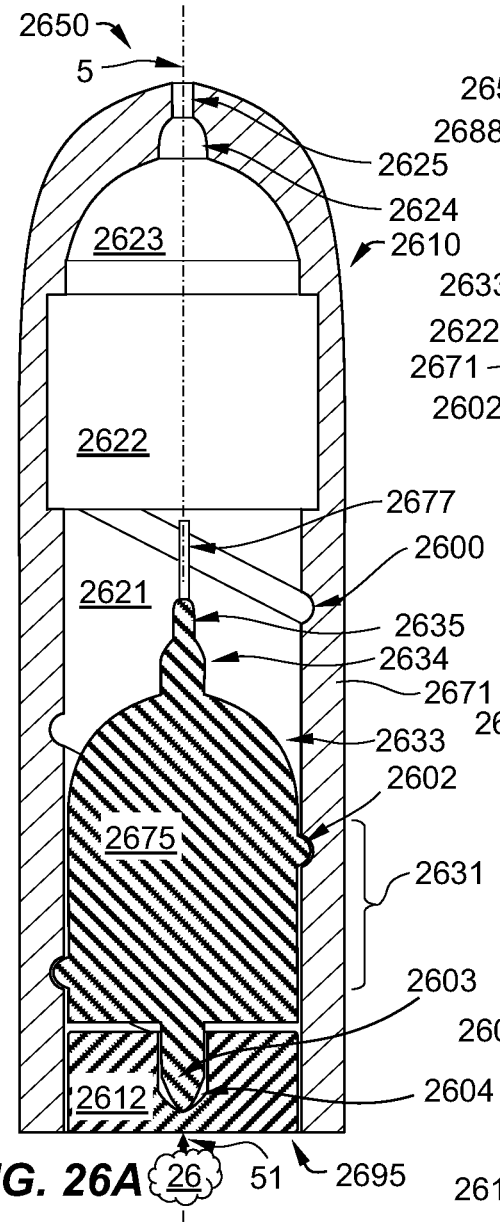
Figure 26B:
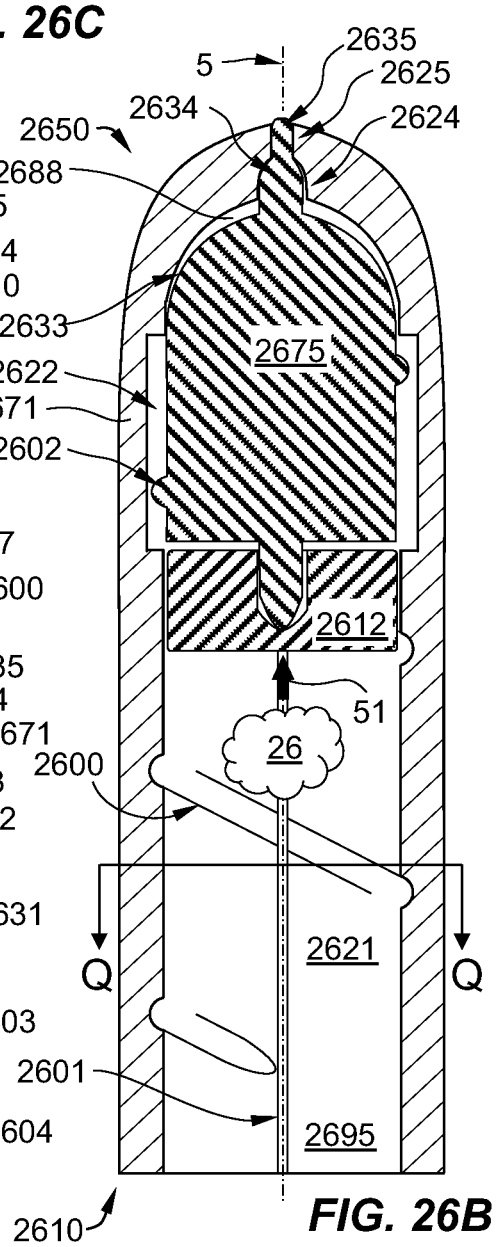

Turning now to FIGS. 26A, 25B, and 26C, FIGS. 26A and 26B illustrate an example projectile 2650 in two respective modes according to some embodiments of the disclosure. FIGS. 26A and 26B illustrate cross sectional views of the projectile 2650 with an axis 5 of the projectile 2650 in the cutting plane of the view. The mode of the projectile 2650 that FIG. 26A illustrates corresponds generally to the mode of the projectile 150 illustrated by FIG. 1K as discussed above. The mode of the projectile 2650 that FIG. 26B illustrates corresponds generally to the mode of the projectile 150 illustrated by FIG. 1L as discussed above. FIG. 26C illustrates a cross sectional view taken at Section Q-Q with a modified helical configuration according to some embodiments of the disclosure.

As illustrated by FIGS. 26A and 26B, the projectile 2650 comprises a leading member 2671, a rotor 2675, and a sliding member 2612. The leading member 2671 forms a trailing aperture 2695 in which the rotor 2675 and the sliding member 2612 are disposed. As illustrated, the rotor 2675 comprises a helix 2602 that engages with a corresponding helix 2600 of the leading member 2671 in a single-start helical configuration. The cross sectional view of FIG. 26C illustrates a modification with an example multi-start helical configuration in which the leading member 2671 comprises eight helices 2600 (the helix 2600 that FIGS. 26A and 26B illustrate and seven additional helices 2600). Under this modification, the rotor 2675 similarly comprises seven additional helices (not illustrated by FIG. 26) matching the rotor's illustrated helix 2602, so that eight rotor helices 2602 engage eight leading member helices 2600.

The illustrated projectile 2650 comprises an example embodiment of a drive 2610. As illustrated by FIG. 26, the drive 2610 of the projectile 2650 comprises an example embodiment of a gas drive. The projectile 2650 comprises an example embodiment of a mechanism.

Example embodiments of the drive 2610 can be incorporated in projectiles of guns, smoothbore guns, firearms, smoothbore firearms, light firearms, smoothbore light firearms, crew-served firearms, smoothbore crew-served firearms, light-gas guns, air guns, smoothbore air guns, railguns, or archery devices, including the disclosed examples thereof (not an exhaustive list). Example embodiments of the drive 2610 can further be incorporated in other aeronautical systems, including in the disclosed examples of aeronautical systems.

In example operation, the projectile 2650 can launch from the mode that FIG. 26A illustrates, with the rotor 2675 and sliding member 2612 disposed rearward in the trailing aperture 2695. Expanding propellant gas 26 produces propellant force 51 on the sliding member 2612 that moves the sliding member 2612 forward. As the sliding member 2612 moves forward, the sliding member 2612 pushes the rotor 2675 forward. As the rotor 2675 moves forward, gas exits the projectile through a forward gas channel 2625.

The illustrated rotor 2675 comprises a nib 2603 that is disposed in a recess 2604 of the sliding member 2612, forming a self-centering pivot joint. In the illustrated embodiment of FIG. 26, the nib 2603 comprises a spindle of the rotor 2675. As illustrated, the nib 2603 and the recess 2604 are centered on the axis 5. In the embodiment illustrated by FIG. 26, the nib 2603 further comprises an axle that extends rearward along the axis 5, and the recess 2604 comprises a hole into which the axle is disposed. The sliding member 2612 applies forward force to the rotor 2675 through the recess 2604 and the nib 2603. In some example embodiments, adjoining surfaces of the recess 2604 and the nib 2603 can be configured with features, contours, and/or one or more bearings as discussed above with reference to FIGS. 25A and 25B and to the recess 2504 and the nib 2503 of the projectile 2550 illustrated by FIGS. 25A and 25B.

As the projectile 2650 transitions from the mode of FIG. 26A to the mode of FIG. 26B, the rotor 2675 moves through a helical portion 2621 of the trailing aperture 2695 in which the helix 2600 is formed. As the rotor 2675 moves through the trailing aperture's helical portion 2621 towards an intermediate portion 2622 of the trailing aperture 2695, the engaged helices 2600, 2602 drive rotation of the rotor 2675. The rotor 2675 rotates about the axis 5 with the nib 2603 rotating in the recess 2604.

As illustrated by FIG. 26, the leading member 2671 comprises two internal grooves 2601 that extend linearly lengthwise in the helical portion 2612 of the trailing aperture 2695. (Two is an example, rather than limiting, number of the internal grooves 2601.) As best seen in FIG. 26C, each internal groove 2601 is deeper than the groove of the helix 2600. That is, the internal grooves 2601 extend radially outward farther than the helix 2600 extends radially outward. The internal grooves 2601 end rear of the trailing aperture's intermediate portion 2622. At ending portions 2677 of the internal grooves 2601, each groove 2601 narrows progressively.

The sliding member 2612 comprises two radial projections (not illustrated by FIG. 26) that respectively extend into the internal grooves 2601. In some example embodiments, the sliding member's radial projections extend into the internal grooves 2601 like the flange 1266 extends into the leading member 1261 to form the keyed joint 1269 that FIG. 12F illustrates as discussed above. In some example embodiments, the radial projections comprise cylindrical projections like the cylindrical projections 400C illustrated in FIG. 4I. As the sliding member 2612 moves forward to the position that FIG. 26B illustrates, the sliding member's radial projections move into the ending portions 2677 of the internal grooves 2601. The groove narrowing in the ending portions 2677 progressively brakes the forward motion of the sliding member 2612 and stops the sliding member 2612 in the position that FIG. 26B illustrates. The radial projections further wedge into the grooves 2601. The grooves' ending portions 2677 thus comprise a brake, a stop, and a retainer for the sliding member 2612 that operate as the projectile 2650 transitions into the mode illustrated by FIG. 26B.

As the projectile 2650 transitions into the mode illustrated by FIG. 26B, a helical portion 2631 of the rotor 2675, from which the helix 2602 extends, moves into the intermediate aperture portion 2622 of the trailing aperture, and the helices 2600, 2602 disengage. As shown in FIG. 26B, the intermediate portion 2622 is diametrically enlarged relative to the rotor's helix 2602 to provide clearance for free spinning of the rotor 2675.

The rotor 2675 comprises a convex portion 2633 that extends forward from the rotor's helical portion 2631, a projection 2634 that extends forward from the convex portion 2633 along the axis 5, and a leading projection 2635 that extends forward from the projection 2634 along the axis 5. As illustrated, the leading projection 2635 is diametrically smaller than the projection 2634. As illustrated by FIG. 26B, the projection 2634 of the rotor 2675 comprises an example embodiment of a spindle.

As the projectile 2650 transitions to the mode illustrated by FIG. 26B and the rotor 2675 moves forward, the helix 2602 separates from the helix 2600. The illustrated example projectile 2650 is dimensioned so that once the rotor 2675 has moved sufficiently forward for helical disengagement, the leading projection 2635 begins moving into the forward gas channel 2625. The leading projection 2635 thus occludes the forward gas channel 2625, and gas is trapped forward of the rotor 2675. A cushion of gas forms in a space 2688 between the rotor's convex portion 2633 and a concave forward portion 2623 of the trailing aperture 2695. The cushion of gas gradually slows forward motion of the rotor 2675. The cushion of gas further comprises a gas bearing that supports the forward axial load of the rotor 2675 and provides a low-friction interface for rotation of the rotor 2675.

In the illustrated embodiment of FIG. 26, as the leading projection 2635 moves into the forward gas channel 2625, the rotor projection 2634 moves into a recess 2624 formed between the concave forward portion 2633 and the forward gas channel 2625. Thus, the rotor projection 2634 and the recess 2624 can support rotation of the rotor 2675 as pressure in the gas cushion decays. In some example embodiments, the rotor projection 2634 and the recess 2624 can be configured with features, contours, and/or one or more bearings as discussed above with reference to FIGS. 25A and 25B and to the recess 2504 and the nib 2503 of the projectile 2550 illustrated by FIGS. 25A and 25B.

In some example embodiments, the rotor projection 2634 is diametrically undersized relative to the illustrated embodiment of FIG. 26. So undersized, the rotor 2675 can move farther forward without interference between the rotor projection 2634 and the recess 2624. Without this interference, the rotor's convex portion 2633 can move forward to a position of contact with the concave forward portion 2623 of the trailing aperture 2695. In such an embodiment, the convex portion 2633 of the rotor 2675 can patterned with grooves that form an aero spiral groove bearing that is self-acting. The aero spiral groove bearing can pump gas into the interface between the rotor's convex portion 2633 and the concave forward portion 2623 to sustain a pressurized layer of gas. Thus, the aero spiral groove bearing can use rotation of the rotor 2675 to maintain separation between the rotor's convex portion 2633 and the concave forward portion 2623.

Figure 27C:
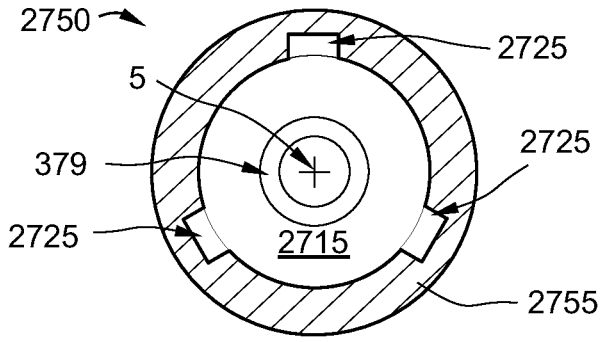
FIGS. 27A, 27B, and 27C, collectively
Figure 27A:
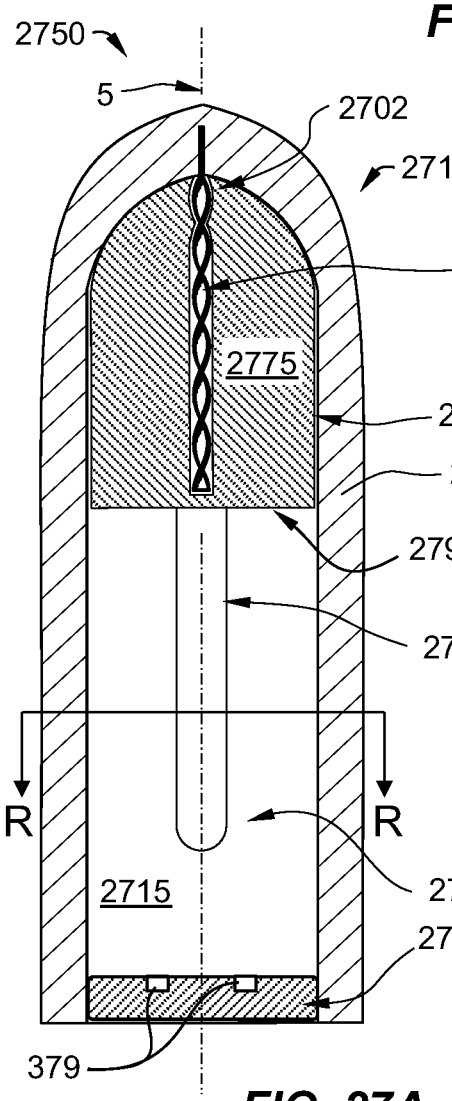
Figure 27B:
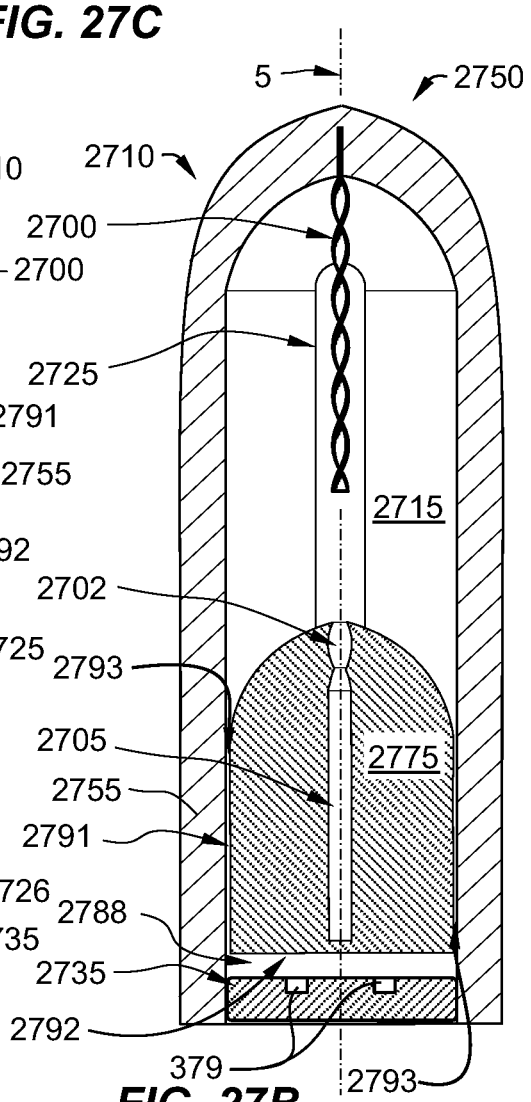

Turning now to FIGS. 27A, 27B, and 27C, FIGS. 27A and 27B illustrate an example projectile 2750 in two respective modes according to some embodiments of the disclosure. FIGS. 27A and 27B illustrate cross sectional views of the projectile 2750 with an axis 5 of the projectile 2750 in the cutting plane of the view. The mode of the projectile 2750 that FIG. 27A illustrates corresponds generally to the mode of the projectile 150 illustrated by FIG. 1K as discussed above. The mode of the projectile 2750 that FIG. 27B illustrates corresponds generally to the mode of the projectile 150 illustrated by FIG. 1L as discussed above. FIG. 27C illustrates a cross sectional view taken at Section R-R according to some embodiments of the disclosure.

The illustrated projectile 2750 comprises an example embodiment of a drive 2710. As illustrated by FIG. 27, the drive 2710 of the projectile 2750 comprises an example embodiment of an inertial drive. The projectile 2750 comprises an example embodiment of a mechanism.

Example embodiments of the drive 2710 can be incorporated in projectiles of guns, smoothbore guns, firearms, smoothbore firearms, light firearms, smoothbore light firearms, crew-served firearms, smoothbore crew-served firearms, light-gas guns, air guns, smoothbore air guns, railguns, or archery devices, including the disclosed examples thereof (not an exhaustive list). Example embodiments of the drive 2710 can further be incorporated in other aeronautical systems, including in the disclosed examples of aeronautical systems.

As illustrated by FIGS. 27A, 27B, and 27C, the projectile 2750 comprises a leading member 2755, a rotor 2775, and a trailing member 2735. The leading member 2755 forms a central aperture 2715 that extends lengthwise along the axis 5 of the projectile, with the rotor 2775 disposed in the central aperture 2715 and centered on the axis 5. In the illustrated example embodiment, the rotor 2775 comprises a circumferential surface 2791 that is cylindrical. The trailing member 2735 is fastened to the leading member 2755 and closes the central aperture 2715. A rear surface 2792 of the rotor 2775 is oriented towards the trailing member 2735. In some example embodiments that differ from what FIG. 27 illustrates, the rear surface 2792 of the rotor 2775 and the forward surface of the trailing member 2735 are contoured like the forward surface of the rotor 2875 and the rear surface of the forward portion 2859 of the intermediate member 2805 of the projectile 2850 that FIG. 28 illustrates as discussed below.

In example operation of the projectile 2750 as illustrated by FIG. 27, the projectile 2750 can launch from the mode that FIG. 27A illustrates, with the rotor 2775 disposed forward in the central aperture 2715. The rotor 2775 can be retained in the forward position until launch with a retainer. In some example embodiments, the retainer can comprise a jammed-against shoulder and/or elastic deformation (see FIGS. 11A and 11B, example element 1159), a shear pin (see FIG. 4K, example element 414), a pin or wire under tension (see FIG. 4L, example element 414B, FIG. 4M, example element 414C, and FIG. 18A, example element 791), a breakable filament connection (see FIG. 7A, example element 791), a magnet (see FIG. 3B, example element 379 and FIG. 4F, example element 479), or other appropriate retainer means (not an exhaustive list).

With the rotor 2775 in the forward position that FIG. 27A illustrates, a helix 2700 extends into an axial aperture 2705 in the rotor 2775. As illustrated, the helix 2700 is centered on the axis 5, and the rotor's axial aperture 2705 is centered on the axis 5. The axial aperture 2705 comprises a forwardly disposed helix 2702 that engages the helix 2700. As illustrated, the helix 2702 is centered on the axis 5. Rear of the helix 2702, the axial aperture 2705 is diametrically enlarged relative to the helix 2700 to provide clearance.

When the projectile 2750 is accelerated during launch, inertial force drives the rotor 2775 rearward along the axis 5. Helical engagement between the helices 2700, 2702 rotate the rotor 2775 as the rotor 2775 moves rearward in the projectile's central aperture 2715. During rearward movement of the rotor, the leading member 2755 of the projectile 2750 can be rotationally constrained, for example by a gun barrel, a rail, or other appropriate apparatus associated with launching the projectile 2750. The projectile 2750 thus transitions from the mode illustrated by FIG. 27A toward the mode illustrated by FIG. 27B.

As the rotor 2775 moves rearward, internal grooves 2725 that are formed in the leading member 2755 transmit gas, which is inside the projectile 2750 in the illustrated embodiment, from rear of the rotor 2775 to forward of the rotor 2775. The internal grooves 2725 comprise an example embodiment of gas channels. When the rotor 2775 has moved sufficiently rearward, the rotor 2775 separates from the helix 2700. With the helices 2700, 2702 disengaged, the rotor 2775 can spin freely.

In the illustrated example embodiment, each internal groove 2725 comprises a respective groove end 2726 that is forward of the trailing member 2735. At the groove ends 2726, groove depth progressively diminishes. That is, rearward of the axial location where the rotor 2775 disengages from the helix 2700, each groove 2725 becomes progressively more shallow with axial extension. As the rotor 2775 traverses this region, gas-carrying capacity of the internal grooves 2725 declines, and gas becomes increasingly confined between the rotor 2775 and the trailing member 2735. The progressive buildup of gas pressure brakes the rotor's rearward movement. Once the rotor 2775 moves rearward past the groove ends 2726, the circumferential surface 2791 of the rotor 2775 block gas from entering the internal grooves 2725, and a gas cushion forms in a space 2788 that is rear of the rotor 2775 and forward of the trailing member 2735. In the resulting mode of the projectile 2750, which FIG. 27B illustrates, the gas cushion provides a gas bearing that supports the rotor's axial load and provides a low-friction interface for rotor rotation. The rotor 2775 can thus rotate freely as the projectile 2750 travels along a trajectory towards a target or other destination. In the illustrated example embodiment of FIG. 27, a magnet 379 embedded in the trailing member 2735 attracts the rotor 2775 to retain the rotor 2775 in the rear position of FIG. 27B while the rotor 2775 rotates freely. For embodiments in which the rotor 2775 is formed of materials lacking sufficient magnetic attraction, another magnet (not illustrated by FIG. 27) can be embedded in the rotor 2775.

In some example embodiment, the circumferential surface 2791 of the rotor 2775 comprises spiral grooves that capture gas forward of the rotor 2775 and pump the captured gas rearward through an annular space 2793 between the rotor 2775 and the leading member 2755. The rotor's circumferential surface 2791 can comprise an aero spiral groove bearing that utilizes rotor rotation to create and maintain a layer of gas separating the rotor 2775 and the leading member 2755. In some embodiments, the aero spiral groove bearing pumps the gas into the space 2788 rear of the rotor 2775 to maintain a layer of gas between the rotor 2775 and the trailing member 2735. In some example embodiments, the rear surface 2792 of the rotor 2775 comprises an aero spiral groove bearing that further pumps the gas radially inward, i.e., toward the axis 5, to sustain gas pressure in the space 2788.

Figure 28A:
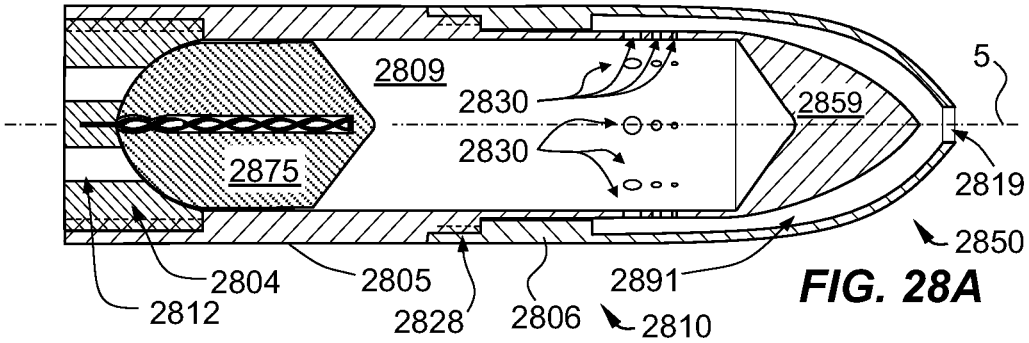
FIGS. 28A, 28B, 28C, 28D, and 28E, collectively

Turning now to FIGS. 28A, 28B, 28C, 28D, and 28E, these figures illustrate an example projectile 2850 according to some embodiments of the disclosure. FIGS. 28A, 28B, 28C, 28D, and 28E respectively illustrate example progressive modes of the projectile 2850 in cross sectional view, where an axis 5 of the projectile 2850 is in the view cutting plane, according to some embodiments. The mode of the projectile 2850 that FIG. 28A illustrates corresponds generally to the mode of the projectile 150 illustrated by FIG. 1K as discussed above. The modes of the projectile 2850 that FIGS. 28D and 28E respectively illustrate correspond generally to the mode of the projectile 150 illustrated by FIG. 1L as discussed above.

The illustrated projectile 2850 comprises an example embodiment of a drive 2810. As illustrated, the drive 2810 of the projectile 2850 comprises an example embodiment of a gas drive. The projectile 2850 comprises an example embodiment of a mechanism.

Example embodiments of the drive 2810 can be incorporated in projectiles of guns, smoothbore guns, firearms, smoothbore firearms, light firearms, smoothbore light firearms, crew-served firearms, smoothbore crew-served firearms, light-gas guns, air guns, smoothbore air guns, railguns, or archery devices, including the disclosed examples thereof (not an exhaustive list). Example embodiments of the drive 2810 can further be incorporated in other aeronautical systems, including in the disclosed examples of aeronautical systems.

As illustrated by FIGS. 28A, 28B, 28C, 28D, and 28E, the projectile 2850 comprises a leading member 2806, an intermediate member 2805, a trailing member 2804, and a rotor 2875. The leading member 2806, the intermediate member 2805, and the trailing member 2804 are firmly fastened together to enclose an interior space 2809 that extends lengthwise along the axis 5 of the projectile 2850. The rotor 2875 is disposed in the interior space 2809 and comprises an axial aperture 2705 with a helix 2702 formed in a rearward end of the axial aperture 2705. The rotor 2875 further comprises a forward-oriented nib 2503 that is disposed on the axis 5. The nib 2503 faces and is aligned with a recess 2504 in a forward portion 2859 of the intermediate member 2805 that is oriented towards the interior space 2809 and disposed on the axis 5. The rotor's forward surface 2883 and the intermediate member's rearward surface 2884 radiate respectively from the nib 2503 and the recess 2504 at divergent angles that provide angular clearance 2581.

In the illustrated example embodiment, a threaded connection 2828 fastens the leading member 2806 to the intermediate member 2805. The leading member 2806 extends forward from the threaded connection 2828 while extending circumferentially around the intermediate member 2805. Forward of the threaded connection 2828, the leading member 2806 is hollow and internally enlarged relative to the forward portion 2859 of the intermediate member 2805 to form an annular space 2891 that comprises an example embodiment of a gas channel as further discussed below. As illustrated, the leading member 2806 comprises an example embodiment of a shell covering the forward portion 2859 of the intermediate member 2805 with separation that provides the annular space 2891. The leading member 2806 comprises a forward aperture 2819 that is disposed on the axis 5 and that comprises an example embodiment of a gas outlet as further discussed below. As illustrated, the intermediate member 2805 comprises radial apertures 2830 extending between the interior space 2809 and the annular space 2891. In the illustrated example embodiment of FIG. 28, the radial apertures 2830 form an array in which the radial apertures 2830 become progressively smaller moving forward along the axis 5. That is, radial apertures 2830 disposed rearwardly in the array have larger diameters than radial apertures 2830 disposed forwardly in the array. The radial apertures 2830 comprise example embodiments of gas channels between the interior space 2809 and the annular space 2891 as further discussed below.

The illustrated example trailing member 2804 comprises four rear apertures 2812 that extend to the interior space 2809 from rear of the projectile 2850. The four rear apertures 2812 are arranged around the axis 5 with 90 degree spacing, so that two of the four rear apertures 2812 are exposed by the cutting plane of the views of FIG. 28 and thus are visible in the illustrations. The rear apertures 2812 comprise example embodiments of gas inlet channels as further discussed below. A helix 2700 is firmly fastened to the trailing member 2804 on the axis 5 and extends forward on the axis 5. In some example embodiments, the trailing member 2804 is formed from porous metal that transmits gas without the illustrated rear apertures 2812. In such a porous-metal embodiment, the trailing member 2812 can comprise a distribution of gas channels.

In example operation, the projectile 2850 can launch from the mode that FIG. 28A illustrates, with the rotor 2875 disposed rearward in the interior space 2809. The rotor 2875 can be held in the rear position until launch with a retainer. In some example embodiments, the retainer can comprise a jammed-against shoulder and/or elastic deformation (see FIGS. 11A and 11B, example element 1159), a shear pin (see FIG. 4K, example element 414), a pin or wire under tension (see FIG. 4L, example element 414B, FIG. 4M, example element 414C, and FIG. 18A, example element 791), a breakable filament connection (see FIG. 7A, example element 791), a magnet (see FIG. 3B, example element 379 and FIG. 4F, example element 479), or other appropriate retainer means (not an exhaustive list).

With the rotor 2875 in the rearward position that FIG. 28A illustrates, the helix 2700 extends into the axial aperture 2705 of the rotor 2875. As illustrated, the helix 2700 is centered on the axis 5, and the rotor's axial aperture 2705 is centered on the axis 5. The rotor's helix 2702 engages the helix 2700. As illustrated, the helix 2702 is centered on the axis 5. Forward of the helix 2702, the axial aperture 2705 is diametrically enlarged relative to the helix 2700 to provide clearance.

Figure 28B:
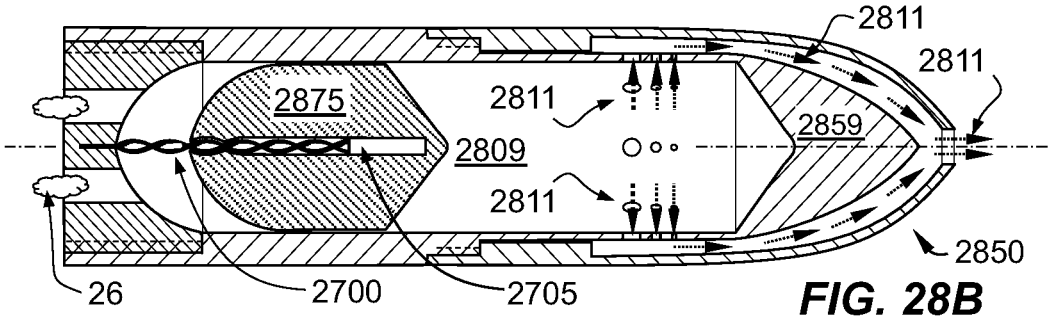

Referring now to FIG. 28B, in the illustrated example embodiment, expanding propellant gas 26 is produced responsive to launch initiation. The expanding propellant gas 26 enters the projectile 2850 through the rear apertures 2812 and drives the rotor 2875 axially forward. The rotor's forward motion produces rotor rotation via engagement between the helices 2700, 2702. As the rotor moves forward, gas 2811 that is in the interior space 2809 flows through the radial apertures 2830 to the annular space 2891. The annular space 2891 conveys the gas 2811 forward to the forward aperture 2819. The gas 2811 exits the projectile 2850 through the forward aperture 2819 on the axis 5. The gas 2811 can comprise gas that was in the interior space 2809 prior to launch initiation, for example air or nitrogen. In some example embodiments, the gas 2811 can further comprise some expanding propellant gas 26 that may leak around the rotor 2875.

Figure 28C:
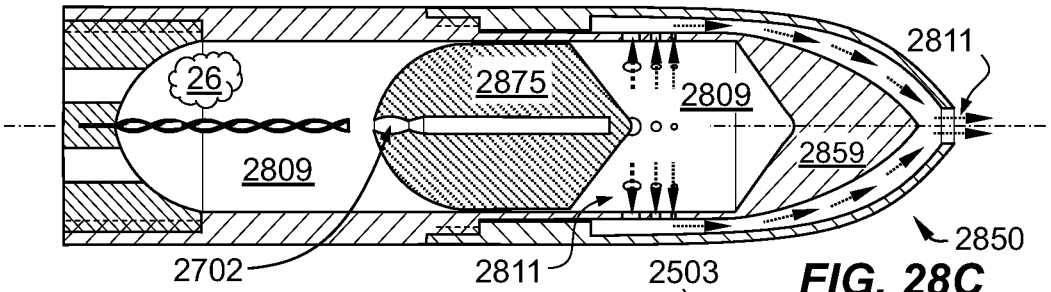

Referring now to FIG. 28C, the expanding propellant gas 26 continues driving the rotor 2875 axially forward and producing rotor rotation. As the rotor 2875 moves beyond the helix 2700, the helices 2700, 2702 disengage. The rotor 2875 then continues moving forward while rotating freely. Gas 2811 in the interior space 2809 continues flowing out of the projectile through the radial apertures 2830, the annular space 2891, and the forward aperture 2819, which comprise an example embodiment of a gas channel. In the mode that FIG. 28C illustrates, the rotor 2875 is axially between the helix 2700 and the radial apertures 2830 moving forward and rotating freely.

Figure 28D:
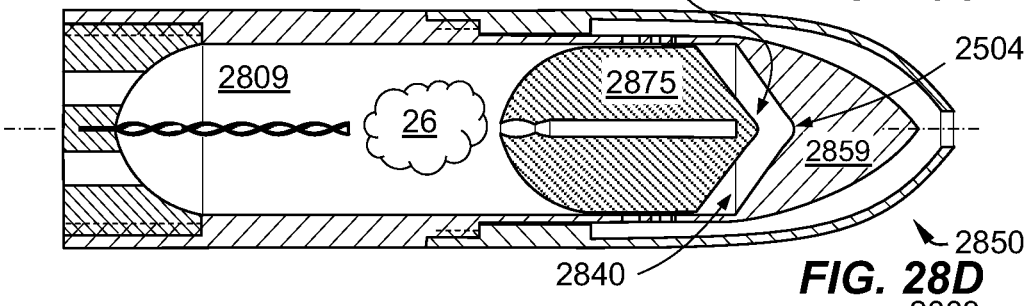

Referring now to FIG. 28D, as the expanding propellant gas 26 drives the rotor 2875 forward, the rotor 2875 progressively blocks the radial apertures 2830. In the illustrated example embodiment of FIG. 28, the largest-diameter radial apertures 2830 are covered first, followed by radial apertures 2830 of progressively smaller diameter. Accordingly, as the rotor 2875 moves forward, gas flow out of the interior space 2809 is progressively diminished and gas pressure forward of the rotor 2875 progressively increases. Thus, the forward movement of the rotor 2875 is progressively braked. The projectile 2850 thus comprises an example embodiment of a valve.

In the example mode that FIG. 28D illustrates, the rotor 2875 has moved sufficiently forward to obstruct all the radial apertures 2830. A gas cushion has formed in a space 2840 between the rotor 2875 and the forward portion 2859 of the intermediate member 2805. The gas cushion provides a gas bearing that supports the rotor's axial load and provides a low-friction interface for rotor rotation. The rotor 2875 can thus rotate freely as the projectile 2850 travels along a trajectory towards a target or other destination. In some example embodiments, inertia due to deceleration-caused air resistance along the trajectory can retain the rotor 2875 in the forward position that FIG. 28D illustrates.

In some example embodiments that differ from what FIG. 28 illustrates, the rotor 2875 comprises a forwardly projecting rod centered on the axis 5, and the forward portion 2859 of the intermediate member 2805 comprises a hole centered on the axis 5 that is sized to receive the rod. When the rotor 2875 moves forward to the position that FIG. 28D illustrates, the rod extends through the hole and into the forward aperture 2819 to close or partially close the forward aperture 2819. For a related configuration, see FIGS. 16D, 16E, and 16F and the foregoing discussion directed thereto.

Figure 28E:
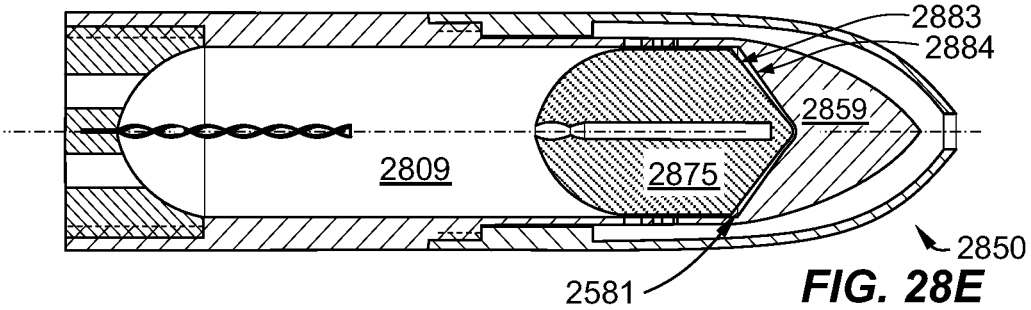

Referring now to FIG. 28E, in some example embodiments, the gas cushion may decay while the projectile 2850 travels in open air in route to its intended target or another destination. For instance, in some applications, the projectile 2850 may travel over an extended trajectory. As another example of gas cushion decay, in some applications, the projectile 2850 may be manufactured with loose tolerances that result in leakage of gas from the gas cushion. In the example mode that FIG. 28E illustrates, the gas cushion has decayed so that the nib 2503 is seated in the recess 2504. The nib 2503 and recess 2504 can support rotation of the rotor 2875 as discussed above with reference to FIGS. 25 and 26. Further, in some example embodiments, the nib 2503 and the recess 2504 can be configured as discussed above with reference to FIGS. 25 and 26. As illustrated by FIG. 28, the nib 2503 and the recess 2504 comprise a self-centering pivot joint. In some example embodiments, the projectile 2850 comprises an aero spiral groove bearing at the interface between the rotor 2875 and the forward portion 2859 of the intermediate member 2805. The aero spiral groove bearing can be self-acting and utilize rotational motion to pump gas in the interface to sustain a layer of gas separating the nib 2503 and the recess 2504.

In some example embodiments, the projectile 2850 comprises a gas bearing that produces a layer of gas that extends circumferentially around the projectile 2850 between the projectile 2850 and a gun barrel through which the projectile 2850 is launched. (FIGS. 1A, 1B, and 1C illustrate example embodiments of a gun barrel identified with reference numbers 35A and 35B.) In some example embodiments, this gas bearing comprises an array of radial apertures (not illustrated by FIG. 28) that extend from the interior space 2809 laterally through the intermediate member 2805 and laterally through a rear portion of the leading member 2806 that is disposed where the intermediate and leading members 2805, 2806 connect to one another. Each radial aperture can comprise a gas channel extending laterally from the interior space 2809 to the projectile's exterior. The array of radial apertures can be disposed forward of the position of the rotor 2875 in the mode illustrated by FIG. 28A and rearward of the position of the rotor 2875 in the mode illustrated by FIG.

28D. The array of radial apertures can extend circumferentially about the projectile 2850. Thus, the projectile 2850 can comprise an array of radial apertures having a layout like the array of radial apertures 3033 of the projectile 3050 that FIG. 30A illustrates as discussed below. In operation, once the rotor 2875 of the projectile 2850 moves forward to the mode of FIG. 28D, the radial apertures emit expanding propellant gas 26 laterally out of the projectile 2850 and into the interface between the projectile 2850 and the gun barrel 35A, 35B. In such embodiments, the projectile 2850 and the gun barrel 35A, 35B can be diametrically dimensioned as discussed below with reference to FIG. 30. As further discussed below with reference to FIG. 30, the radial apertures can be configured to impart rotational force and/or thrust on the projectile 2850.

Figure 29A:
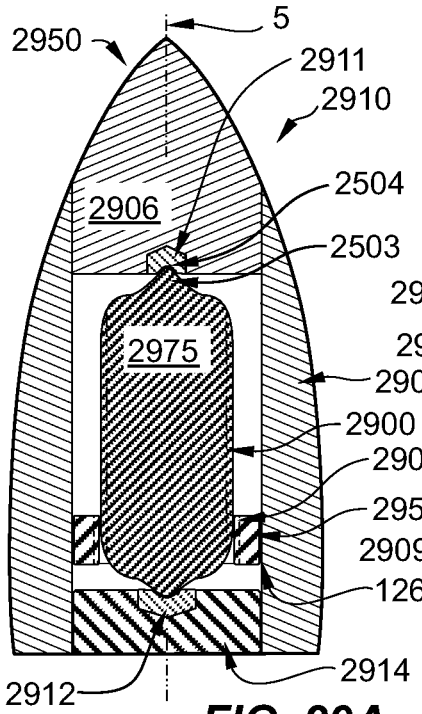
FIGS. 29A, 29B, 29C, and 29D, collectively
Figure 29B:
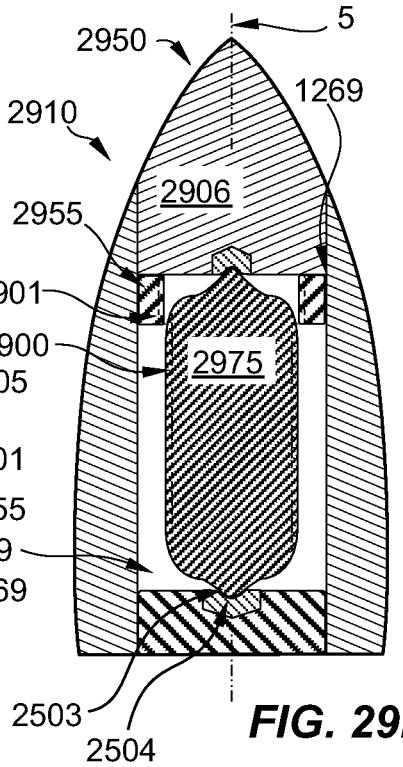
Figure 29C:
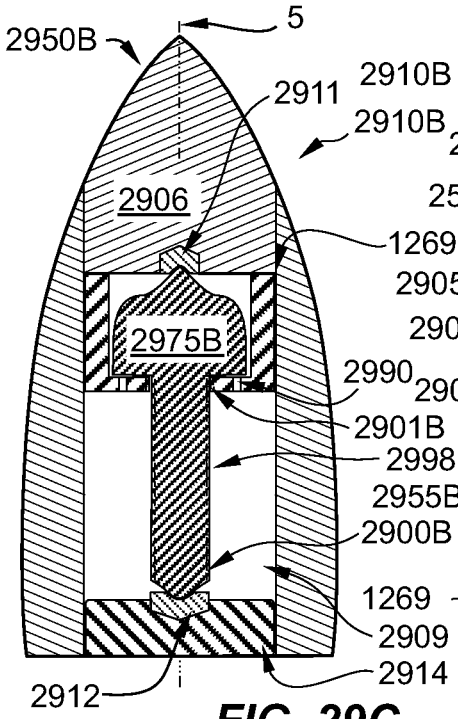
Figure 29D:
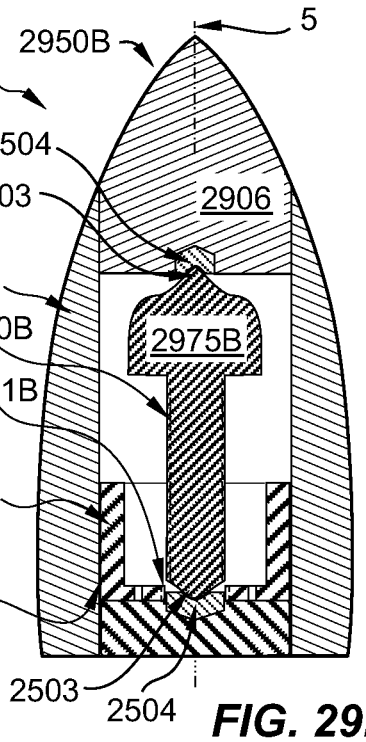

Turning now to FIGS. 29A, 29B, 29C, and 29D, these figures illustrate two example projectiles 2950, 2950B according to some embodiments of the disclosure. FIGS. 29A, 29B, 29C, and 29D illustrate cross sectional views in which the projectiles' axis 5 is in the view cutting plane. FIGS. 29A and 29B illustrate the example projectile 2950 in two respective modes according to some embodiments of the disclosure. FIGS. 29C and 29D illustrate the example projectile 2950B in two respective modes according to some embodiments of the disclosure. The modes that FIGS. 29A and 29C illustrate correspond generally to the mode of the projectile 150 illustrated by FIG. 1K as discussed above. The modes that FIGS. 29B and 29D illustrate correspond generally to the mode of the projectile 150 illustrated by FIG. 1L as discussed above.

The illustrated projectiles 2950, 2950B comprise example embodiments of drives 2910, 2910B. As illustrated by FIGS. 29A and 29B, the drive 2910 of the projectile 2950 comprises an example embodiment of a gas drive. As illustrated by FIGS. 29C and 29D, the drive 2910B of the projectile 2950B comprises an example embodiment of an inertial drive. The projectiles 2950, 2950B comprise example embodiments of mechanisms.

Example embodiments of the drives 2910, 2910B can be incorporated in projectiles of guns, smoothbore guns, firearms, smoothbore firearms, light firearms, smoothbore light firearms, crew-served firearms, smoothbore crew-served firearms, light-gas guns, air guns, smoothbore air guns, railguns, or archery devices, including the disclosed examples thereof (not an exhaustive list). Example embodiments of the drives 2910, 2910B can further be incorporated in other aeronautical systems, including in the disclosed examples of aeronautical systems.

Each of the projectiles 2950, 2950B comprises a leading member 2906, an intermediate member 2905, and a trailing member 2914. The intermediate member 2905 extends circumferentially around an interior space 2909, which is disposed axially between the leading member 2906 and the trailing member 2914. A forward recessed member 2911 is fastened to the leading member 2906 on the axis 5 facing the interior space 2909, for example using solder or braze. A rear recessed member 2912 is fastened to the trailing member 2914 on the axis 5 facing the interior space 2909, for example using solder or braze. The forward and rear recessed members 2911, 2912 each comprise a respective recess 2504. In each projectile 2950, 2950B, a respective rotor 2975, 2975B extends between the forward and rear recessed members 2911, 2912 and is mounted on the axis 5 to rotate about the axis 5. The rotors 2975, 2975B comprise nibs 2503 that are seated in the recesses 2504. The nibs 2503 and recesses 2504 can support rotation of the rotors 2975, 2975B as discussed above with reference to FIGS. 25, 26, and 28. In each of the projectiles 2950, 2950B, the respective rotor 2975, 2975B is mounted between and supported by two opposing self-centering pivot joints. Further, in some example embodiments, the nibs 2503 and recesses 2504 can be configured as discussed above with reference to FIGS. 25, 26, and 28. In some example embodiments, the projectiles 2950, 2950B comprises aero spiral groove bearings at the interfaces between the rotors 2975, 2975B and the forward and rear recessed members 2911, 2912. The aero spiral groove bearings can be self-acting and utilize rotational motion to pump gas in the interfaces to sustain a layer of gas separating the nibs 2503 and the recesses 2504.

Referring now to FIGS. 29A and 29B, in the illustrated example projectile 2950, the leading and trailing members 2906, 2914 comprise a porous material that transmits expanding propellant gas. For example, the leading and trailing members 2906, 2914 can be made of a porous material discussed above with reference to the porous member 771 that FIG. 7I illustrates. In some example embodiments, the porous material comprises porous metal. As an alternative to porous material that is transmissive to the expanding propellant gas, in some example embodiments, the leading and trailing members 2906, 2914 comprise holes drilled parallel to the axis 5 that transmit the expanding propellant gas. FIG. 28 illustrates an example embodiment of such an alternative, as the rear apertures 2812 provided in the trailing member 2804 of the projectile 2850 as discussed above. In the illustrated example embodiment of FIGS. 29A and 29B, the intermediate member 2905 comprises a solid metal that is impervious to the expanding propellant gas, for instance solid carbon steel, bearing bronze, or solid copper alloy.

The rotor 2975 comprises a helix 2900 that is formed on the rotor's outer, cylindrical surface. A drive member 2955 extends circumferentially around the rotor 2975 and comprises a helix 2901 that engages with the rotor's helix 2900. A keyed joint 1269 operably couples the drive member 2955 to the intermediate member 2905. In the illustrated example embodiment of FIGS. 29A and 29B, the drive member 2955 comprises a solid metal that is impervious to the expanding propellant gas, for instance solid carbon steel, bearing bronze, or solid copper alloy. In the illustrated example embodiment of FIGS. 29A and 29B, the rotor 2975 comprises a solid metal that is impervious to the expanding propellant gas, for instance solid carbon steel, tungsten, tungsten alloy, tungsten carbide, bearing bronze, or solid copper alloy.

In example operation, the projectile 2950 can launch from the mode illustrated by FIG. 29A, in which the drive member 2955 is rearwardly positioned. In some embodiments, a retainer (not illustrated by FIG. 29) retains the drive member 2955 in the rear position and releases the drive member 2955 during projectile launch. Suitable retainer embodiments for incorporation in the projectile 2950 are described above. In an example launch, expanding propellant gas is produced in response to launch initiation. The expanding propellant gas transmits through the trailing member 2914 and enters the interior space 2909. The intermediate member 2905 and the rotor 2975 guide the expanding propellant gas forward through the interior space 2909, between the rotor 2975 and the intermediate member 2905. The expanding propellant gas drives the drive member 2955 forward, between the rotor 2975 and the intermediate member 2905, as the projectile 2950 transitions from the mode that FIG. 29A illustrates to the mode that FIG. 29B illustrates. The leading member 2906 transmits gas out of the projectile 2950 as gas is pushed forward through the interior space 2909.

The keyed joint 1269 keeps the drive member 2955 in a predefined rotational orientation as the drive member 2955 moves forward. With the drive member 2955 moving forward, helical engagement between the rotor's helix 2900 and the drive member's helix 2901 produces rotation of the rotor 2975. As the drive member 2955 moves fully forward to the position illustrated by FIG. 29B, the helices 2900, 2901 disengage. With the helices 2900, 2901 disengaged, the rotor 2975 spins freely. The projectile 2950 can travel in open air towards a target or other destination with the rotor 2975 spinning freely. In some example embodiments, the spinning rotor 2975 can gyroscopically stabilize the projectile 2950 as the projectile 2950 travels in open air. With the drive member 2955 in the forward position of FIG. 29B, the drive member 2955 blocks further gas flow through the leading member 2906. In some example embodiments of the projectile 2950, the forward recess member 2911 extends radially outward further than illustrated (i.e., the forward recess member 2911 is diametrically enlarged), with a result of the drive member 2955 obstructing a larger fraction of the leading member's gas-receiving surface when the drive member 2955 is in the fully-forward position.

In some example embodiments, the keyed joint 1269 maintains a fixed rotational orientation between the drive member 2955 and the intermediate member 2905 throughout the drive member's forward travel from the rear position of FIG. 29A to the forward position of FIG. 29B. In some such embodiments, the keyed joint 1269 can comprise a key, a keyseat, and a keyway extending parallel to the axis 5.

In some example embodiments, the keyed joint 1269 controls rotational orientation between the drive member 2955 and the intermediate member 2905 so that the drive member 2955 rotates about the axis 5 in a predefined manner during forward travel from the rear position of FIG. 29A to the forward position of FIG. 29B. In some such embodiments, the keyed joint 1269 can comprise a key, a keyseat, and a keyway that spiral about the axis 5 while extending along the axis 5. As discussed above with reference to FIG. 19, inter alia, the concurrent forward motion and rotation of the intermediate member 2905 can provide a compounding effect on the rotation of the rotor 2975. Some example embodiments of the drive 2910 can thus comprise a compound drive.

Referring now to FIGS. 29C and 29D, in the illustrated example projectile 2950B, the leading and trailing members 2906, 2914 are made from a nonporous material that is impervious to expanding propellant gas, for instance solid copper or carbon steel. In example operation, the projectile 2950B can launch from the mode illustrated by FIG. 29C, in which the drive member 2955B is forwardly positioned. In some embodiments, a retainer (not illustrated by FIG. 29) retains the drive member 2955B in the forward position and releases the drive member 2955B during projectile launch. Suitable retainer embodiments for incorporation in the projectile 2950B are described above.

In an example launch, the projectile 2950B accelerates during launch, and resulting inertial force drives the drive member 2955B rearward. The keyed joint 1269 controls rotational orientation of the drive member 2955B during rearward travel of the drive member 2955B. The drive member's rearward movement coupled with engagement between a helix 2900B of the rotor 2975B and a helix 2901B of the drive member 2955 produces rotation of the rotor 2975B. In the illustrated embodiment of FIGS. 29C and 29D, the helix 2900B is formed on a relatively slender cylindrical extension 2998 of the rotor 2975B that comprises an example embodiment of a spindle. As illustrated, the rotor 2975B comprises the spindle. Embodiments of the keyed joint 1269 can maintain the drive member 2955B in a fixed rotational orientation or rotate the drive member 2955B for compound rotation of the rotor 2975B as discussed above with reference to FIGS. 29A and 29B. Gas channels 2990 in the drive member 2955B transmit gas from rear of the rotor 2975B to forward of the rotor 2975B during the rotor's rearward travel to avoid undue inhabitation of the rotor's rearward motion. In some example embodiments, the interior space 2909 is evacuated, in which case the gas channels 2990 may not be incorporated.

As the drive member 2955B moves into the rearward position that FIG. 29D illustrates, the helices 2900B, 2901B disengage. With the helices 2900B, 2901B disengaged, the rotor 2975B can spin freely with the projectile 2950B in the mode illustrated by FIG. 29D. In some embodiments, a retainer (not illustrated by FIG. 29) retains the drive member 2955B in the rearward position. Suitable retainer embodiments for incorporation in the projectile 2950B are described above. As discussed above with reference to FIGS. 29A and 29B, in some example embodiments, the spinning rotor 2975B can gyroscopically stabilize the projectile 2950B as the launched projectile 2950B travels towards a destination.

Figure 30C:
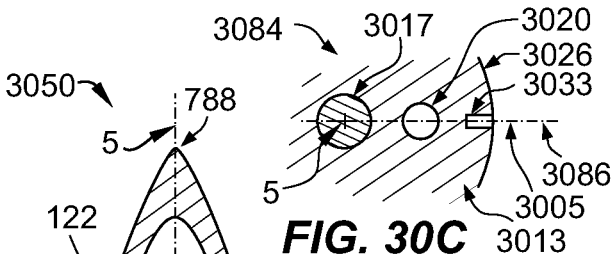
FIGS. 30A, 30B, 30C, 30D, and 30E, collectively
Figure 30D:
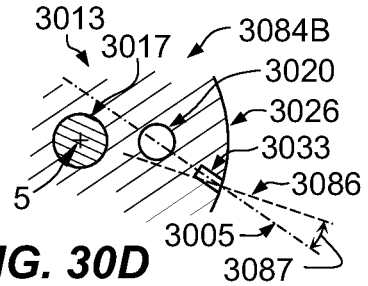
Figure 30A:
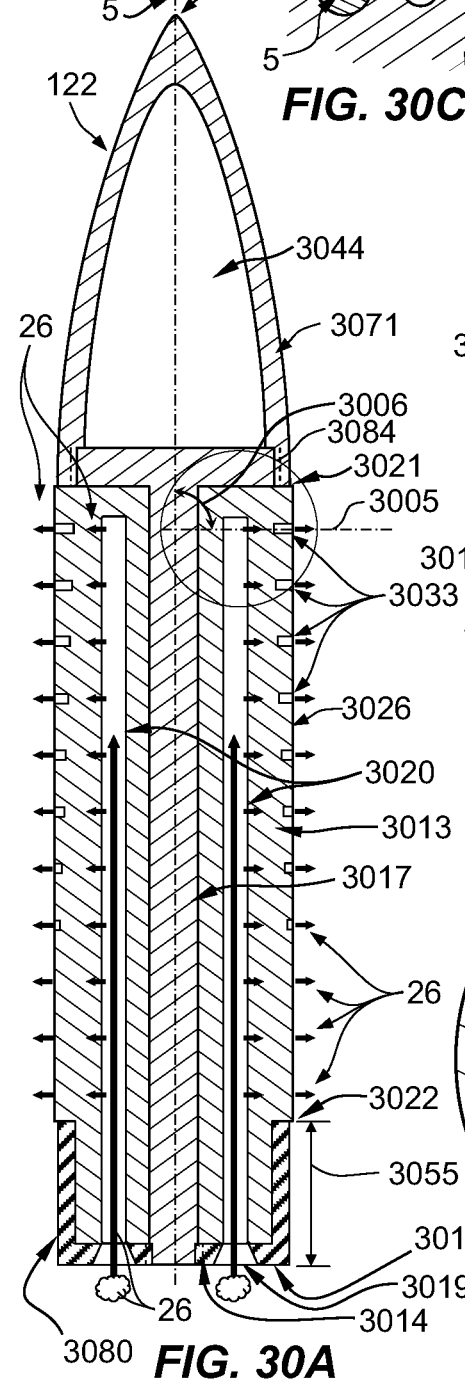
Figure 30B:
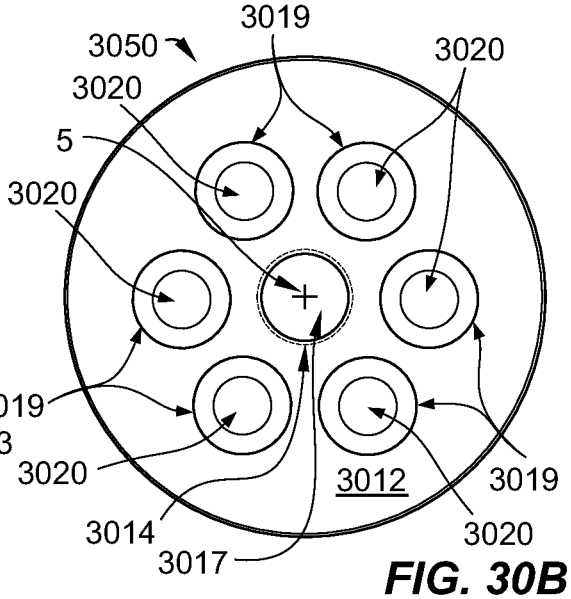
Figure 30E:
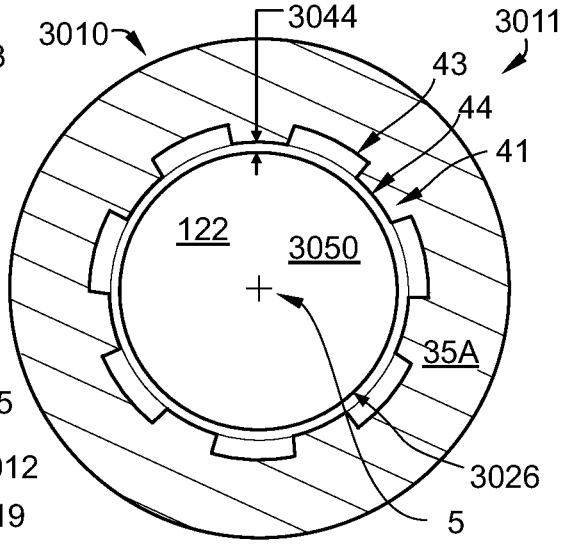

Turning now to FIGS. 30A, 30B, 30C, 30D, and 30E, these figures illustrate an example projectile 3050 according to some embodiments of the disclosure. FIG. 30A illustrates an example cross section of the projectile 3050 in which an axis 5 of the projectile 3050 is in the cutting plane of the view according to some embodiments. FIG. 30B illustrates a trailing end of the example projectile 3050 as viewed from rear of the projectile 3050 according to some embodiments. FIG. 30C illustrates a detail cross sectional view of an example portion 3084 of the projectile 3050 in which the cutting plane of the view is perpendicular to the projectile's axis 5 according to some embodiments. FIG. 30D corresponds to FIG. 30C while illustrating an alternative embodiment of the portion 3084 of the projectile 3050, indicated as 3084B. FIG. 30D illustrates a detail cross sectional view of the example portion 3084B of the projectile 3050 in which the cutting plane of the view is perpendicular to the projectile's axis 5 according to some embodiments. FIG. 30E illustrates the example projectile 3050 in an example gun barrel 35A according to some embodiments. In FIG. 30E, the barrel 35A is illustrated in a representative cross section in which the cutting plane of the view is perpendicular to an axis 5 of the barrel 35A; the projectile 3050 is in the barrel 35A behind the cutting plane and pointed towards the cutting plane. As illustrated, the example barrel 35A comprises representative rifling 41 depicted with exaggerated groove and land dimensions.

In the illustrated example embodiment of FIG. 30, the projectile 3050 comprises a leading member 3071, an intermediate member 3013, and a trailing member 3012. The leading member 3071 comprises a bar 3017 that extends rearward along the axis 5 through the intermediate member 3013 and is fastened to the trailing member 3012 via a threaded connection 3014. In the example projectile 3050, the leading member 3071 forms an ogive 122, the intermediate member 3013 forms an intermediate surface 3026 that is cylindrical, and the trailing member 3012 forms a trailing surface 3080. In the illustrated example embodiment, the intermediate member 3013 is diametrically larger than the leading member 3071 and is diametrically larger than the trailing member 3012. Thus, the projectile's exterior comprises a diametric increase 3021 from the ogive 122 to the intermediate surface 3026 and another diametric increase 3022 from the trailing surface 3080 to the intermediate surface 3026. As illustrated, the intermediate surface 3026 of the intermediate member 3013 is of a uniform diameter that is the projectile's largest diameter. In some example .30 caliber embodiments of the projectile 3050, each of the diametric increase 3021 and the diametric increase 3022 is in a range of 50 to 100 microns (a representative, nonlimiting range that is among others supported by the written description).

In the illustrated example, the leading member 3071 and the trailing member 3012 comprise a material that is impervious to expanding propellant gas 26. For instance, example embodiments of the leading member 3071 and the trailing member 3012 can be made of carbon steel, copper alloy, lead, tungsten, brass, bronze, or a combination of metals. The intermediate member 3013 comprises a porous material that transmits expanding propellant gas 26 and comprises a distribution of gas inlets, gas channels, and gas outlets. For example, the intermediate member 3012 can be made of a porous material discussed above with reference to the porous member 771 that FIG. 7I illustrates. In some example embodiments, the intermediate member 3012 is made of porous metal.

The illustrated trailing member 3012 comprises six rear apertures 3019 that are arranged about the axis 5 with equal angular spacing (of 60 degrees) between adjacent rear apertures 3019, which represents an example, non-limiting configuration. As illustrated by FIG. 30, the rear apertures 3019 taper and comprise example embodiments of gas inlets that transmit expanding propellant gas 26 into the projectile 3050.

As illustrated, the intermediate member 3013 comprises six longitudinal apertures 3020 that are aligned to the six rear apertures 3019 and that extend lengthwise along the axis 5 and that are disposed between the axis 5 and the intermediate surface 3026. The longitudinal apertures 3020 and the rear apertures 3019 form gas channels that transmit expanding propellant gas 26 forward in the intermediate member 3012. As illustrated and discussed below, the longitudinal apertures 3020 further comprise example embodiments of gas manifolds.

The intermediate member 3013 comprises an array of radial apertures 3033, each of which extends radially inward from the intermediate surface 3026 towards the projectile's axis 5 and towards a respective longitudinal aperture 3020. In the illustrated example embodiment that FIGS. 30A and 30B illustrate, each radial aperture 3033 extends perpendicularly to the intermediate surface 3026 and perpendicularly to the axis 5. As illustrated by FIGS. 30A and 30C, each radial aperture 3033 is formed on an aperture axis 3005 that is oriented for intersection with the axis 5 of the projectile 3050 at an angle 3006 that is perpendicular to the axis 5. The aperture axis 3005 is colinear with a normal 3086 of the intermediate surface 3026.

In some alternative embodiments (not illustrated by FIG. 30), the radial apertures 3033 have respective aperture axes 3005 that are oriented to intersect the projectile's axis 5 at an angle 3006 that is obtuse. With the angle 3006 obtuse, the radial apertures 3033 can emit expanding propellant gas 26 having a rearward direction that produces forward thrust or force on the projectile 3050, so the emitted expanding propellant gas 26 tends to push the projectile 3050 forward. In some alternative embodiments, the radial apertures 3033 have respective aperture axes 3005 that are oriented to intersect the projectile's axis 5 at an angle 3006 that is acute. With the angle 3006 acute, the radial apertures 3033 can emit expanding propellant gas 26 having a forward direction that produces rearward thrust or force on the projectile 3050, so the emitted expanding propellant gas 26 tends to push the projectile 3050 rearward.

Referring now to FIG. 30D, some other example embodiments will be discussed. In the example embodiment illustrated by FIG. 30D, the radial apertures 3033 have respective aperture axes 3005 that are oriented not to intersect the projectile's axis 5; so the projectile's axis 5 and each aperture axis 3005 comprise skew lines. That is, a single aperture axis 3005 and the axis 5 define skew lines. As illustrated, the aperture axes 3005 form a non-zero angle 3087 with the normal 3086 of the intermediate surface 3026. As illustrated, the normal 3086 is taken where the aperture axis 3005 intersects with the intermediate surface 3026 (as if the intermediate surface 3026 continues smoothly over the radial aperture 3033). In this configuration, the radial apertures 3033 can emit expanding propellant gas 26 that produces torque or rotational force on the projectile 3050 relative to the projectile's axis 5. The torque or rotational force tends to rotate the projectile 5 about the projectile's axis 5. In some example embodiments, the array of radial apertures 3033 extends on the intermediate surface 3026 from the trailing member 3012 to the ogive 122 of the leading member 3017. With the array of radial apertures 3033 covering the intermediate surface 3026, the torque or rotational force can be applied throughout the axial length of the intermediate member 3013. Further, each radial aperture 3033 in the extended array of radial apertures 3033 can be extended in depth to penetrate into a longitudinal aperture 3020. That is, in FIG. 30D, the radial aperture 3033 can be extended along the aperture axis 3005 to intersect with the longitudinal aperture 3020. In this configuration, expanding propellant gas 26 can flow directly from the longitudinal apertures 3020 to the radial apertures 3033; and in some such embodiments, the intermediate member 3013 can be formed of nonporous metal that is impervious to expanding propellant gas 26. To compensate for pressure drop along the longitudinal apertures 3020, the rearward radial apertures 3033 in the extended array can be of smaller diameter than the forward radial apertures 3033 in the extended array. That is, radial aperture diameter can progressively increase from the trailing end of the intermediate surface 3026 (which is adjacent the trailing surface 3080) to the forward end of the intermediate surface 3026 (which is adjacent the ogive 122). In some example embodiments, the radial apertures 3033 are oriented so the projectile's axis 5 and each aperture axis 3005 form a pair of skew lines as illustrated by FIG. 30D to produce torque about the axis 5 as discussed above in the present paragraph; and each aperture axis 3005 is further tilted forward or rearward to produce rearward or forward thrust as discussed above in the immediately preceding paragraph. Thus, each aperture axis 3005 can be emit expanding propellant gas 26 in a direction that produces rotational force while producing forward or reverse thrust.

The projectile embodiment that FIGS. 30A and 30B illustrate will now be further discussed. In the illustrated embodiment of FIGS. 30A and 30B, the projectile 3050 comprises 48 radial apertures 3033 (an example, nonlimiting number) that form the array. The radial apertures 3033 are spaced along the projectile's axis 5 in eight circles, with each circle of radial apertures 3033 formed from six radial apertures 3033 (one for each longitudinal aperture 3020)—an example, nonlimiting configuration. In the illustrated example, the array of radial apertures 3033 begins adjacent the ogive 122 and extends rearward to cover about three-fourths of the intermediate member 3013, so about the rear one-fourth of the intermediate surface area 3026 remains uncovered by the array of radial apertures 3033. In the illustrated example embodiment, radial aperture depth progressively deepens moving forward along the axis 5. That is, radial apertures 3033 disposed forwardly in the intermediate member 3013 are deeper than radial apertures 3033 disposed rearwardly in the intermediate member 3013. The radial apertures 3033 comprise example embodiments of gas channels that transmit expanding propellant gas 26 out of the projectile 3050. The progressively increasing depth can compensate for axial pressure drop within the intermediate member 3013, to help equalize pressure of expanding propellant gas 26 emitted by the radial apertures 3033.

In some example embodiments, the projectile 3050 is mounted in a case 21 of a cartridge 20 as illustrated by FIG. 1D and as discussed above, with a seating depth corresponding to the axial length 3055 of the trailing member 3012. In example operation, the cartridge 20 produces expanding propellant gas 26 by combustion of solid propellant 25 housed in the case 21. The expanding propellant gas 26 is incident on the rear end of the projectile 3050. Respective portions of the expanding propellant gas 26 apply forward force to the trailing member 3012 and enter the rear apertures 3019.

The expanding propellant gas 26 that enters the rear apertures 3019 flows axially forward through the longitudinal apertures 3020. Lacking porosity, the ogive portion 122 of the leading member 3071 blocks the expanding propellant gas 26 from flowing forward beyond the forward end of the intermediate member 3013. The expanding propellant gas 26 flows out of the longitudinal apertures 3020 and laterally through the porous material of the intermediate member 3013. The expanding propellant gas 26 emits laterally from the projectile 3050 through the intermediate surface 3026 and from the radial apertures 3033. The intermediate surface 3026 comprises a distribution of gas outlets. The intermediate surface 3026 comprises a distribution of apertures. The array of radial apertures 3033 comprises a distribution of radial apertures 3033. The array of radial apertures 3033 comprises a distribution of gas outlets. The progressive depth of the radial apertures 26 compensates for pressure drop in the longitudinal apertures 3020 along the axis 5, as the deeper radial apertures 3033 are separated from the longitudinal apertures 3020 by less porous material of the intermediate member 3013. Thus, as radial aperture depth increases, the expanding propellant gas 26 transmits laterally through a decreased distance of porous material. In some example embodiments, the illustrated rings of radial apertures 3033 are replaced with grooves of progressively increasing depth that circumscribe the intermediate member 3013. For example, the illustrated eight circles of discrete radial apertures 3033, can be replaced with eight grooves that circle the intermediate member 3013 with incrementally increased depth that regulates pressure and volume of expanding propellant gas 26 emitted laterally from the projectile 3030.

As illustrated by FIG. 30A, the ogive portion 122 of the projectile 3050 comprises a interior space 3044. In some example embodiments, the interior space 3044 is filled with a solid material, for example lead, copper, or tungsten carbide, or is filled with a frangible material. In some example embodiments, the ogive portion 122 of the projectile 3050 is configured like the leading member 61B illustrated by FIG. 1S and as discussed above with reference to FIG. 1S, with the interior space 3044 corresponding to the cavity 156 of the leading member 61B and with the material 155 disposed in the interior space 3044. In some example embodiments, the ogive portion 122 of the projectile 3050 is configured like the leading member 61C that FIGS. 1T, 1U, 1V, and 1W illustrate and according to the above discussion of FIGS. 1T, 1U, 1V, and 1W.

In some example embodiments of the projectile 3050 of FIG. 30, a drive with a rotor is disposed in the interior space 3044. For example, embodiments of the projectile 3050 can comprise the drive 10, the drive 410, the drive 510, the drive 610, the drive 710, the drive 810, the drive 910, the drive 1010, the drive 1110, the drive 1210, the drive 1310, the drive 1410, the drive 1510, the drive 1610, the drive 1610B, the drive 1710, the drive 1810, the drive 1910, the drive 2010, the drive 2510, the drive 2610, the drive 2710, the drive 2810, the drive 2910, the drive 2910B, or disclosed variants thereof. In some example embodiments, the cartridge case 21 can maintain a firm hold on the trailing surface 3080 of the projectile 3050 as the expanding propellant gas 26 pushes the projectile 3050 out of the cartridge case 21. With the firm hold, torque can be applied to the rotor for rotational acceleration of the rotor about the axis 5 as the projectile 3050 is propelled out of the cartridge case 21. The rotational acceleration of the rotor can be completed or substantially completed while the projectile 3050 is at least partially disposed in the cartridge case 21. The rotor can spin freely following separation of the projectile 3050 from the cartridge case 21. In some embodiments, the cartridge case 21 comprises steel. For gas drives, the projectile 3050 can comprise a gas channel (not illustrated by FIG. 30A) that conveys expanding propellant gas 26 into the interior space 3044. For example, the projectile 3050 can comprise a gas channel that extends from the forward end of the longitudinal apertures 3020 to the interior space 3044. As another example, the projectile 3050 can comprise a gas channel that extends from the rear of the projectile 3050 forward through the bar 3017 along the axis 5 to the interior space 3044. That is, the bar 3017 of the leading member 3071 can be made hollow to form a tube that carries expanding propellant gas 26 from rear of the projectile 3050 forward along the projectile's axis 5 and into the interior space 3044. In support of gas drive embodiments, the projectile 3050 can further comprise an outlet gas channel that extends from the interior space 3044 through the tip 788 of the projectile 3050, for example like the forward gas channel 1991 of the projectile 450C that FIGS. 19A and 19B illustrate as discussed above with reference to FIGS. 19A and 19B or the forward gas channel 1622 of the projectile 1650 that FIGS. 16D, 16E, and 16F illustrate as discussed above with reference to FIGS. 16D, 16E, and 16F.

In some example embodiments, the projectile 3050 is launched through a smoothbore gun barrel 35B as illustrated in FIG. 1C and discussed above. In such embodiments, the intermediate surface 3026 of the projectile 3050 is diametrically undersized relative to the smoothbore 45 of the barrel 35. In some example embodiments, the projectile 3050 and smooth bore 45 can be diametrically dimensioned for an RC5 fit or an RC6 fit as specified under ANSI AMSE B4.1. The expanding propellant gas 26 emitting laterally through the intermediate surface 3026, as discussed above, creates a layer of gas that provides a low-friction interface between the smoothbore 45 and the projectile 3050. A gas bearing thus exists at the interface between the smoothbore 45 and the intermediate surface 3026. The expanding propellant gas 26 accelerates the projectile 3050 down the barrel 35B while producing a low-friction gaseous annulus between the barrel 35B and the projectile 3050. In some example .30 caliber embodiments of the projectile 3050, the intermediate surface 3026 of the intermediate member 3013 represents the maximum diameter of the projectile 3050 and is undersized from the smoothbore 45 to provide a radial separation between the intermediate surface 3026 and the smoothbore 45 that is a range of 15 to 60 microns (i.e., the projectile's intermediate surface 3026 is diametrically undersized 30 to 120 microns)—a representative, nonlimiting range that is among others supported by the written description.

Turning now to FIG. 30E, a system 3011 is illustrated according to some embodiments. In an example embodiment, the system 3011 comprises a gun 50 and a cartridge 20 as illustrated in FIG. 1 and discussed above. FIG. 30E illustrates a rifled barrel 35A of the gun in cross section and the projectile 3050 disposed in the barrel 35. The system 3011, as discussed below, comprises a drive 3010 that rotates the projectile during projectile launch. Example embodiments of the system 3011 can comprise one or more guns, smoothbore guns, firearms, smoothbore firearms, light firearms, smoothbore light firearms, crew-served firearms, smoothbore crew-served firearms, light-gas guns, air guns, smoothbore air guns, railguns, or archery devices, including the disclosed examples thereof (not an exhaustive list).

As illustrated by FIG. 30E, some example embodiments of the projectile 3050 can be launched through a rifled gun barrel 35A that comprises grooves 43 and lands 44 that spiral about the axis 5 of the barrel 35A as discussed above with reference to FIG. 1. In the example illustrated by FIG. 30E, the projectile 3035 is diametrically undersized relative to the barrel lands 3044 so that a radial separation 3044 exists between the lands 44 and the projectile's intermediate surface 3026, which represents the maximum diameter of the projectile 3050 in the illustrated example. In some example embodiments, the projectile 3050 and the barrel lands 3044 can be diametrically dimensioned for an RC5 fit or an RC6 fit as specified under ANSI AMSE B4.1. In some example .30 caliber embodiments of the projectile 3050, the radial separation 3044 between the intermediate surface 3026 and the lands 44 is a range of 15 to 60 microns (a representative, nonlimiting range that is among others supported by the written description). In operation, the expanding propellant gas 26 emitted laterally from the intermediate surface 3026 forms a layer of gas between the intermediate surface 3026 and the lands 44 that provides a low-friction gaseous annulus between the barrel 35A and the projectile 3050. The projectile 3050 thus accelerates down the rifled barrel 35A supported by a gas bearing that extends circumferentially around the projectile 3050. The layer of gas extending circumferentially around the projectile 3050, the forward velocity and acceleration of the projectile 3050 in the barrel 5, and the spiraling of the grooves 43 and lands 44 along the barrel's axis 5 can produce rotation of the projectile 3050 as the projectile 3050 is propelled down the barrel 5. Additionally, as discussed above with reference to FIG. 30D, the radial apertures 3033 of the projectile 3050 can be oriented to produce torque or rotational force on the projectile 3050. The expanding propellant gas 26 emitted from the radial apertures 3033 can thus rotate the projectile 3050 as the projectile 3050 accelerates down the rifled barrel 35A on the gas bearing.

Figure 31A:
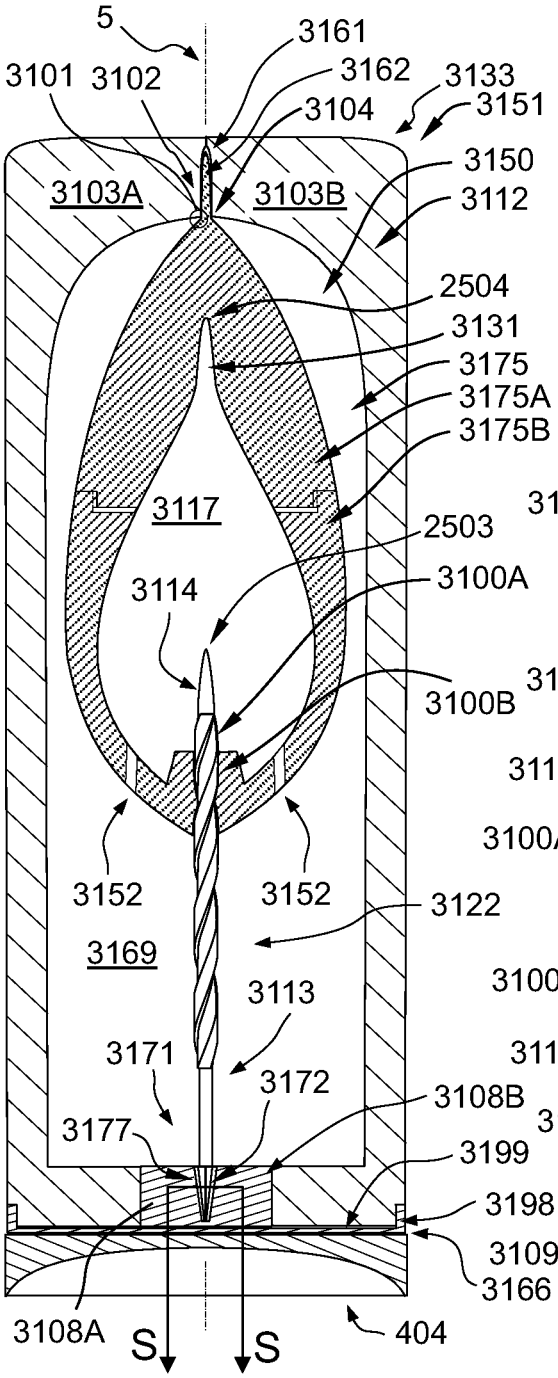
FIGS. 31A, 31B, 31C, 31D, 31E, 31F, 31G, 31H, 31I, 31J, 31K, and 31L, collectively
Figure 31B:
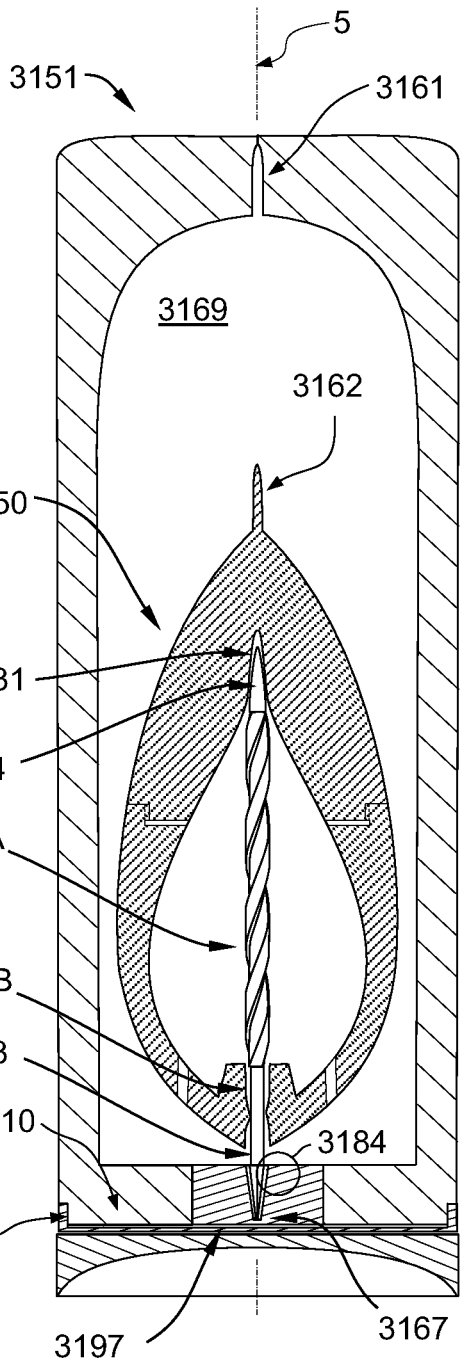
Figure 31C:
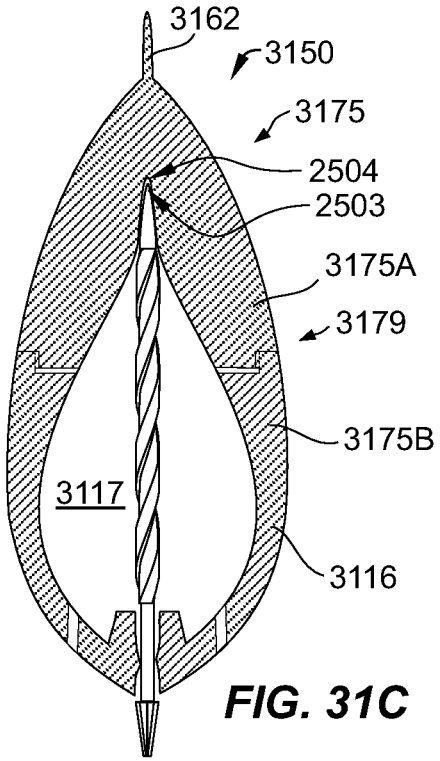

Turning now to FIGS. 31A, 31B, 31C, 31D, 31E, 31F, 31G, 31H, 31I, 31J, 31K, and 31L, some example embodiments will be further discussed with reference to these figures. These figures illustrate an example projectile 3150 according to some embodiments of the disclosure. FIGS. 31A and 31B illustrate the projectile 3150 in two respective modes in a sabot 3133 according to some embodiments of the disclosure. FIGS. 31A and 31B further illustrate a sabot system 3151 in which the sabot 3133 carries the projectile 3150. FIG. 31C illustrates the projectile 3150 with the sabot 3133 discarded. In some example embodiments, the projectile 3150 and the sabot 3133 emit together from a gun barrel (for example, see the embodiment of a gun barrel 35A that FIG. 1B illustrates or the embodiment of a gun barrel 35B that FIG. 1C illustrates) as a projectile comprising the sabot system 3151. The sabot system 3151 can be characterized as a projectile, and the projectile 3150 can be characterized as a sub-projectile. Once emitted from the barrel, the sabot 3133 separates from the projectile 3150, and the projectile 3150 travels towards its destination in the example mode that FIG. 31C illustrates.

Some example embodiments of the projectile 3150 and/or the sabot system 3151 can comprise a gun projectile, a smoothbore gun projectile, a firearm projectile, a smoothbore firearm projectile, a light firearm projectile, a smoothbore light firearm projectile, a crew-served firearm projectile, a smoothbore crew-served firearm projectile, a light-gas gun projectile, an air gun projectile, a smoothbore air gun projectile, a railgun projectile, or an archery device projectile (not an exhaustive list). The disclosure and teaching support a wide range of operating environments and applications involving sabot systems carrying projectiles that comprise integrated stabilization systems. For instance, the disclosure is sufficiently detailed to enable those skilled in the art to carry out and practice such sabot systems in sizes and configurations suited for launch through cannons, heavy machine guns, howitzers, guns exceeding .50 caliber permanently mounted to airplanes and other military vehicles, tank guns, and railguns (some representative examples that is not an exhaustive list).

The illustrated projectile 3150 comprises an example embodiment of a drive 3112. As illustrated by FIG. 31, the drive 3112 of the projectile 3150 comprises an example embodiment of an inertial drive. The projectile 3150 comprises an example embodiment of a mechanism.

Example embodiments of the drive 3112 can be incorporated in projectiles of guns, smoothbore guns, firearms, smoothbore firearms, light firearms, smoothbore light firearms, crew-served firearms, smoothbore crew-served firearms, light-gas guns, air guns, smoothbore air guns, railguns, or archery devices, including the disclosed examples thereof (not an exhaustive list). Example embodiments of the drive 3112 can further be incorporated in other aeronautical systems, including in the disclosed examples of aeronautical systems.

In the embodiment that FIG. 31 illustrates, the projectile 3150 and the sabot 3133 in which it is disposed can be compatible with a shotgun 451 with a barrel 35 that is smoothbore, as illustrated by FIG. 4 and discussed above. FIG. 31 thus illustrates an example embodiment that is configured for a shoulder-mounted light firearm that comprises the shotgun 451 comprising a smoothbore and will be further discussed below in this example application, without limitation. In some example embodiments, the sabot system 3151 is sized for loading in a 10 gauge cartridge, a 12 gauge cartridge (for instance in an industry-standard length of 2.75 inch, 3 inch, or 3.5 inch), a 20 gauge cartridge, a 28 gauge cartridge or a 410 bore cartridge, to mention some representative examples. For example, see the embodiment of a cartridge 420 that FIG. 4B illustrates and the associated textual disclosure.

FIG. 31A illustrates the sabot system 3151, which comprises the projectile 3150, in a mode as housed or loaded in a cartridge 420 (see FIG. 4B) prior to initiating launch through the barrel 35 of the shotgun 451 (see FIG. 4A). A rearwardly disposed gas seal 404 is disposed between the sabot 3133 and solid propellant 25 (as illustrated by FIG. 4B). In some example embodiments, the gas seal 404 is integral with the sabot 3133. The sabot 3133 can be configured to achieve gas sealing or to comprise one or more gas seals that may incorporate features of the illustrated gas seal 404, one or more driving bands, one or more obturators, or other suitable obturation features.

The example sabot 3133 that FIG. 31 illustrates comprises three petals 3103A, 3103B, 3103C, two of which are visible in the cross sectional views of FIGS. 31A and 31B. FIG. 31E illustrates an end-on view of the trailing end of the sabot 3133 that shows all three petals 3103A, 3103B, 3103C, which collectively enclose, restrain, and house the projectile 3150 in this illustrated embodiment as further discussed below. As illustrated in FIGS. 31A, 31B, and 31E, a rearwardly disposed notch 3109 extends circumferentially about the sabot 3133 to form a cylindrical projection 3110 in the three petals 3103A, 3103B, 3103C that projects rearward. As illustrated, the notch 3109 comprises an indented corner. The illustrated cylindrical projection 3110 is of reduced diameter relative to the overall sabot 3133.

Figure 31D:
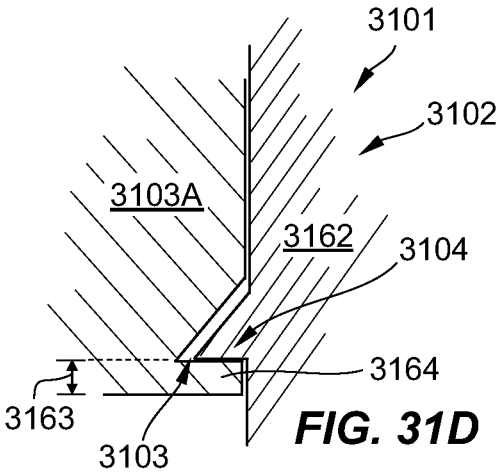
Figure 31F:
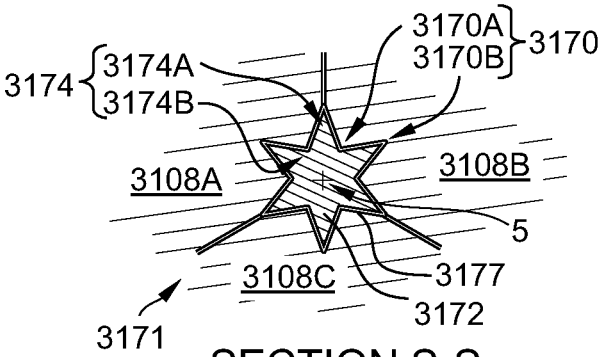
Figure 31E:
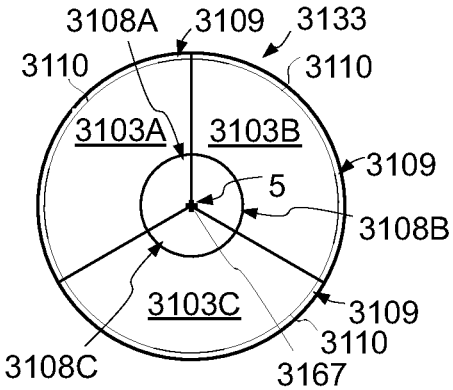
Figure 31H:
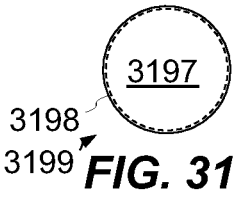
Figure 31G:
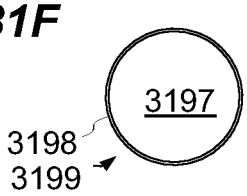

As illustrated in FIGS. 31A and 31B, the cylindrical projection 3110 of the sabot 3133 seats in a member 3199 that comprises a cup shape as further illustrated in FIGS. 31G and 31H. The illustrated example embodiment of the member 3199 thus caps or crowns the cylindrical projection 3110. In the illustrated example embodiment, the member 3199 comprises a sidewall 3198 that extends circumferentially about and circumscribes the cylindrical projection 3110 of the sabot 3133. The sidewall 3198 is disposed in the notch 3109 to form an encircling band that holds the three petals 3103A, 3103B, 3103C together centered the axis 5 of the projectile 3150. As further discussed below, the member 3199 and its sidewall 3198 releasably fasten the petals 3103A, 3103B, 3103C together. In the illustrated example embodiment, the member 3199 further comprises a central portion 3197 that extends over the rear face of the cylindrical projection 3110 of the sabot 3133. In some example embodiments, the central portion 3197 is fused to the gas seal 404 at their interface 3166, so they are joined to one another. As further discussed below, the member 3199 structurally supports a joint 3171 between the sabot 3133 and a rearwardly disposed end 3172 of a drive member 3122 of the projectile 3150.

In the illustrated example embodiment of the sabot 3133, each of the petals 3103A, 3103B, 3103C comprises a respective strengthened portion 3108A, 3108B, 3108C that is rearwardly and centrally disposed. In the illustrated example embodiment and as visible in FIG. 31F, the strengthened portions 3108A, 3108B, 3108C of the petals 3103A, 3103B, 3103C converge upon the axis 5 and collectively form an aperture 3177 that the joint 3171 comprises as further discussed below.

In some example embodiments, the strengthened portions 3108A, 3108B, 3108C of the petals 3103A, 3103B, 3103C are composed of metal, for instance steel or copper or aluminum or an alloy thereof, and the balance of the petals 3103A, 3103B, 3103C is composed of plastic, for instance acetal resin, acetal homopolymer, acetal copolymer, nylon, fluoropolymer, or other appropriate material. In some example embodiments, the petals 3103A, 3103B, 3103C are fabricated using an insert injection molding process wherein the strengthened portions 3108A, 3108B, 3108C are inserted elements of the process. In some example embodiments, the strengthened portions 3108A, 3108B, 3108C are composed of the same material as the balance of the petals 3103A, 3103B, 3103C and may be strengthened via enhanced bulk or thickness. In some example embodiments, the entire petals 3103A, 3103B, 3103C are composed of aluminum, copper, an alloy of aluminum or copper, or other appropriate metal. In some example embodiments, a thin layer of fluoropolymer or other low-friction material (not illustrated by FIG. 31) coats such metallic petals 3103A, 3103B, 3103C and is operative to reduce wear and/or friction as the sabot 3133 travels through the barrel 35 of the shotgun 451 (see FIG. 4A).

FIG. 31F illustrates a detail cross sectional view of an example embodiment of the joint 3171 with the viewing plane perpendicular to the axis 5 of the sabot system 3151 and the projectile 3150. As further visible in FIG. 31A, the end 3172 of the drive member 3122 is disposed in the aperture 3177 to form the joint 3171. In the illustrated embodiment as discussed below, the end 3172 comprises external splines 3174 and the aperture 3177 comprises internal splines 3170 corresponding to and matching the external splines 3174. The matching splines 3174, 3170 maintain angular correspondence between the end 3172 of the drive member 3122 and the aperture 3177 and thus between the drive member 3122 and the sabot 3133 and provide a keyed joint that the joint 3171 comprises. The splines 3174, 3170 thus inhibit or prevent rotation of the drive member 3122 relative to the sabot 3133.

In the illustrated example embodiment, the external splines 3174 of the end 3172 comprise six ridges 3174A and six grooves 3174B extending lengthwise along the axis 5, with six being a multiple of the number of petals 3103A, 3103B, 3103C of the sabot 3133. The grooves 3174B comprise an example embodiment of channels. As illustrated, the grooves 3174B can be characterized as comprising flutes, and the ridges 3174A can be characterized as comprising teeth. The internal splines 3170 of the aperture 3177 comprise six ridges 3170A and six grooves 3170B extending lengthwise along the axis 5, with six being a multiple of the number of petals 3103A, 3103B, 3103C of the sabot 3133. As illustrated, the grooves 3170B can be characterized as comprising flutes, and the ridges 3170A can be characterized as comprising teeth. The grooves 3170B comprise an example embodiment of channels. In the mated configuration illustrated by FIG. 31F with the end 3172 disposed in and mated with the aperture 3177, the six end ridges 3174A are disposed in the six aperture grooves 3170B and the six aperture ridges 3170A are disposed in the six end grooves 3174B.

Figure 31L:
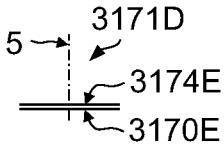
Figure 31I:
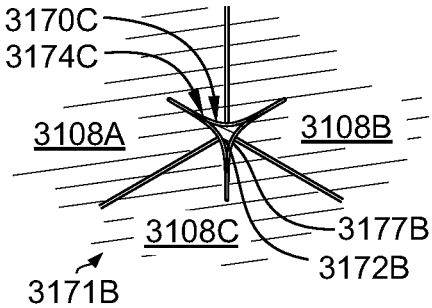

In some other embodiments, the number of petals 3103A, 3103B, 3103C equals the number of the ridges 3174A and equals the number of the grooves 3174B. And, the number of petals 3103A, 3103B, 3103C equals the number of the ridges 3170A and equals the number of the grooves 3170B. For example, in a variation of the three-petal sabot embodiment that FIG. 31F illustrates, the end 3172 can comprise three ridges 3174A and three grooves 3174B, and the aperture 3177 can comprise three ridges 3170A and three grooves 3170B. In some such embodiments, each ridge 3174A is formed to angularly bisect a respective petal 3103A, 3103B, 3103C. That is, the six-point-star pattern that FIG. 31F illustrates can be replaced with a three-point-star pattern with points at two o'clock, six o'clock, and ten o'clock. FIG. 31I illustrates an example of such an embodiment. In the embodiment of FIG. 31I, an alternative joint 3171B comprises an alternative end 3172B of the drive member 3122 and an alternative aperture 3177B of the sabot 3133. As illustrated, external splines 3174C of the end 3172B are mated with internal splines 3170C of the aperture 3177B.

Figure 31J:
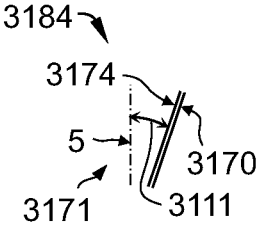

In the illustrated example of FIGS. 31A, 31B, and 31F, the end 3172 is tapered, with diameter decreasing rearwardly along the axis 5. Thus, as the end 3172 extends rearward, the end's diameter decreases. The tapering forms an acute angle 3111 between the axis 5 and the splines 3174, 3170 as illustrated by the diagram of FIG. 31J, which further describes an example embodiment of a portion 3184 of the sabot system 3151 shown in FIG. 31B. As visible in the cross sectional views of FIGS. 31A and 31B, in which the axis 5 is in the cutting plane of the view, the example end 3172 comprises a geometrical form of a truncated cone that is centered on the axis 5 and has a base-forward, apex-rearward orientation. The aperture 3177 is tapered in correspondence with tapering of the end 3172 and comprises a geometrical form of a corresponding truncated cone. As illustrated, the conical shapes of the end 3172 and the aperture 3177 are truncated to terminate in a flat surface that is perpendicular to the axis 5. In the illustrated embodiment, the strengthened portions 3108A, 3108B, 3108C of the petals 3103A, 3103B, 3103C collectively comprise a region 3167 that adjoins this flat surface and extends across the axis 5 rearward of the aperture 3177 and the end 3172. Thus, the region 3167 of the strengthened portions 3108A, 3108B, 3108C adjoins the rearmost surface of the end 3172, adjoins the central portion 3197 of the member 3199, and is disposed between the end 3172 and the central portion 3197 of the member 3199. In some example embodiments, the rearmost surface of the end 3172 adjoins the central portion 3197 of the member 3199, and the region 3167 is absent.

In some other example embodiments, the end 3172 and the aperture 3177 comprise a geometry of a truncated cone that terminates in a surface that is arched, rounded, or curved rather than flat. In some other example embodiments, the end 3172 and the aperture 3177 comprise a geometry of a cone comprising an apex.

Figure 31K:
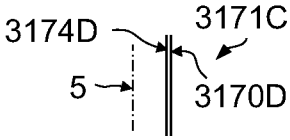

In some other example embodiments, the end 3172 and the aperture 3177 comprise cylindrical geometries as an alternative to conical geometries, and the internal and external splines 3170, 3174 extend lengthwise parallel to the axis 5. In some embodiments, the internal and external splines 3170, 3174 can thus comprise axial splines. FIG. 31K illustrates an example diagram according to some such embodiments, wherein an alternative joint 3171C comprises internal splines 3174D mated with external splines 3170D with the splines 3174D, 3170D extending parallel to the axis 5. In some such embodiments, the end 3172 adjoins the central portion 3197 of the member 3199. Alternatively, the region 3167 may exist between the central portion 3197 of the member 3199 and the end 3172.

In some example embodiments, the joint 3171 comprises a Hirth joint centered on the axis 5. In an example embodiment of a Hirth joint, the end 3172 can comprise a rearmost planar surface that is perpendicular to the axis 5 and that comprises splines radiating outward radially from the axis 5. The central portion 3197 of the member 3199 can comprise a forward-oriented surface that comprises matching splines radiating outward radially from the axis 5. The two splined surfaces mate. For example, FIG. 31L illustrates a diagram of a joint 3171D, in which the end 3172 of the drive member 3122 and the aperture 3177 of the sabot 3133 respectively comprise splines 3174E and splines 3170E that are mated and substantially perpendicular to the axis 5.

Referring now to FIGS. 31A and 31D, in the illustrated mode of FIG. 31A, an example rotor 3175 of the projectile 3150 is disposed forward in a cavity 3169 of the sabot 3133. In the illustrated example embodiment, the rotor 3175 comprises a projection 3162 that is slender and that projects axially forward into a corresponding aperture 3161 of the sabot 3133 that is forwardly and centrally disposed. As further discussed below, the axial projection can comprise a retainer, a spindle that maintains axial alignment of the rotor 3175 as the rotor 3175 begins moving rearward and gaining angular momentum, and/or a drag-reducing aerospike that reduces aerodynamic drag of the projectile 3150 after launch.

As illustrated in FIGS. 31A and 31D, the retainer 3102 retains the rotor 3175 forward in the cavity 3169. FIG. 31D illustrates a cross sectional detail view of a portion 3101 of the sabot system 3151 comprising an example embodiment of the retainer 3102. In the illustrated example embodiment, the retainer 3102 comprises a conditional-release retainer that releases during projectile launch. As illustrated, the retainer 3102 comprises a projection 3104 that projects radially from the axial projection 3162 of the rotor 3175 into an annular aperture 3103 of the sabot 3133 that extends radially from the aperture 3161 of the sabot 3133. In some example embodiments, the axial projection 3162 comprises a barb. In the illustrated embodiment, the example radial projection 3104 circumscribes the axial projection 3162 of the rotor 3175, and the annular aperture 3103 circumscribes the aperture 3161 of the sabot 3133. As illustrated, a peripheral edge 3164 of the sabot 3133 that is rear of the radial projection 3104 retains the radial projection 3104 in the annular aperture 3103 to retain the rotor 3151 in the forward position that FIG. 31A illustrates. The peripheral edge 3164 of the sabot 3133 is formed of plastic or other suitable deformable material that facilitates insertion of the axial projection 3162 of the rotor 3175 into the aperture 3161 during fabrication of the sabot system 3151, resulting in the configuration that FIG. 31D illustrates. During projectile launch, inertial force presses the rotor 3175 rearward against the peripheral edge 3164. When the inertial force produces a threshold level of pressure between the axial projection 3162 and the peripheral edge 3164, the peripheral edge 3164 deforms sufficiently to release the axial projection 3162, and the rotor 3175 moves rearward. Thickness 3163 of the peripheral edge 3164 can be varied according to desired threshold.

In some alternative example embodiments, the retainer 3102 can comprise a jammed-against shoulder and/or elastic deformation (see FIGS. 11A and 11B, example element 1159), a shear pin (see FIG. 4K, example element 414), a pin or wire under tension (see FIG. 4L, example element 414B, FIG. 4M, example element 414C, and FIG. 18A, example element 791), a breakable filament connection (see FIG. 7A, example element 791), a magnet (see FIG. 3B, example element 379 and FIG. 4F, example element 479), or other appropriate retainer means (not an exhaustive list).

As the illustrated example rotor 3175 begins moving rearward, a forward portion of the axial projection 3162 (a portion forward of the radial projection 3104) remains disposed in the aperture 3161 and maintains axial alignment of the rotor 3175 as the rotor 3175 moves rearward, spins, and accumulates a sufficient level of angular momentum to maintain the axial alignment without aid of the axial projection 3104. Once the axial projection 3162 exits the aperture 3161, angular momentum keeps the rotor 3162 effectively centered on the axis 5.

As inertial force drives the rotor 3175 rearward, a helix 3100A on the drive member 3122 engages a helix 3100B on the rotor 3175 to produce rotation of the rotor 3175. In some example embodiments, the helix 3100B comprises a helical component that is composed of a material engineered for withstanding high loads, for instance a steel alloy, and that is inset into a relatively soft material of the rotor 3175, for instance copper. Gas channels 3152 vent gas from a cavity 3117 within the rotor 3175 to facilitate movement of the drive member into the cavity 3117. Contact between the sabot system 3151 and the barrel 35 (see FIG. 4A) suppresses rotation of the sabot system 3151, while the joint 3171 suppresses rotation of the drive member 3122 relative to the sabot system 3151.

As the rotor 3175 moves rearward and transitions into the mode that FIG. 31B illustrates, the rotor's helix 3100B moves to an undersized cylindrical portion 3113 of the drive member 3122; whereby the helices 3100A, 3100B disengage so the rotor 3175 can spin freely. A forward end 3114 of the drive member 3122 moves into a corresponding forward aperture 3131 inside the rotor 3175, and the rotor 3175 spins freely about the drive member 3122. In some example embodiments, the forward end 3114 traps a cushion of gas in the forward aperture 3131 that supports free rotation of the rotor 3175. In the illustrated example embodiment of FIG. 31, the forward end 3114 of the drive member 3122 comprises a nib 2503, and the forward aperture 3131 of the rotor 3175 comprises a recess 2504. Some example embodiments of the nib 2503 and the recess 2504 are illustrated in the figures and are discussed above with reference to FIGS. 25, 28, and 29, inter alia. In some example embodiments, the nib 2503 and the recess 2504 comprise a fluid bearing, a gas bearing, an aerostatic bearing, an aerodynamic bearing, a spiral groove bearing, an aero spiral groove bearing, a thrust bearing, a self-centering pivot joint, or a combination thereof in accordance with the disclosure provided throughout this specification and the accompanying figures. In some example embodiments, rotation of the rotor 3175 can be supported by a sintered brass bearing, a graphite bearing, a magnetic bearing, or other appropriate bearing technology as disclosed herein.

Once the sabot system 3151 exits the barrel 35 of the shotgun 451 (see FIG. 4A), air pressure on the sabot 3133 opens the pedals 3103A, 3103B, 3103C. The pedals 3103A, 3103B, 3103C can generally pivot about the joint 3171 as they open in some example embodiments. The opening petals 3103A, 3103B, 3103C force the member 3199 off of the cylindrical projection 3110, and the sabot 3133 discards.

With the sabot discarded, the projectile 3150 travels towards its destination in the mode that FIG. 31C illustrates in some example embodiments. In supersonic applications, the axial projection 3162 can comprise a drag-reducing aerospike that reduces aerodynamic drag on the projectile 3150 by producing a detached shock that leads the body 3179 of the projectile 3150.

In the example embodiment that FIG. 31C illustrates, the rotor 3175 of the projectile 3150 comprises a forward portion 3175A and a rear portion 3175B, which can be screwed together via threads (as illustrated) or fastened via welding, brazing, or other appropriate fastening means. In some example embodiments, the forward portion 3175A and the rear portion 3175B have a common composition, for instance steel, brass, copper, tungsten, or other appropriate material. In some example embodiments, the forward portion 3175A can be composed of one or more materials of relatively high density, for example tungsten, tungsten alloy, depleted uranium, or lead; and the rear portion 3175B can be composed of one or more materials of relatively low density, for example steel, titanium, titanium alloy, aluminum, or aluminum alloy. Such configuration can move the center of mass of the projectile 3150 forward relative to forming the rotor 3175 of a single material. Placing the center of mass forward in this manner can facilitate gyroscopically stabilizing the projectile 3150 with a relatively low level of rotational momentum.

The embodiment of the projectile 3150 that FIG. 31C illustrates further comprises a cross sectional geometry that can promote forward orientation of the projectile's center of mass. In this geometry, the cavity 3117 is teardrop shaped. In the illustrated teardrop-shaped geometry, the cavity 3117 is forwardly narrow and expands rearwardly. Forward portions of sidewalls 3116 of the rotor 3175 are thick, with the sidewalls 3116 progressively thinning rearwardly along the axis 5. For strength to support helical engagement, the rotor 3175 thickens adjacent the helix 3100B. Some aspects of the written description will now be discussed, without limitation.

In some aspects of the written description, an aeronautical system comprises a drive that comprises a member and a rotor that is disposed to rotate about an axis of the aeronautical system, wherein the member and the rotor form a helical pair. In a subaspect, the aeronautical system comprises a projectile. In a subaspect, the aeronautical system further comprises an aero spiral groove bearing disposed to support rotation of the rotor about the axis. In a subaspect, the aeronautical system further comprises an aerostatic bearing disposed to support rotation of the rotor about the axis. In a subaspect, the drive comprises a compound helical drive. In a subaspect, the drive comprises a soft starter. In a subaspect, the drive comprises a gas drive. In a subaspect, the drive comprises an inertial drive. In a subaspect, the drive is configured to convert inertial force produced during launch of the projectile into torque on the rotor. In a subaspect, the drive is configured to convert relative movement between the member and the rotor into rotation of the rotor.

In some aspects of the written description, an aeronautical system comprises: a member that defines an axis and comprises a first surface; a rotor disposed for rotation about the axis and comprising a second surface; and a gas bearing disposed to form an interface between the first surface and the second surface. In a subaspect, the aeronautical system comprises a projectile. In a subaspect, the gas bearing comprises a thrust bearing or a journal bearing. In a subaspect, the gas bearing comprises an aerostatic bearing. In a subaspect, the gas bearing comprises an aero spiral groove bearing. In a subaspect, the gas bearing comprises an aerodynamic bearing. In a subaspect, the aeronautical system further comprises a gas channel that extends from the gas bearing to a trailing end of the projectile and that is sized to convey expanding propellant gas to the gas bearing.

In some aspects of the written description, an aeronautical system comprises: a member comprising an exterior surface that extends circumferentially around an axis; a cavity disposed on the axis; a rotor that is disposed in the cavity, that can rotate about the axis relative to the exterior surface, and that can move along the axis from a forward portion of the cavity to a rear portion of the cavity; and a conditional-release retainer retaining the rotor in the forward portion of the cavity. In a subaspect, the aeronautical system comprises a projectile, and the axis comprises an axis of the projectile. In a subaspect, the projectile comprises a fluid bearing disposed in the cavity to support rotation of the rotor about the axis. In a subaspect, the rotor and the cavity comprise a dashpot. In a subaspect, the aeronautical system further comprises a retainer positioned to retain the rotor in the rear portion of the cavity once the conditional-release retainer has released the rotor and the rotor has moved from the forward portion of the cavity to the rear portion of the cavity. In a subaspect, the rotor comprises a buffer. In a subaspect, the rotor is operative to moderate a response of the projectile to impulsive torque applied to the exterior surface.

In some aspects of the written description, an aeronautical system comprises a first member and a second member that are helically engaged with one another, wherein the first member is configured to rotate about an axis responsive to axial movement between the first member and the second member occurring during launch of the aeronautical system. In a subaspect, the aeronautical system comprises a projectile, wherein the axis comprises an axis of the projectile, and wherein the launch of the aeronautical system comprises launch of the projectile. In a subaspect, the aeronautical system comprises an aerostatic bearing supporting the first member. In a subaspect, the aeronautical system comprises an aerodynamic bearing supporting the first member. In a subaspect, the first member is mounted with an aerostatic bearing. In a subaspect, the first member is mounted with an aerodynamic bearing. In a subaspect, a helix engages the first and second member with one another, the helix extending helically with respect to the axis.

In some aspects of the written description, a projectile comprises: a rotor that is configured to spin about an axis of the projectile to gyroscopically stabilize the projectile; and a drive that is operably coupled to the rotor and that is operative to convert inertial force produced by acceleration of the projectile during projectile launch into torque for spinning the rotor. In a subaspect, the projectile comprises an aerostatic bearing or an aerodynamic bearing that supports the rotor.

In some aspects of the written description, a projectile comprises: two members that are operably coupled to one another; and a drive configured to: convert expanding propellant gas into relative movement between the two members along an axis of the projectile; and convert the relative movement into rotation of a mass that the projectile comprises. In a subaspect, the projectile comprises an aero spiral groove bearing disposed to support said rotation of the mass. In a subaspect, the mass comprises at least one of the two members. In a subaspect, one of the two members comprises a plunger.

In some aspects of the written description, a projectile comprises a drive that is operative to convert axial movement of a portion of the projectile into rotation of a mass of the projectile. In a subaspect, the drive comprises a gas bearing. In a subaspect, the portion of the projectile comprises the mass. In a subaspect, a second portion of the projectile comprises the mass.

In some aspects of the written description, a method comprises: by a force applied to a projectile during launch of the projectile, spinning a member that the projectile comprises so that the spinning member stores energy; and responsive to the projectile transitioning from a first mode to a second mode, transferring at least a portion of the stored energy from the spinning member to a second member that the projectile comprises. In a subaspect, the method further comprises supporting the spinning member with a gas bearing. In a subaspect, transitioning from the first mode to the second mode comprises transitioning from acceleration of the projectile to deceleration of the projectile.

In some aspects of the written description, a projectile comprises a helical pair that comprises a drive. In a subaspect, the helical pair comprises a rotor supported by a gas bearing.

In some aspects of the written description, a method comprises: providing a projectile that comprises two members that are operably coupled to one another, wherein one of the members is movable in the projectile along a path that extends lengthwise and one of the members is rotatable in the projectile relative to an exterior surface of the projectile; responsive to initiating a launch of the projectile, applying force to the projectile; responsive to the force application, moving one of the members along the path; responsive to one of the members moving along the path, rotating one of the members relative to the projectile to produce angular momentum; and stabilizing the projectile using the angular momentum. In a subaspect, the method further comprises supporting the rotating one of the members with an aerostatic bearing or an aerodynamic bearing. In a subaspect, moving one of the members along the path comprises moving a piston. In a subaspect, moving one of the members along the path comprises moving a plunger.

In some aspects of the written description, a projectile comprises: a first member that is disposed along an axis of the projectile and that is rotatable about the axis; a second member that is disposed along the axis adjacent the first member and that is movable relative to the first member along a path that the projectile comprises, wherein the path extends along the axis, and wherein the first and second members are coaxially arranged; and a drive that comprises a helix operably coupling the first member and the second member to one another and that is operative to convert relative movement between the first member and the second member along the path into rotation of the first member about the axis. In a subaspect, the projectile further comprises a thrust bearing disposed at a trailing end of the first member, the thrust bearing comprising an aerostatic bearing, an aerodynamic bearing, or a hybrid aerostatic-aerodynamic bearing. In a subaspect, the projectile is configured so that inertia produced by acceleration of the projectile during launch of the projectile produces said relative movement. In a subaspect, the projectile is configured so that expanding propellant gas produced during launch of the projectile produces said relative movement. In a subaspect, a trailing end of the projectile comprises an aperture disposed to receive expanding propellant gas during launch of the projectile, wherein at least a portion of the second member is disposed in the aperture and is configured to move towards a leading end of the projectile under pressure of the received expanding propellant gas.

In some aspects of the written description, a projectile comprises: a member comprising a cavity that extends lengthwise; a rotor releasably disposed at a position in the cavity; and a retainer retaining the rotor at the position in the cavity, the retainer configured to release the rotor from the position responsive to an occurrence of a predetermined event, wherein once released by the retainer, the rotor is movable lengthwise and rotationally in the cavity. In a subaspect, the projectile further comprises a gas bearing that supports the rotor. In a subaspect, the occurrence of the predetermined event comprises an application of a threshold level of torque or axial force to the rotor. In a subaspect, the retainer comprises: first threads that are formed in the member; and second threads that are formed in the rotor, wherein the first threads and the second threads are screwed together, and wherein the retainer is configured to release the rotor from the position responsive to rotationally accelerating the projectile to produce rotational inertia that unscrews the first and second threads from one another.

In some aspects of the written description, a projectile comprises: an axis extending lengthwise between a leading end and a trailing end of the projectile; a rotor disposed to rotate about the axis; and a member operably coupled to the rotor by a drive that is operative to convert linear motion between the rotor and the member into rotation of the rotor, the drive comprising: a helix disposed to provide engagement between the rotor and the member; and a release disposed to release the provided engagement responsive to the projectile assuming a mode. In a subaspect, the projectile further comprises a sabot that restrains the member. In a subaspect, the release comprises an end of the helix. In a subaspect, linear motion between the rotor and the member comprises axial motion of the rotor. In a subaspect, said linear motion between the rotor and the member comprises axial motion of the member. In a subaspect, the drive comprises a compound helical drive. In a subaspect, the drive comprises a soft starter. In a subaspect, the projectile is of a caliber in the range of 17 caliber to .50 caliber. In a subaspect, the projectile has an outer diameter in the range of 4 millimeters to 14 millimeters. In a subaspect, the projectile has an outer diameter in the range of 14 millimeters to 65 millimeters.

In some aspects of the written description, a drive for stabilizing an aeronautical system comprises: a helical pair that comprises a rotor; a gas bearing that supports the rotor; a conditional-release retainer that is configured to start an interval of driving rotation of the rotor responsive to identifying an occurrence of a launch event; a release that is configured to release a helical engagement of the rotor once the interval is complete; and a retainer that is configured to retain the rotor in a helically disengaged mode after the release releases the helical engagement of the rotor. In a subaspect, the drive comprises a compound helical drive.

In some aspects of the written description, a gas bearing comprises an interface between: a bore of a barrel; and an exterior surface of a projectile that extends circumferentially about an axis of the projectile and lengthwise along the axis, that is diametrically undersized relative to the bore of the barrel, and that comprises a plurality of gas outlets covering the exterior surface. In a subaspect, the plurality of gas outlets comprise pores in porous material. In a subaspect, the plurality of gas outlets comprise an array of apertures formed in the surface. In a subaspect, the gas bearing comprises an aerostatic gas bearing.

In some aspects of the written description, a system comprises: a barrel having exactly one gas inlet, said gas inlet comprising a breach; and a projectile dimensioned for disposing in the barrel with an annular space between the projectile and the barrel that comprises a gas bearing. In some aspects of the written description, a projectile comprises: an ogive centered on an axis of the projectile; a trailing surface comprising one or more gas inlets; an intermediate surface that is disposed between the ogive and the trailing surface, that extends circumferentially fully about the axis, that extends lengthwise along the axis, and that comprises a distribution of gas outlets; and one or more gas channels extending from the one or more gas inlets to the distribution of gas outlets.

In some aspects of the written description, a method comprises: by a projectile, receiving expanding propellant gas during a launch of the projectile; and by the projectile, emitting the received expanding propellant gas through apertures in an exterior surface of the projectile, to form a supporting layer of expanding propellant gas between the exterior surface and an adjoining surface.

In conclusion, useful aeronautical and stabilization technologies have been described. From the description, it will be appreciated that an embodiment of the disclosure overcomes limitations of the prior art. Disclosed embodiments fulfill needs in the field and solve technical problems of the field. Embodiments fulfill the needs and solve the problems that those of skill in the art will appreciate, recognize, or infer following a review of the written description, the specification, and the appended figures. Embodiments fulfill the needs and solve the problems that are expressly identified herein, as well as suggested needs and other needs. Nothing in the written description, the specification, or the appended figures is to be interpreted as disparaging, disclaiming, or disavowing any approach or technology, nor to be viewed as excluding any approach or technology from claim coverage. Those skilled in the art will further appreciate that the technology is not limited to any specifically discussed application or implementation and that the embodiments described herein are illustrative and not restrictive. The particular features, structures, and characteristics that are set forth (including bearings, grooves, spiral patterns, drives, gas drives, inertial drives, compound helical drive configurations, soft starters, mechanisms, projectile configurations, guns, aeronautical systems, gas-management systems, gas channels, pistons, plungers, barrel bores, calibers, sources of propellant force, sabots, helices, helical configurations, helical forms and geometries, helical pairs, releases, stops, retainers, conditional-release retainers, modes, keyed joints, rotors, materials, projectile geometries, rupture disks, buffers, rotary dampers, dashpots, gas chambers, cases, cartridges, drive members, method and process blocks and steps, and so forth) have been described in ways that empower combinations and can be combined in any suitable manner in one or more embodiments based on this disclosure and ordinary skill. Those of ordinary skill having benefit of this disclosure can make, use, and practice a wide range of embodiments via combining the disclosed features and elements in many permutations without undue experimentation and further by combining the disclosed features and elements with what is well known in the art. This is not to suggest that any combinations, substitutions, or permutations are obvious variants. This disclosure not only includes illustrated and textually described embodiments, but also provides a roadmap for creating many additional embodiments using the various disclosed technologies, elements, features, their equivalents, and what is well known in the art. From the description of the example embodiments, equivalents of the elements shown herein will suggest themselves to those skilled in the art, and ways of constructing other embodiments will appear to practitioners of the art. Therefore, the scope of the technology is to be limited only by the appended claims.

What is claimed is:

1. A method for gyroscopically stabilizing a projectile, the method comprising:

by the projectile during a projectile launch, experiencing propulsive force, wherein the projectile comprises a helical pair comprising two members;

by the projectile during the projectile launch, responsive to experiencing the propulsive force, translating one of the two members along an axis of the projectile, wherein relative axial displacement between the two members occurs;

by the projectile during the projectile launch, responsive to said translating one of the two members along the axis, synchronously rotating one of the two members about the axis, wherein relative rotation between the two members occurs;

by the projectile during the projectile launch, gaining angular momentum from said synchronously rotating one of the two members about the axis;

by the projectile, changing from said synchronously rotating one of the two members about the axis to producing free rotation between the two members about the axis; and by the projectile after the projectile launch, advancing towards a destination while said free rotation occurs, with the gained angular momentum gyroscopically stabilizing the projectile.

2. The method of claim 1, wherein the projectile is disposed in a tube throughout the projectile launch, wherein the tube comprises a smooth bore, wherein the projectile is expelled from the tube, and wherein once expelled from the tube, the projectile coasts to the destination while said free rotation continues.

3. The method of claim 2, wherein the projectile has a maximum outer diameter that is no greater than 65 millimeters.

4. The method of claim 1, wherein said synchronously rotating one of the two members about the axis comprises rotating said one of the two members relative to an exterior surface of the projectile, wherein the projectile comprises a gas bearing, and wherein the method further comprises by the gas bearing, supporting at least one of the two members during said free rotation about the axis.

5. The method of claim 1, wherein an exterior surface of the projectile comprises fins.

6. The method of claim 1, wherein the projectile comprises a center of mass and a center of pressure, wherein prior to the projectile launch, the center of mass is disposed rearward of the center of pressure , and wherein the center of mass is disposed forward of the center of pressure during said advancing towards the destination while said free rotation occurs, with the gained angular momentum gyroscopically stabilizing the projectile.

7. The method of claim 1, wherein the two members comprise a first member and a second member, wherein said free rotation comprises free rotation of the first member relative to the second member, and wherein the method further comprises by the projectile after the projectile launch, coasting to the destination with at least a portion of the first member disposed in the second member.

8. A method for gyroscopically stabilizing a projectile, the method comprising:

by the projectile, operating in a first mode in which a rotor that the projectile comprises is rearwardly disposed;

by the projectile, operating in a second mode in which the rotor rotates synchronously while moving forward; and by the projectile, operating in a third mode in which the rotor is forwardly disposed and spins freely, wherein the projectile comprises a center of mass and a center of pressure, wherein operating in the first mode comprises the center of mass disposed rearward of the center of pressure, and wherein operating in the third mode comprises the center of mass disposed forward of the center of pressure.

9. The method of claim 8, wherein the projectile comprises a cavity, wherein operating in the first mode comprises the rotor being disposed rearwardly in the cavity, wherein operating in the second mode comprises the rotor rotating synchronously while moving forward in the cavity, and wherein operating in the third mode comprises braking forward motion of the rotor while the rotor spins freely and is forwardly disposed in the cavity.

10. The method of claim 8, wherein the projectile comprises a gas channel, wherein in the first mode, the rotor is disposed rearwardly in the gas channel, wherein in the second mode, gas drives the rotor forward in the gas channel, and wherein in the third mode, the rotor spins freely in the gas channel cavity while blocking gas flow through the gas channel.

11. The method of claim 8, wherein in the third mode, the rotor spins freely while supported by a bearing.

12. The method of claim 8, wherein in the third mode, a gas bearing supports the rotor as the rotor spins freely.

13. The method of claim 8, wherein operating in the third mode comprises the spinning rotor producing a gyroscopic effect for stabilizing the projectile while the projectile advances towards a destination.

14. The method of claim 8, further comprising by the projectile, coasting towards a destination with the rotor at least partially disposed in the projectile.

15. The method of claim 8, wherein an exterior surface of the projectile comprises fins.

16. A method for gyroscopically stabilizing a projectile, the method comprising:

by the projectile, receiving expanding propellant gas into a gas channel that the projectile comprises, wherein the projectile comprises a rotor disposed in the gas channel;

by the projectile, responsive to force provided by the received expanding propellant gas, producing forward motion of the rotor in the gas channel;

by the projectile, converting the forward motion of the rotor in the gas channel into rotational motion of the rotor; and by the projectile, braking the forward motion of the rotor in the gas channel while supporting the rotational motion of the rotor.

17. The method of claim 16, further comprising by the projectile, continuing to support the rotational motion of the rotor while the projectile travels in open air, whereby the rotational motion produces a gyroscopic effect.

18. The method of claim 16, wherein the projectile comprises a center of mass and a center of pressure, and wherein the method further comprises by the projectile, responsive to said forward motion of the rotor, moving the center of mass from rearward of the center of pressure to forward of the center of pressure.

19. The method of claim 16, wherein supporting the rotational motion of the rotor comprises a bearing supporting free spinning of the rotor, and wherein an exterior of the projectile comprises fins.

20. The method of claim 16, wherein braking the forward motion of the rotor in the gas channel comprises forming a gas bearing, and wherein supporting the rotational motion of the rotor comprises the gas bearing supporting free spinning of the rotor.

* * * * *